US005340710A

United States Patent [19]

Ohya et al.

[11] Patent Number: 5,340,710

[45] Date of Patent: Aug. 23, 1994

[54] PHOTOSENSITIVE SILVER HALIDE PHOTOGRAPHIC MATERIAL

[75] Inventors: Yukio Ohya; Syoji Matsuzaka; Yasushi Irie; Shuji Murakami; Satomi Asano; Hiroshi Okusa, all of Hachioji; Hirofumi Ohtani, Hino, all of Japan

[73] Assignee: Konica Corporation, Tokyo, Japan

[21] Appl. No.: 86,571

[22] Filed: Jul. 6, 1993

Related U.S. Application Data

[63] Continuation of Ser. No. 758,419, Sep. 3, 1991, abandoned, which is a continuation of Ser. No. 598,776, Oct. 18, 1990, abandoned, which is a continuation of Ser. No. 428,027, Oct. 27, 1989, abandoned, which is a continuation of Ser. No. 290,954, Dec. 28, 1988, abandoned.

[30] Foreign Application Priority Data

| | | | |
|---|---|---|---|
| Dec. 28, 1987 | [JP] | Japan | 62-333934 |
| Mar. 18, 1988 | [JP] | Japan | 63-65532 |
| Mar. 18, 1988 | [JP] | Japan | 63-65533 |
| Mar. 18, 1988 | [JP] | Japan | 63-65534 |
| Mar. 23, 1988 | [JP] | Japan | 63-69123 |
| Mar. 25, 1988 | [JP] | Japan | 63-71217 |
| Apr. 5, 1988 | [JP] | Japan | 63-83600 |
| Apr. 19, 1988 | [JP] | Japan | 63-96085 |
| Sep. 7, 1988 | [JP] | Japan | 63-224002 |

[51] Int. Cl.[5] ..... G03C 1/035

[52] U.S. Cl. ..... 430/567; 430/568; 430/569

[58] Field of Search ..... 430/567, 568, 569

[56] References Cited

U.S. PATENT DOCUMENTS

| | | | |
|---|---|---|---|
| 3,206,313 | 9/1965 | Porter et al. | 430/569 |
| 3,342,592 | 9/1967 | Chu et al. | 430/579 |
| 4,229,525 | 10/1980 | Ueda | 430/568 |
| 4,497,895 | 2/1985 | Matsuzaka et al. | 430/569 |
| 4,684,607 | 8/1987 | Maskasky | 430/567 |
| 4,735,894 | 4/1988 | Ogawa | 430/567 |
| 4,797,354 | 1/1989 | Saitou et al. | 430/569 |
| 4,798,775 | 1/1989 | Yagi et al. | 430/569 |
| 4,952,489 | 8/1990 | Amicucci | 430/567 |

FOREIGN PATENT DOCUMENTS

| | | |
|---|---|---|
| 0135883A3 | 9/1984 | European Pat. Off. . |
| 0244184 | 4/1987 | European Pat. Off. . |

OTHER PUBLICATIONS

Abstract from Japanese Patent Publication 62-278543.

*Primary Examiner*—Janet C. Baxter

*Attorney, Agent, or Firm*—Finnegan, Henderson, Farabow, Garrett & Dunner

[57] ABSTRACT

A photosensitive silver halide photographic material having a support and, provided thereon, the photographic component layers including at least one silver halide emulsion layer containing silver halide grains (1) having at least two kinds of halogens, is disclosed. The silver halide grains (1) are grown to in a system in the presence of silver halide grains (2) coexisting:

with silver halide grains which are growing to the silver halide grains (1), for at least some portion of period that said silver halide grains are growing in the system, and comprising solubility product less than that of said growing silver halide grains.

16 Claims, 4 Drawing Sheets

PHOTOSENSITIVE SILVER HALIDE PHOTOGRAPHIC MATERIAL

This application is a continuation of application Ser. No. 07/758,419, filed Sep. 3, 1991, now abandoned, which is a continuation of Ser. No. 07/598,776, filed Oct. 18, 1990, now abandoned, which is a continuation of application Ser. No. 07/428,027 filed Oct. 27, 1989, now abandoned, which is a continuation of application Ser. No. 07/290,954 filed Dec. 28, 1988, now abandoned.

FIELD OF THE INVENTION

The present invention relates to a photosensitive silver halide photographic material, more specifically to the photosensitive silver halide photographic material which comprises high sensitivity and can provide an image comprising high optical density and excellent graininess.

BACKGROUND OF THE INVENTION

Recently there have been increasing demands for photosensitive silver halide photographic material having better photographic characteristics such as high sensitivity, excellent graininess, and sufficiently high optical density.

In general, silver halide grains are prepared by a method comprising preparation process of silver halide seed grains followed by process of growing the seed grains, wherein water soluble silver salt solution and water soluble halide solution are supplied using jet method (for example, single jet method, double jet method). Said preparation of silver halide grains is described in U.S. Pat. No. 4,610,958, U.S. Pat. No. 2,996,287, U.S. Pat. No.3,785,777 and U.S. Pat. No.90386.

However, the photosensitive silver halide photographic material containing silver halide grains mentioned above, can't meet the above mentioned demands sufficiently.

SUMMARY OF THE INVENTION

The object of the present invention is to provide a photosensitive silver halide photographic material comprising high sensitivity, and capable of providing an image having excellent graininess and sufficiently high optical density.

These and other objects are achieved in accordance with the present invention.

In this regard, the photosensitive silver the halide photographic material of the invention comprises at least one silver halide emulsion layer containing silver halide grains (1) having at least two kinds of halogens, wherein said silver halide grains (1) are grown to in a system in the presence of silver halide grains (2) coexisting with silver halide grains which are growing to the silver halide grains (1), for at least some portion of period that the silver halide grains are growing in the system, and comprising solubility product less than that of said growing silver halide grains.

DETAILED DESCRIPTION OF THE INVENTION

Figure 1:
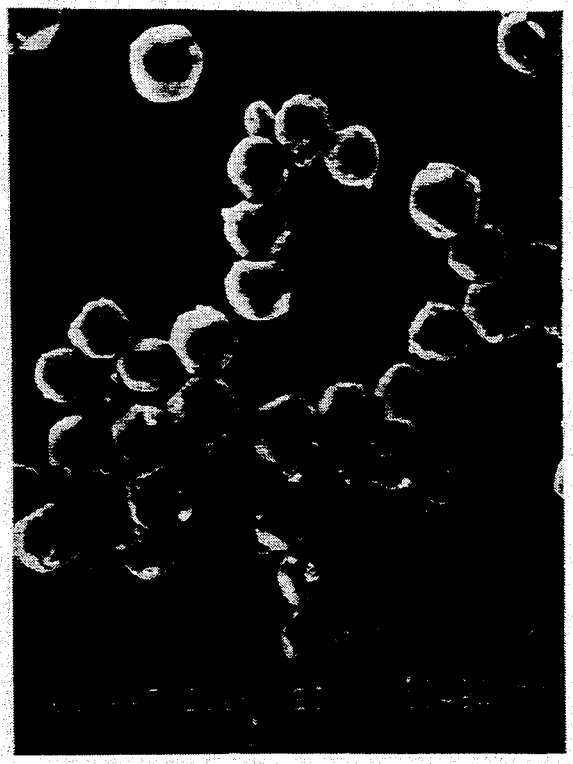
FIGS. 1-5 are electron micrographs of inventive grains.

The at least two kinds of halogens may distribute uniformly or ununiformly in the AgX(1).

Preferably, AgX(1) is the grains in which distribution of said halogens is not uniform, such as core/shell type or epitaxitial type silver halide grains, and core/shell type grains are more preferable.

Preferable composition of Agx (1) is AgBrCl, AgBrI or AgBrClI, and more preferably AgBrI.

It is preferable that the AgX(1) is contained in a ratio of not less than 30 mol %, more preferably not less than 60 mol % as the amount of AgX, in at least one of the emulsion layers constituting the photosensitive material. When the photosensitive material is of multilayer structure, at least one emulsion layer for which the AgX(1) should be contained is chosen, but it is preferable that AgX(1) is contained in all emulsion layers.

The characteristic of the present invention is to consume AgX(2) grains as an alternative for at least one portion of water soluble silver salt solution and water soluble halide solution (hereinafter referred to as the grain growth compositions) to form the AgX(1) grains.

The preparation process of AgX(1 ) is described below in detail.

One preparation process is that AgX seed grains are grown to AgX(1) by supply of water soluble silver salt solution and water soluble halide solution. Another preparation process is that without said seed grains, AgX nucleus is formed followed by growth of said nucleus to AgX(1) by supply of said two solution. The former process is preferable because reproduction of size of AgX grains formed is better.

AgX(2) is necessary to exist at latest by completion of growth to AgX(1) in the grain growth suspension (hereinafter referred to as mother suspension.).

In case of using AgX seed grains, said seed grains may be added to AgX(2), and AgX(2) may be added to said seed grains prior to and/or in the middle of adding of grain growth compositions in mother suspension.

In case of grain growth without the seed grains, preferably AgX(2) is added after AgX nucleation prior to and/or in the middle of adding of the grain growth compositions.

Each of AgX(2) and the grain growth composition may be added continuously, discontinuously or at a time.

Preferably AgX(2) and the grain growth compositions respectively are added to mother suspension by the multi jet method (for example, double jet method ) at an adaptive rate to grain growth under the controlled pH, pAg and temperature etc.

Each of AgX(2) and AgX seed grains may be prepared out of the grain growth suspension followed by addition to said suspension or may be prepared in mother suspension.

Water soluble silver solution used for forming AgX(2) is preferably an ammoniacal silver nitrate solution.

In case that AgX(1) is AgBrI, AgX(2) is preferably AgI or AgBrI of which iodide content is more than that of growing AgBrI and in case that AgX(1) is AgClBr, AgX(2) is preferably AgBr or AgClBr of which bromide content is more than that of growing AgClBr.

More preferably, in case that AgX(1) is AgBrI, AgX(2) is AgI.

AgBrI or AgBrClI is preferably used in this invention, and in such case, it is preferable that an entire amount of iodide used in grain growth is provided by AgX(2), but a portion of iodide may be supplied by water soluble iodide solution.

It is preferable that AgX (2) be highly monodispersible. Although they may not necessarily be very fine, their average grain size is preferably 0.001 to 0.7 μm, more preferably, 0.3 to 0.005 μm, still more preferebly, 0.1 to 0.01 μm.

The seed emulsion particles can have any composition, various silver compounds can be used, e.g. silver chloride, silver bromide, silver chlorobromide, silver chloroiodide, silver bromoiodide, and silver bromochloroiodide.

In the AgX (1) preparation process, mother suspension temperature is preferably 10° to 70° C., more preferably 20° to 60° C.; pAg is preferably 6 to 11, more preferably 7.5 to 10.5; and pH is preferably 5 to 11, more preferably 7 to 11.

The substances other than gelatin, adsorptive to AgX grains, may be added in preparation of an AgX grains (including preparation of an AgX seed grains). The examples of the adsorptive substances which serve well for this purpose include sensitizing dyes and compounds or heavy metal ions used in the relevant industry as anti-fogging agents or stabilizers. The preceding adsorptive substances are described in the examples of Japanese Patent Publication Open to Public Inspection No. 7040/1987.

For inhibiting AgX emulsion fogging and improving pot life, it is preferable that at least one anti-fogging agent or stabilizer chosen from the preceding adsorptive substances be added in preparation of an Agx seed grains emulsion.

Among the anti-fogging agents and stabilizers, heterocyclic mercapto compounds and/or azaindene compounds are particularly preferable. The examples of more preferable heterocyclic mercapto compounds and azaindene compounds are described in detail in Japanese Patent Publication O.P.I. No. 41848/1988; those substances can be used for the present invention.

Although there is no limitation on an addition amount of the above-mentioned heterocyclic mercapto compounds and azaindene compounds, it is preferably $1\times10^{-5}$ to $3\times10^{-2}$, more preferably, $5\times10^{-5}$ to $3\times10^{-3}$ per mole of AgX. This amount depends on production conditions of AgX grains, AgX average grain size and a type of the preceding compounds.

A finished emulsion containing the AgX(1) grains with the needed properties is then desalinated by a known method after AgX grain formation. For desalination, gelatin coagulating agents used for desalination of AgX grains as AgX seed grains described in Japanese Patent Application Nos. 81373/1987 and 9047/1988 may be used. It is also possible to use a noodle washing method in which gelatin is gelated, or a coagulation method which utilizes inorganic salts comprising multivalent anions such as sodium sulfate, anionic surfactants or anionic polymers (e.g. polystyrene sulfate).

The AgX grains thus desalinated are then redispersed in gelatin to prepare an AgX emulsion.

There is no particular limitation on the halogen compositions of AgX(1); silver chloride, silver bromide and silver iodide can be used in any combination, as long as it meets the purpose. AgX(1) may be of uniform composition or of shell-layer type core/shell composition; AgX(1) of the present invention is efficient for a core-shell composition.

There is no particular limitation on an average grain size of AgX(1) grain, and it may vary by application, but it is preferably 0.1 to 3.0 μm. Here, the average grain size means the length of one side of an AgX grain if it is in a cube form, or the length of one side of a cube assumed to have the volume equal to that of an AgX grain if it is in a non-cube form. When each grain size in this sense is ri and the total number of the measured grains is n, the average grain size $\overline{\gamma}$ can be expressed by the equation.

$$r = \frac{\Sigma r i}{n}$$

A large part of the AgX grains with high monodispersibility have an identical crystal phase, and thus have a narrow size distribution.

In a group of highly monodispersible grains, the value obtained by dividing a standard deviation in a grain size distribution by an average grain size (variation coefficient) is not more than 0.20.

The AgX emulsion of the present invention is desirable, since it broadens an exposure latitude of AgX photosensitive materials having at least one emulsion layer containing at least two AgX emulsions with substantially different sensitivities, as well as improves graininess and sharpness, when it is used as at least one of said two AgX emulsions.

For incorporating the preceding at least two silver halide emulsions with substantially different sensitivities, it is possible to mix two or more silver halide emulsions with different average grain sizes. Two or more emulsions with different sensitivities prepared by varying an addition amount of chemical sensitizer or spectrally sensitizing dye may also be mixed. It is also possible to use the method in which two or more emulsions with different amounts of desensitizing agent are mixed, and the method in which two or more AgX seed grain emulsions with different amounts of desensitizing are mixed and grown.

The requirement of "substantially different sensitivities" in the present invention is satisfied by the condition that at least two emulsions have different sensitivities; it is preferable that at least two emulsions have difference of not less than 0.2 as expressed in logE value on a characteristic curve, and difference of 0.4 to 2.0 is more preferable.

Exposure latitude relating to the present invention is the range of light acceptance in which significantly different exposure effects are observed.

The possible desensitizing agents are arbitrarily selected from various agents such as metal ions, antifoggants, stabilizers and desensitizing dyes; however, for desensitizing, a method of metal ion doping is preferable.

The examples of metal ions used for the doping are metal ions such as Cd, Zn, Pb, Fe, Tl, Ru, Rh, Bi, Ir, Au, Os, Os, and Pd. These types of metal ions are preferably used, for example, in the form of halogen complex salt; the preferred pH level in the Agx suspension system in the course of doping is not higher than 5.

The preferred amount of metal ions used for doping varies depending upon the type of metal ions, size of silver halide grains, position of doping with metal ions, and intended sensitivity. However the preferred amount is $10^{-17}$ to $10^{-2}$or, in particular, $10^{-16}$ to $10^{-4}$ mol per mol Agx. If such metal ions are rhodium ions, the preferred amount is $10^{-14}$ to $10^{-2}$ mol, in particular, $10^{-11}$ to $10^{-4}$ mol per mol Agx.

By selecting per Ag grains, a kind of doping metal, and a position an amount of metal ions used for doping, each Agx grain is endowed with different sensitivity potential.

An amount of metal ions used for doping not more than $10^{-2}$ mol/Agx mol does not significantly affect the growth of silver halide grains. Accordingly, it is possible under identical conditions for growing grains, to prepare Agx grains exhibiting a narrow size distribution.

Each of the respective Agx grain respectively undergone doping under different conditions can be subjected to treatment that allows these grains to be industrially applicable, thereby these grains are mixed together at a specific mixing ratio into a same batch, that is chemically sensitized. The respective Agx grains are sensitized depending on their unique sensitivity potential, whereby a resultant emulsion is endowed with intended latitude based on the sensitivities of the grains and on a mixing ratio between the grains.

According to the invention, in addition to the use of the previously mentioned metal ion doping technique, a compound known in the art as antifoggant, stabilizer or desensitizing dye may be used in order to prepare the Agx grains of different sensitivity potentials. Such Agx grains are mixed at a specific mixing ratio in compliance with the intended exposure latitude.

The examples of the preceding anti-fogging agents and stabilizers include azoles such as benzthiazolium salts, indazoles, triazoles, benztriazoles, benzimidazoles, heterocyclic mercapto compounds such as mercaptotetrazoles, mercaptothiazoles, mercaptothiadiazoles, mercaptobenzthiazols mercaptobenzimidazoles, mercaptopyrimidine, azaindenes such as tetrazaindenes, pentazaindenes, nucleic acid decomposition products such as adenine, guanine, benzenethiosulfonic acids, and thioke to compounds.

The examples of the spectral desensitizing dyes include cyanine dyes, merocyanine dyes, complex cyanine dyes, complex merocyanine dyes, holopolar cyanine dyes, hemicyanine dyes, styryl dyes, and hemioxol dyes.

The emulsion of the present invention is chemically sensitized by a conventional method. It is possible to use singly or in combination a sulfur sensitization method using a sulfur compound capable of reacting with silver ions or using active gelatin, a selenium sensitization method using a selenium compound, a reduction sensitization method using a reducing substance, and a noble metal sensitization method using a compound of gold or another noble metal.

In the present invention, chalcogen sensitizers, for instance, can be used as a chemical sensitizer; sulfur sensitizers and selenium sensitizers are particularly preferable.

The examples of sulfur sensitizers include thiosulfates, allyl thiocarbazide, thiourea, allyl isothiocyanate, cystine, p-toluenethiosulfonate, and rhodanine. It is also possible to use the sulfur sensitizers described in U.S. Pat. Nos. 1,574,944, 2,410,689, 2,278,947, 2,728,668, 3,501,313, and 3,656,955; West German OLS Patent No. 1,422,869; Japanese Patent Publication Open to Public Inspection Nos. 24937/1981 and 45016/1980, for instance.

The amount of the sulfur sensitizer added may vary over a fairly wide range depending on various conditions such as pH, temperature and silver halide grain size, but, as a standard, it is preferably about $10^{-7}$ to $10^{-1}$ mole per mole of silver halide.

The examples of selenium sensitizers include aliphatic isoselenocyanates such as allyl isoselenocyanate; selenoureas; selenoketones; selenoamides; salts and esters of selenocarboxylic acids; selenophosphates; and selenides such as diethyl selenide and diethyl diselenide. The examples thereof are described in U.S. Pat. Nos. 1,574,944, 1,602,592, and 1,623,499.

Reduction sensitization can also be applied in combination. Reducing agents include stannous chloride, thiourea dioxide, hydrazine and polyamine.

It is also possible to use compounds of noble metals other than gold, e.g. palladium compounds.

It is preferable that the AgX grains of the present invention contain a gold compound. Gold compounds which can be preferably used for the present invention include a wide variety of compounds of monovalent or trivalent gold. The typical examples include potassium chloroaurate, auric trichloride, potassium iodoaurate, tetracyanoauric azide, ammonium aurothiocyanate, pyridyltrichlorogold, gold sulfide, and gold selenide.

The gold compounds may be used in such manner that the AgX grains are sensitized, or in such manner that it does not substantially contribute to sensitization.

The amount of the gold compound added varies depending on various conditions, but, as a standard, it is $10^{-8}$ to $10^{-1}$ mole, preferably $10^{-7}$ to $10^{-2}$ mole per mole of silver halide. These compounds can be added in any of the processes of AgX grain formation, physical aging and chemical aging, or after completion of chemical aging.

An emulsion of the present invention can be spectrally sensitized for a desired wavelength range by means of sensitizing dyes, which may be used singly or in combination of two or more sensitizers.

The dyes which have no spectral sensitizing function or the supersensitizers, which virtually do not absorb visible light, and can strengthen a sensitizing function of a sensitizing dye may be incorporated into an emulsion together with the sensitizing dyes.

The emulsion of the present invention spectrally sensitized with at least one sensitizing dye selected from the group of the sensitizing dyes represented by Formula [A] shown below, improves a photosensitive AgX photographic material in sensitizing dye adsorption, sensitivity and provides an image with excellent graininess.

$$[D^p - L^a = D^q]^s \oplus (X\ominus)_s$$

wherein $D^p$ and $D^q$ independently represent an electron-donative basic heterocyclic group; $L^a$ represents a conjugated linear linkage group; X represents an acid anion; s represents an integer of 0 or 1.

Of the sensitizing dyes represented by the above Formula [A], the cyanine dyes represented by Formula [I] or [II] are preferable for the present invention.

Formula [I]

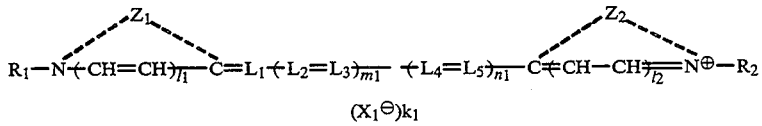

Formula [II]

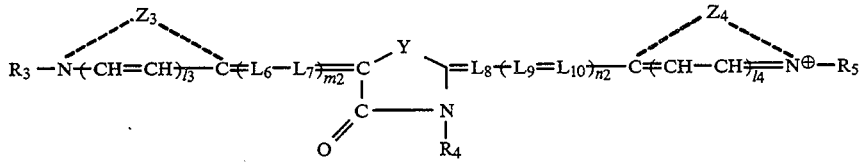

Wherein, $Z_1$, $Z_2$, $Z_3$, and $Z_4$ independently represent the group of the atoms necessary to form a 5- or 6-membered nitrogen containing heterocyclic ring; $L_1$, $L_2$, $L_3$, $L_4$, $L_5$, $L_6$, $L_7$, $L_8$, $L_9$, and L10 independently represent a methine group; Y represents an oxygen atom, a sulfur atom, a selenium atom, or —N—$R_7$ group; $R_1$, $R_2$, $R_3$, and $R_5$ independently represents an alkyl group; $R_4$ and $R_7$ independently represent an alkyl group, an alicyclic group, a heterocyclic group, or an aryl group; $X_1^{\ominus}$ and $X_2^{\ominus}$ independently represent an acid anion; $k_1$, $k_2$, $l_1$, $l_2$, $l_3$, and $l_4$ independently represent the integer of 0 or 1; $m_1$, $m_2$, $n_1$, and $n_2$ independently represent the integer of 0 to 2, provided that $m_2$ and $n_2$ do not make more than 2.

A heterocyclic ring formed by $Z_1$, $Z_2$, $Z_3$ or $Z_4$ is a 5- or 6-membered heterocyclic ring usually composing cyanine dyes and includes a condensed ring with an aromatic ring such as a benzene ring or a naphthalene ring. That is, said heterocyclic ring includes cyanine heterocycle nuclei which comprises, for example, a thiazole ring, a selenazole ring, an oxazole ring, a tetrazole ring, a pyridine ring, a pyrroline ring an imidazole ring, an oxazoline ring, a thiazoline ring, an isoxazole ring, a 1, 3, 4-thiadizole ring, a thienothiazole ring, an imidazoquinoxaline ring, an imidazoquinoline ring, a pyrrolopyridine ring, a pyrrolopyrazine ring, a pyridopyridine ring or condensed ring thereof, each substituted or not substituted. The examples include a thiazole series such as thiazole, 4-methylthiazole, 4-phenylthiazole, 5-methylthiazole, 5-phenylthiazole, 4,5-dimethylthiazole, 4,5-diphenylthiazole, benzothiazole, 5-fluorobenzothiazole, 5-chlorobenzothiazole, 6-chlorobenzothiazole, 5-methylbenzothiazole, 6-methylbenzothiazole, 5-bromobenzothiazole, 5-carboxybenzothiazole, 5-ethoxycarbonylbenxothiazole, 5-hydroxybenzothiazole, 5-phenylbenzothiazole, 6-phenylbenzothiazole, 5-methoxybenzothiazole, 6-methoxybenzothiazole, 5-iodobenzothiazole, 6-ethoxybenzothiazole, tetrahydrobenzothiazole, 5,6-dimethylbenzothiazole, 5,6-dimethoxybenzothiazole, 5,6-dioxymethylenebenzothiazole, 6-ethoxy-5-methylbenzothiazole, 5-phenethylbenzothiazole, naphtho[1,2-d]thiazole, naphtho[2,1-d]thiazole, naphtho[2,3-d]thiazole, 5-methoxynaphtho[1,2-d]thiazole, 8-methoxynaphtho[2,1-d]thiazole, 7-methoxynaphtho[2,1-d]thiazole, 5-methoxythionaphtheno[6,7-d]thiazole, 8,9-dihydronaphtho[1,2-d]thiazole, and 4,5-dihydronaphtho[2,1-d]thiazole); an oxazole series such as 4-methyloxazole, 5-methyloxazole, 4-phenyloxazole, 4,5-dimethyloxazole, 5-phenyloxazole, 5,6-diphenyloxazole, benzoxazole, 5-chlorobenzoxazole, 5-methylbenzoxazole, 5-phenylbenzoxazole, 6-methylbenzoxazole, 5,6-dimethylbenzoxazole, 5-methoxybenzoxazole 5-ethoxybenzoxazole; 5-phenethylbenzoxazole, 5-hydroxybenzoxazole, 5-ethoxycarbonylbenzoxazole; 5-bromobenzoxazole, 5-methyl-6-chlorobenzoxazole, naphtho[1,2-d]oxazole, naphtho[2,1-d]oxazole, and naphtho[2,3-d]oxazole, a selenazole series such as 4-methylselenazole; 4-phenylselenazole; benzoselenazole; 5-chlorobenzoselenazole, 5-methoxybenzoselenazole, 5-methylbenzoselenazole, tetrahydrobenzoselenazole, naphtho[1,2-d]selenazole, and naphtho[2,1-d]selenazole; tellurazole series such as 4-phenyltellurazole, 4-methyltellurazole, benzotellurazole, 5-methylbenzotellurazole, 5-methoxybenzotellurazole, 5,6-dimethylbenzotellurazole, naphtho[2,1-d]tellurazole, and naphtho[1,2-d]tellurazole; a pyridine series such as 2-pyridine, 5-methyl-2-pyridine, 4-pyridine, and 3-methyl-4-pyridine; a quinoline series such as 2-quinoline, 6-methyl-2-quinoline, 5-ethyl-2-quinoline, 6-chloro-2-quinoline, 8-chloro-2-quinoline, 6-methoxy-2-quinoline, 8-ethoxy-2-quinoline, 6-methyl-2-quinoline, 8-fluoro-2-quinoline, 6-dimethylamino-2-quinoline, 4-quinoline, and 6-methoxy-4-quinoline, 7-methyl-4-quinoline, 8-chloro-4-quinoline; a 3,3-dialkylindolenine series such as 3,3-dimethylindolenine, 3,3,5-trimethylindolenine, 3,3-dimethyl-5-(dimethylamino)indolenine, and 3,3-diethylindolenine; an imidazole series such as imidazole, 1-(cyclo)alkylimidazole, 1-(cyclo)alkyl-4-phenylimidazole; 1-(cyclo)alkyl-4,5-dimethylimidazole, 1-(cyclo)alkyl-4,5-dimethylimidazole, 1-(cyclo)alkylbenzimidazole, 1-phenyl-5,6-dichlorobenzimidazole, 1-(cyclo)alkyl-5-cyanobenzimidazole, 1-(cyclo)alkyl-5-chlorobenzimidazole, 1-(cyclo)alkyl-5,6-dichlorobenzimidazole, 1-(cyclo)alkyl-5-chloro-6-cyanobenzimidazole, 1-(cyclo)alkyl-5-trifluoromethylbenzimidazole, 1-(cyclo)alkyl-5-methylsulfonylbenzimidazole, 1-(cyclo)alkyl-5-methoxycarbonylbenzimidazole, 1-(cyclo)alkyl-5-acetylbenzimidazole, 1-(cyclo)alkyl-5-(N,N-dimethylamino)sulfonylbenzimidazole, 1-(cyclo)alkylnaphtho[1,2-d]imidazole, 1-(cyclo)alkylnaphtho[2,1-d]imidazole, and 1-(cyclo)alkylnaptho[2,3-d]imidazole; an oxazoline series such as oxazoline, and 4,4-dimethyloxazoline; a thiazoline series such as thiazoline, and 4-methylthiazoline, an isoxazole series such as isoxazole, benzisoxazole, 5-chlorobenzisoxazole, 6-methylbenzisoxazole, 7-methylbenzoxazole, 6-methoxybenzoxazole, and 7-methoxybenzisoxazole); a 1,3,4-thiadiazole series such as 5-methyl-1,3,4-thiadiazole, and 5-methylthio-1,3,4-thiadiazole; a thienothiazole series such as thieno[2,3-d]thiazole, thieno[3,2-d]thiazole, thieno[2,3-e]benzothiazole, thieno[3,2-e]benzothiazole, and thiazolo[4,5-b]benzothiophene; a tetrazole series such as 1-(cyclo)alkyltetrazole; an imidazoquinoxaline series such as 1-(cyclo)alkylimidazo[4,5-b]quinoxaline; 6,7-dichloro-l-(cyclo)alkyl-imidazo[4,5-b]quinoxaline, and 6-chloro-l-aryl-imidazo[4,5-b]quinoxaline), an imidazoquinoline series such as 1-(cyclo)alkyl-imidazo[4,5-b]quinoline, and 6,7-dichloro-1-(cyclo)alkylimidazo[4,5-b]quinoline; a pyrrolopyridine series such as 3,3-dialkyl-3H-pyrrolo[2,3-b]pyridine; a pyrrolopyrazine series such as pyrrolo-[2,3-b]pyrazine; and a pyridopyridine series such as pyrido[2,3-b]pyridine. The preceding 1-(cyclo)alkyl-groups are preferably the alkyl groups or cycloalkyl group with a carbon number of 1 to 10 (not including the carbon atoms of the substituents), and also include the alkyl groups or cycloalkyl groups substituted with an alkoxy group having a carbon number of 1 to 6, an alkoxycarbonyl group having an alkoxy group with a carbon number of 1 to 4, a carboxy group, a carbamoyl group, a cyano group, a halogen atom, a hydroxy group, a sulfo group, a phenyl group, including substituted phenyl group, a vinyl group, etc.; the examples of the 1-(cyclo)alkyl include methyl group, ethyl group, cyclohexyl group, butyl group, decyl group, 2-methoxyethyl group, 3-butoxypropyl group, 2-hydroxy-ethoxyethyl group, ethoxycarbonylmethyl group, carboxymethyl group, 2-carboxyethyl group, 2-cyanoethyl group, 2-carbamoylethyl group, 2-hydroxyethyl group, 2-fluoroethyl group, 2,2,2-trifluoroethyl group, 2-sulfoethyl group, 3-sulfopropyl group, 4-sulfobutyl group, phenethyl group, benzyl group, sulfophenethyl group, carboxybenzyl group, and allyl group.

The methine group represented by $L_1$, $L_2$, $L_3$, $L_4$, $L_5$, $L_6$, $L_7$, $L_8$, $L_9$, and $L_{10}$, include substituted methine group. The examples of the substituents include a lower alkyl groups having 1 to 6 carbon atoms (e.g. methyl group, ethyl group, propyl group, isobutyl group), an aryl group (e.g. phenyl group, p-tolyl group, p-chlorophenyl group), an alkoxy group having 1 to 4 carbon atoms (e.g. methoxy group, ethoxy group), an aryloxy group (e.g. phenoxy group), an aralkyl group (e.g. benzyl group, phenetyl group), a heterocyclic group (e.g. thienyl group, furyl group), a substituted amino group (e.g. dimethyl amino group, tetramethylenamino group, anilino group), an alkylthio group (e.g. methylthio group), and an acid nuclei groups (e.g. malononitrile, alkylsulfonylacetonitrile, cyanomethylbenzofuranyl ketone or cyanomethylphenyl ketone, 2-pyrrazolin-5-one, pyrrazolidine-3,5-dione, imidazolin-5-one, hydantoin, 2- or 4-thiohydantoin, 2-iminoxazolin-4-one, 2-oxazoline-5-one, 2-thioxazolidine-2,4-dione, isoxazolin-5-one, 2-thiazoline-4-one, thiazolidine-4-one, thiazolidine-2,4-dione, rhodanine, thiazolidine-2,4-dithione, isorhodanine, indane-1,3-dione, thiophene-3-one, thiophene-3-1,1-dioxide, indolin-2-one, indolin-3-one, indazolin-3-one, 2-oxoindazolinium, 3-oxoindazolinium, 5,7-dioxo-6,7-dihydrothiazolo[3,2-a]pyrimidine, cyclohexane-1,3-dione, 3,4-dihydroisoquinoline-4-one, 1,3-dioxane-4,6-dione, barbituric acid, 2-thiobarbituric acid, chroman-2,4-dione, indazolin-2-one, and pyrido[1,2-a]pyrimidine-l,3-dione). The substituents of the methine groups may be combined to form a 4- to 6-membered ring (e.g. 2-hydroxy-4- oxocyclobutene ring, cyclopentene ring, 3,3-dimethylcyclohexene).

The alkyl groups for each of $R_1$, $R_2$, $R_3$ and $R_5$include substituted alkyl groups. The preferred alkyl group is an alkyl groups having 1 to 8 carbon atoms (e.g. methyl group, ethyl group, butyl group, isobutyl group), and the examples of the substituent include an alkoxy group, an alkoxycarbonyl group, an aryl group, a hydroxy group, a cyano group, a vinyl group, a halogen atom, a carbamoyl group, a sulfamoyl group, a carboxy group, a sulfo group, and a sulfato group.

The alkyl groups for each of $R_4$ and $R_7$ include substituted alkyl groups and the preferred alkyl groups is an alkyl group having 1 to 6 carbon atoms (e.g. methyl group, ethyl group, propyl group). The examples of the substituent include an alkoxy group, an alkylthio group, an aryloxy group, an aryl group, a hydroxy group, a cyano group, a vinyl group, a halogen atom, a carbamoyl group, a sulfamoyl group, a sulfonyl group, an alkoxycarbonyl group, and a carboxy group.

The alicyclic groups for each of $R_4$ and $R_7$ are preferably 5- or 6-membered alicyclic groups (e.g. cyclopentyl group, cyclohexyl group) and include substituted alicyclic group.

The heterocyclic group and the aryl group represented by R4 and $R_7$ respectively include the substituted heterocyclic group and the substituted aryl group.

The examples of the heterocyclic group include a pyridyl group (e.g. a 2-pyridyl group, 3-pyridyl group, 4-pyridyl group) and a 2-thiazolyl group; the examples of the aryl group include a phenyl group, a 2-naphthyl group (e.g. p-tolyl group, p-chlorophenyl group, p-carboxyphenyl group).

The acid anion represented by $X_1\ominus$ and $X_2\ominus$ may be any acid residue; the examples include ethyl sulfate, methyl sulfate, p-toluenesulfonate, benzenesulfonate, thiocyanate, chloride, bromide, iodide, perchlorate, and perfluoroborate. When a dye forms an intramolecular salt, $k_1$ and $k_2$ each is zero.

Of the compounds represented by Formula [I] or [II], those represented by Formula [Ia] through [Ie] or [IIa] are particularly preferable;

Formula [Ia]

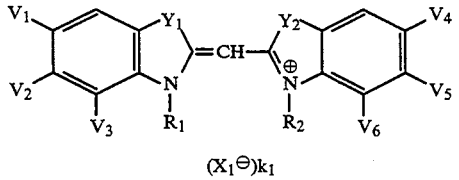

$(X_1\ominus)k_1$

Formula [Ib]

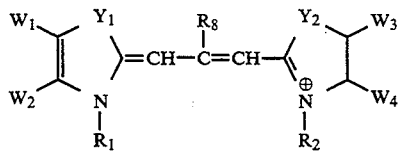

$(X_1\ominus)k_1$

-continued

Formula [Ic]

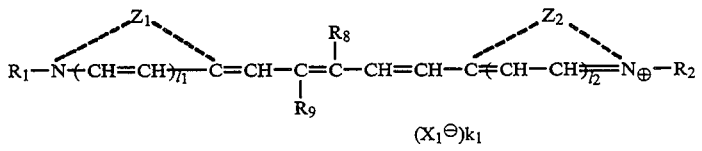

$(X_1^{\ominus})k_1$

Formula [Id]

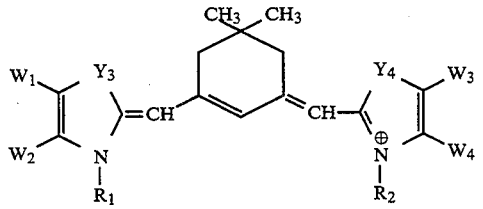

$(X_1^{\ominus})k_1$

Formula [Ie]

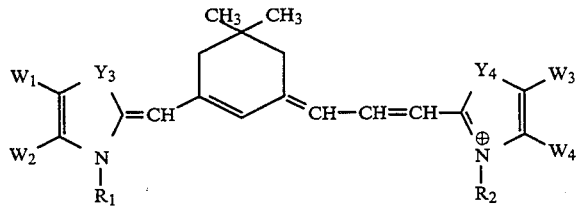

$(X_1^{\ominus})k_1$

Formula [IIa]

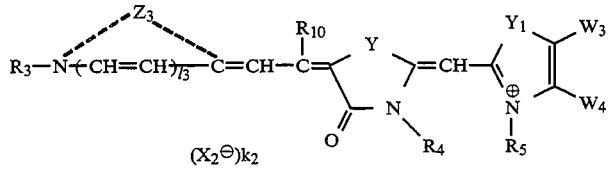

$(X_2^{\ominus})k_2$

Wherein $Z_1$, $Z_2$, $Z_3$, Y, $R_1$, $R_2$, $R_3$, $R_4$, $R_5$, $R_7$, $X_1$, $X_2$, $l_1$, $l_2$, $l_3$, $k_1$, and $k_2$ represent the same groups and numbers as those defined in Formula [I] and [II].

$Y_1$ and $Y_2$ independently represent an oxygen atom, a sulfur atom, a selenium atom, tellurium atom, or —N—$R_7$ group; $Y_3$ and $Y_4$ independently represent an oxygen atom, a sulfur atom, a selenium atom, or a tellurium atom.

$V_1$, $V_2$, $V_3$, $V_4$, $V_5$, and $V_6$ independently represent a hydrogen atom, an alkyl group (e.g. methyl group, ethyl group, trifluoromethyl group), an alkoxy group (e.g. methoxy group, ethoxy group), a halogen atom (e.g. fluorine, chlorine, bromine), a phenyl group, a hydroxy group, a cyano group, an alkoxycarbonyl group (e.g. methoxycarbonyl group, butoxycarbonyl group), a carbamoyl group (e.g. carbamoyl group, N,N-dimethylaminocarbamoyl group), a sulfamoyl group (e.g. sulfamoyl group, N,N-pentamethylenaminosulfonyl group), or a sulfonyl group (e.g. methanesulfonyl group; benzenesulfonyl group); $V_1$ and $V_2$, $V_2$ and $V_3$, $V_4$ and $V_5$, and $V_5$ and $V_6$ may be combined each other to form, e.g. a benzene ring, a cyclohexene ring or a thiophene ring;

$W_1$, $W_2$, $W_3$, and $W_4$ independently represent a hydrogen atom, an alkyl group (e.g. methyl group, ethyl group), or a phenyl group and W1 and W2, and/or W3 and W4 can be combined each other to form a ring which includes substituted ring. The ring formed by combining $W_1$ and $W_2$ and/or $W_3$ and $W_4$ each other is a benzene ring, a cyclohexene ring, a thiophene ring, or a naphthalene ring, which may be substituted by, for example, a halogen atom (e.g. fluorine, chlorine, bromine), an alkyl group (e.g. methyl group, a trifluoromethyl group, ethyl group), an alkoxy group (e.g. methoxy group, ethoxy group), a phenyl group, a cyano group, an alkoxycarbonyl group (e.g. methoxycarbonyl group, butoxycarbonyl group), a carbamoyl group (e.g. carbamoyl group, N,N-dimethylaminocarbamoyl group), a sulfonyl group (e.g. methanesulfonyl group, benzenesulfonyl group), and a sulfamoyl group (e.g. sulfamoyl group, N,N-dimethylaminosulfonyl group);

$R_8$ represents a hydrogen atom, an alkyl group (e.g. methyl group, ethyl group, propyl group, n-butyl group, an aralkyl group such as benzyl group), an aryl group (e.g. phenyl group, p-tolyl group), a heterocyclic group (e.g. 2-furyl group, 2-thienyl group), or an acid nucleus group (e.g. 2,4,6 triketohexahydropyrimidine derivatives, pyrazolone derivatives, 2-thio-2,4,6-triketohexapyrimidine derivatives, hydantoin derivatives, indandione derivatives, thianaphthenone derivatives, oxazolone derivatives);

$R_9$ represents a hydrogen atom, an alkyl group (e.g. methyl group, ethyl group, butyl group), an alkoxy group (e.g. methoxy group, ethoxy group), or an aryloxy group (e.g. phenoxy group); $R_{10}$ represents an alkyl group (e.g. methyl group, ethyl group), an alkoxy group (e.g. a lower akkoxy group such as methoxy group, ethoxy group), or aphenyl group.

The examples of the sensitizing dye of the present invention are given below, but these are not to be construed as limitations in the present invention.

A-1
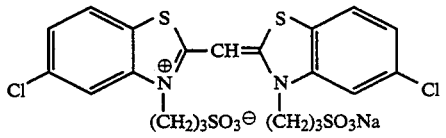
A-2
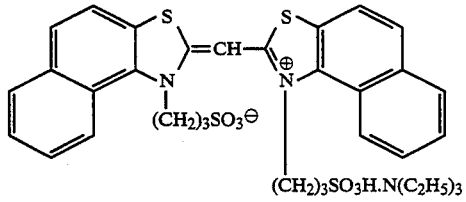
A-3
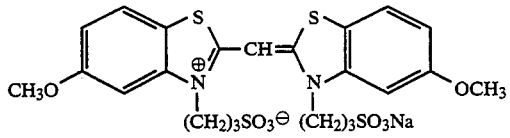
A-4
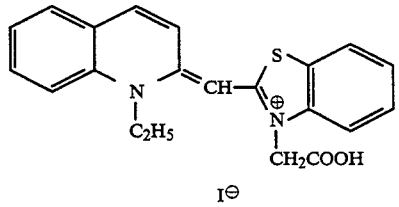
A-5
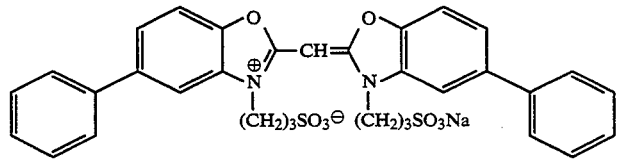
A-6
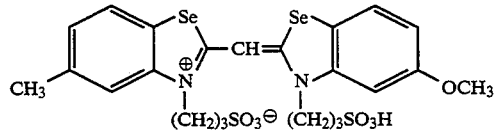
A-7
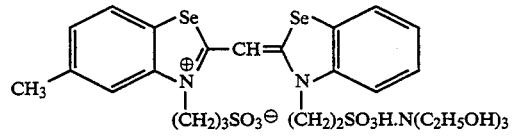
A-8
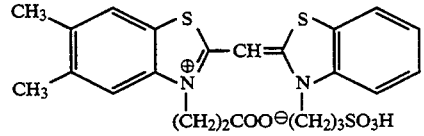
A-9
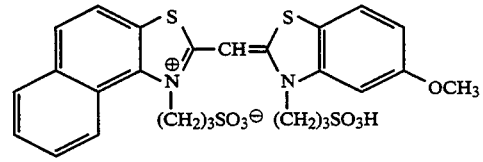

-continued
A-10
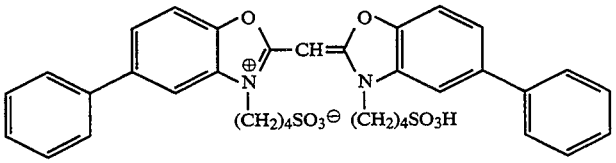
A-11
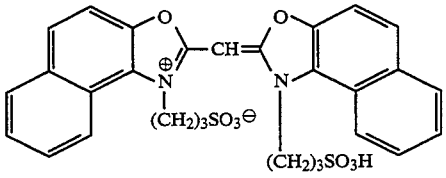
A-12
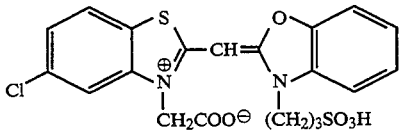
A-13
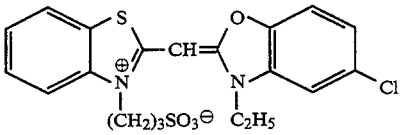
A-14
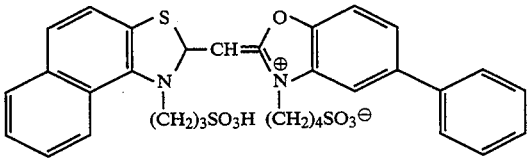
A-15
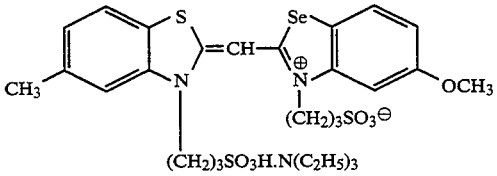
A-16
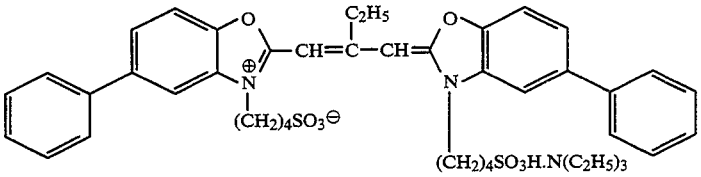
A-17
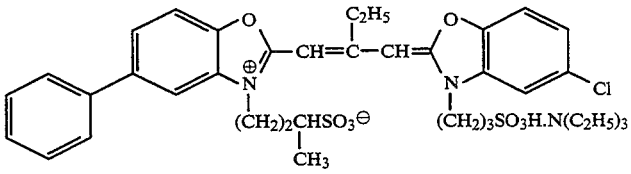
A-18
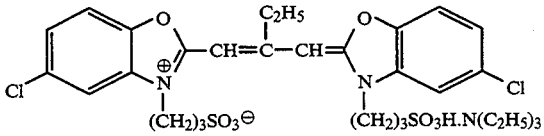

-continued
A-19
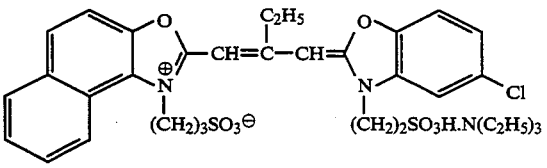
A-20
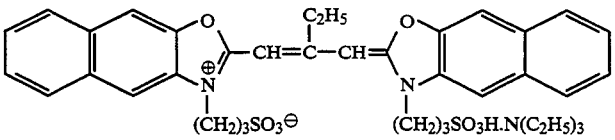
A-21
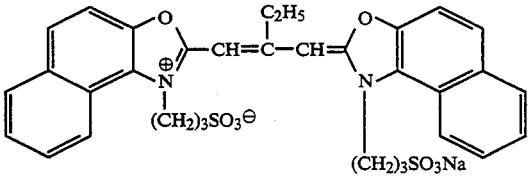
A-22
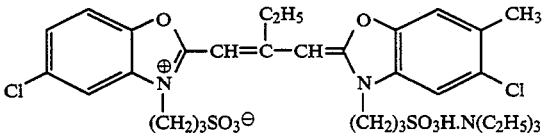
A-23
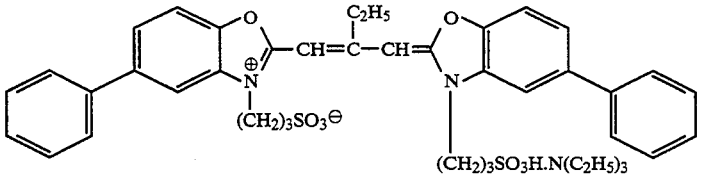
A-24
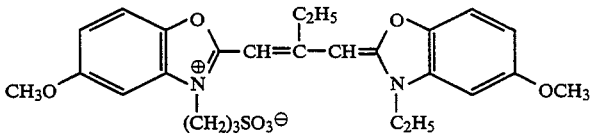
A-25
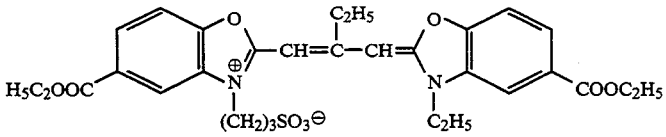
A-26
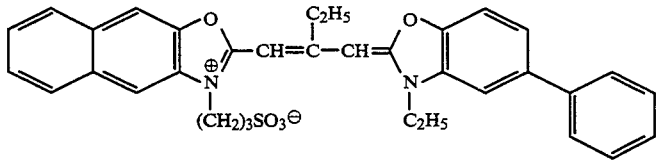
A-27
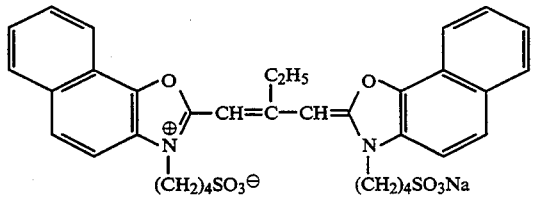

-continued
A-28
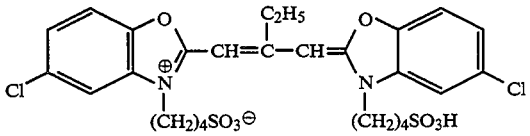
A-29
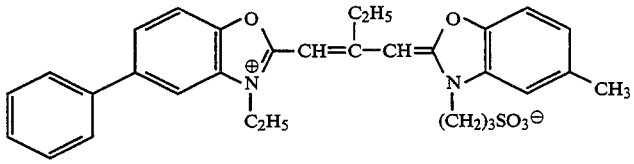
A-30
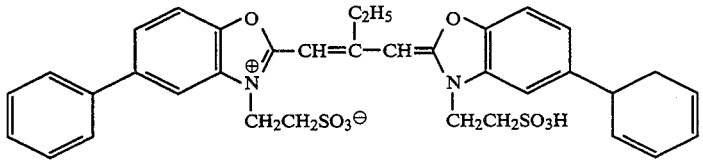
A-31
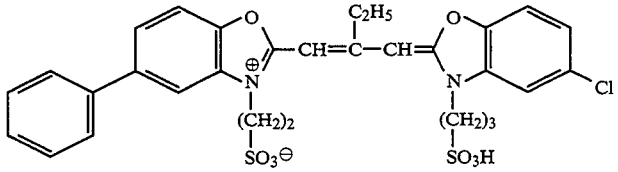
A-32
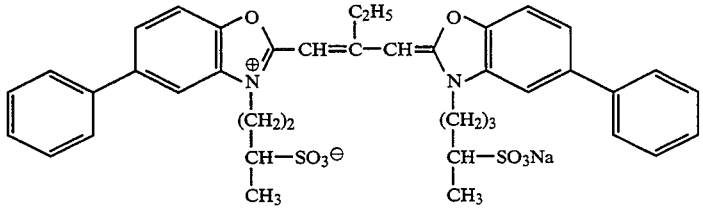
A-33
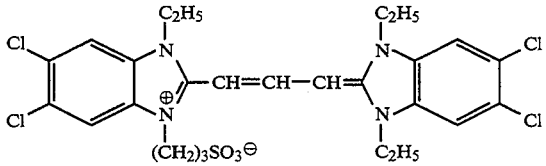
A-34
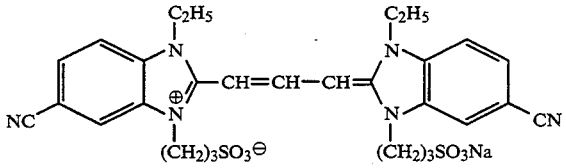
A-35
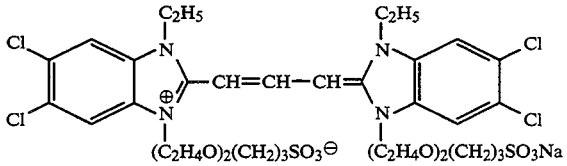
A-36
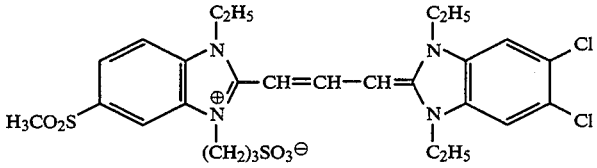

-continued
A-37
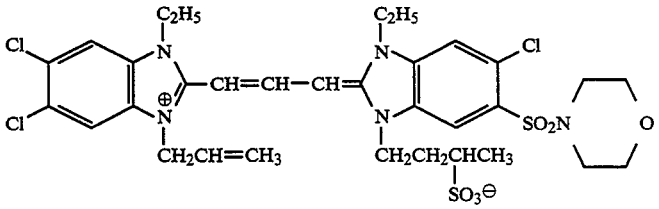
A-38
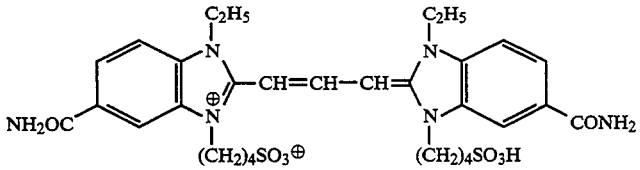
A-39
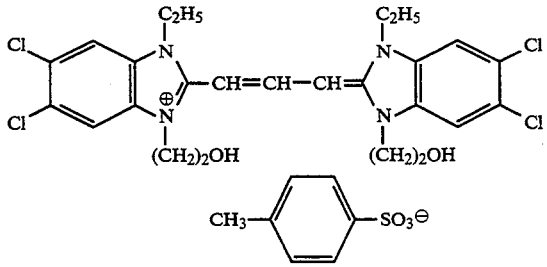
A-40
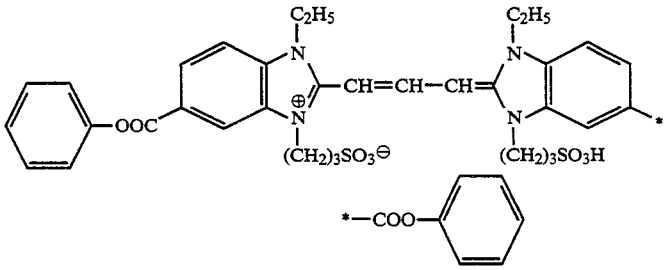
A-41
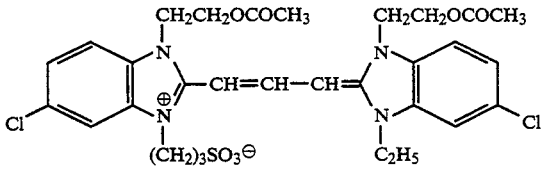
A-42
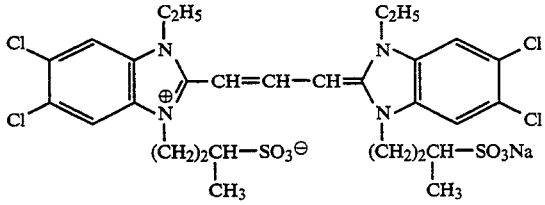
A-43
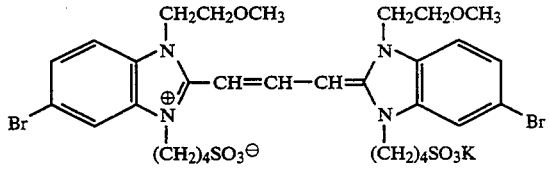
A-44
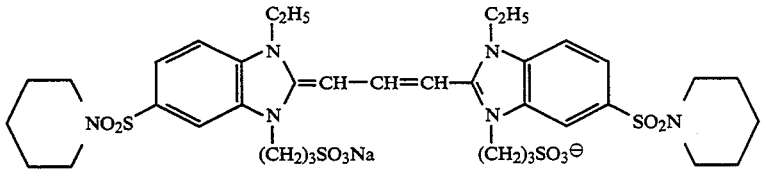

-continued
A-45
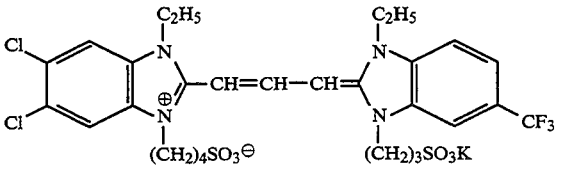
A-46
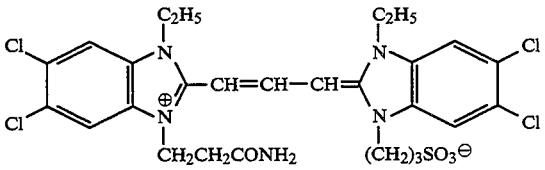
A-47
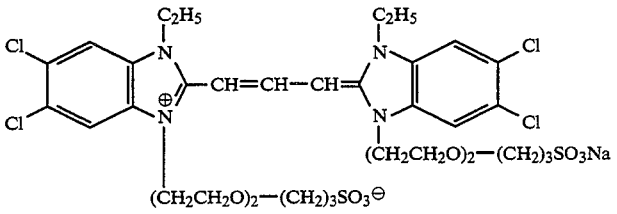
A-48
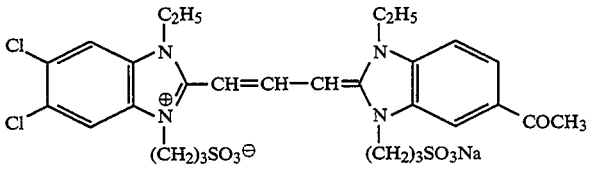
A-49
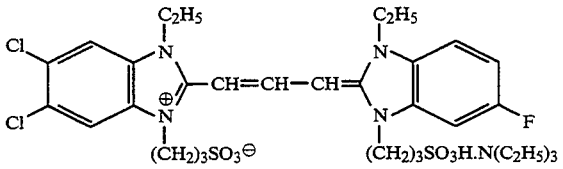
A-50
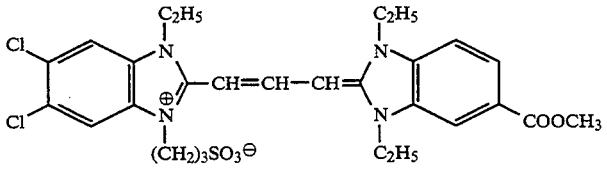
A-51
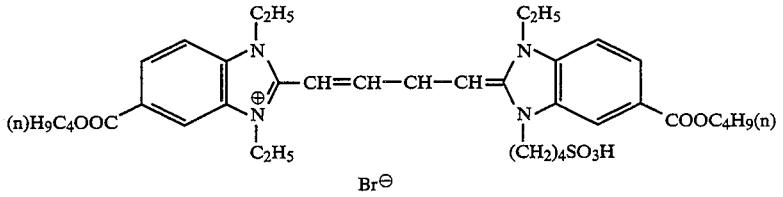
A-52
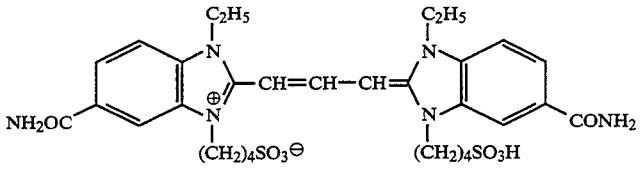
A-53
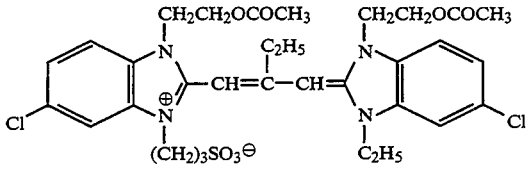

-continued
A-54
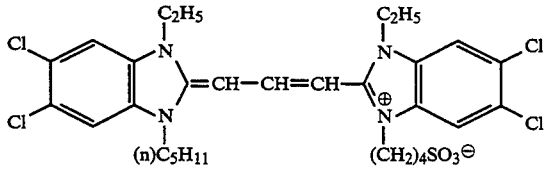
A-55
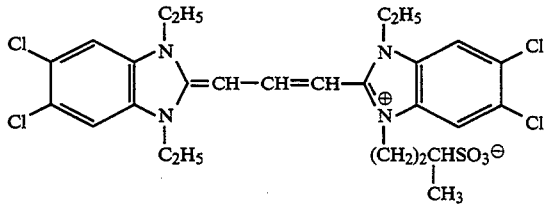
A-56
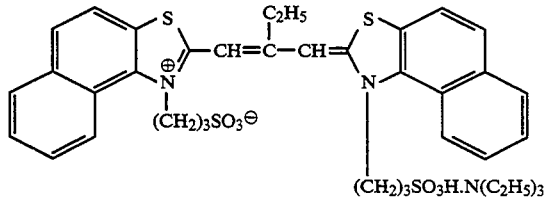
A-57
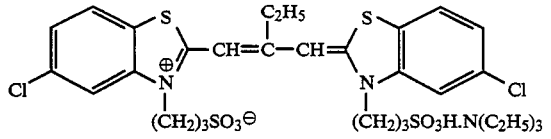
A-58
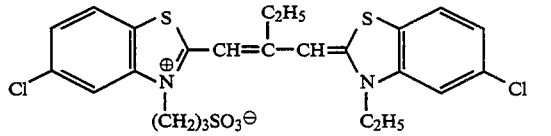
A-59
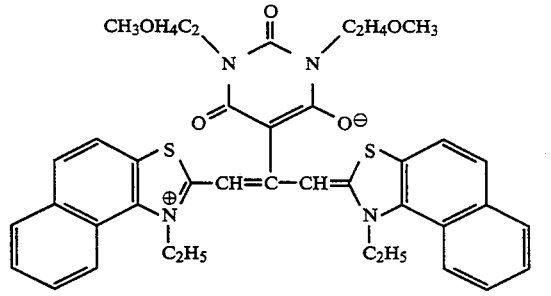
A-60
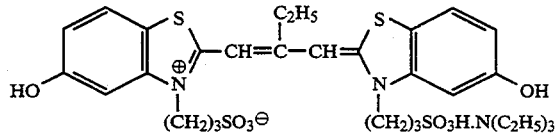
A-61
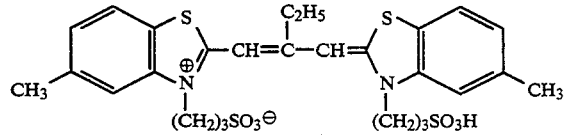
A-62
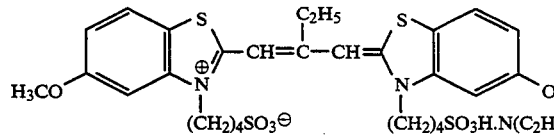

-continued
A-63
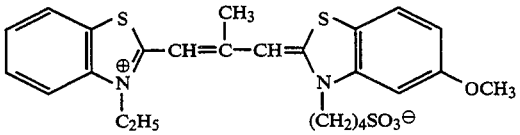
A-64
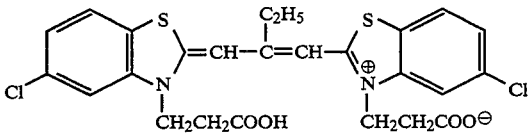
A-65
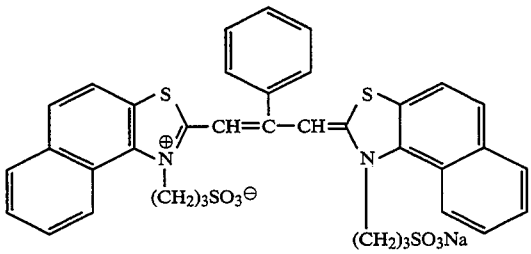
A-66
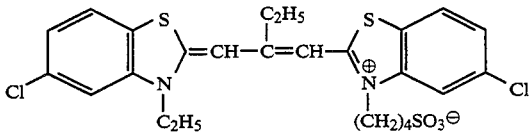
A-67
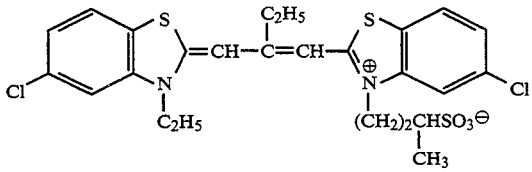
A-68
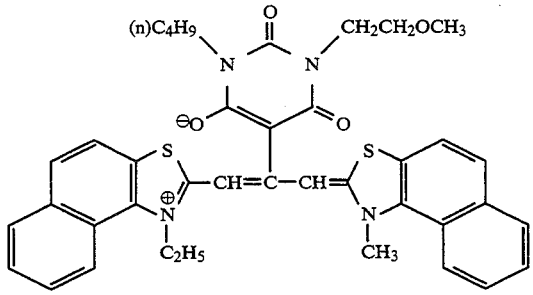
A-69
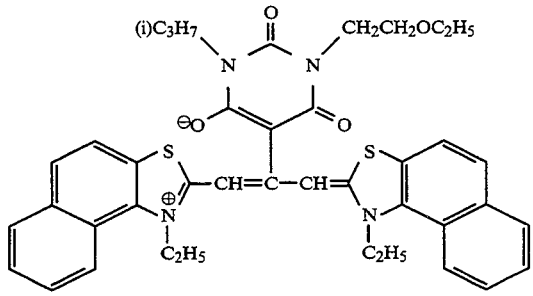
A-70
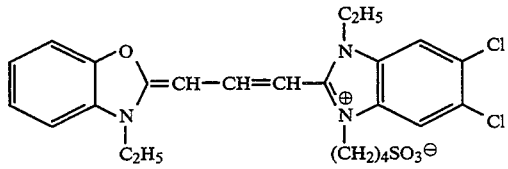

-continued
A-71
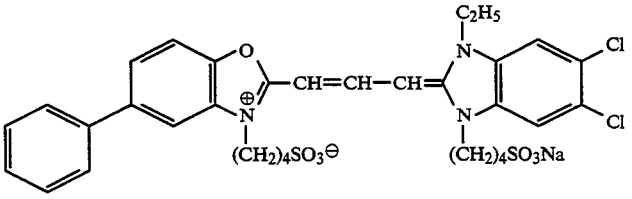
A-72
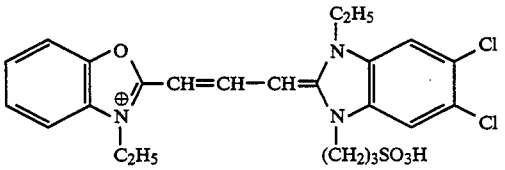
A-73
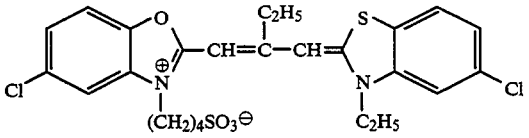
A-74
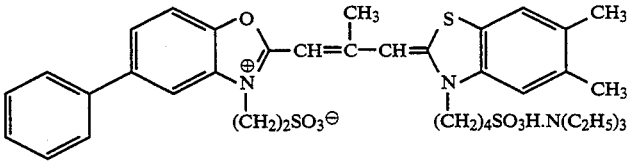
A-75
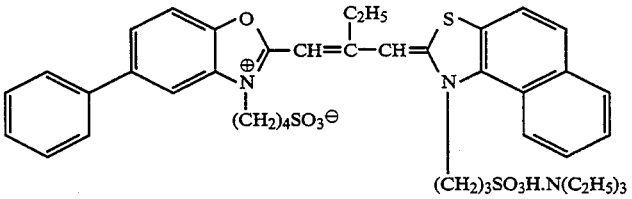
A-76
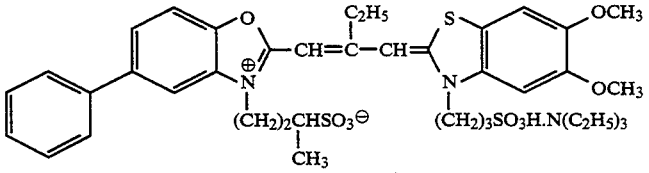
A-77
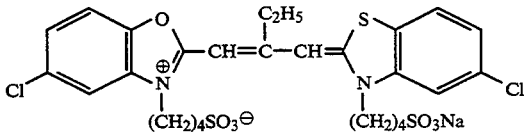
A-78
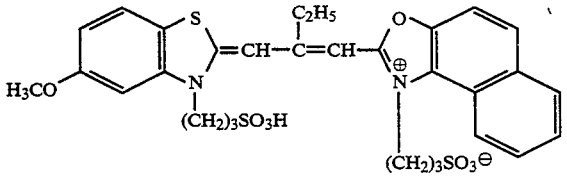
A-79
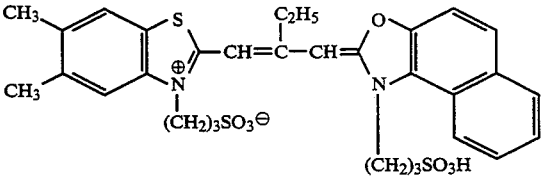

-continued
A-80
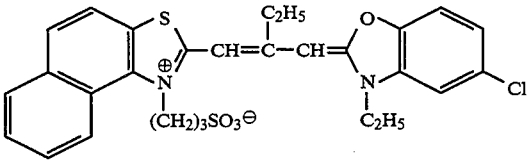
A-81
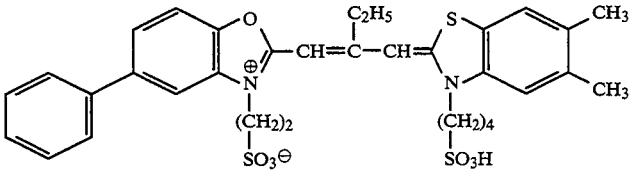
A-82
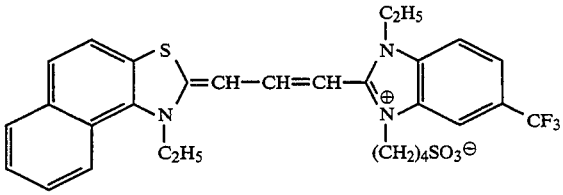
A-83
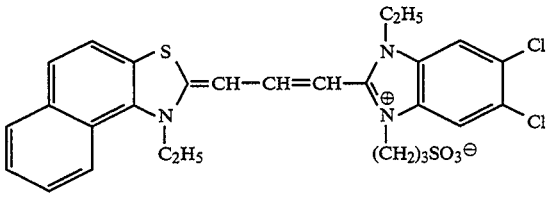
A-84
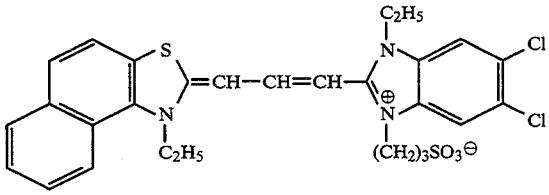
A-85
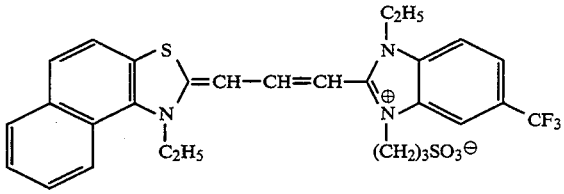
A-86
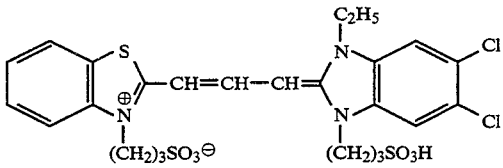
A-87
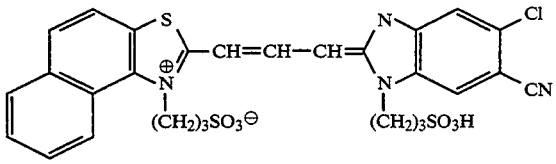

-continued
A-88
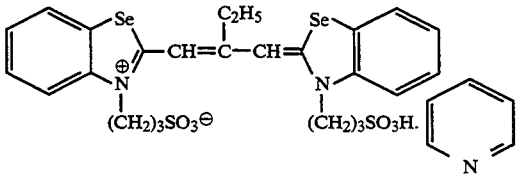
A-89
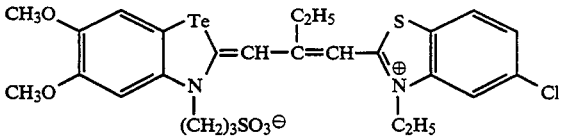
A-90
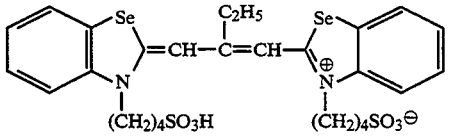
A-91
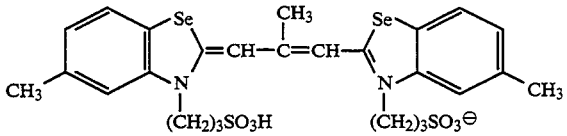
A-92
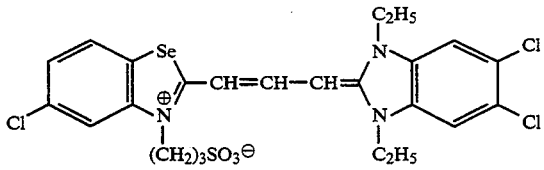
A-93
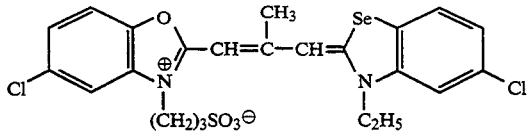
A-94
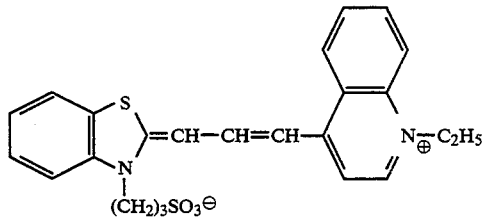
A-95
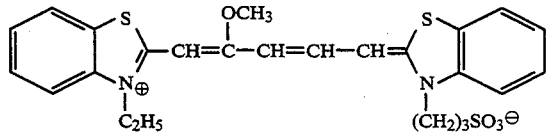
A-96
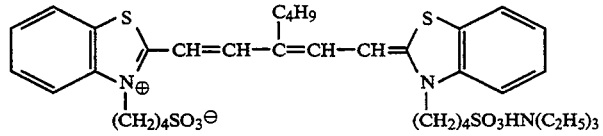

-continued
A-97
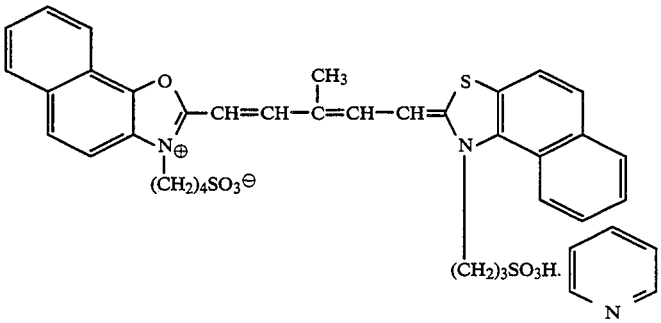
A-98
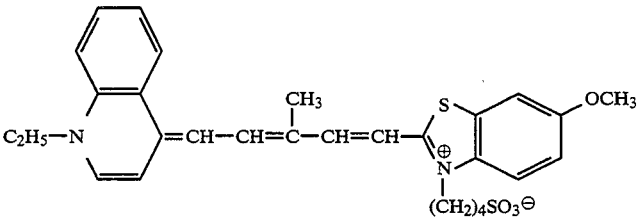
A-99
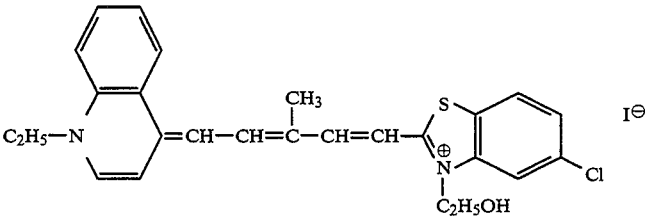
A-100
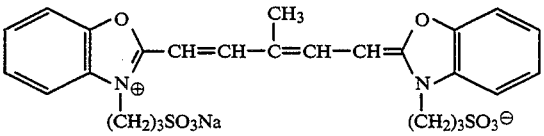
A-101
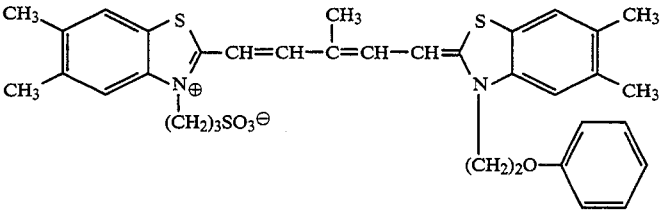
A-102
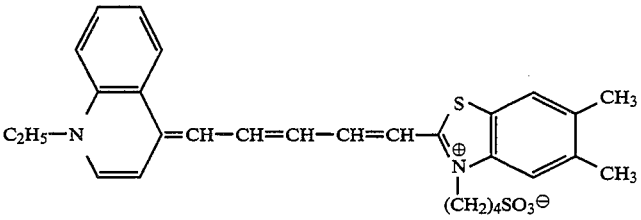
A-103
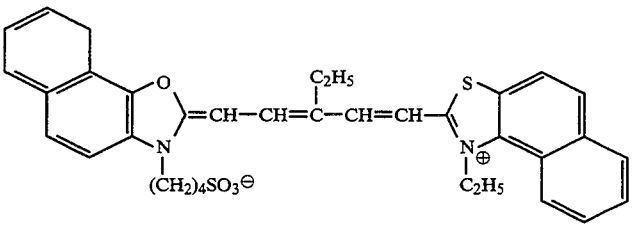

-continued
A-104
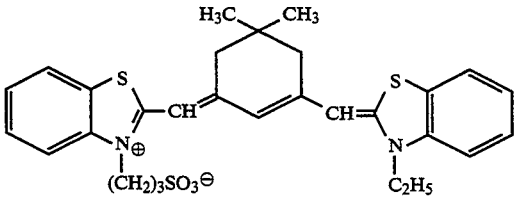
A-105
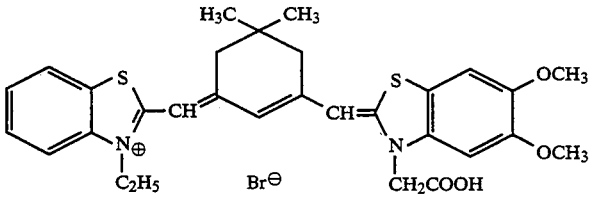
A-106
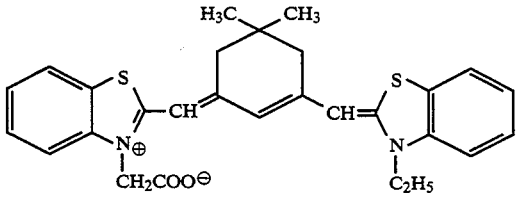
A-107
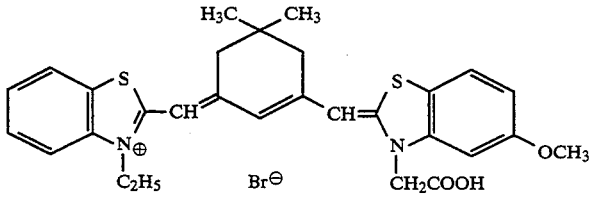
A-108
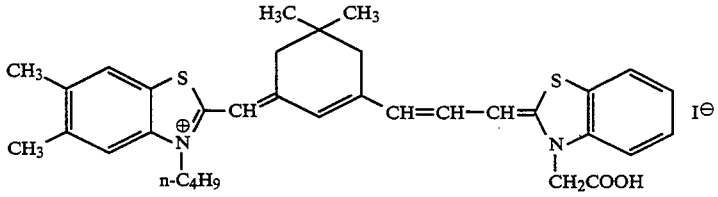
A-109
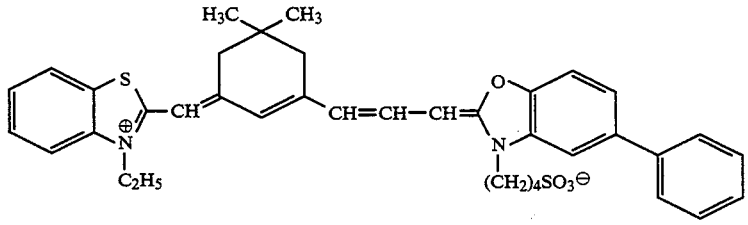
A-110
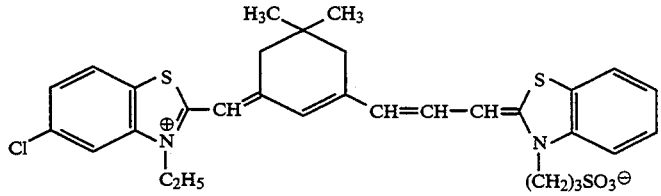
A-111
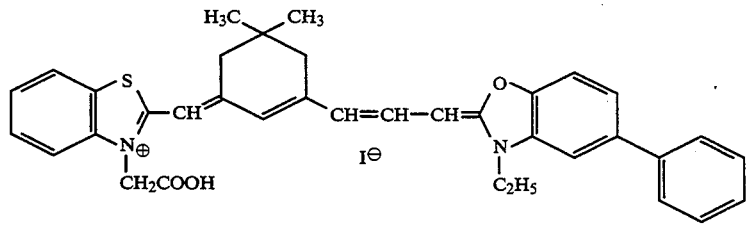

-continued
A-112
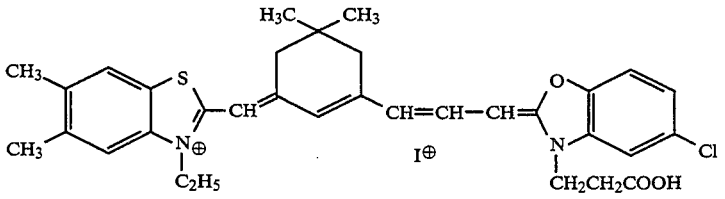
A-113
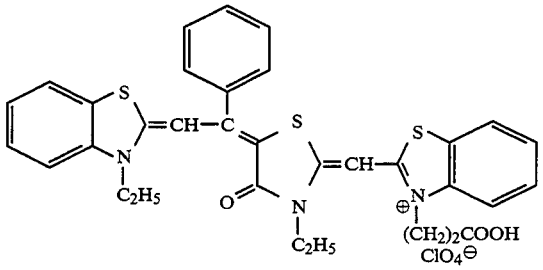
A-114
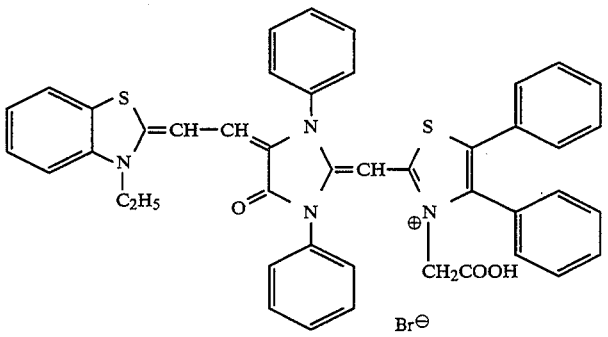
A-115
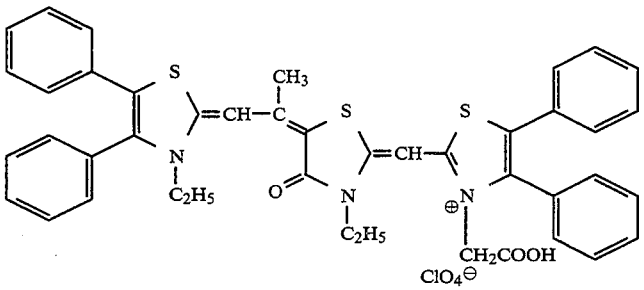
A-116
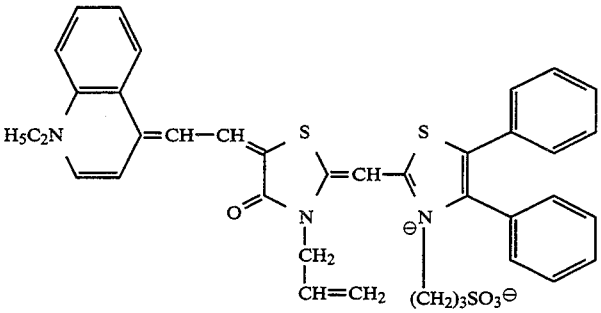

-continued

A-117

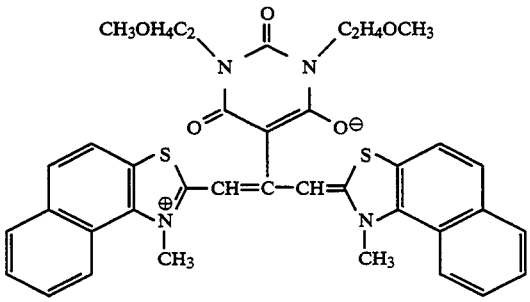

A-118

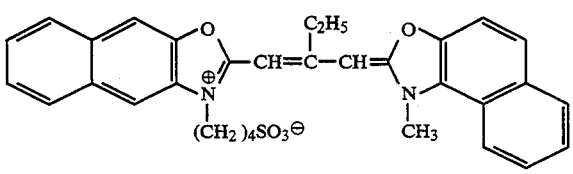

The sensitizing dyes represented by Formula [A] of the present invention can easily be synthesized by the methods described in, for example, the Journal of the American Chemical Society, 67, 1875–1899 (1945), "Heterocyclic Compounds-Cyanine Dyes and Related Compounds", F. M. Hamer, published by Inter Science Publishers (1964), U.S. Pat. Nos. 3,483,196, 3,541,089, 3,598,595, 3,598,596, 3,632,808, 3,757,663, and Japanese Patent Publication Open to Public Inspection No. 78445/1985.

The preceding spectral sensitizing dye is preferably used at a ratio of $1\times10^{-6}$ to $1\times10^{-2}$ mole, more preferably $5\times10^{-6}$ to $1\times10^{-3}$ mole per mole of silver halide. The spectral sensitizing dyes described above can be added to a silver halide emulsion by various methods. The methods include a protonization dissolution method described in Japanese Patent Publication Open to Public Inspection Nos. 80826/1975 and 80827/1975, a method in which a dye is dispersed in the presence of a surfactant, described in Japanese Patent Publication Open to Public Inspection Nos. 44895/1974 and 11419/1975, a method in which a dye is added in dispersion in hydrophilic medium, described in U.S. Pat. Nos. 3,676,147, 3,469,987, 4,247,627, 53-102733, and 53-137131, and a method in which a dye is added in solid solution, described in Democratic Republic of Germany Patent No. 143,324. It is also possible to use a method described in Democratic Republic of Germany Patent No. 21,802, Japanese Patent Examined Publication No. 40659/1975, Japanese Patent Publication Open to Public Inspection No. 148035/1984, etc., in which a dye is dissolved in at least one water-soluble solvent capable of dissolving the dye, selected from the group comprising of water, methanol, ethanol, propylalcohol, acetone, fluorinated alcohol, and dimethylformamide, and then added to an emulsion. It may be added at any stage of emulsion preparation, but it is Preferable to add in chemical aging or after that.

The sensitizing dye described above can be used in combination of various dyes having a supersensitizing function.

Furthermore, the sensitizing dye can be used in combination with other dyes such as hemicyanine dyes, styryl dyes and benzilidene dyes.

The AgX emulsion of the present invention can be applied to black-and-white photosensitive silver halide photographic material (e.g. X-ray film, lith type photosensitive material, black-and-white negative film) and color photographic material (e.g. color negative film, color reversal film, color paper). It can also be applied to diffusion transfer photosensitive material (e.g. color diffusion transfer component, silver salt diffusion transfer component) and heat development photosensitive material (black-and-white, color).

In regard of multicolor photosensitive AgX photographic material, it usually comprises a support provided thereon the blue-sensitive, green-sensitive and red-sensitive AgX emulsion layers respectively containing yellow, magenta and cyan couplers, and a non-photosensitive layer as needed, each having a prescribed number of layers in prescribed layering order, but the number of layers and the layering order are changeable according to key performance and application.

With regard to a multicolor photosensitive AgX photographic material of the present invention, at least one, or preferably all, of the blue-sensitive, green-sensitive and red sensitive layer is composed of a single layer comprising an AgX emulsion of the present invention, whereby it can provide a color image with a higher maximum density and excellent graininess and sharpness.

In a multicolor photosensitive silver halide photographic material, a non-photosensitive hydrophilic colloid layer (e.g. interlayer) may be or may not be present between the blue-sensitive, green-sensitive and red-sensitive emulsion layers. In addition, on an uppermost photosensitive emulsion layer, a non-photosensitive hydrophilic colloid layer (e.g. protective layer) may be or may not be present; between the lowest emulsion layer and a support, a non-photosensitive hydrophilic colloid layer may be or may not be present. From a viewpoint of graininess, sharpness and high sensitivity, dry thickness of the entire photographic component layers of the multicolor photosensitive material is preferably not more than 20 μm, more preferably, 8 to 18 μm. For much higher graininess and sharpness, the dry thickness is further preferably 10 to 15 μm. The photographic component layers include all of the emulsion layers and the non-photosensitive layers prepared as needed, excluding a support.

In measuring dry layer thickness, commercially available contact or non-contact thickness meters can be used. It is also possible to calculate coating layer thickness as the difference of dry thickness including a film base and thickness of a film base itself separately measured. Another method is to measure directly by observing visually or taking photograph with a microscope a thin section of a photosensitive material cut by a microtome.

From a viewpoint of sensitivity, preservability at high temperature and high humidity conditions, and color image graininess, it is preferable that the couplers used for a multicolor photosensitive material is added in a solution of a high boiling point organic solvent.

The yellow couplers preferably used for multicolor photosensitive silver halide photographic materials are benzoylacetanilide yellow couplers and pivaloylacetanilide yellow couplers. Of these yellow couplers, the compounds represented by Formulae [III] and [IV] can be preferably used.

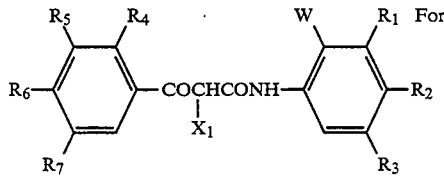

Formula [III]

wherein $R_1$ through $R_7$ and W independently represent a hydrogen atom or a substituent; preferably $R_1$, $R_2$ and $R_3$ represent a hydrogen atom, a halogen atom, an alkyl group, an aryl group, an alkoxy group, an acylamino group, a carbamoyl group, an alkoxycarbonyl group, a sulfonamide group, or a sulfamoyl group.

$R_4$, $R_5$, $R_6$, and $R_7$ preferably represent a hydrogen atom, an alkyl group, an alkoxy group, an aryloxy group, an acylamino group, or a sulfonamide group.

W, preferably represents a halogen atom, an alkyl group, an alkoxy group, an aryloxy group, or a dialkylamino group.

$X_1$ represents a hydrogen atom or a group capable of splitting off by reaction with an oxidized product of a color developing agent. The examples of such splitting off groups include a monovalent group such as a halogen atom, a group bonded via an oxygen atom (e.g. an alkoxy group, an aryloxy group, a heterocyclic oxy group, an acyloxy group), a group bonded via a sulfur atom (e.g. an alkylthio group, an arylthio group, a heterocyclic thio group), a group bonded with a nitrogen atom (e.g. —N $X_1$, wherein $X_1$ represents the group of the atoms necessary to form a 5- or 6-membered ring with the nitrogen atom in the formula and at least one atom selected from carbon, oxygen, nitrogen and sulfur atoms; an acylamino group; a sulfonamide group) and a divalent group such as an alkylene group.

Of these separating groups, those bonded via a nitrogen or oxygen atom are preferred. Formula [III ] involves the cases where a dimer or higher polymer is formed at $R_1$ through $R_7$, W, or $X_1$.

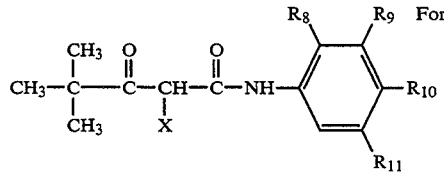

Formula [IV]

wherein $R_8$ through $R_{11}$ independently represent a hydrogen atom or a substituent; $R_8$ preferably represents a hydrogen atom, a halogen atom, or an alkoxy group, and a halogen atom is more preferable; $R_9$, $R_{10}$, and $R_{11}$ independently preferably represent a hydrogen atom, a halogen atom, an alkyl group, an alkenyl group, an alkoxy group, an aryl group, a carboxy group, an alkoxycarbonyl group, a carbamoyl group, a sulfone group, a sulfamoyl group, an alkylsulfonamide group, an acylamide group, an ureido group, or an amino group; more preferably $R_9$ and $R_{10}$ is a hydrogen atom, respectively, and $R_{11}$ is an alkoxycarbonyl group, an acylamide group or an alkylsulfonamide group. X represents the same groups as $X_1$ in Formula [III]; the preferred examples of the splitting off groups are the same as those of Formula [III].

Formula [IV] involves the cases where a dimer or higher polymer is formed at $R_8$ through $R_{11}$ or X.

Of the preceding yellow couplers, a diequivalent benzoyl type yellow coupler is particularly preferable.

The magenta couplers preferably used are represented by Formula [V], [VI], [VII] or [VIII];.

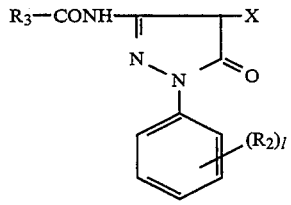

Formula [V]

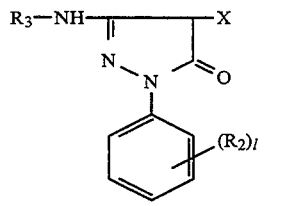

Formula [VI]

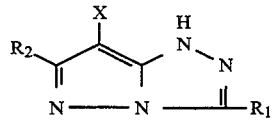

Formula [VII]

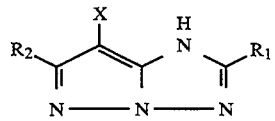

Formula [VIII]

In Formulae [V] through [VIII], $R_3$ represents a substituent; $R_1$ and $R_2$ independently represent a hydrogen atom or a substituent; X represents the same groups as $X_1$ in Formula [III]; l represents the integer of 0 through 5; each $R_2$ may be identical or not, provided that l is 2 or more.

The examples of the substituent represented by $R_1$ or $R_2$ include a halogen atom and a group bonded directly or via a divalent group or atom such at alkyl, cycloalkyl, aryl or heterocyclic groups, which include substituted ones.

The examples of the substituent represented by $R_3$ include a group such as alkyl, cycloalkyl, aryl, and heterocyclic groups, which include substituted ones.

In the above magenta couplers, the splitting off group represented by X is exemplified by the same examples as those of $X_1$ in Formula [III]. Of these splitting off groups, those bonded via a nitrogen atom or a sulfur atom are preferred for X in Formulae [V] and [VI] and halogen atom is preferred for X in Formula [VII] and [VIII].

Formulae [V] and [VI] involve the cases where a dimer or higher polymer is formed at $R_2$, $R_3$ or X; Formulae [VII] and [VIII] involve the cases where a dimer or higher polymer is formed at $R_1$, $R_2$ or X.

The cyan couplers preferably used are represented by Formula [IX], [X], or [XI];

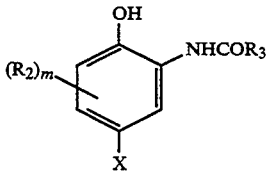

Formula [IX]

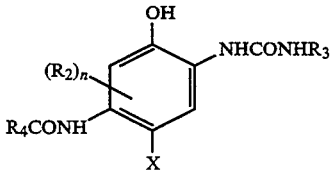

Formula [X]

-continued

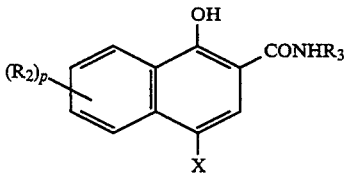

Formula [XI]

Wherein, $R_2$ and $R_3$ represent the same groups as $R_2$ and $R_3$ in Formula [V]; X represents the same groups as $X_1$ in Formula [III]; $R_4$ represents a substituent; m is the integer of 1, 2 or 3; n is the integer of 1 or 2; p is the integer 1 through 5; each $R_2$ may be identical or not, provided that m, n, and p are independently 2 or more.

$R_2$ and $R_3$ are exemplified by the same examples as those of $R_2$ and $R_3$ in Formula [[V]; $R_4$ is exemplified by the same examples as those of $R_3$ in Formula [V].

In the above cyan couplers, the examples of the splitting off group represented by X are the same as those of Formula [III]; a halogen atom and a group bonded via an oxygen atom are preferred.

Formula [IX] and [IX] involve the cases where a dimer or higher polymer is formed at $R_2$, $R_3$, or X; Formula [X] involves the cases where a dimer or higher polymer is formed at $R_2$, $R_3$, $R_4$ or X.

The examples of yellow couplers, magenta couplers and cyan couplers used for the present invention are given below, but these are not to be construed as limitations in the present invention.

Diequivalent yellow couplers

Y-1

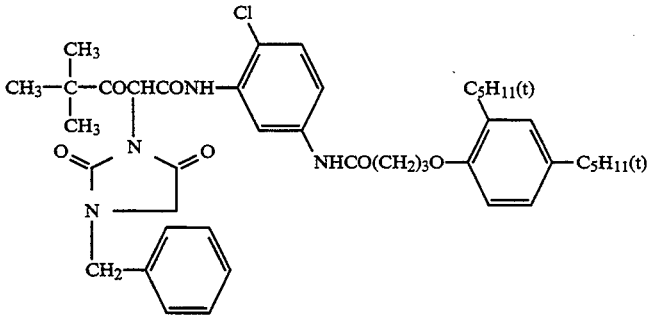

Y-2

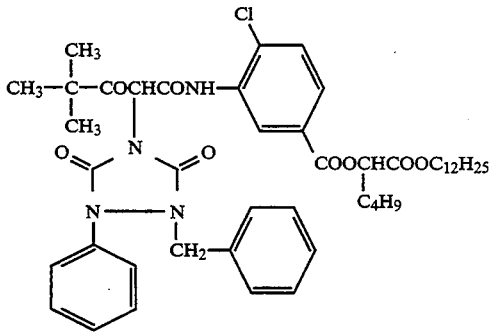

-continued
Y-3
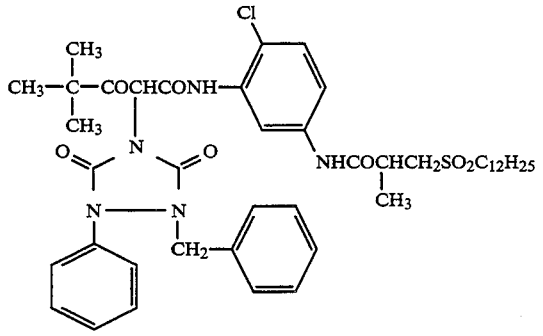
Y-4
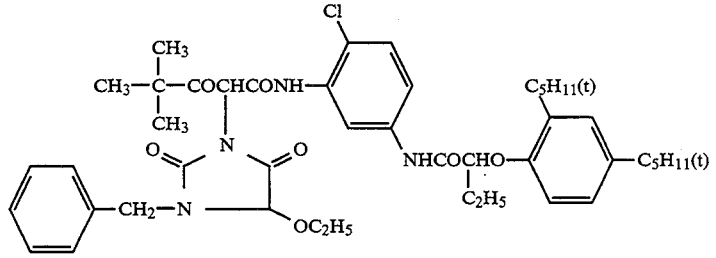
Y-5
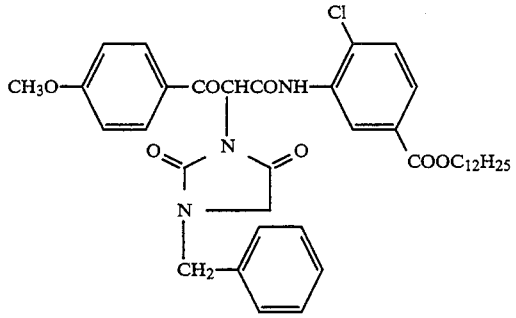
Y-6
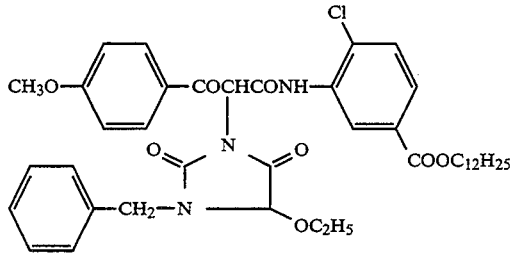
Y-7
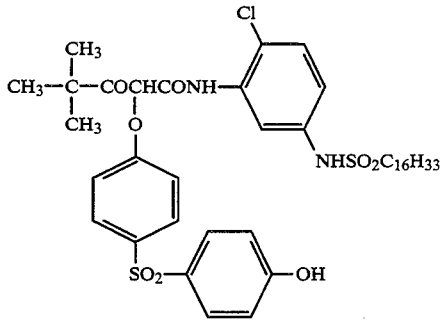

-continued
Y-8
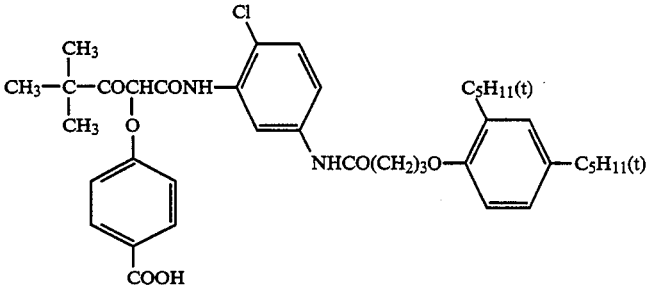
Y-9
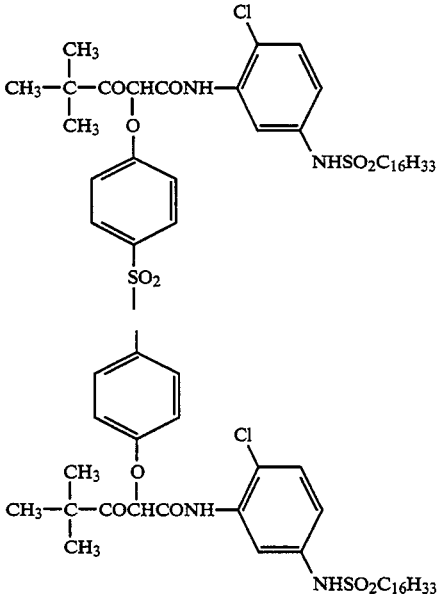
Y-10
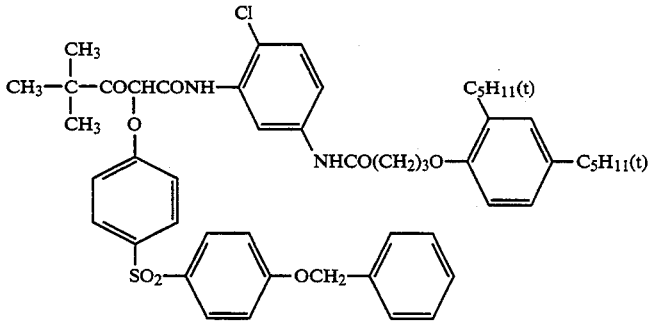
Y-11
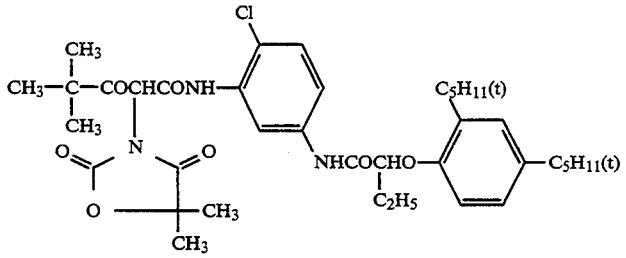
Y-12
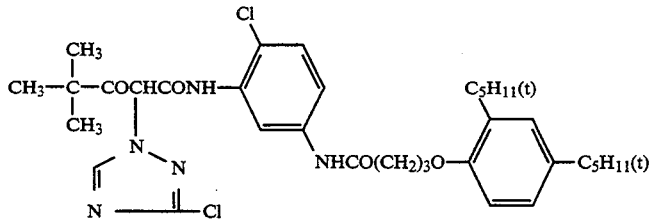

-continued
Y-13
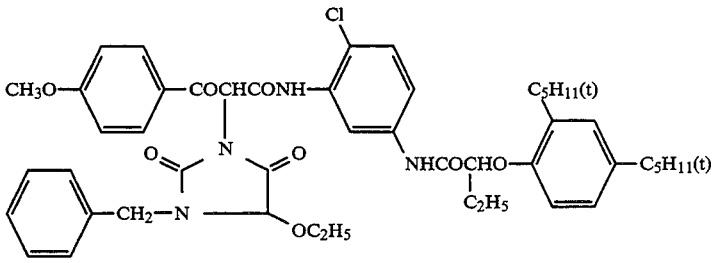
Y-14
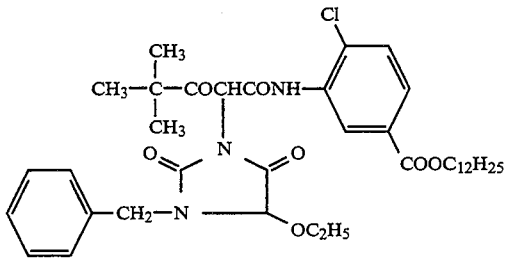
Y-15
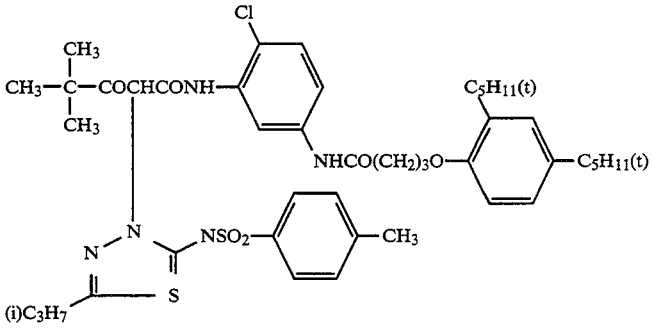
Y-16
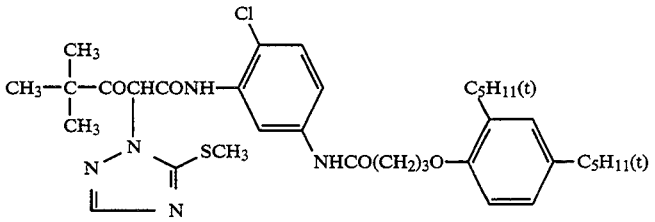
Y-17
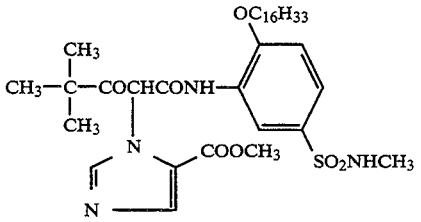
Y-18
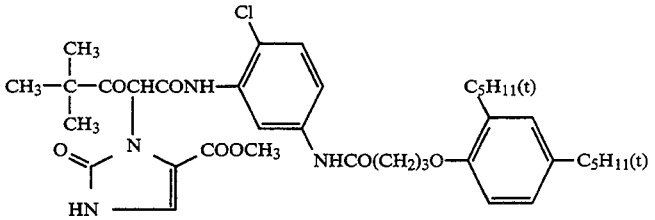

-continued
Y-19
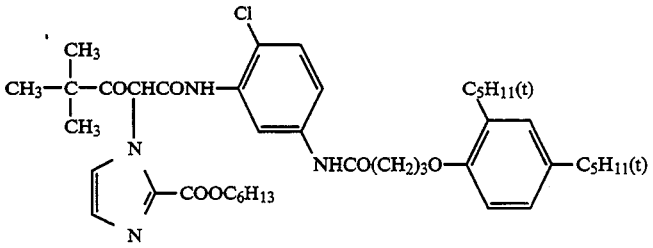
Y-20
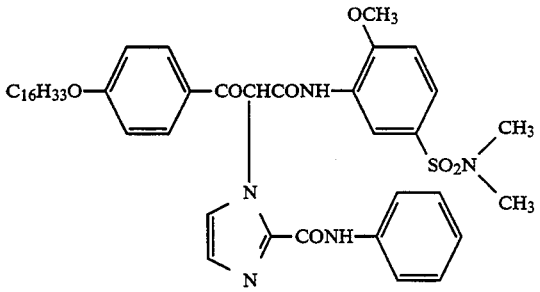
Y-21
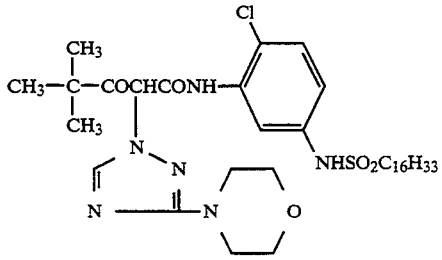
Y-22
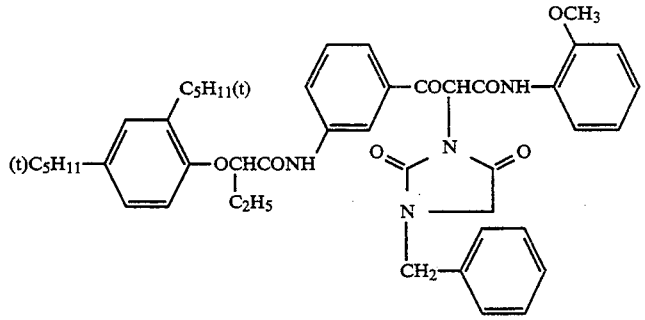
Y-23
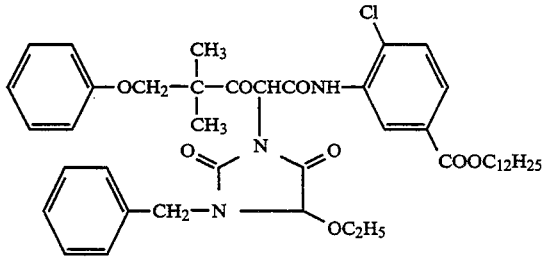

-continued
Y-24
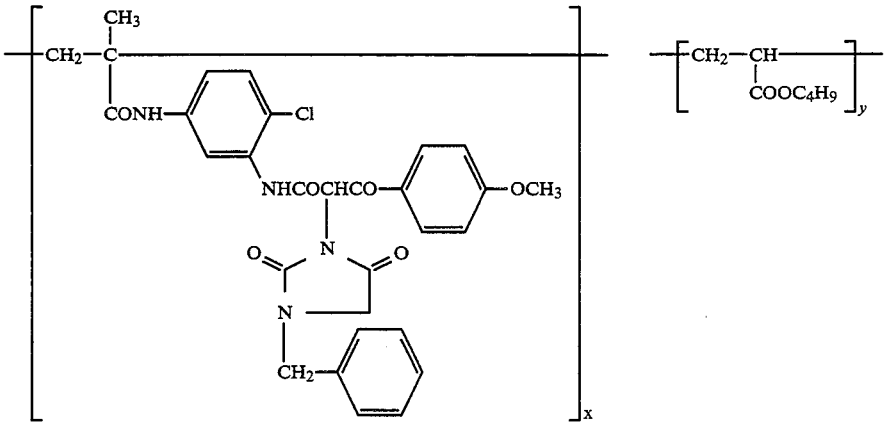
x:y = 50:50
Y-25
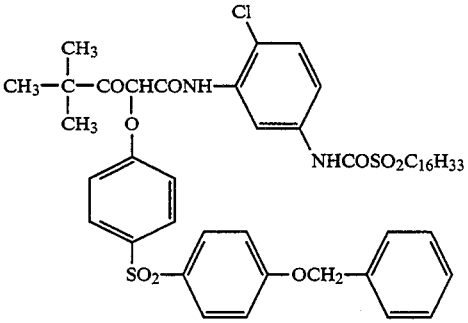
Y-26
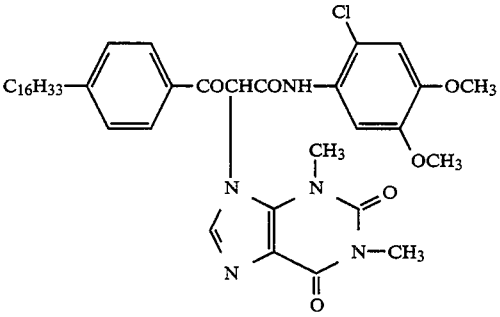
Y-27
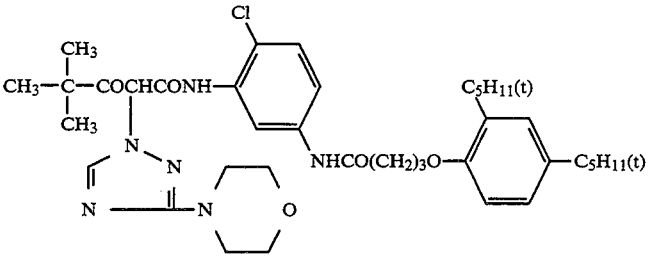
Diequivalent magenta couplers
M-1
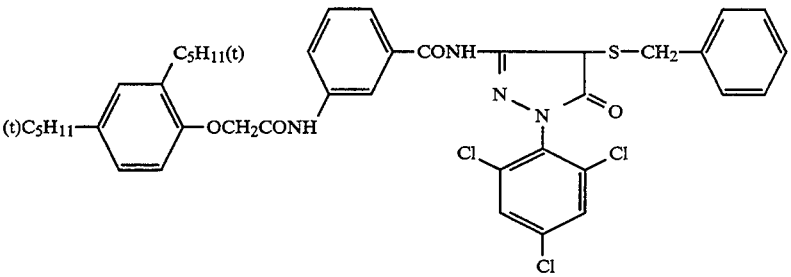

-continued
M-2
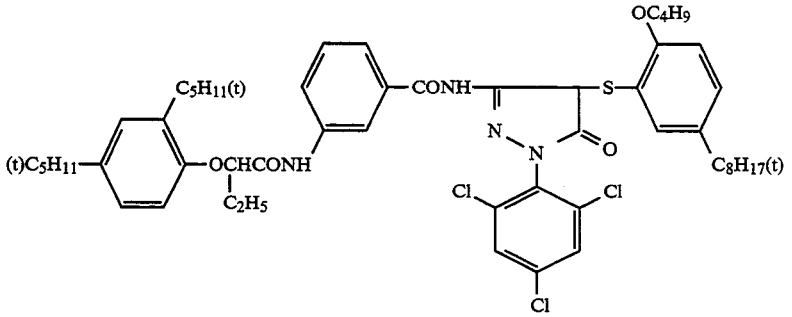
M-3
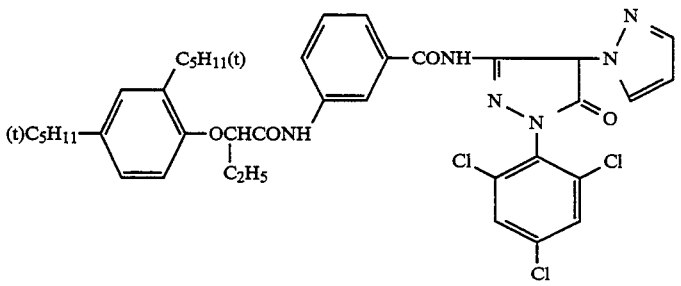
M-4
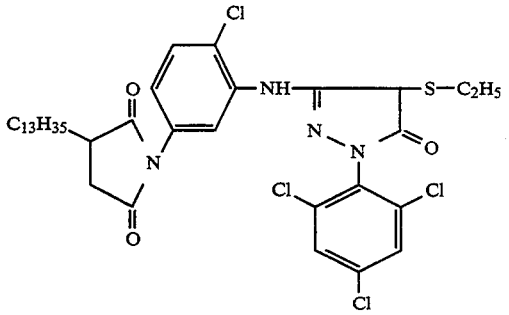
M-5
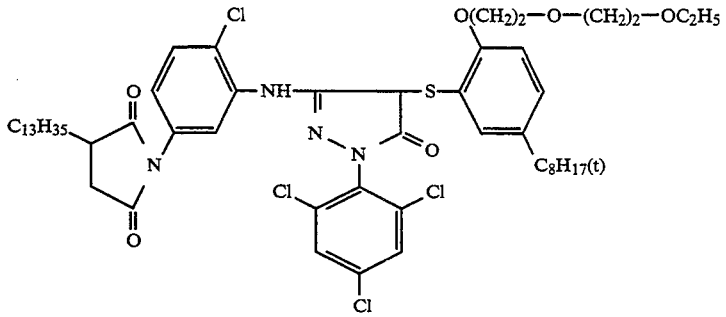
M-6
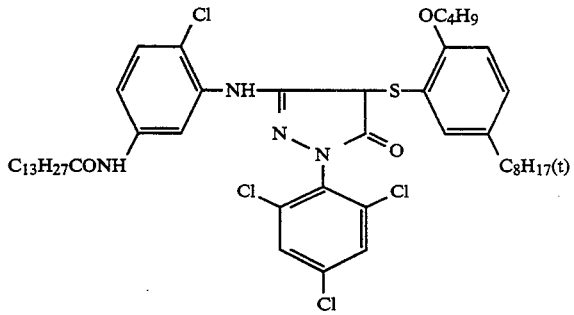

-continued
M-7
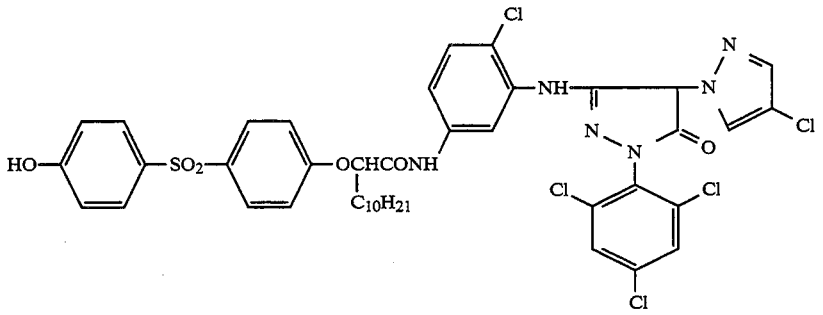
M-8
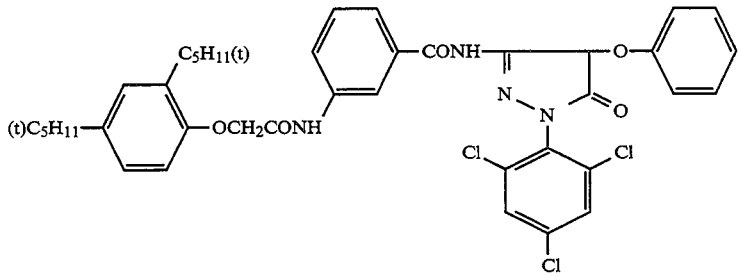
M-9
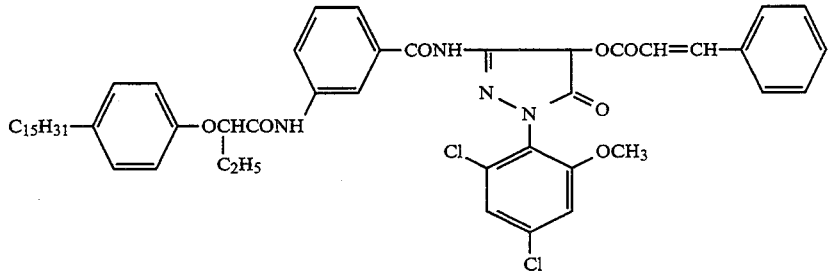
M-10
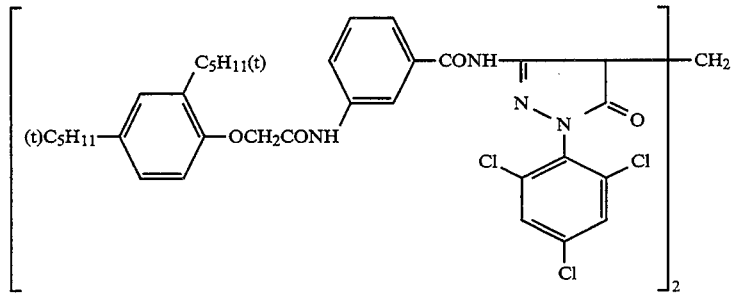
M-11
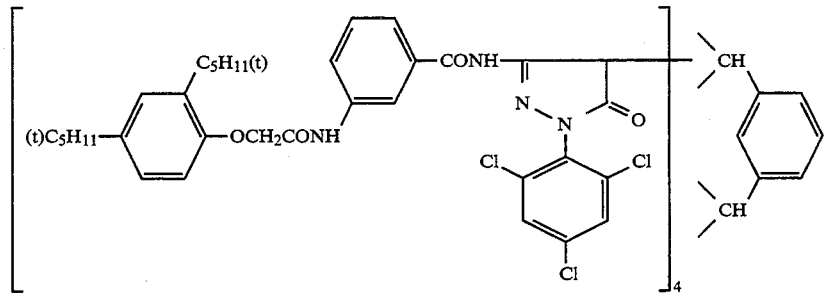

-continued
M-12
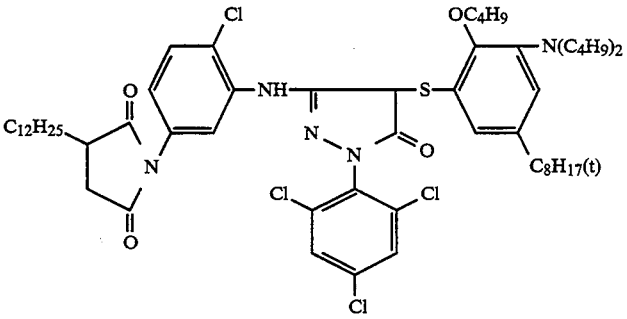
M-13
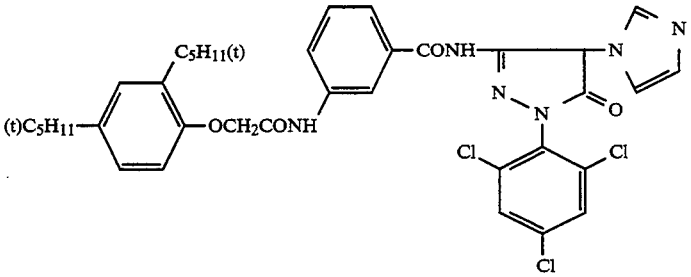
M-14
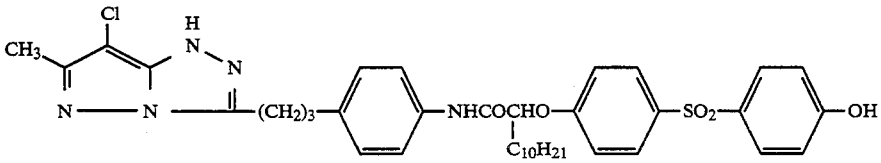
M-15
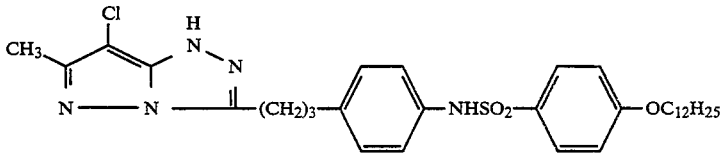
M-16
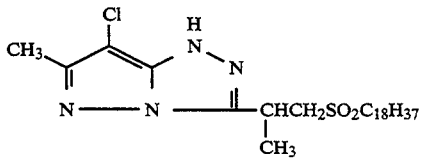
M-17
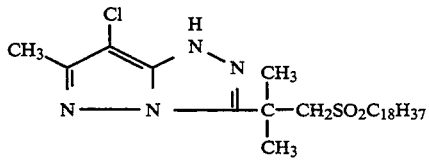
M-18
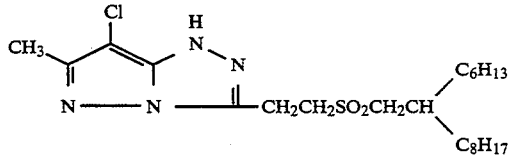

-continued
M-19
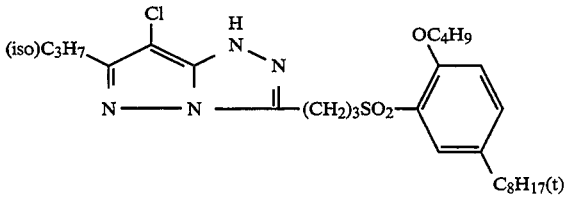
M-20
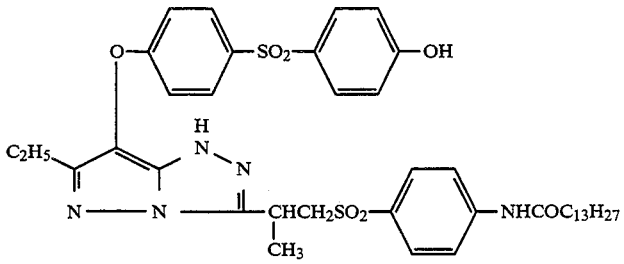
M-21
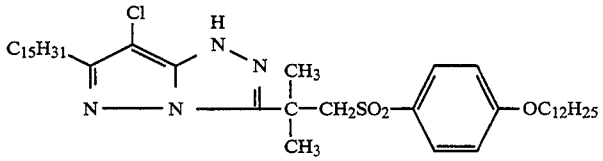
M-22
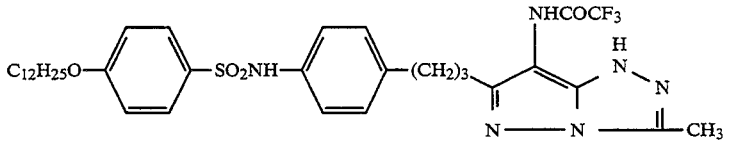
M-23
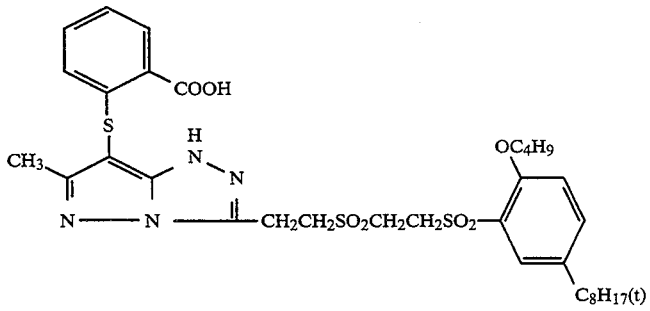
M-24
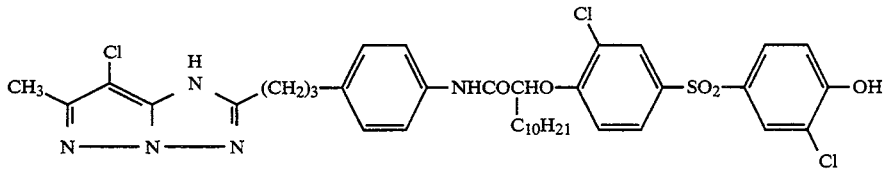
M-25
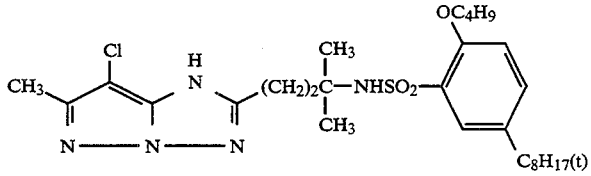

-continued
M-26
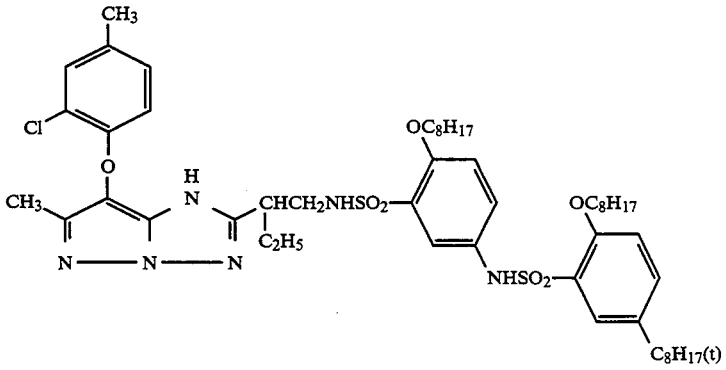
M-27
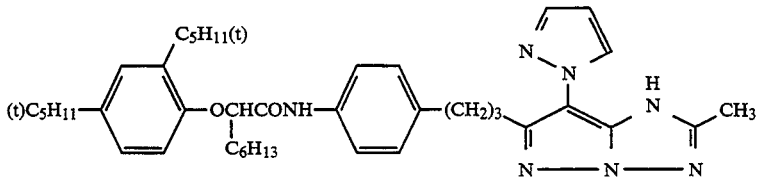
M-28
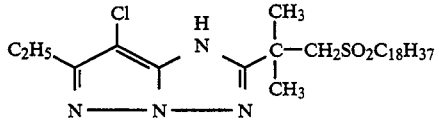
M-29
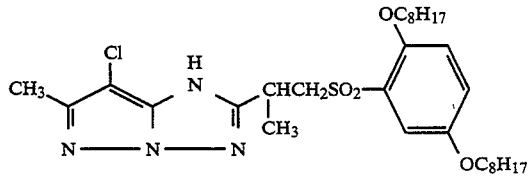
M-30
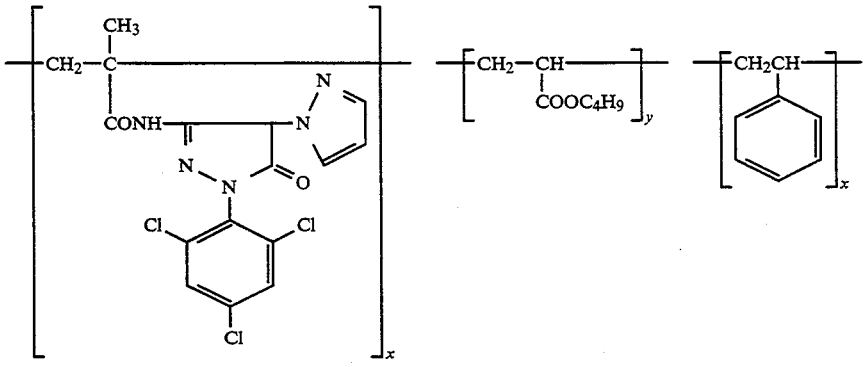
x:y:z = 50:25:25 (ratio by weight)
M-31
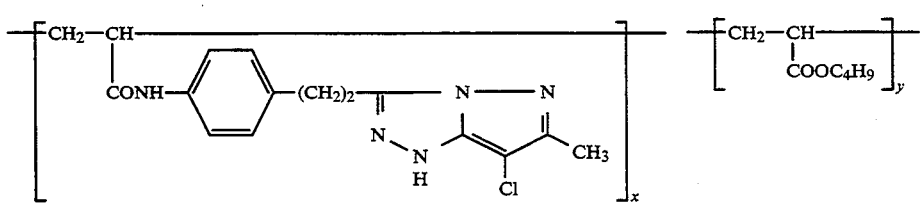
x:y = 50:50

-continued
M-32
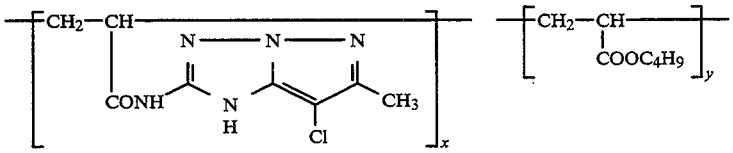
x:y = 50:50
M-33
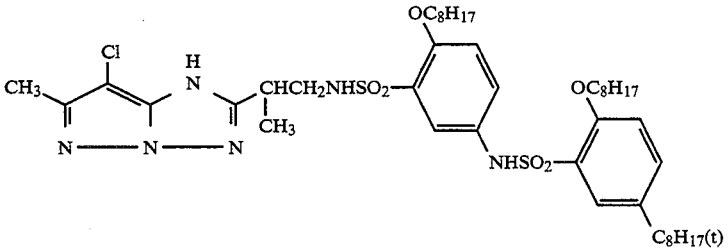
Diequivalent cyan couplers
C-1
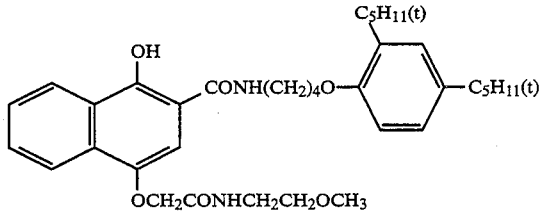
C-2
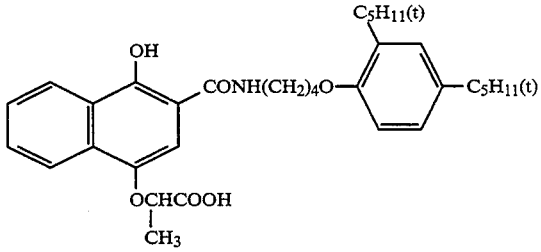
C-3
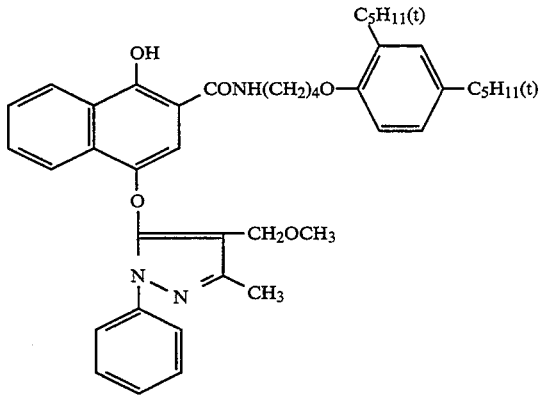
C-4
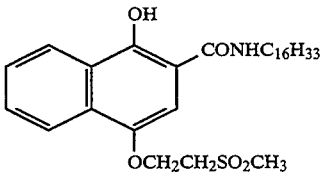

C-5
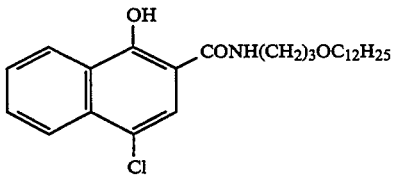
C-6
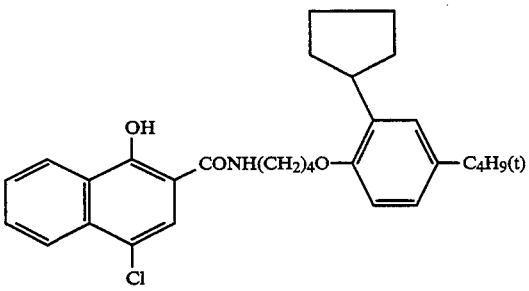
C-7
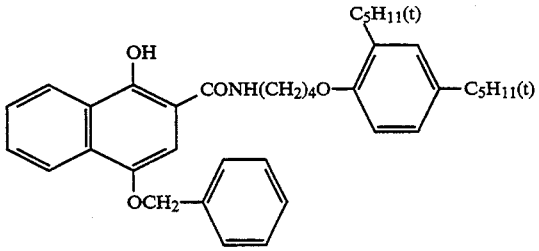
C-8
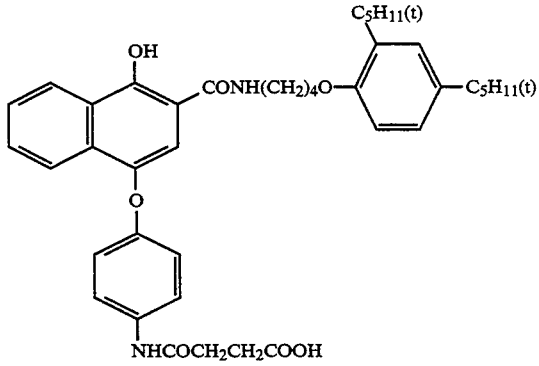
C-9
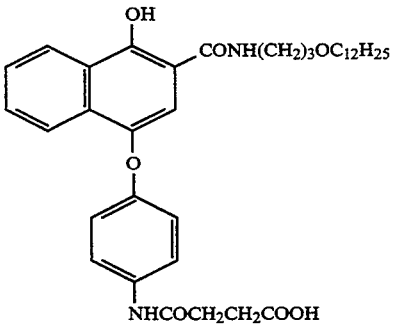

-continued
C-10
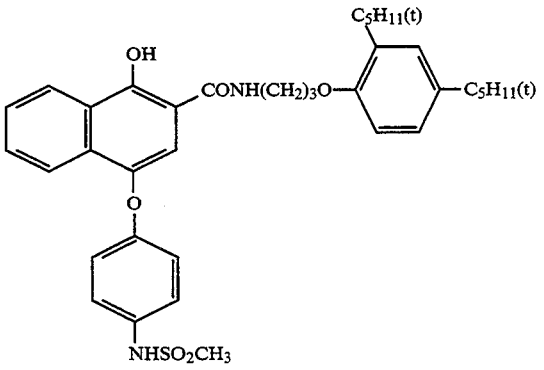
C-11
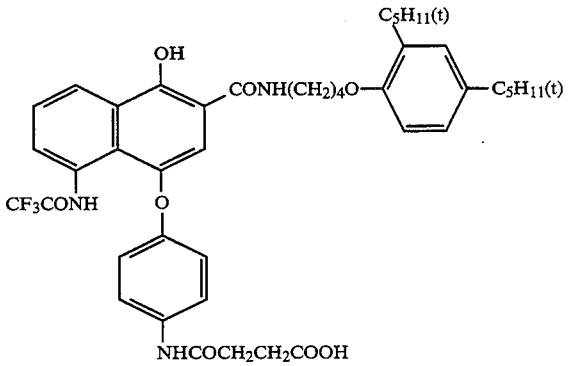
C-12
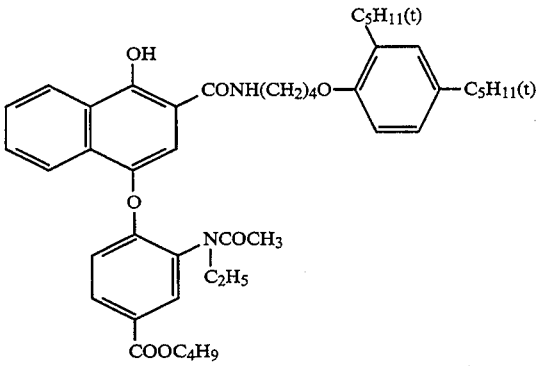
C-13
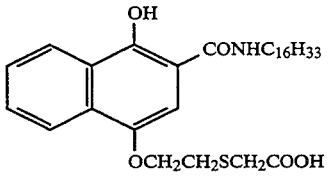
C-14
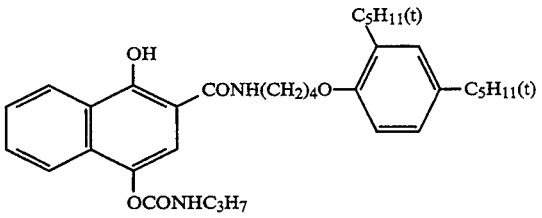

-continued
C-15
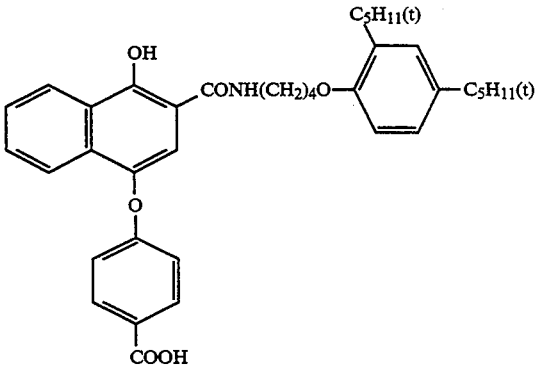
C-16
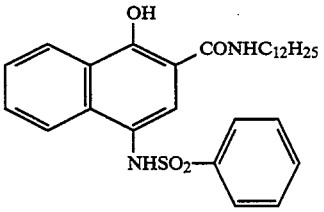
C-17
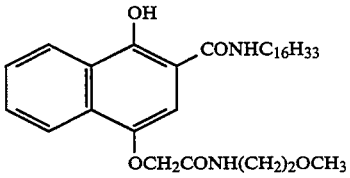
C-18
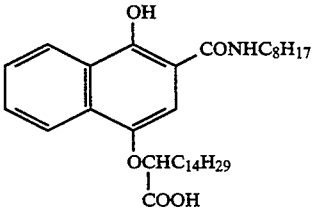
C-19
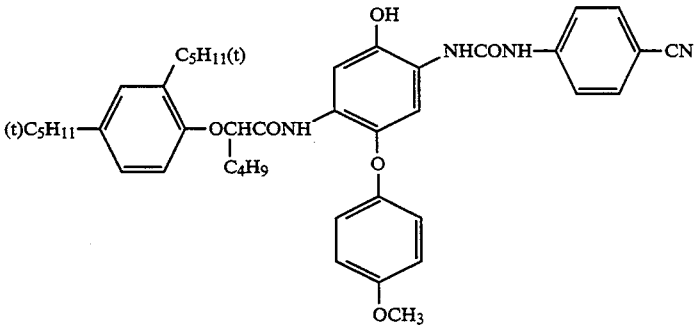
C-20
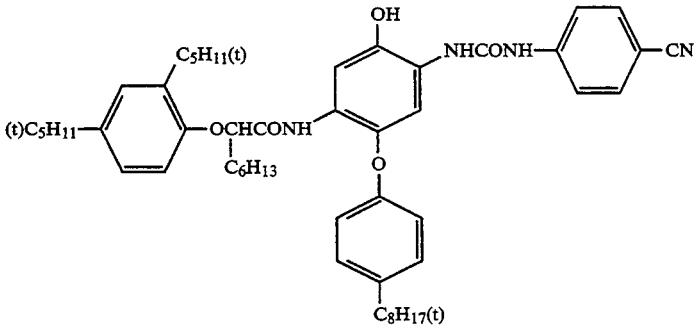

-continued
C-21
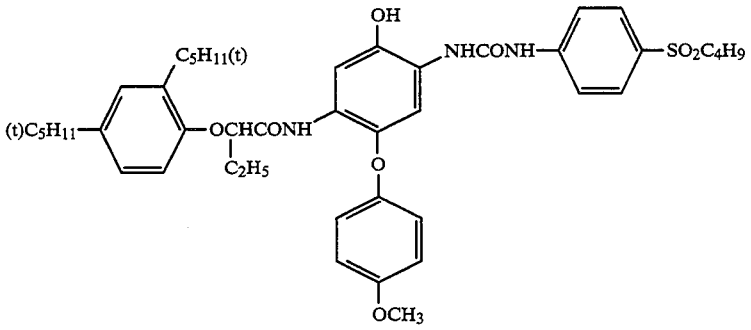
C-22
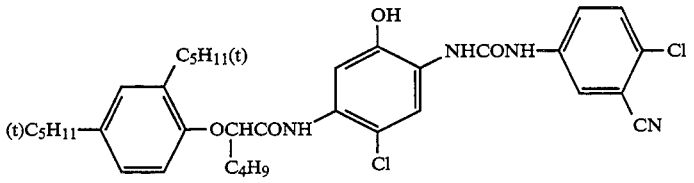
C-23
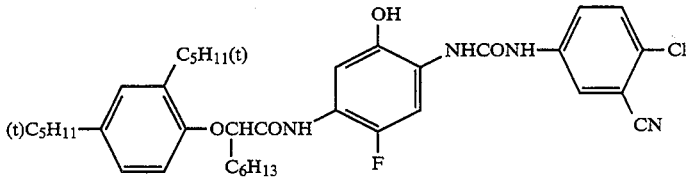
C-24
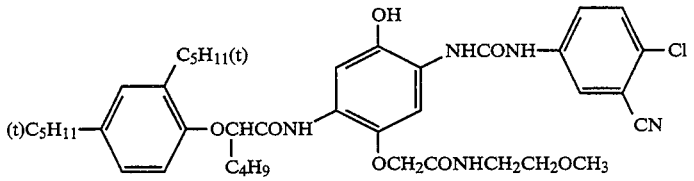
C-25
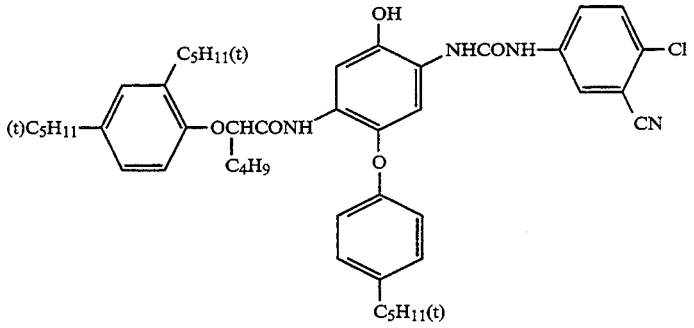
C-26
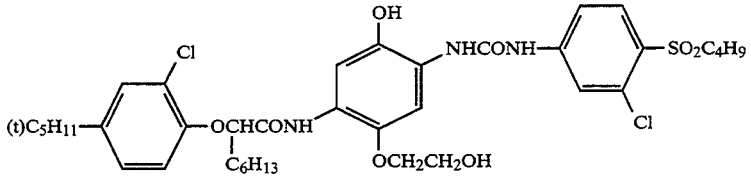

-continued
C-27
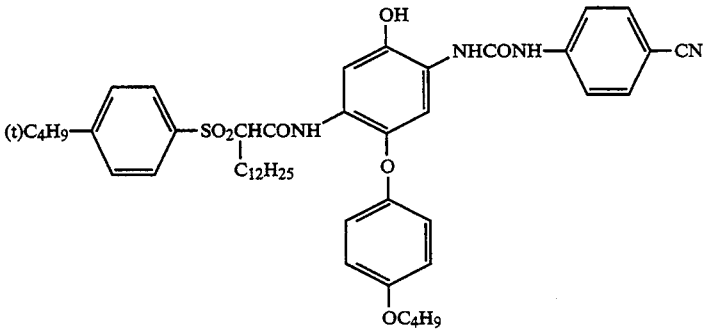
C-28
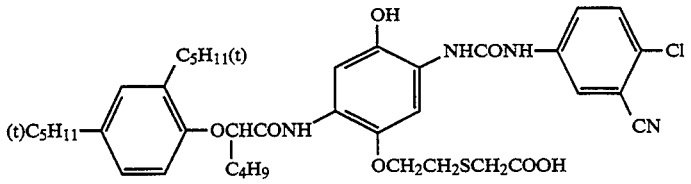
C-29
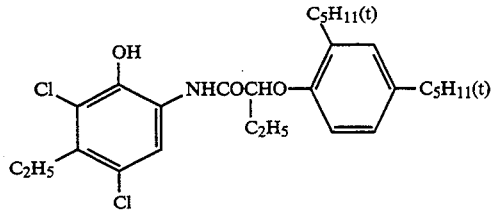
C-30
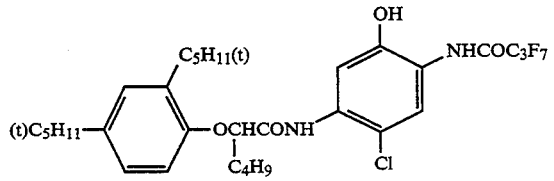
C-31
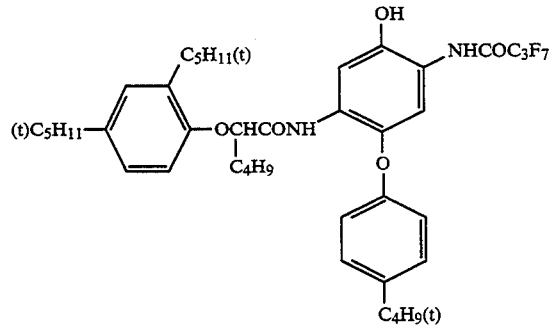
C-32
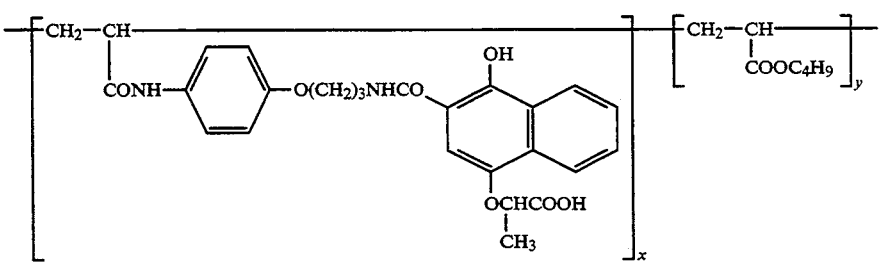
x:y = 40:60

-continued
C-33
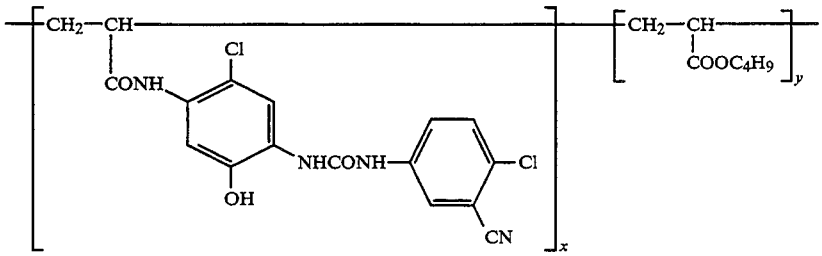
x:y = 50:40
The examples of tetra equivalent couplers are given below.
Tetra equivalent yellow couplers
Y4-1
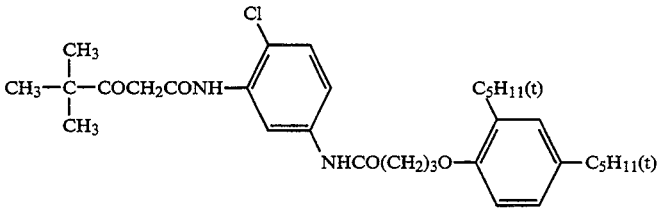
Y4-2
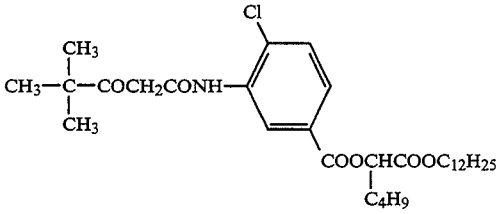
Y4-3
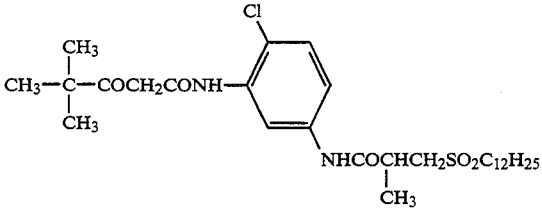
Y4-4
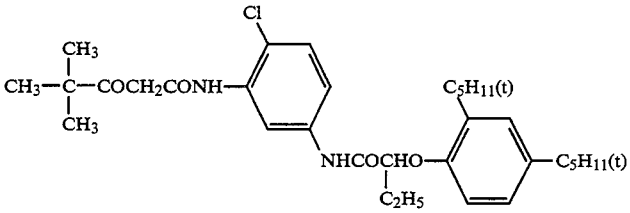
Y4-5
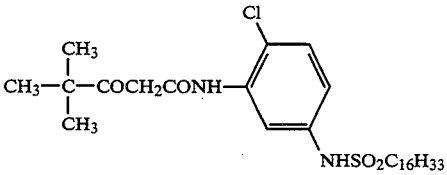
Y4-6
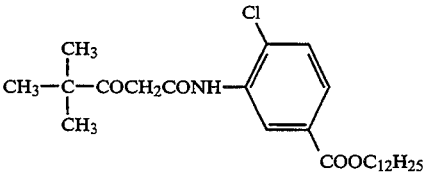

-continued
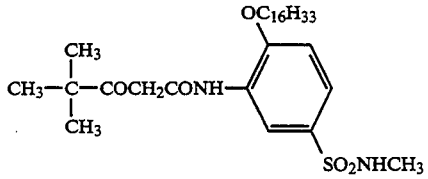
Y4-7
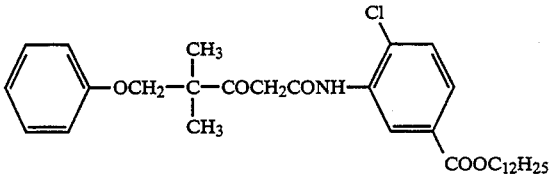
Y4-8
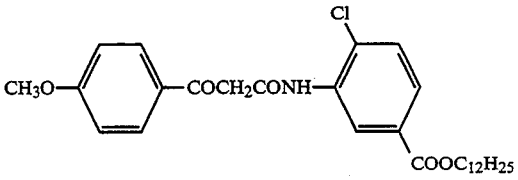
Y4-9
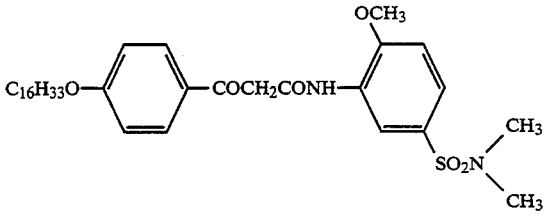
Y4-10
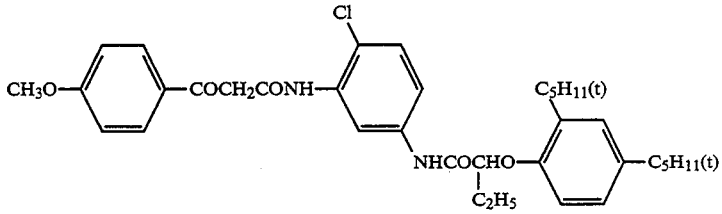
Y4-11
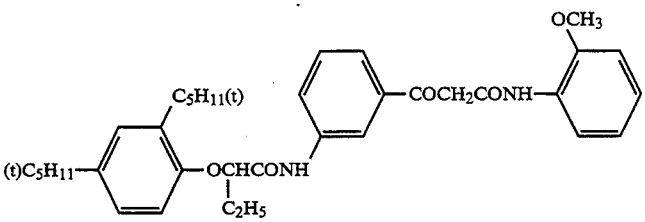
Y4-12
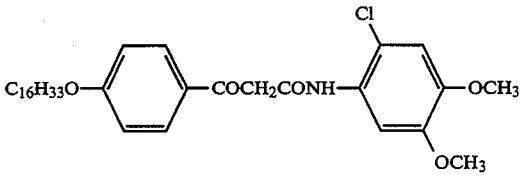
Y4-13
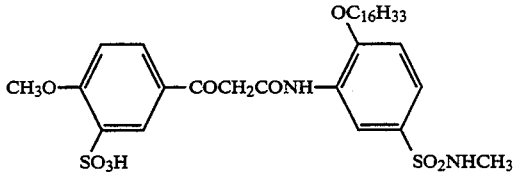
Y4-14

-continued
Y4-15
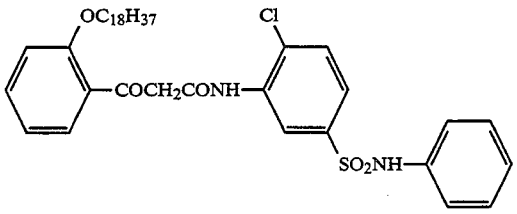
Y4-16
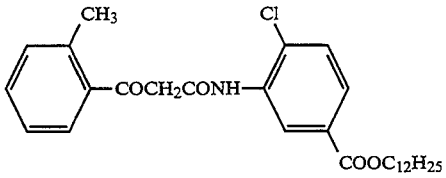
Y4-17
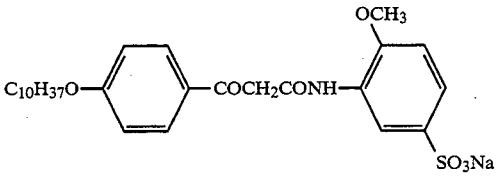
Y4-18
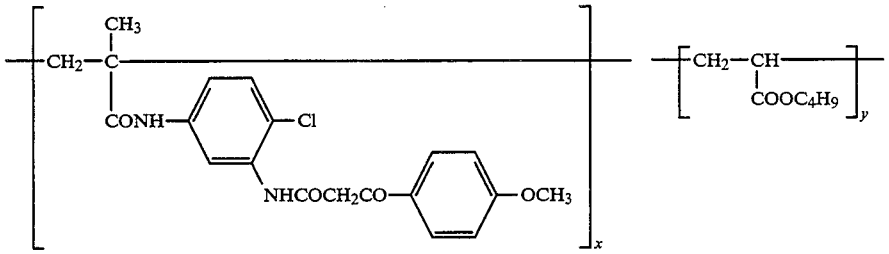
x:y = 50:50 (ratio by weight)
Tetra equivalent magenta couplers
M4-1
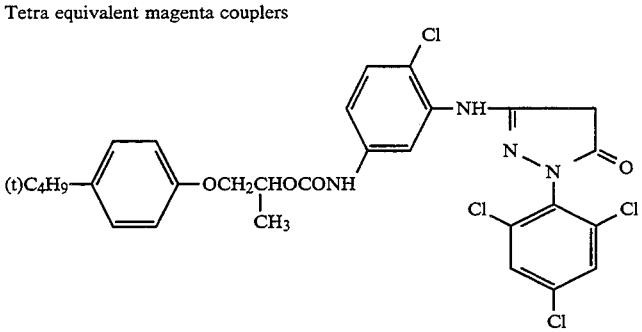
M4-2
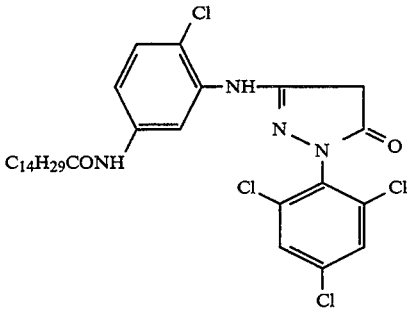

-continued
M4-3
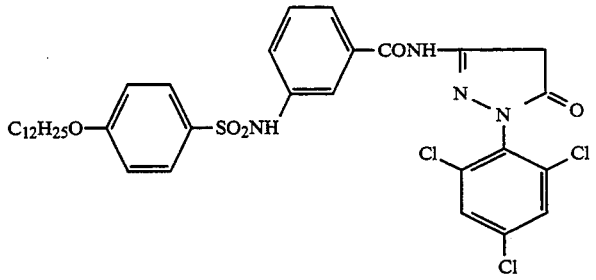
M4-4
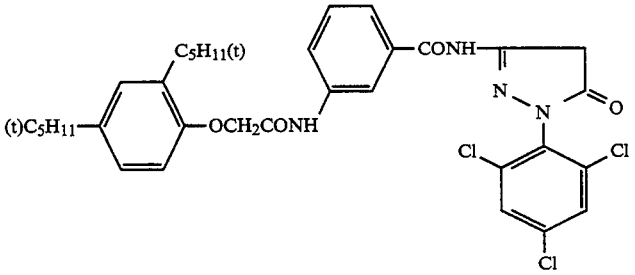
M4-5
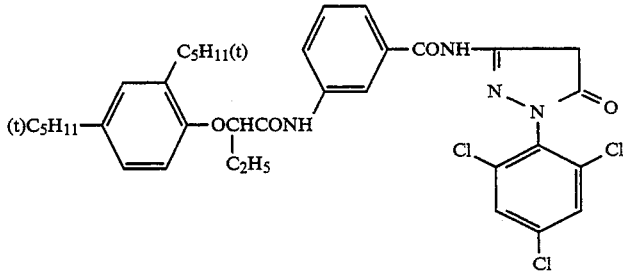
M4-6
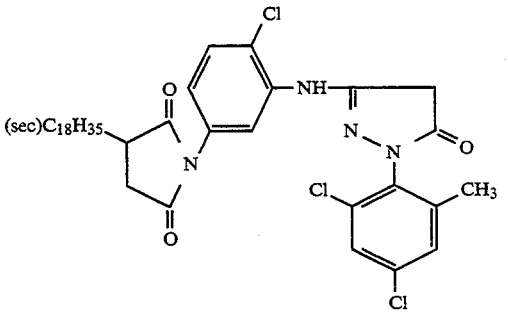
M4-7
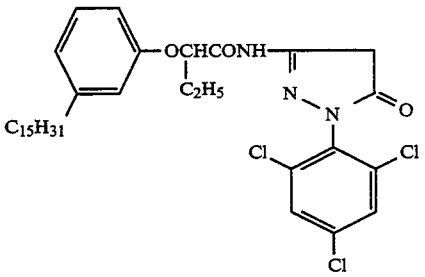

-continued
M4-8
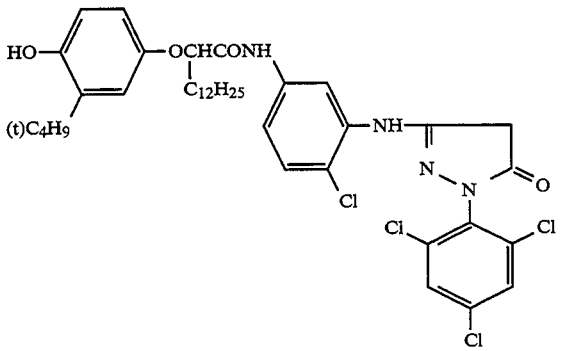
M4-9
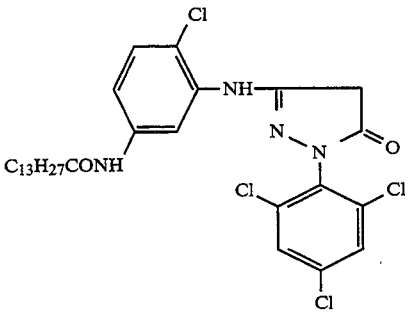
M4-10
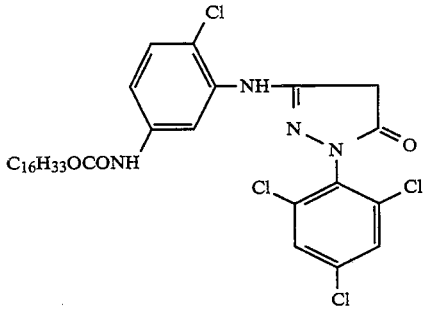
M4-11
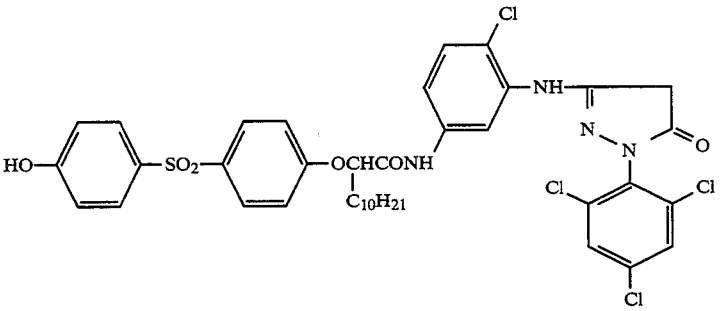
M4-12
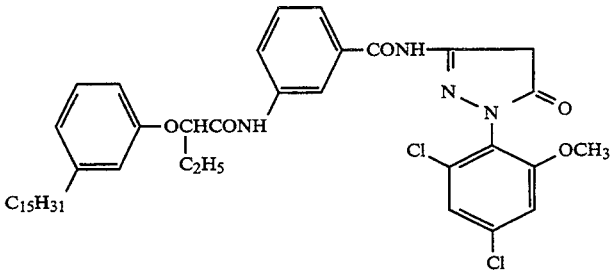

-continued
M4-13
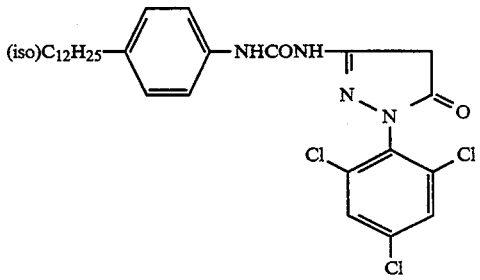
M4-14
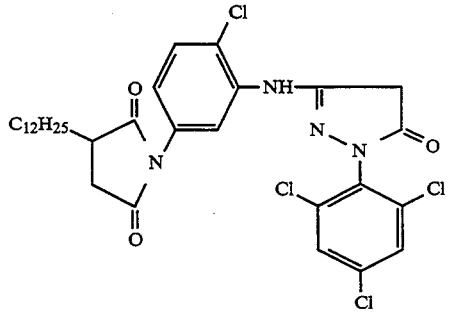
M4-15
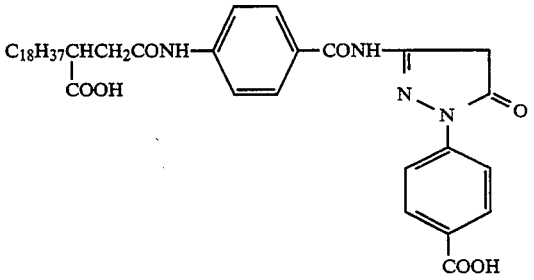
M4-16
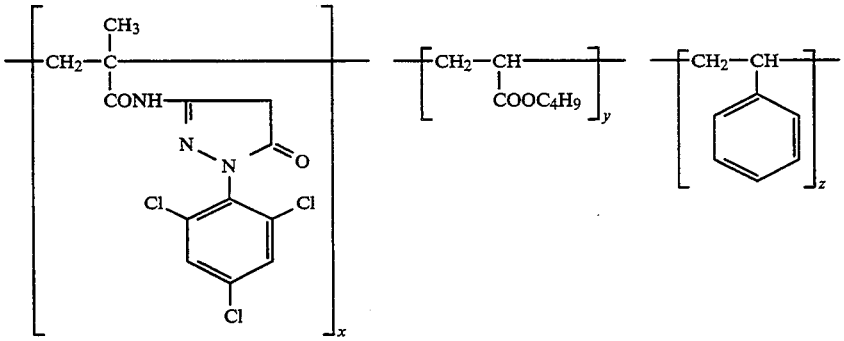
x:y:z = 50:25:25
(ratio by weight)
M4-17
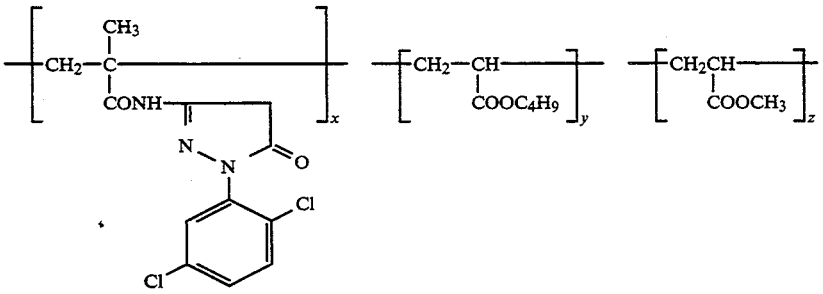
x:y:z = 50:25:25
(ratio by weight)

-continued
M4-18
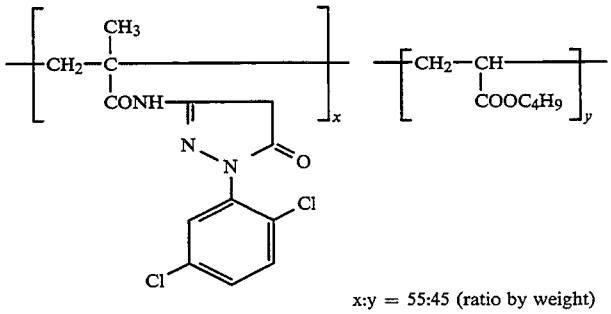
x:y = 55:45 (ratio by weight)
M4-19
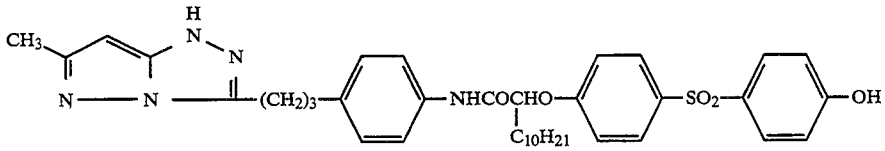
M4-20
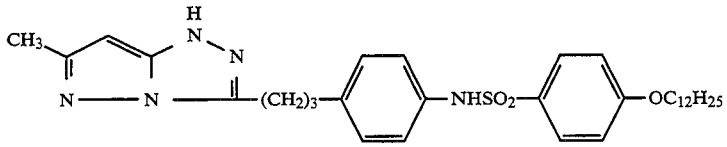
M4-21
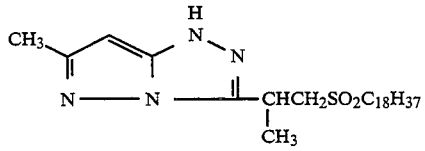
M4-22
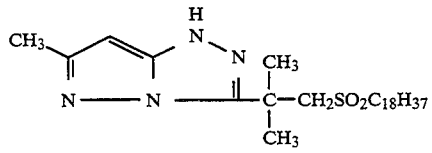
M4-23
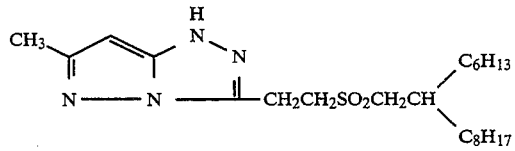
M4-24
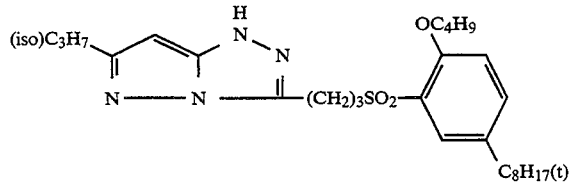
M4-25
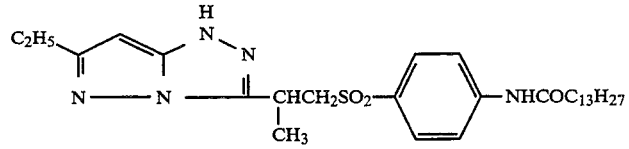
M4-26
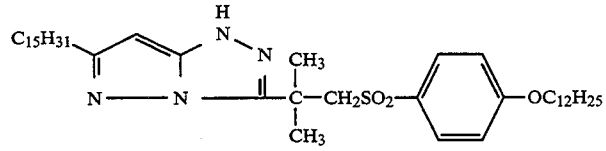

-continued
M4-27
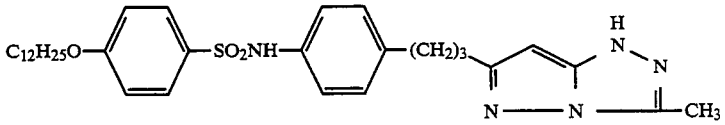
M4-28
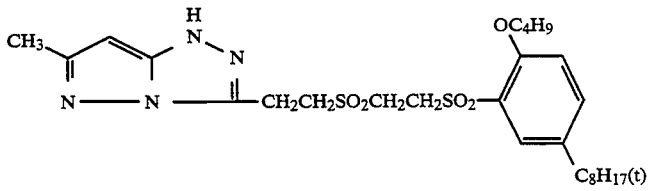
M4-29
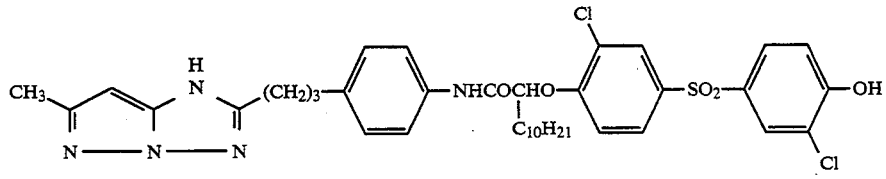
M4-30
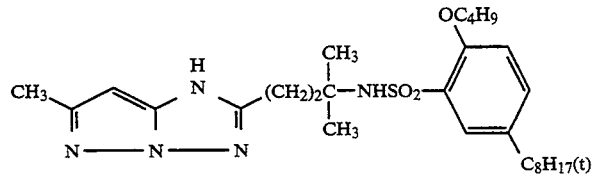
M4-31
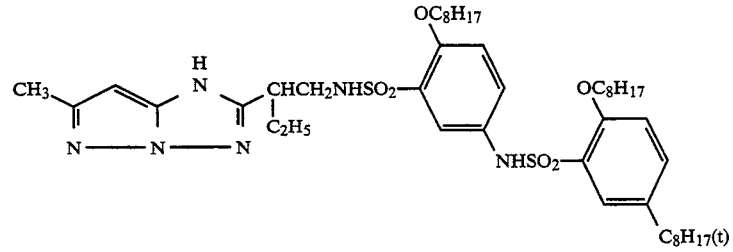
M4-32
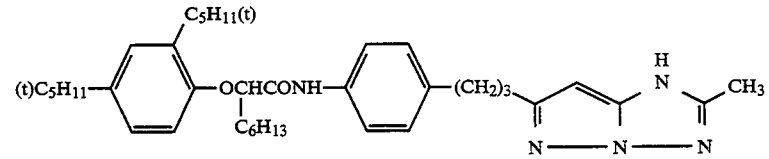
M4-33
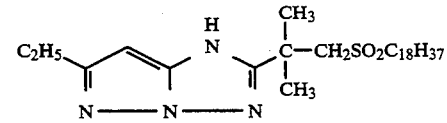
M4-34
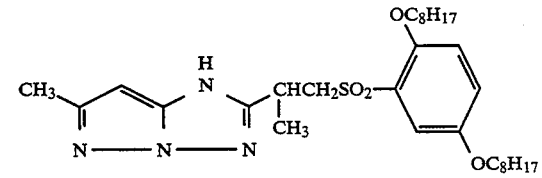

-continued
M4-35
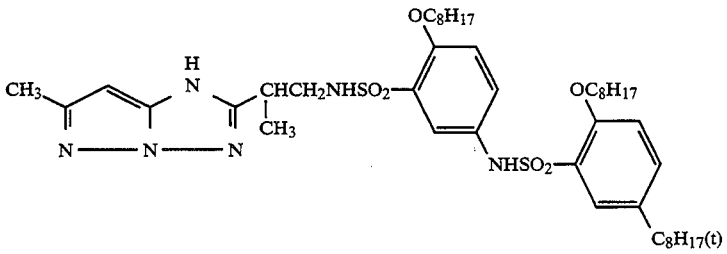
M4-36
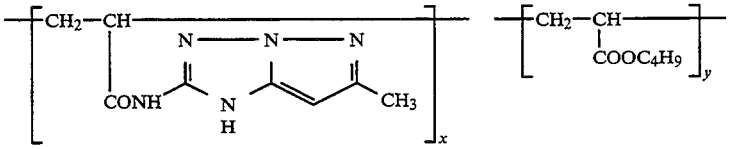
x:y = 50:50 (ratio by weight)
M4-37
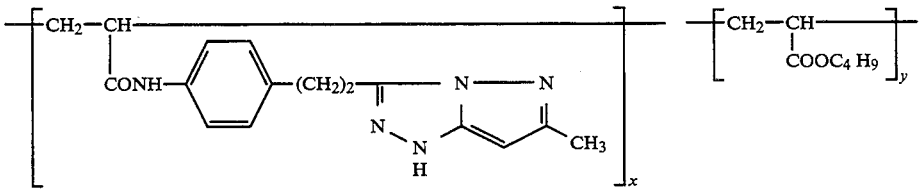
x:y = 50:50
(ratio by weight)
Tetra equivalent cyan couplers
C4-1
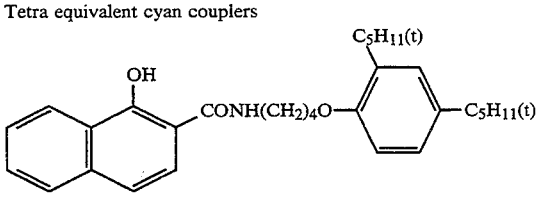
C4-2
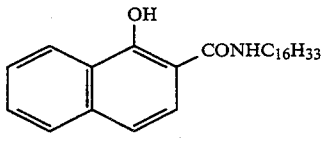
C4-3
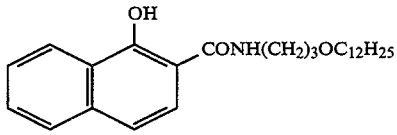
C4-4
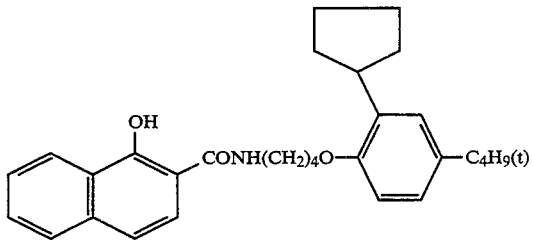
C4-5
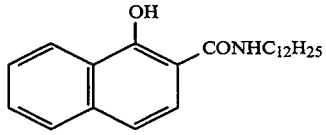

-continued
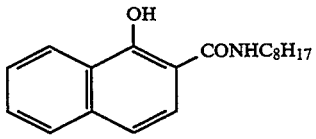
C4-6
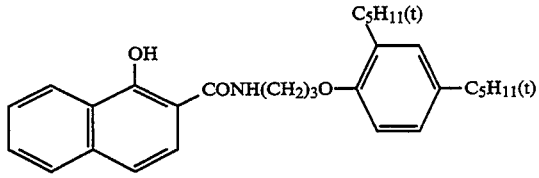
C4-7
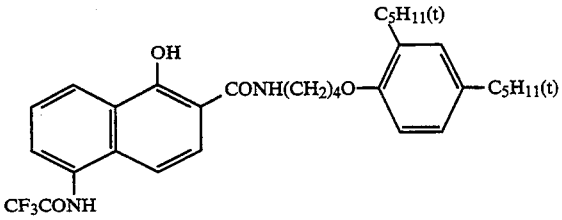
C4-8
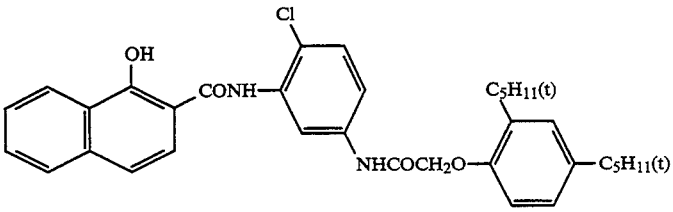
C4-9
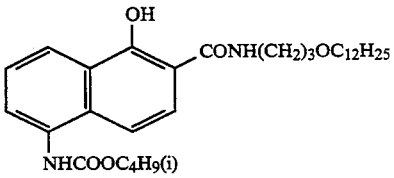
C4-10
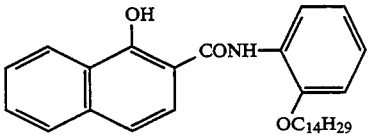
C4-11
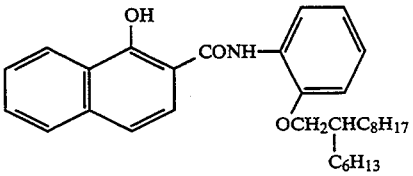
C4-12
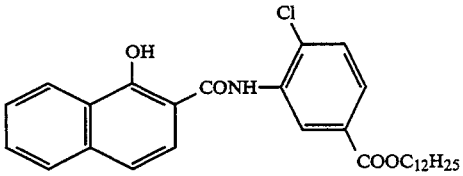
C4-13

-continued
C4-14
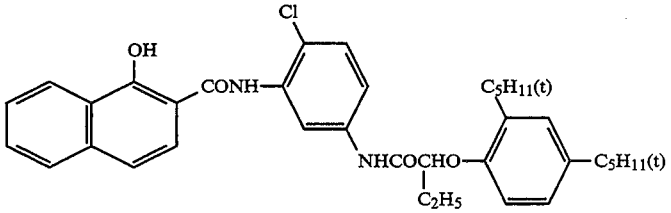
C4-15
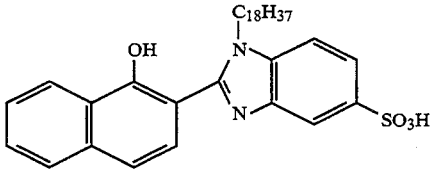
C4-16
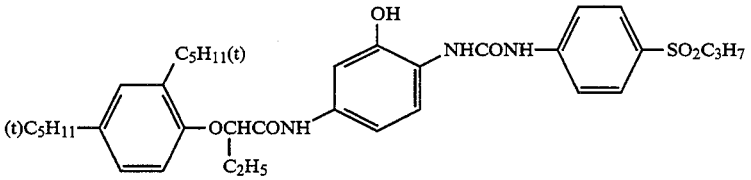
C4-17
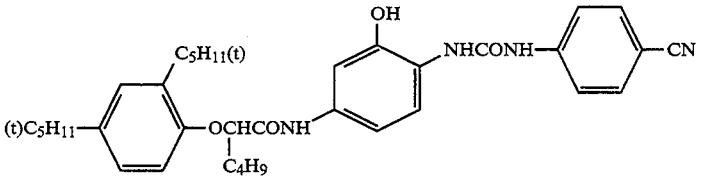
C4-18
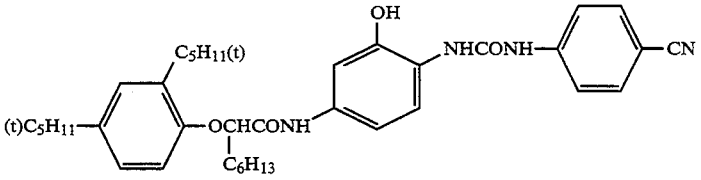
C14-19
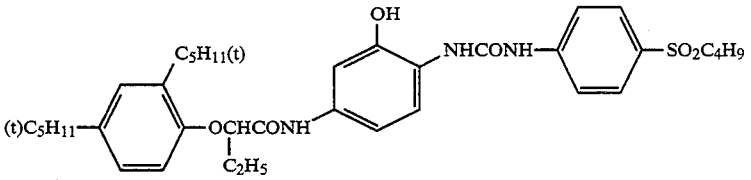
C4-20
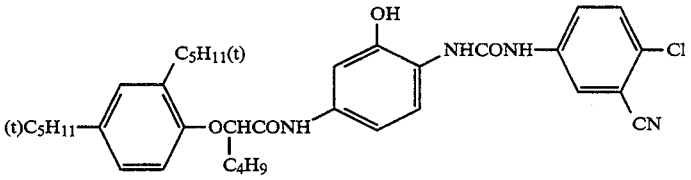
C4-21
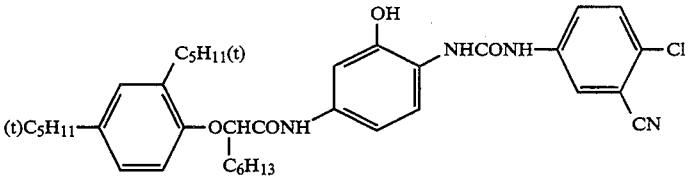

-continued
C4-22
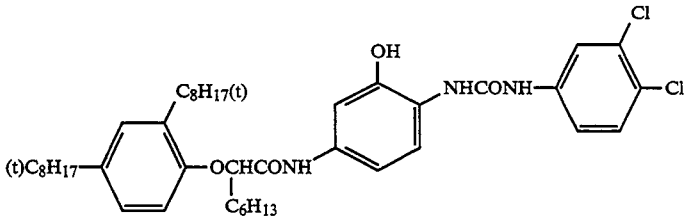
C4-23
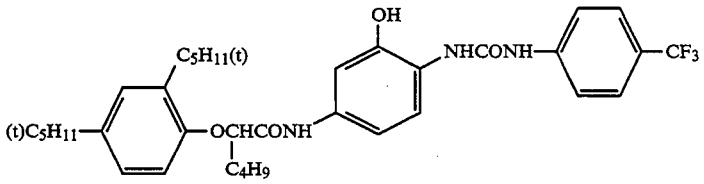
C4-24
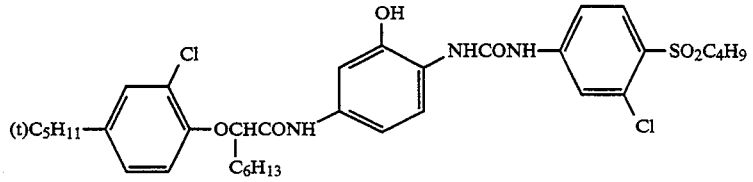
C4-25
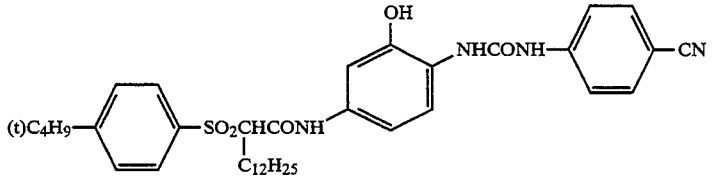
C4-26
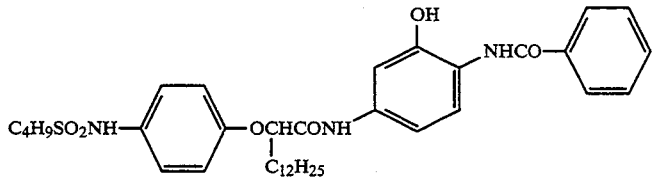
C4-27
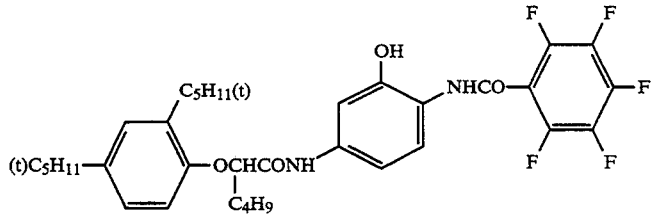
C4-28
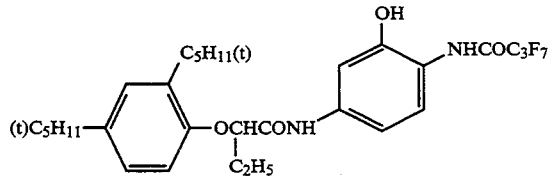
C4-29
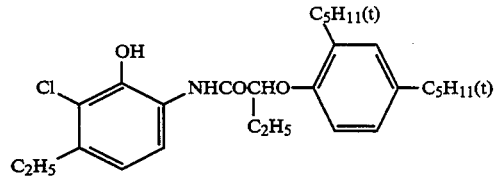

-continued

C4-30

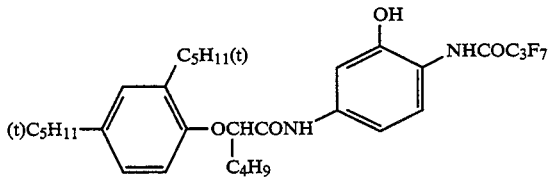

C4-31

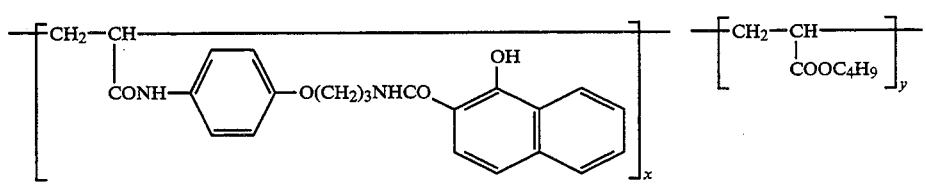

x:y = 40:60 (ratio by weight)

C4-32

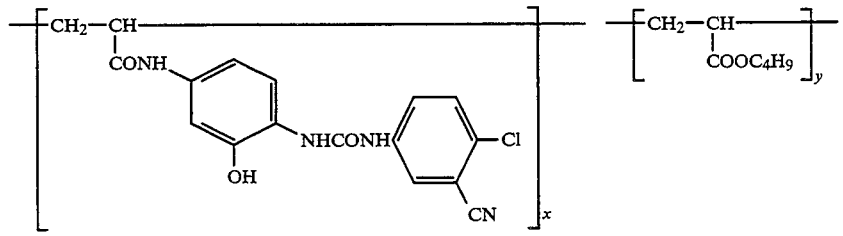

x:y = 50:50
(ratio by weight)

The preceding yellow, magenta, and cyan couplers are normally used in an amount of $1\times10^{-4}$ to 10 moles per mole of silver halide.

In addition to the preceding couplers which are used mainly for image forming, it is preferable to use coupler which releases a development inhibitor (e.g. DIR coupler), or a compound capable of scavenging an oxidized product of a color developer (e.g. DSR coupler ) or masking coupler capable of correcting color (e.g. colored couplers). The preferred development inhibitor-releasing couplers (DIR couplers) are diffusible DIR couplers.

The diffusible DIR couplers should meet the requirement that a development inhibitor or a compound capable of releasing a development inhibitor, which splits off by reaction with an oxidized product of a color developer has a diffusibility of not less than 0.34, as determined by the evaluation method described below, preferably not less than 0.40.

Diffusibility is evaluated as follows:

Photosensitive material samples (I) and (II) each having a layer of the following composition is prepared on a transparent support.

Sample (I): Sample having a green-sensitive silver halide emulsion layer.

A gelatin coating solution containing silver bromoiodide (iodide 6 mol %, average grain size 0.48 m) spectrally sensitized for green-sensitivity and the following coupler in an amount of 0.07 mole per mole of silver, is coated so that the amounts of coated silver and gelatin are 1.1 g/m$^2$ and 3.0 g/m$^2$, respectively. Another gelatin coating solution containing silver bromoiodide (iodide 2 mol %, average grain size 0.08 $\mu$m) neither chemically nor spectrally sensitized, is coated there on as a protective layer so that the amounts of coated silver and gelatin are 0.1 g/m$^2$ and 0.8 g/m$^2$ respectively.

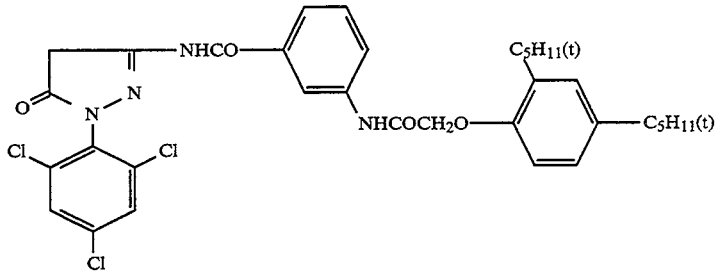

Sample (II): the same sample as sample (I), besides that silver bromoiodide is removed from a protective layer.

Each layer contains a gelatin hardener and surfactant.

Samples (I) and (II) are subjected to white light wedge exposure, and are processed by the following procedure, using developers containing or not containing various development inhibitors in such amounts that the sensitivity of sample (II) is reduced to 60% (in logarithmic indication, $-\Delta\log E=0.22$).

| Processing (38° C.) | |
|---|---|
| Color development | 2 min. 40 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in respective processes are as follows:

| [Color developer] | |
|---|---|
| 4-Amino-3-methyl-N-ethyl-N-(β-hydroxyethyl)-aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |
| Water is added to make total quantity 1 lit. | |
| [Bleaching solution] | |
| Ferric ammonium ethylenediaminetetracetate | 100.0 g |
| Diammonium ethylenediaminetetracetate | 10.0 g |
| Ammonium bromide | 150.0 g |
| Glacial acetic acid | 10.0 ml |

Water is added to make total quantity lit., and pH is adjusted to 6.0 with aqueous ammonia.

| [Fixing solution] | |
|---|---|
| Ammonium thiosulfate | 175.0 g |
| Anhydrous sodium sulfite | 8.5 g |
| Sodium metasulfite | 2.3 g |

Water is added to make total quantity 1 lit., and pH is adjusted to 6.0 with acetic acid.

| [Stabilizing solution] | |
|---|---|
| Formalin (37% aqueous solution) | 1.5 m |
| Konidax (moduced by Konica Corporation) | 7.5 ml |
| Water is added to make total quantity 1 lit. | |

The sensitivities of sample (I) and sample (II), in the absence of development inhibitors, are indicated by $S_0$ and $S_0$, respectively and also the sensitivities of sample (I) and sample (II) in the presence of development inhibitors are indicated by $S_I$ and $S_{II}$, respectively; then, the degree of desensitization of sample (I) $\Delta S = S_0 - S_I$ the degree of desensitization of sample (II) $\Delta S_0 = S_0' - S_{II}$ diffusibility $= \Delta S / \Delta S_0$; wherein all sensitivities are indicated by the logarithm (−logE) of the reciprocal of exposure at a fog density of +0.3.

Any diffusible DIR coupler can be used irrespective of its chemical structure, as long as a diffusibility of groups released therefrom is at the preceding range.

A representative structural formula is as follows:

Formula (D -1)

$$A-(Y)_m$$

wherein A represents a coupler residue; m represents the integer of 1 or 2; Y represents a group a combining a coupling site of the coupler residue A, which splits off by reaction with an oxidized product of a color developer and is capable of releasing a development inhibitor or a development-inhibiting group having diffusibility not less than 0.34.

In Formula (D-1), Y is represented by Formulae (D-1) through (D-19).

Formula (D-2)

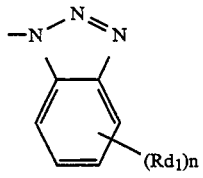

Formula (D-3)

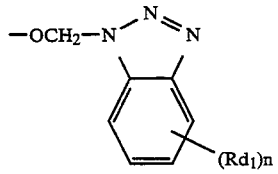

Formula (D-4)

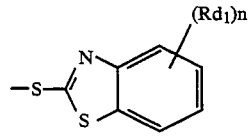

Formula (D-5)

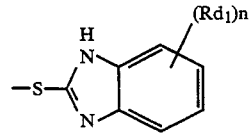

Formula (D-6)

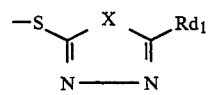

Formula (D-7)

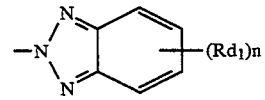

Formula (D-8)

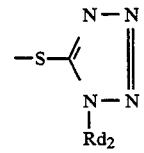

Formula (D-9)

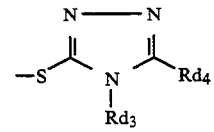

In Formulae (D-2) through (D-7), $Rd_1$ represents a hydrogen atom, a halogen atom, alkyl, alkoxy, acylamino, alkoxycarbonyl, thiazolidinilideneamino, aryloxycarbonyl, acyloxy, carbamoyl, N-alkylcarbamoyl, N,N-dialkylcarbamoyl, nitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl or aryloxycarbonylamino group; n represents the integer of 0, 1, or 2; $Rd_1$ may be identical or not when n is 2. The total number of carbon atoms contained in n $Rd_1$ units is 0 to 10. The number of carbon atoms contained in $Rd_1$ is 0 to 15; X represents an oxygen atom or a sulfur atom in Formula (D-6).

In Formula (D-8), $Rd_2$ represents an alkyl group, an aryl group, or a heterocyclic group.

In Formula (D-9), $Rd_3$ represents a hydrogen atom, alkyl, cycloalkyl, aryl, or heterocyclic group; $Rd_4$ represents a hydrogen atom, halogen atom, alkyl, cycloalkyl, aryl, acylamino, alkoxycarbonylamino, aryloxycarbonylamino, alkanesulfonamide, cyano, heterocyclic, alkylthio, or amino group.

Provided that $Rd_1$, $Rd_2$, $Rd_3$, or $Rd_4$ represents an alkyl group, the alkyl group includes a substituted alkyl, a linear alkyl and a branched alkeyl.

Provided that $Rd_1$, $Rd_2$, $Rd_3$, or $Rd_4$ represents a heterocyclic group, the heterocyclic group is preferably a 5- or 6-membered monocyclic ring or a condensed ring containing at least one atom selected from nitrogen, oxygen, and sulfur atoms as a hetero atom; the examples of such heterocyclic rings include groups such as pyridyl, quinolyl, furyl, benzothiazolyl, oxazolyl, imidazolyl, thiazolyl, triazolyl, benzotriazolyl, imide, and oxazine.

The preceding group represented by $Rd_1 \sim Rd_4$ includes substituted one. The preferred substituents include a halogen atom, a nitro group, a cyano group, a sulfonamide group, a hydroxyl group, a carboxyl group, an alkyl group, an alkoxy group, a carbonyloxy group, an acylamino group, and an aryl group.

In Formulae (D-8), $Rd_2$ contains 0 to 15 carbon atoms.

In Formula (D-9), the total number of carbon atoms contained in $Rd_3$ and $Rd_4$ is 0 to 15.

Formula (D-10)

—TIME—INHIBIT

In this formula, the TIME group is a group combining a coupling site of A in Formula (D-1), which can split off by reaction with an oxidized product of a color developer and control the INHIBIT group for releasing after separating from the coupler. The INHIBIT group is a group which becomes a development inhibitor [e.g. groups represented by Formulae (D-2) through (D-9)] after releasing.

In Formula (D-10), the —TIME—INHIBIT group is preferably represented by Formulae (D-11) through (D-19) shown below.

Formula (D-11)

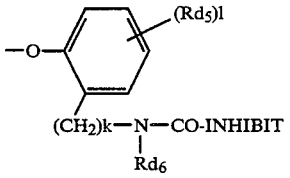

Formula (D-12)

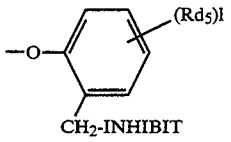

Formula (D-13)

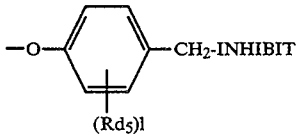

-continued

Formula (D-14)

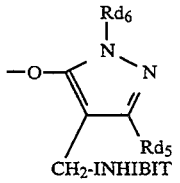

Formula (D-15)

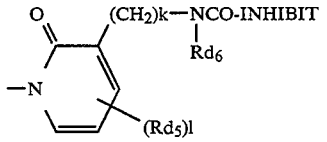

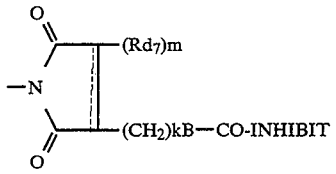

Formula (D-17)

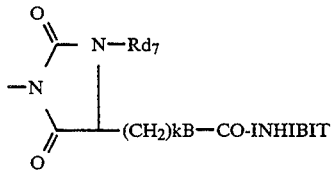

Formula (D-18)

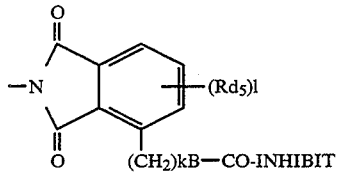

Formula (D-19)

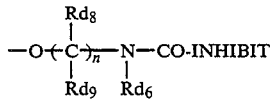

In Formulae (D-11) through (D-15) and (D-18), $Rd_5$ represents a hydrogen atom, a halogen atom, alkyl, cycloalkyl, alkenyl, alkoxy, alkoxycarbonyl, anilino, acylamino, ureido, cyano, nitro, sulfonamide, sulfamoyl, carbamoyl, aryl, carboxy, sulfo, hydroxy, alkanesulfonyl group. In Formulae (D-11) through (D-13), (D-15) and (D-18), $Rd_5$ may be combined each other to form a condensed ring. In Formulae (D-11), (D-14), (D-15) and (D-19), $Rd_6$ represents alkyl, alkenyl, cycloalkyl, heterocyclic, or aryl group. In Formulae (D-16) and (D-17), $Rd_7$ represents a hydrogen atom, alkyl, alkenyl, cycloalkyl, heterocyclic, or aryl group. $Rd_8$ and $Rd_9$ in Formula (D-19) independently represent a hydrogen atom or an alkyl group (preferably an alkyl group with a carbon number of 1 to 4). k in Formulae (D-11) and (D-15) through (D-18) represents the integer of 0, 1 or 2; in Formulae (D-11) through (D-13), (D-15), and (D-18) represents the integer of 1 through 4; m in Formula (D-16) represents the integer of 1 or 2; $Rd_7$ may be identical or not, when m is 2; n in Formula (D-19) represents the integer of 2, 3 or 4; n groups of $Rd_8$ and Rd9 may be identical or not; B in Formulae (D-16) through (D-18) represents an oxygen atom or

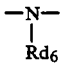

($Rd_6$ represents the same group as defined above); ═ in General (D-16) represents a single bond or a double bond; in a single bond, m is 2, and in a double bond, m is and the INHIBIT group represents the same groups as those defined in Formulae (D-2) through (D-9) except the number of carbon atoms.

With respect to the INHIBIT group, the number of carbon atoms contained in $Rd_1$ per molecule of Formulae (D-2) through (D-7) is 0 to 32; $R_{d2}$ in Formula (D-8) contains 1 to 32 carbon atoms; $Rd_3$ and $Rd_4$ in Formula (D-9) contain 0 to 32 carbon atoms in total.

The preceding groups represented by $Rd_5$ to $Rd_7$ includes a substituted one.

Of the diffusible DIR compounds, those represented by Formula (D-2), (D-3) or (D-10) are preferred. Of the compounds represented by Formula (D-10), are preferred those having an INHIBIT group represented by Formula (D-2), (D-6) [particularly when X in Formula (D-6) is an oxygen atom], or (D-8) [particularly when $Rd_2$ in Formula (D-8) is a hydroxyaryl group or an alkyl group with a carbon number of 1 through 3].

The coupler components represented by A in Formula (D-1) are yellow, magenta and cyan color image forming coupler residues, and non-color-forming coupler residue.

The preferred diffusible DIR couplers are shown below, but these are not to be construed as limitations in the present invention.

| Example Compounds No. | $R_1$ | $R_2$ | Y |
|---|---|---|---|
| D-1 | | | |

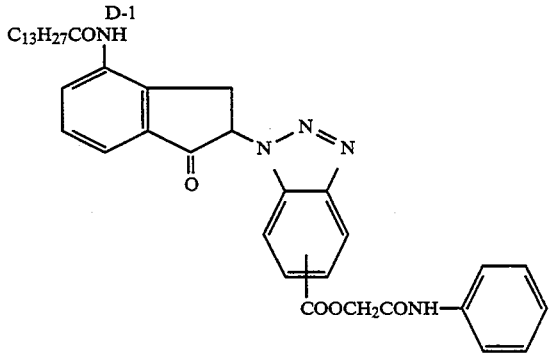

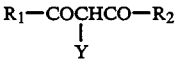

| | | | |
|---|---|---|---|
| D-2 | (1) | (1) | (30) |
| D-3 | (2) | (3) | (30) |
| D-4 | (2) | (4) | (30) |
| D-5 | (5) | (6) | (31) |
| D-6 | (2) | (4) | (32) |
| D-7 | (2) | (3) | (32) |
| D-8 | (7) | (8) | (33) |
| D-33 | (2) | (4) | (55) |

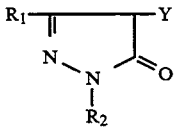

| | | | |
|---|---|---|---|
| D-9 | (9) | (10) | (30) |

-continued

| Example Compounds No. | $R_1$ | $R_2$ | Y |
|---|---|---|---|
| D-10 | (11) | (10) | (30) |
| D-11 | (12) | (7) | (34) |
| D-12 | (12) | (13) | (35) |
| D-13 | (9) | (14) | (36) |
| D-14 | (15) | (16) | (37) |

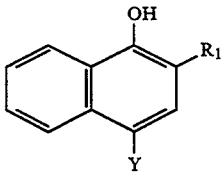

| | | | |
|---|---|---|---|
| D-15 | (17) | | (38) |
| D-16 | (17) | | (39) |
| D-17 | (18) | | (40) |
| D-18 | (19) | | (41) |
| D-19 | (18) | | (42) |
| D-20 | (18) | | (43) |
| D-21 | (18) | | (44) |
| D-22 | (18) | | (45) |
| D-23 | (18) | | (46) |
| D-24 | (20) | | (47) |
| D-25 | (20) | | (48) |
| D-26 | (21) | | (49) |
| D-27 | (21) | | (50) |
| D-28 | (21) | | (51) |
| D-29 | (22) | | (52) |
| D-30 | (18) | | (53) |
| D-31 | (18) | | (54) |
| D-32 | (22) | | (49) |

1

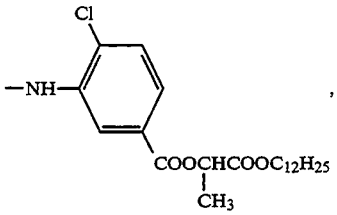

2

$-C(CH_3)_3$,

3

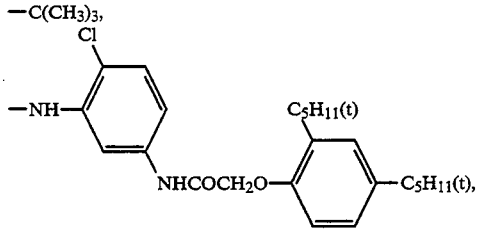

4

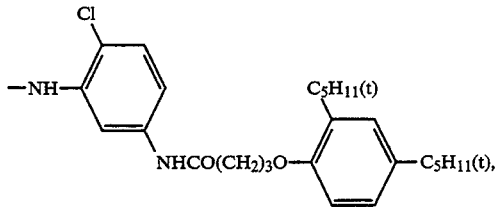

5

$-OCH_3$,

6

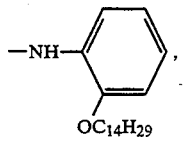

-continued
7
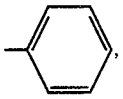
8
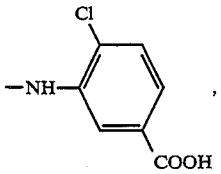
9
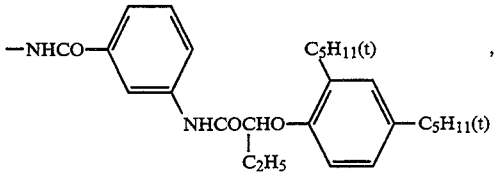
10
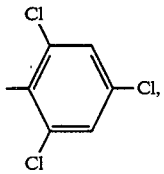
11
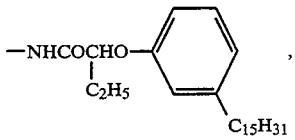
12 $-C_{17}H_{35}$,
13
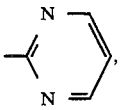
14
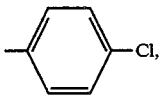
15 $-CH_3$,
16
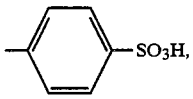
17 $-CONHC_{18}H_{37}$,
18
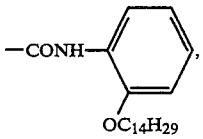
19
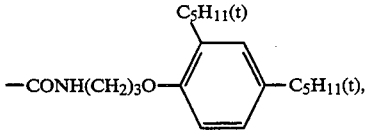
20
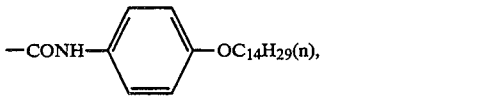
-continued
21 $-CONHCH_2CH_2COOH$
22 $-CONHCH_2CH_2COOCH_3$
30
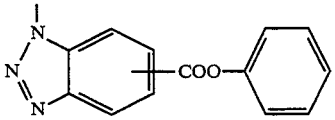
31
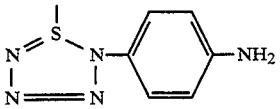
32
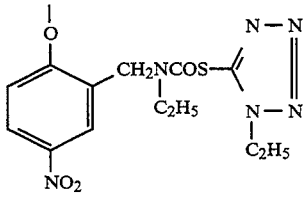
33
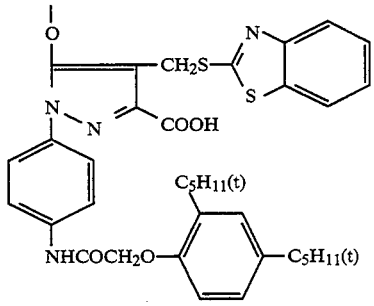
34
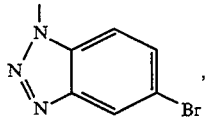
35
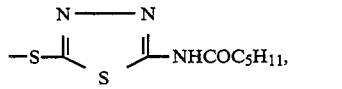
36
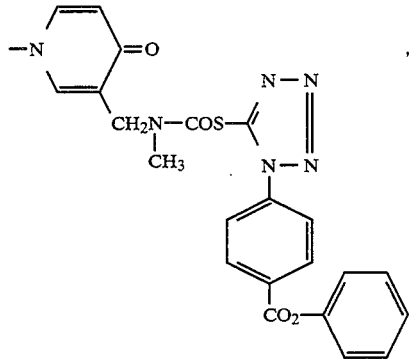
37
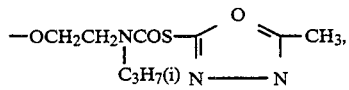

-continued
38
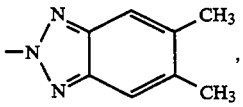
39
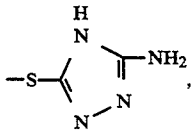
40
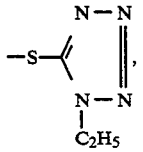
41
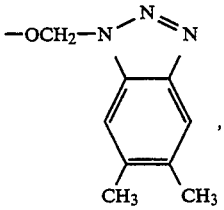
42
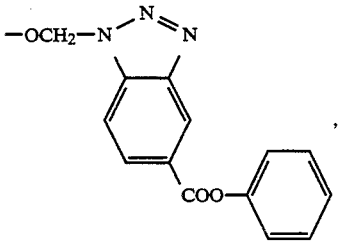
43
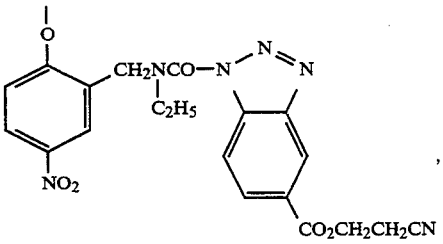
44
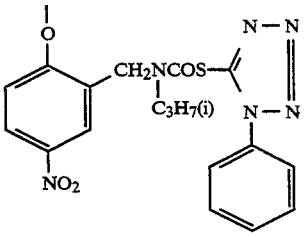
45
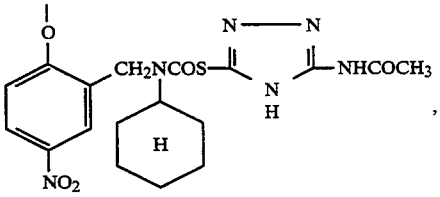
-continued
46
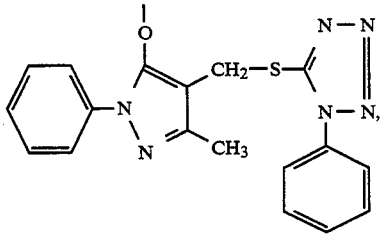
47
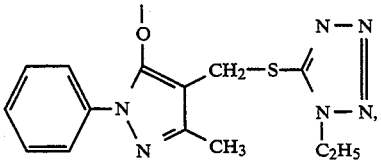
48
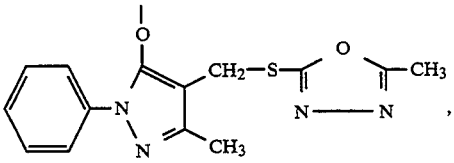
49
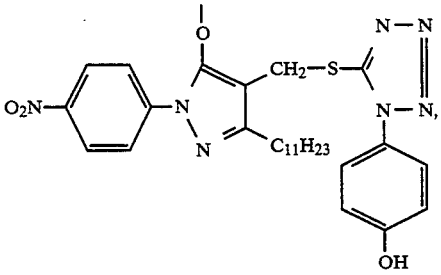
50
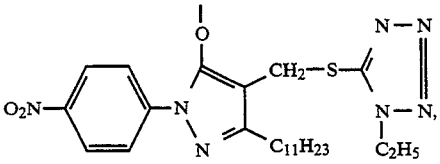
51
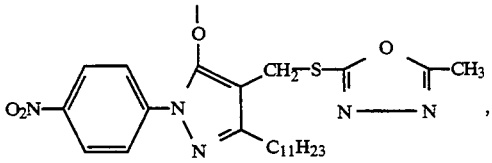
52
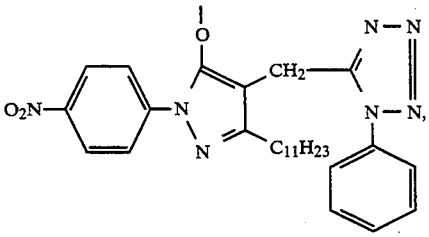

-continued

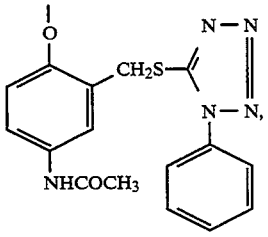

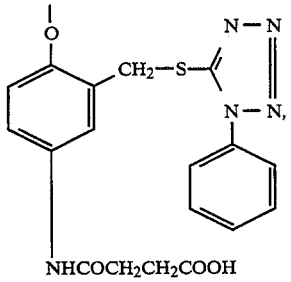

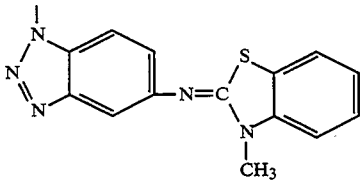

The examples of diffusible DIR couplers including these couplers, which can be used for the present invention, are described in U.S. Pat. Nos 4,234,678, 3,227,554, 3,617,291, 3,958,993, 4,149,886, and 3,933,500, Japanese Patent Publication Open to Public Inspection Nos. 56837/1982 and 13239/1976, U.S. Pat. Nos. 2,072,363 and 2,070,266 and Research Disclosure No. 21228/December, 1981, for instance.

The diffusible DIR compounds are used preferably in amounts of 0.0001 to 0.1 mole, more preferably 0.001 to 0.05 mole per mole of silver halide.

A DSR coupler is defined as a coupler capable of releasing a compound capable of scavenging an oxidized product of a color developer, or its precursor by reaction with an oxidized product of a color developer, and preferably is represented by Formula [S];

General Formula [S]

Coup(Time)l—Sc wherein Coup represents a coupler residue capable of releasing (Time l--Sc by reaction with an oxidized product of a color developer; Time represents a timing group capable of releasing Sc after release of Time-Sc from Coup; Sc represents a scavenger capable of scavenging an oxidized product of a color developer by oxidation-reduction reaction or coupling reaction; 1 represents the integer of 0 or 1.

For more details of the compound represented by Formula [S], the coupler residue represented by Coup is generally a yellow coupler residue, magenta coupler residue, cyan coupler residue, or a coupler residue which forms substantially no image forming coupling dye, or preferably a coupler residue represented by Formulae [Sa] through [Sh].

Formula[Sa]

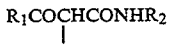

Formula[Sb]

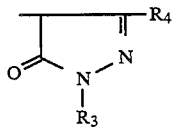

Formula[Sc]

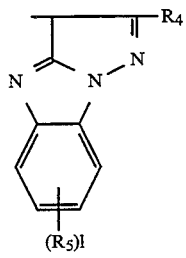

Formula[Sd]

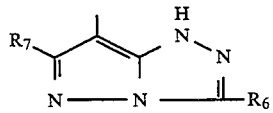

Formula[Se]

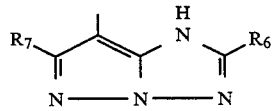

Formula[Sf]

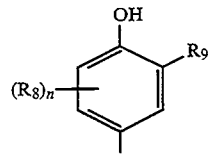

Formula[Sg]

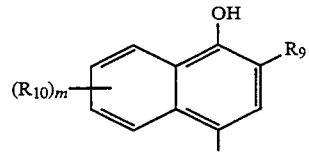

Formula[Sh]

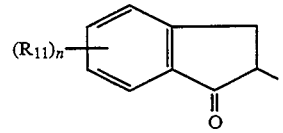

In Formula [Sa], $R_1$ presents an alkyl group, an aryl group, or an arylamino group; $R_2$ represents an aryl group or an alkyl group.

In Formula [Sb], $R_3$ represents an alkyl group or an aryl group; $R_4$ represents an alkyl group, an acylamino group, an arylamino group, an arylureido group, or an alkylureido group.

In Formula [Sc], $R_4$ represents the same groups as those defined in Formula [Sb]; $R_5$ represents an acylamino group, a sulfonamide group, an alkyl group, an alkoxy group, or a halogen atom.

In Formulae [Sd] and [Se], $R_7$ represents an alkyl group, an aryl group, an acylamino group, an arylamino group, an alkoxy group, an arylureido group, or an alkylureido group; $R_6$ represents an alkyl group or an aryl group.

In Formula [Sf], $R_9$ represents an acylamino group, a carbamoyl group, or an arylureido group; $R_8$ represents a halogen atom, an alkyl group, an alkoxy group, an acylamino group, or a sulfonamide group.

In Formula [Sg], $R_9$ represents the same groups as defined in Formula [Sf]; $R_{10}$ represents an amino group, a acylamide group, a sulfonamide group, or a hydroxyl group.

In Formula [Sh], $R_{11}$ represents a nitro group, an acylamino group, a succinimide group, a sulfonamide group, an alkoxy group, an alkyl group, a halogen atom, or a cyano group.

In the above formulae, in [Sc] represents the integers of 0 through 3; n in [Sf] and [Sh] represents the integer of 0, 1, or 2; m in [Sg] represents the integer of 0 or 1; when l and/or n is 2 or more, $R_5$ $R_8$ and $R_{11}$ may independently be identical or not.

The preceding groups may have substituents; the preferred substituents include a halogen atom, a nitro group, a cyano group, a sulfonamide group, a hydroxyl group, a carboxyl group, an alkyl group, an alkoxy group, a carbonyloxy group, an acylamino group, and an aryl group, and also include groups having a coupler moiety which constitutes what is called his type coupler or polymer coupler.

An oleophile exhibited by $R_1$ through $R_{11}$ in the above Formulae can be arbitrarily selected by purpose. In ordinary image forming couplers, the total number of carbon atoms of $R_1$ through $R_{10}$ is preferably 10 to 60, more preferably 15 to 30. Provided that dyes formed by color development processing are provided with a function to shift in a photosensitive material to some extent, the total number of carbon atoms of $R_1$ through $R_{10}$ is preferably not more than 15.

The couplers which virtually do not form dyes for forming an image represent the couplers which leave no color image after development, including couplers which form no colored dye, what is called effluent dye-forming couplers, where colored dyes flow out from a photosensitive material into a processing solution, and what is called bleaching dye-forming couplers, where colored dyes are bleached by reaction with components in a processing solution. In effluent dye-forming couplers, the total number of carbon atoms of $R_1$ through $R_{10}$ is preferably not more than 15, and preferably contains at least one carboxyl group, arylsulfonamide group or alkylsulfonamide group as a substituent for $R_1$ through $R_{10}$.

The timing group represented by Time in the above Formula [S] is preferably represented by Formula [Si], [Sj] or [Sk];

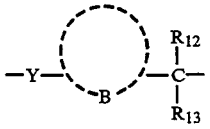

Formula [Si]

wherein B represents an atomic group necessary to form a benzene ring or a naphthalene ring; Y represents —O—, —S—, or

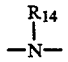

and combines an active site of Coup (coupling component) in the above Formula [S]; $R_{12}$, $R_{13}$, and $R_{14}$ independently represent a hydrogen atom, an alkyl group or an aryl group.

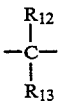

is positioned at ortho or para to Y in

Bring, and the other end is combined to Sc in the above Formula [S].

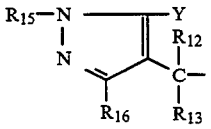

Formula[Sj];

wherein Y, $R_{12}$, and $R_{13}$ independently represent the same atoms and groups as those defined in Formula [Si]; $R_{15}$ represents a hydrogen atom, an alkyl group, an aryl group, an acyl group, a sulfone group, an alkoxycarbonyl group, or a heterocyclic residue; $R_{16}$ represents a hydrogen atom, an alkyl group, an aryl group, a heterocyclic residue, an alkoxy group, an amino group, an acid amide group, a sulfonamide group, a carboxy group, an alkoxycarbonyl group, a carbamoyl group, or a cyano group. In the timing group represented by Formula [Sj], like the above Formula [Si], Y is combined to an active site of Coup (coupling component) and

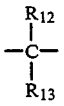

to Sc in the above Formula [S ].

The examples of the Time group which releases Sc by intramolecular nucleophilic substitution include the group represented by the following Formula [Sk ].

Formula [Sk]

—Nu—D—E— wherein Nu represents a nucleophilic group having oxygen, sulfur, nitrogen, or other atoms, and is combined to an active site of Coup (coupling component) in Formula [S]; E represents an electrophilic group having a carbonyl group, a thiocarbonyl group, a phosphinyl group, a thiophosphinyl group, or other groups. This electrophilic group E is combined to a hetero atom of Sc; D represents a linkage group which sterically links Nu and E and is capable of initialing an intramolecular nucleophilic substitution followed by a reaction to form a 3- to 7-membered ring after Nu is released from Coup (coupling component), and thereby releasing Sc.

A scavenger which scavenges an oxidized product of a color developer and is represented by Sc includes two types, namely an oxidation-reduction type and a coupling type.

When Sc in Formula [S] is a group which scavenges an oxidized product of a color developer by oxidation-reduction reaction, it is capable of reducing the oxidized product of the color developing agent; for example, the reducing agents described in Angew. Chem. Int. Ed., 17, 875–886 (1978), "The Theory of the Photographic Process", 4th edition (Macmillan, 1977), Chapter 11, Japanese Patent Publication Open to Public Inspection No. 5247/1984, etc. are preferred for Sc, and in addition, Sc may be a precursor capable of releasing any one of these reducing agents. Specifically, the preferred groups are an aryl group and a heterocyclic group, each having at least two of —OH group, —$NHSO_2R_1$ group,

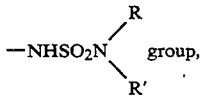

and

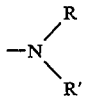

group (wherein R and R′ independently represent a hydrogen atom, an alkyl, a cycloalkyl, an alkenyl, or an aryl group); of these groups, aryl groups are particularly preferable, and a phenyl group is more preferable. An oleophilicity of Sc can be arbitrarily selected by purpose, as is the case in the couplers represented by the above Formulae [Sa] through [Sh]; however, for maximizing the effect of the present invention, the total number of carbon atoms of Sc is 6 to 50, preferably 6 to 30, more preferably 6 to 20.

When Sc scavenges an oxidized product of a color developer by coupling reaction, it may be any one of various coupler residues. However, Sc is preferably a coupler residue which forms substantially no image forming coupling dye; couplers used for this purpose include the preceding effluent dye-forming couplers, bleaching dye-forming couplers, and Weiss couplers which have a non-leaving substituent at a reactive point and forms no dye.

The examples of the compound represented by Formula [S] include the compounds described in British Patent No. 1,546,837, Japanese Patent Publication Open to Public Inspection Nos. 150631/1977, 111536/1982, 111537/1982, 138636/1982, 185950/1985, 203943/1985, 213944/1985, 214358/1985, 53643/1986, 84646/1986, 86751/1986, 102646/1986, 102647/1986, 107245/1986, 113060/1986, 231553/1986, 233741/1986, 236550/1986, 236551/1986, 238057/1986, 240240/1986, 249052/1986, 81638/1987, 205346/1987, and 287249/1987.

Oxidation-reduction type scavengers can be preferably used for Sc; in this case, an oxidized color developer can be reduced for reuse.

The examples of the DSR compound represented by the above Formula [S] are shown below, but these are not to be construed as limitations in the present invention.

DSR-1

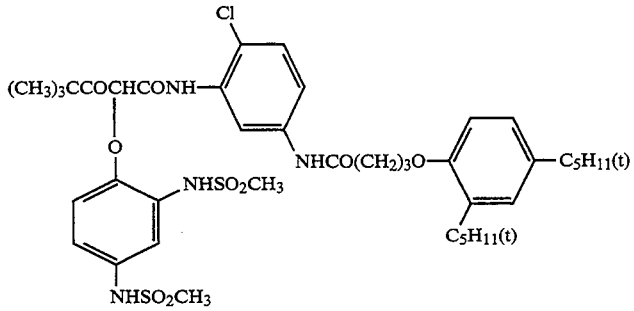

DSR-2

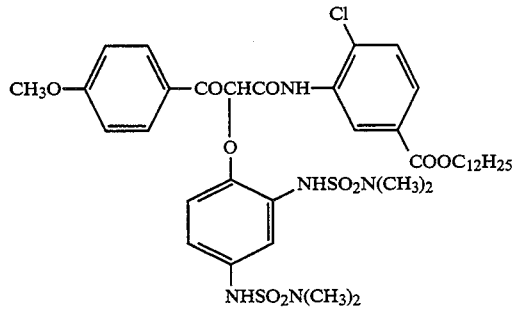

DSR-3

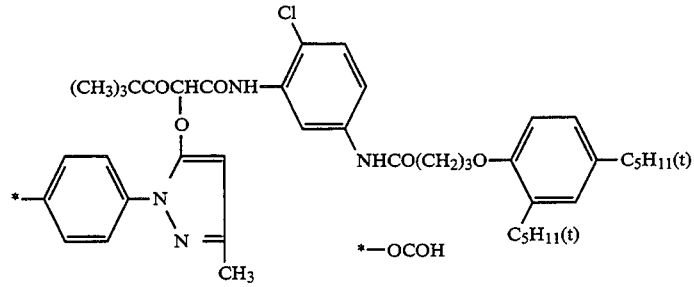

-continued
DSR-4
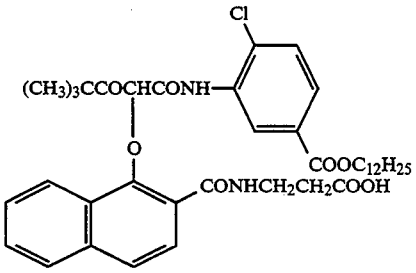
DSR-5
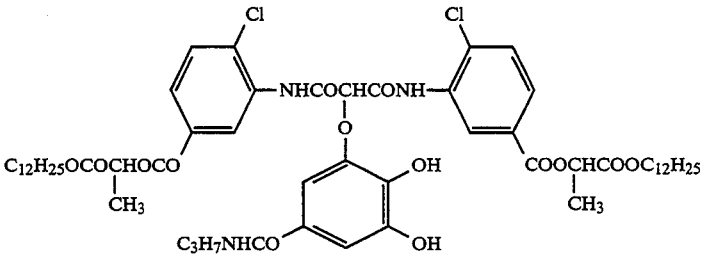
DSR-6
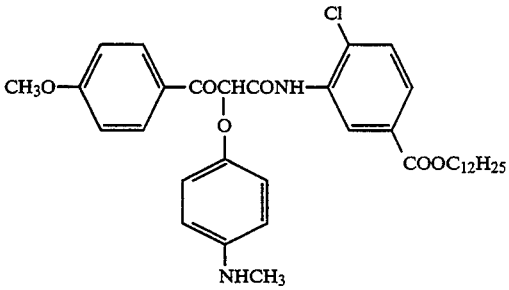
DSR-7
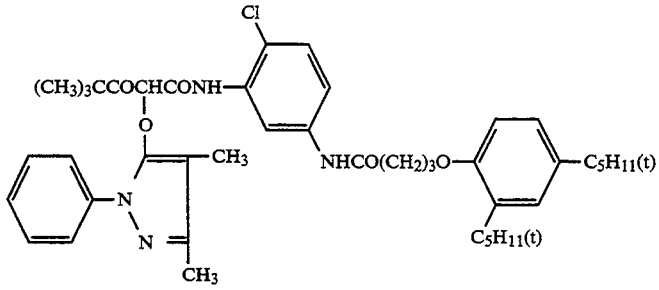
DSR-8
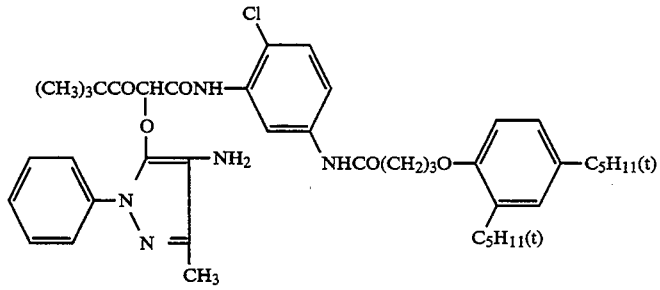
DSR-9
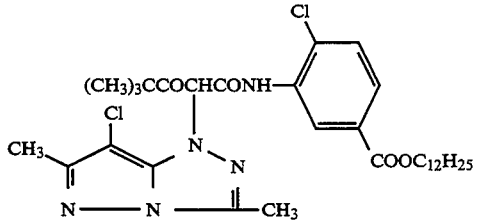

-continued
DSR-10
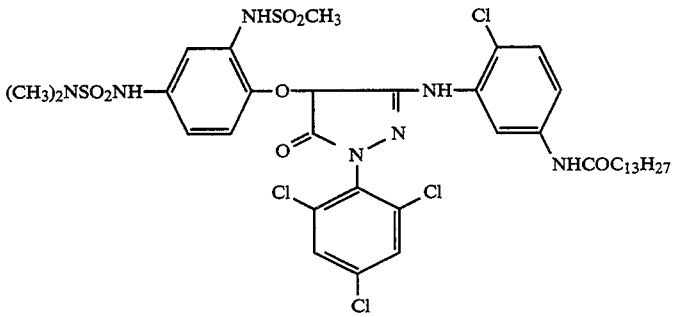
DSR-11
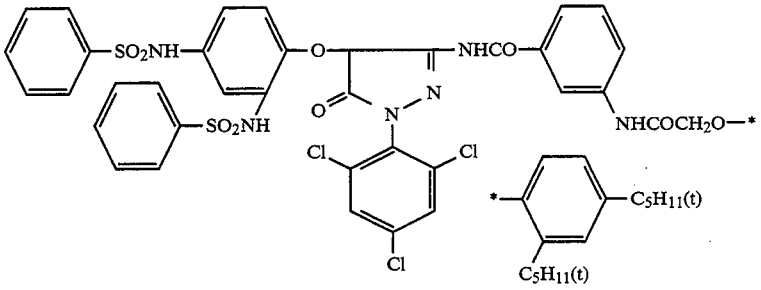
DSR-12
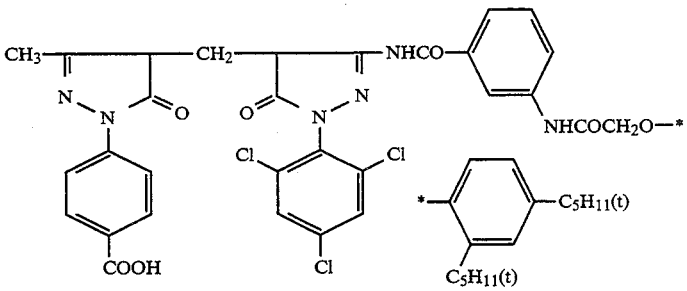
DSR-13
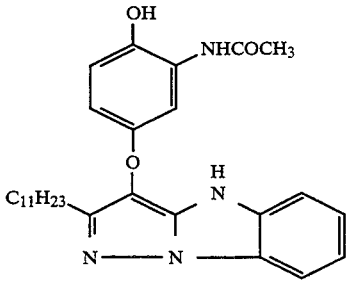
DSR-14
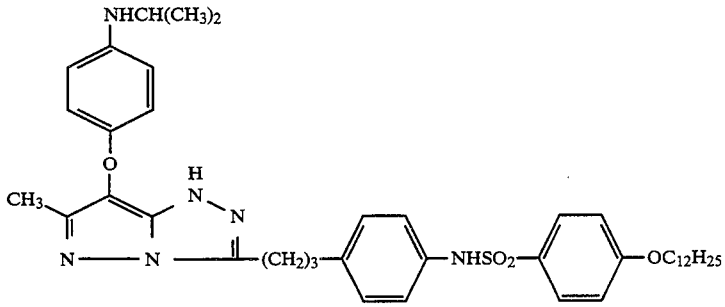

-continued
DSR-15
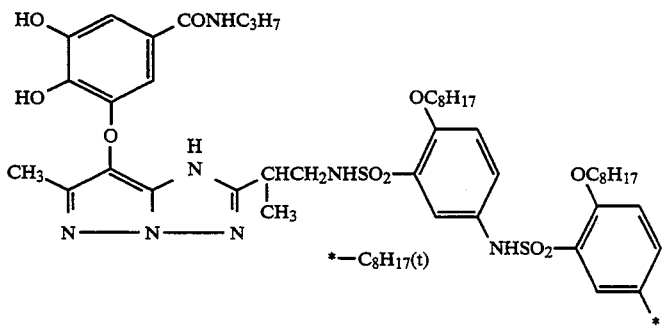
DSR-16
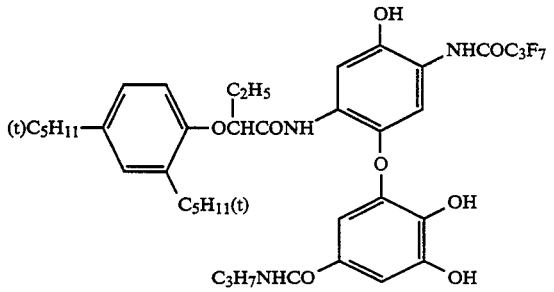
DSR-17
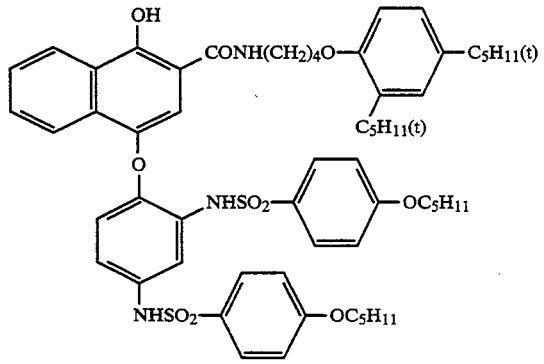
DSR-18
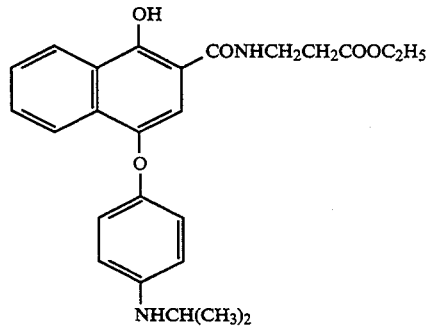
DSR-19
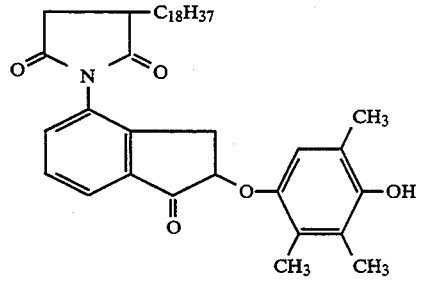

-continued
DSR-20
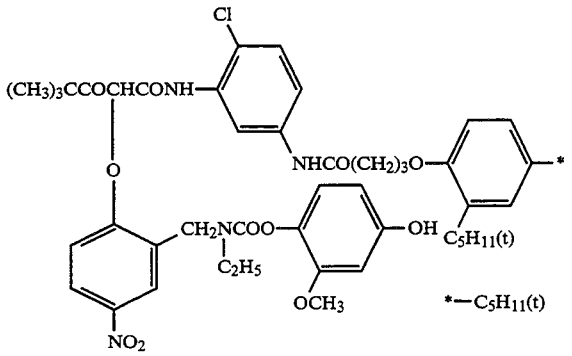
DSR-21
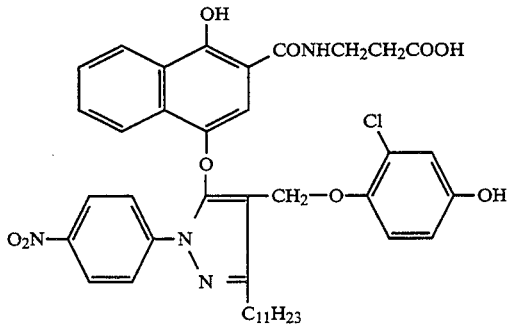
DSR-22
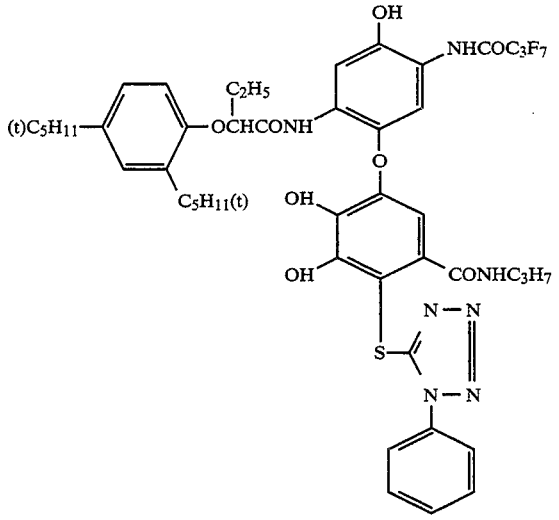
DSR-23
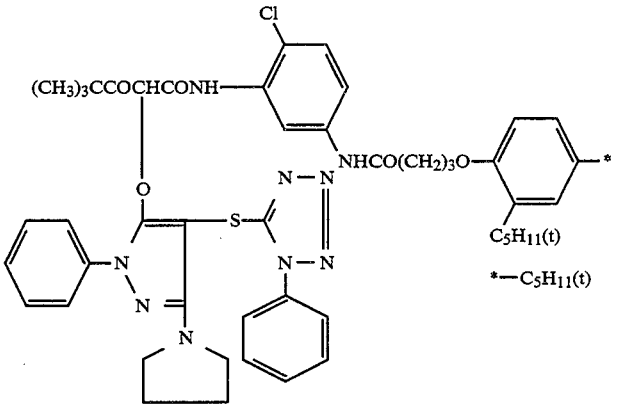

-continued
DSR-24
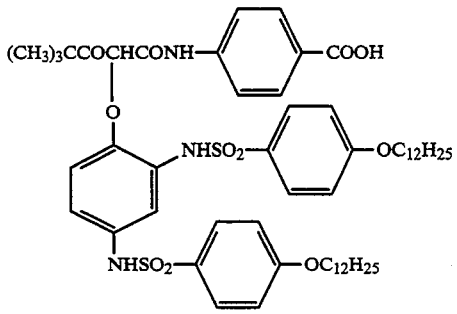
DSR-25
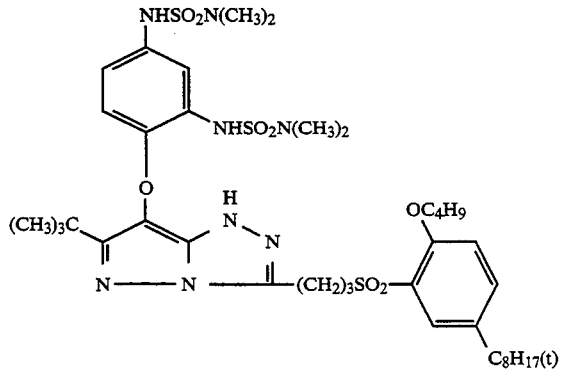
DSR-26
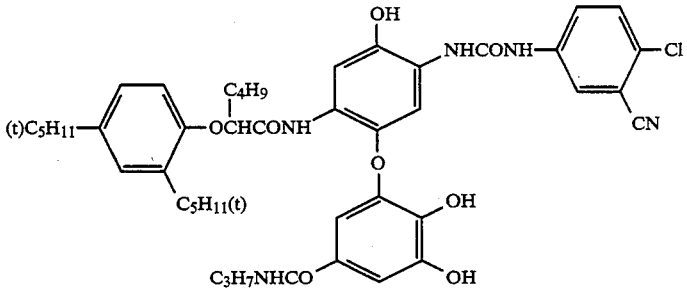
DSR-27
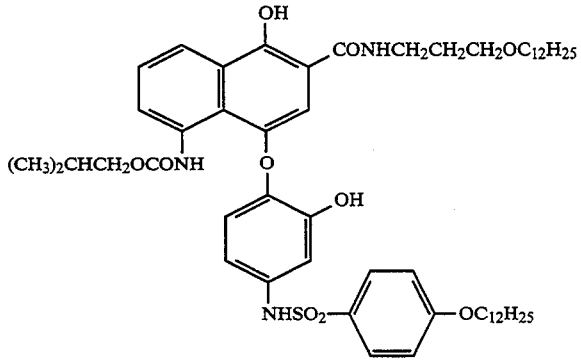
DSR-28
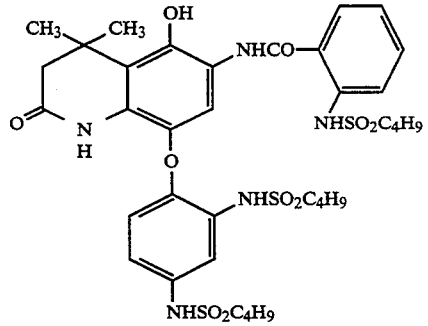

-continued
DSR-29
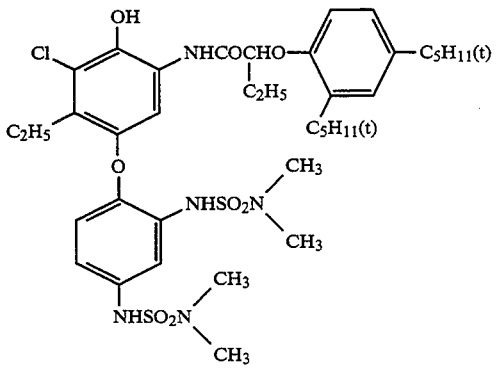
DSR-30
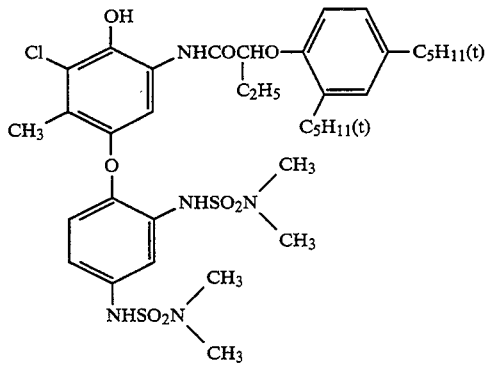
DSR-31
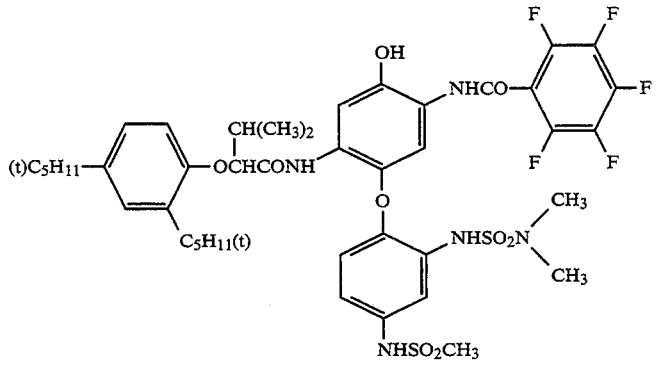
DSR-32
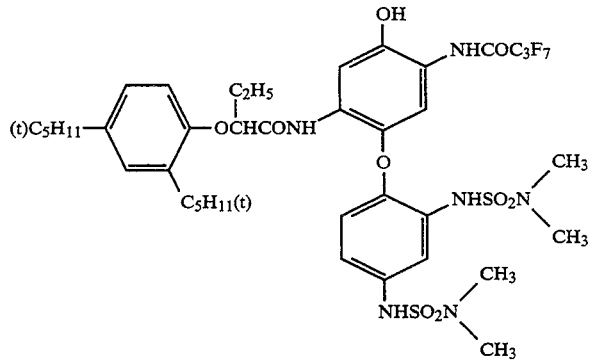

-continued
DSR-33
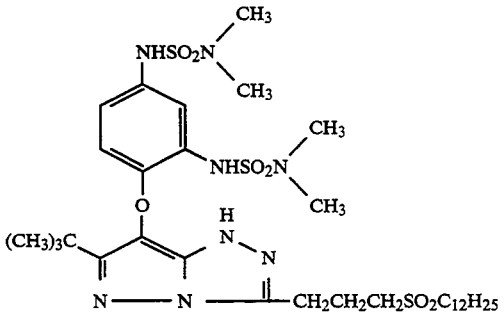
DSR-34
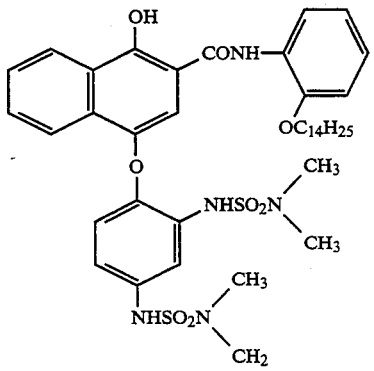
DSR-35
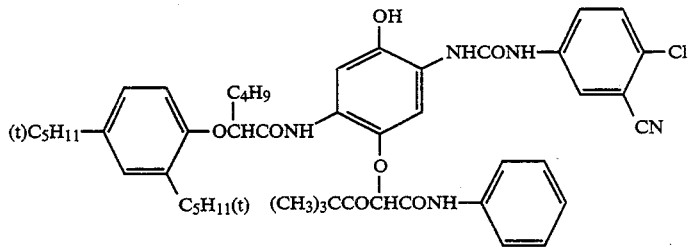
DSR-36
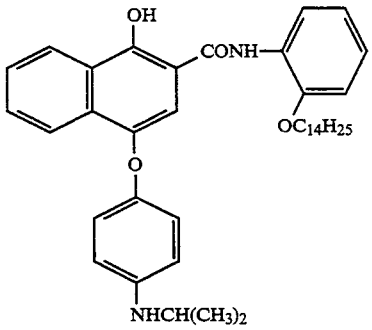
DSR-37
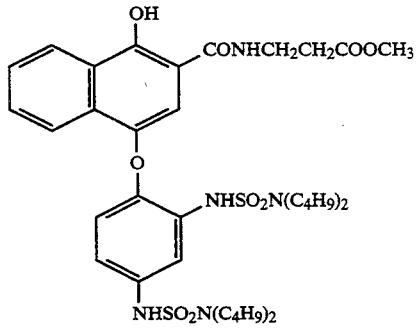

-continued

DSR-38

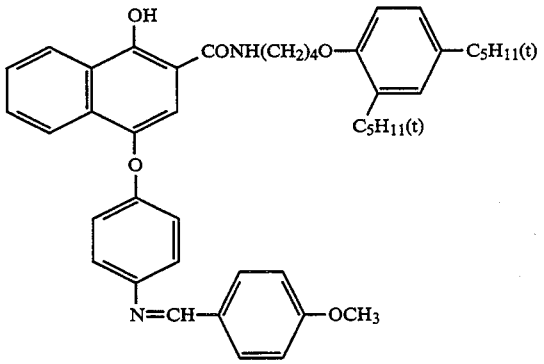

A DSR coupler can be added to a photosensitive silver halide emulsion layer and/or a non-photosensitive layer, but the DSR coupler is preferably added to the photosensitive silver halide emulsion layer.

Two or more DSR couplers may be added to a single layer and the same DSR coupler may be added to two or more layers.

Usually, these DSR couplers are preferably used in amounts of $2\times10^{-4}$ to $5\times10^{-1}$ mole, more preferably, $1\times10^{-2}$ to $2\times10^{-1}$ mole per mole of silver in an emulsion layer.

When the preceding yellow, magenta or cyan coupler used mainly for image forming, and a DSR coupler are used in combination, the amount of the DSR coupler used is preferably 0.01 to 100 moles, more preferably 0.03 to 10 moles per mole of yellow, magenta, or cyan coupler.

The examples of colored couplers used for the invention include those described in U.S. Pat. Nos. 3,476,560, 2,521,908, and 3,034,892, Japanese Patent Examined Publication Nos. 2016/1969, 22335/1963, 11304/1967, and 32461/1969, Japanese Patent Publication Open to Public Inspection Nos. 26034/1976 and 42121/1977, and West German OLS Patent No. 2,418,959.

The preceding various couplers can be added in any manner, as long as they are dissolved in a high-boiling-point organic solvent to be eventually contained in a photosensitive material; usually, after dissolved in a water-immiscible high-boiling-point organic solvent with a boiling point of over 150° C., in combination with a low-boiling-point and/or water-soluble organic solvent as needed, a coupler is mixed with an aqueous gelatin solution containing a surfactant to emulsify by a high-speed rotary mixer, colloid mill or other means, and then is added to a hydrophilic colloid such as silver halide emulsion.

High-boiling-point organic solvents used for the invention include organic solvents with a boiling point of over 150° C., which do not react with an oxidized product of a developer, such as phenol derivatives, alkyl phthalates, phosphates, citrates, benzoates, alkylamides, fatty acid esters, and trimesates; particularly, those with a boiling point of over 170° C. are preferred.

The examples of high-boiling-point organic solvents are described in detail in U.S. Pat. Nos. 2,322,027, 2,533,514, 2,835,579, 3,287,134, 2,353,262, 2,852,383, 3,554,755, 3,676,137, 3,676,142, 3,700,454, 3,748,141, 3,779,765, and 3,837,863, British Patent Nos. 958,441 and 1,222,753, West German OLS Patent No. 2,538,889, Japanese Patent Publication Open to Public Inspection Nos. 1031/1972, 90523/1974, 23823/1975, 26037/1976, 27921/1976, 27922/1976, 26035/1976, 26036/1976, 62632/1975, 1520/1978, 1521/1978, 15127/1978, 119921/1979, 119922/1979, 25057/1980, 36869.1980, 19049/1981, and 81836/1981, and Japanese Patent Examined Publication No. 29060/1973, for instance.

Low-boiling-point and/or water-soluble organic solvents which can be used in combination with high-boiling-point solvents include those described in U.S. Pat. Nos. 2,801,171 and 2,949,360, for instance. The examples of low-boiling-point, substantially water-insoluble organic solvents include ethyl acetate, propyl acetate, butyl acetate, butanol, chloroform, carbon tetrachloride, nitromethane, nitroethane, and benzene; the examples of water-soluble organic solvents include acetone, methyl isobutyl ketone, β-ethoxyethyl acetate, methoxyglycol acetate, methanol, ethanol, acetonitrile, dioxane, dimethylformamide, dimethyl sulfoxide, hexamethylphosphoramide, diethylene glycol monophenyl ether, and phenoxyethanol.

In color developing process, the preceding photosensitive halide photographic material, after imagewise exposing, is subjected to at least color development and a treatment including bleaching and/or fixing; from the viewpoint of sensitivity and image graininess and sharpness, a photosensitive material is developed preferably in not more than 120 seconds, more preferably in 20 to 120 seconds, further more preferably 40 to 100 seconds.

Color developers used for the invention are described below.

Aromatic primary amine-based color developers are preferably used, including known ones widely used for various color photographic processes. These color developers include aminophenol derivatives and p-phenylenediamine derivatives. These compounds are normally used in the form of salts, e.g. hydrochlorides or sulfates, since they are more stable than free forms.

The examples of aminophenols include o-aminophenol, p-aminophenol, 5-amino-2-oxy-toluene, 2-amino-3-oxy-toluene, 2-oxy-3-amino-1,4-dimethylbenzene, and their salts.

The examples of p-phenylenediamine-based color developers include p-phenylenediamine, N,N-diethyl-p-phenylenediamine, 3-methyl-4-amino-N-ethyl-N-β-hydroxyethylaniline, and their salts.

The preferable aromatic primary amine-based color developers include the various compounds described in Japanese Patent Publication Open to Public Inspection No. 162885/1986, pp. 79–86. The preceding color developer is preferably contained in a developing solution in amounts of not less than $2\times10^{31\,2}$ mole, more preferably $2.5\times10^{-2}$ to $2\times10^{-1}$ mole, further more preferably $3\times10^{-2}$ to $1\times10^{-1}$ mole per liter of developing solution.

The other preferred compounds which can be used for a color developing solution are sulfites, hydroxylmaines and development inhibitors.

The sulfites include sodium sulfite, sodium hydrogen sulfite, potassium sulfite, and potassium hydrogen sulfite. They are used preferably at the range of 0.1 to 40 g/l, more preferably 0.5 to 10 g/l.

The hydroxylamines are used as counter salts against hydrochlorides, sulfates, etc.; they are used preferably at the range of 0.1 to 40 g/l, more preferably 0.5 to 10 g/l.

The inhibitors include halides such as sodium bromide, potassium bromide, sodium iodide, and potassium iodide; the organic inhibitors include the following compounds, which are added in amounts of 0.005 to 20 g/l, preferably 0.01 to 5 g/l.

It is preferable to add further an organic inhibitor to a color developing solution. Organic inhibitors used for the invention include the compounds described in Japanese Patent Publication Open to Public Inspection No. 162885/1986, pp. 88–105.

It is preferable that a color developing solution contains a compound represented by the following Formula [IS].

Formula[IS];

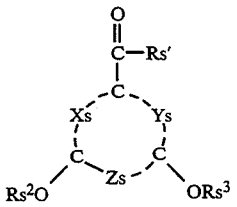

wherein $Rs^1$ represents —OH, —$ORs^4$ or

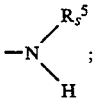

;

$Rs^4$ and $Rs^5$ independently represent an alkyl group; the alkyl groups represented by each of $Rs^4$ and $Rs^5$ include substituted ones, and the examples of substituents are a hydroxyl group and an aryl group such as a phenyl group and the alkyl groups include methyl, ethyl, propyl, butyl, benzy, β-hydroxyethyl, and dodecyl groups;

$Rs^2$ and $Rs^3$ independently represent —H or

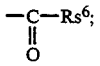

$Rs^6$ represents an alkyl group or an aryl group; the alkyl group represented by $Rs^6$ include long-chained alkyl groups such as undecyl group;

Xs and Ys are respectively carbon atoms and hydrogen atoms, which are combined with other atomic groups to form a 6-membered ring; Zs represents —N═ or —CH═;

Provided that Zs represents —N═, the compound represented by Formula [IS] is typically exemplified by citrazinic acid derivatives; provided that Zs represents —CH═, the compound represented by Formula [IS] is typically exemplified by benzoic acid derivatives; these compounds, as a whole, include compounds having a substituent such as halogen atom in the 6-membered ring.

Zs is preferably —N═.

The examples of the compounds represented by Formula [IS] are shown below, but these are not to be construed as limitations in the present invention. Example compounds:

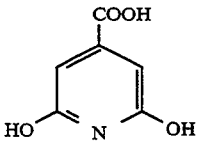

(1)

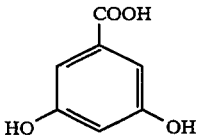

(2)

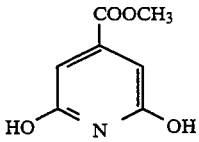

(3)

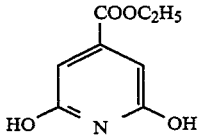

(4)

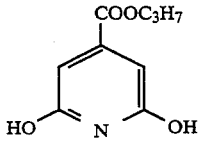

(5)

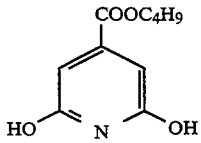

(6)

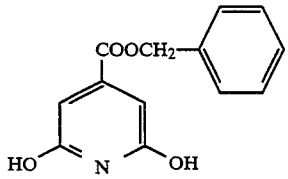

(7)

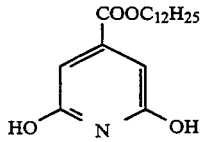

(8)

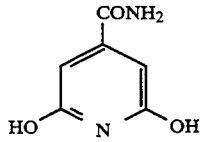

(9)

-continued (10)

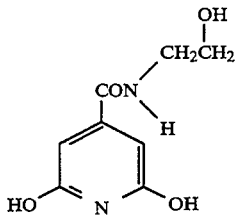

(11)

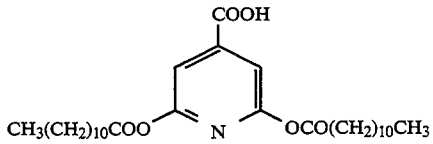

(12)

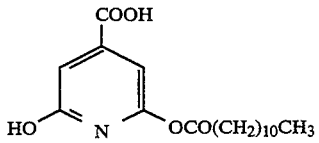

(13)

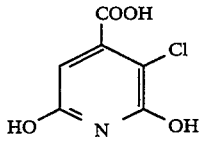

(14)

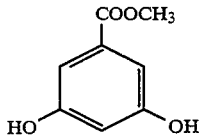

(15)

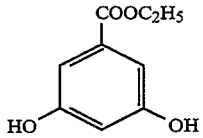

(16)

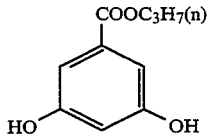

(17)

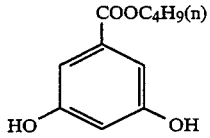

(18)

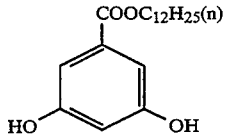

(19)

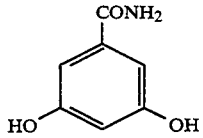

-continued (20)

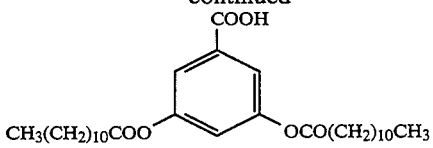

(21)

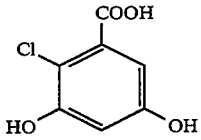

The compound represented by Formula [IS] is preferably used in an amount of 0.1 to 50 g, more preferably 0.2 to 20 g per liter of color developing solution.

The color developing solution may be further supplemented with various conventional additives, e.g. alkali agents such as sodium hydroxide and sodium carbonate; alkali metal thiocyanates; alkali metal halides; benzyl alcohol; water softening agents; thickening agents; and development accelerators.

The other additives used for a developing solution include anti-stain agents, anti-sludge agents, preservatives, interlayer effect accelerators, and chelating agents.

A color developing solution is used preferably at pH not less than 9, more preferably at pH 9 to 13.

Color developing temperature is normally over 15° C., usually at the range of 20° to 50° C., and preferably over 30° C. for quick development.

Essentially, there is no particular limitation to processing of a photographic light-sensitive material of the present invention; various methods of processing are applicable. The representative methods include a method in which bleach-fixing is conducted after color developing and, if needed, followed by washing or stabilization for substituting washing; a method in which bleaching and fixing are separately conducted after color developing, and, if needed, followed by washing or stabilization for substituting washing; a method in which pre-hardening neutralization, color developing, stop-fixing, washing (or stabilization for substituting washing), bleaching, fixing, washing (or stabilization for substituting washing), post-hardening, and washing (or stabilization for substituting washing) are conducted in this order; a method in which color developing, washing (or stabilization for substituting washing), secondary color developing, stop, bleaching, fixing, washing (or stabilization for substituting washing), and stabilization are conducted in this order; and a method in which developed silver resulting from color developing is again subjected to color developing after subjected to halogenation bleaching, to increase the amount of dye formed.

Bleaching agents generally known to be usable in the bleaching bath or bleach-fix bath include aminopolycarboxylic acids and other organic acids such as oxalic acid and citric acid as coordinated with metal ions such as iron, cobalt, and silver ions. Representative examples of aminopolycarboxylic acids include:

Ethylenediaminetetraacetic acid
Diethylenetriaminepentaacetic acid
Propylenediaminetetraacetic acid
Nitrilotriacetic acid
Iminodiacetic acid
Glycoletherdiaminetetraacetic acid Ethylenediaminetetrapropionic acid
Disodium ethylenediaminetetraacetate
Pentasodium diethylenetriaminepentaacetate
Sodium nitrilotriacetate Bleaching and bleach-fixing solutions generally can be used at the pH range of 0.2 to 9.5, preferably over 4.0, more preferably over 5.0. Processing temperature is normally 20° to 80° C., preferably over 30° C.

Bleaching solution may be supplemented with various additives as well as the preceding bleaching agents (ferric complex salts of organic acids are preferred). The particularly preferable additives are alkali halides and ammonium halides, such as potassium bromide, sodium bromide, sodium chloride, ammonium bromide, potassium iodide, sodium iodide, and ammonium iodide. It is also possible to add pH buffers such as borates, oxalates, acetates, carbonates, and phosphates; stabilizing agents such as triethanolamine; and other additives known to be usually added to bleaching bath, such as acetylacetone, phosphonocarboxylic acid, polyphosphoric acid, organic phosphonic acid, oxycarboxylic acid, polycarboxylic acid, alkylamine, and polyethylene oxide.

Bleach-fix solution includes bleach-fix solution with a composition supplemented with small amounts of halides such as potassium bromide, bleach-fix solution with a composition supplemented with large amounts of halides such as potassium bromide and ammonium bromide, and bleach-fix solution specially comprising a bleaching agent of the present invention and large amounts of halides such as potassium bromide.

The examples of such halides include hydrochloric acid, hydrobromic acid, lithium bromide, sodium bromide, ammonium bromide, potassium iodide, sodium iodide, and ammonium iodide, as well as potassium bromide.

The representative examples of a silver halide fixer contained in bleach-fix solution include compounds which react with silver halides to form water-soluble complex salts and is used for ordinary fixing, e.g. thiosulfates such as potassium thiosulfate, sodium thiosulfate, and ammonium thiosulfate; thiocyanates such as potassium thiocyanate, sodium thiocyanate, and ammonium thiocyanate; thioureas; thioethers; high concentration bromides and iodides. These fixers are used at the amount range where they are dissolved at ratio of not less than 5 g/l, preferably not less than 50 g/l, further more preferably not less than 70 g/l.

Bleach-fixing solution, like bleaching solution, can be supplemented with two or more pH buffers containing boric acid, acetic acid, and various salts such as borax, sodium hydroxide, potassium hydroxide, sodium carbonate, potassium carbonate, sodium bicarbonate, potassium bicarbonate, sodium acetate, and ammonium hydroxide. Furthermore, various brightening agents, defoaming agents, surfactants, and fungicides can also be added. It is also possible to add such preservatives as hydroxylamine, hydrazine, sulfites, metabisulfites, and metabisulfite adducts of aldehyde or ketone compounds; organic chelating agents such as acetylacetones, phosphonocarboxylic acids, polyphosphoric acids, organic phosphonic acids, oxycarboxylic acids, polycarboxylic acids, dicarboxylic acids, and aminopolycarboxylic acids; stabilizers such as nitroalcohol and nitrates; anti-stain agents such as organic amines; other additives; and organic solvents such as methanol, dimethylformamide, and dimethylsulfoxide.

The most desirable is the processing method in which bleaching or bleach-fixing is conducted immediately after color developing, but bleaching or bleach-fix processing may be conducted after washing or other processes such as rinsing and stopping, following color developing, and a pre-bath supplemented with bleaching accelerator may also be used as a processing solution prior to bleaching or bleach-fixing.

In processing the photosensitive silver halide photographic material of the present invention, processing temperature in various processes other than developing, e.g. bleaching-fixing (or bleaching and fixing), and washing or stabilization for substituting washing conducted as needed, is preferably 20° to 80° C., more preferably over 30° C.

In the present invention, it is preferable to conduct stabilizing treatment without water washing as disclosed in Japanese Patent Publication Open to Public Inspection Nos. 14834/1983, 10514/1983, 134634/1983, and 18631/1983, and Japanese Patent Application Nos. 2709/1983 and 89288/1984, for instance.

EXAMPLES

The invention is hereunder described in detail by referring to the examples.

Preparation of AgX Seed Emulsion N-1

Using a method described in Japanese Patent O.P.I. Publication No. 45437/1975, to 500 ml of 2.0% aqueous gelatin solution heated to 40° C. were added, in 35 minutes, 250 ml of 4M (mole concentration) aqueous $AgNO_3$ solution, and 250 ml of 4 M aqueous KBr/KI [KBr:KI=98:2 (mole ratio)] solution, by a controlled double-jet method, while the pAg level was maintained at 9.0 and pH level at 2.0. Aqueous gelatin solution containing the AgX grains of a total amount of silver added was adjusted to pH 5.5, and then, 364 ml of 5% aqueous solution of Demol N (produced by Kao Atlas), as well as 244 ml of 20% aqueous solution containing magnesium sulfate as multivalent ion were added to come into coagulation. The resultant precipitant was allowed to settle down, and then, the supernatant was decanted, and redispersed after 1400 ml of distilled water was added. To the dispersion was added 36.4 ml of 20% aqueous magnesium sulfate to allow re-coagulation, and then the supernatant was decanted. An aqueous solution containing 28 g of ossein gelatin was added to make total quantity 425 ml, which was dispersed for 40 minutes at 40° C. to prepare AgX emulsion.

This emulsion was designated N-1. Electromicroscopic observation revealed that N-1 was a monodispersed emulsion with an average grain size of 0.093 μm.

Preparation of AgX Seed Emulsions N-2, and N-3 (Preparation Example 2)

Using a method identical to that of Preparation Example 1, monodispersed AgBrI seed emulsions N-2 and N-3, both having iodide content of 2 mol %, were prepared; the average grain size of the former was 0.27 μm, while that of the latter was 0.8 μm.

Preparation of Seed Emulsions N-4, and N-5

AgX seed emulsions N-4, and N-5 were prepared, at the conditions identical to those of emulsion N-1, wherein an additive was added to the preceding 4M aqueous KBr/KI solution in an amount as specified in Table below. Electromicroscopic observation revealed that each and N-4 and N-5 was a monodispersed emulsion with an average grain size of 0.093 μm.

TABLE

| | Additive | Amount added (mol/mol of Ag) |
|---|---|---|
| N-4 | $RhCl_3$ | $2 \times 10^{-5}$ |
| N-5 | $K_2IRCl_5$ | $2 \times 10^{-5}$ |

Manufacturing Example 1

Using six types of solution specified below, the silver halide grains of the invention were prepared. The grains were the core/shell type silver bromoiodide grains having an average size 0.38 *m, and an average AGI content of 8.46 mol %.

| | |
|---|---|
| Solution A-1 | |
| Ossein gelatin | 28.78 g |
| 10% ethanol solution of | |
| $HO(CH_2CH_2O)_m(CH(CH_3)-CH_2O)_p(CH_2CH_2O)_mH$ | |
| (average M.W. 1700, PRONON, produced by NIHON YUSHI) | 16.5 ml |
| KI | 146.5 g |
| Distilled water | 5287 ml |
| Solution B-1 | |
| Seed emulsion N-1 (average grain size, 0.093 *m; AgBrI; average I content, 2 mol %) | equivalent to 0.1552 mole AgX |
| 4-hydroxy-6-methyl-1,3,3a,7-tetraazaindene (hereinafter referred to as TAI) | 247.5 mg |
| 56% aqueous acetic acid solution | 72.6 ml |
| 28% aqueous ammonium solution | 97.2 ml |
| Distilled water added to make total quantity | 1020 ml |
| Solution C-1 | |
| $AgNO_3$ | 1774 g |
| 28% aqueous ammonium solution | 1447 ml |
| Distilled water added to make total quantity | 2983 ml |
| Solution D-1 | |
| Ossein gelatin | 50 g |
| KBr | 2082.5 g |
| TAI | 2.535 g |
| Distilled water added to make total quantity | 5000 ml |
| Solution E-1 | |
| 20% aqueous KBr solution | amount needed for controlling pAg |
| Solution F-1 | |
| 56% aqueous acetic acid solution | amount needed for controlling pH |

Using a mixer described in Japanese Patent O.P.I. Publication Nos. 92423/1982, and 92524/1982, 252 ml of Solution C-1 was added to Solution A-1 in one minute at 40° C. to generate AgI grains. Electromicroscopic observation revealed that the average size of the AgI grains was approx. 0.05 μm. Then, Solution B-1 was added. Next, solutions C-1 and D-1 were added by a double-jet method, while controlling pAg, pH, and the rates of addition of C-1 and D-1 as specified in Table 1. During addition pAg and pH were controlled by changing the flow rates of Solution E-1 and F-1 using a variable flow rate roller tube pump. Two minutes after the termination of adding Solution C-1, pAg was adjusted to 10.4 by Solution E-1 , and 2 minutes later, pH was adjusted to 6.0 by Solution F-1.

Next, by a conventional method, desalination and washing were performed. Then, the mixture solution was dispersed in aqueous solution containing 197.4 g of ossein gelatin, and distilled water was added to make the total quantity 3000 ml to obtain emulsion EM-1.

FIG. 1 is an electron micrograph of EM-1.

TABLE 1

| Grain growth conditions (EM-1) | | | | |
|---|---|---|---|---|
| Time | | | Addition rate of solution (ml/min.) | |
| (min.) | pH | pAg | Solution C-1 | Solution D-1 |
| 0 | 8.55 | 9.00 | 9.8 | 9.3 |
| 7.85 | 8.55 | 8.81 | 30.7 | 29.2 |
| 11.80 | 8.55 | 8.60 | 44.9 | 42.7 |
| 17.33 | 8.55 | 8.25 | 61.4 | 58.4 |
| 19.23 | 8.55 | 8.10 | 63.5 | 60.4 |
| 22.19 | 8.55 | 7.88 | 56.6 | 53.8 |
| 28.33 | 8.55 | 7.50 | 41.2 | 39.8 |
| 36.61 | 9.38 | 7.50 | 31.9 | 34.1 |
| 40.44 | 9.71 | 7.50 | 30.6 | 37.1 |
| 45.14 | 10.12 | 7.50 | 34.6 | 57.8 |
| 45.97 | 10.20 | 7.50 | 37.3 | 36.3 |
| 57.61 | 10.20 | 7.50 | 57.3 | 55.8 |
| 63.08 | 10.20 | 7.50 | 75.1 | 73.1 |
| 66.63 | 10.20 | 7.50 | 94.0 | 91.4 |

Manufacturing Example 2

In a manner identical to that of Manufacturing Example 1, the AgX (core/shell type AgBrI) grains of the invention were prepared, wherein the average size was 0.27 μm, and the average I content was 8.46 mol %.

| | |
|---|---|
| Solution A-2 | |
| Ossein gelatin | 43 g |
| KI | 142.6 g |
| 10% ethanol solution of PRONON | 20 ml |
| Distilled water added to make total quantity | 5400 ml |
| Solution B-2 | |
| Seed emulsion N-1 | equivalent to 0.4328 mole AgX |
| TAI | 630 mg |
| 56% aqueous acetic acid solution | 105 ml |
| 28% aqueous ammonium solution | 176 ml |
| Distilled water added to make total quantity | 3645 ml |
| Solution C-2 | |
| $AgNO_3$ | 1726 g |
| 28% aqueous ammonium solution | 1409 ml |
| Distilled water added to make total quantity | 2903 ml |
| Solution D-2 | |
| Ossein gelatin | 50 g |
| KBr | 2082.5 g |
| TAI | 5.37 g |
| Distilled water added to make total quantity | 5000 ml |
| Solution E-2 | |
| Same as E-1. | |

Solution F-2

Same as F-1.

As in Manufacturing Example 1, using the mixer used in Manufacturing Example 1, 245.5 m! of solution C-2 was added to solution A-2 at 40° C. in one minute, in order to generate AgI grains. An average grain size of the AgI grains was approximately 0.05 *m, same as that of Manufacturing Example 1. Following AgI precipitation, Solution B-2 was added. Next, Solutions C-2 and D-2 were added simultaneously by a double-jet method, wherein pAg pH and the flow rates of C-2 and D-2 were controlled as specified in Table 2. PAg and pH were controlled in the same manner as in Manufacturing Example 1.

After pAg and pH were adjusted in the same manner as in Manufacturing Example 1, desalination, washing and dispersing were performed, and the total quantity was adjusted to 3000 m!. This emulsion was designated EM-2.

Figure 2:
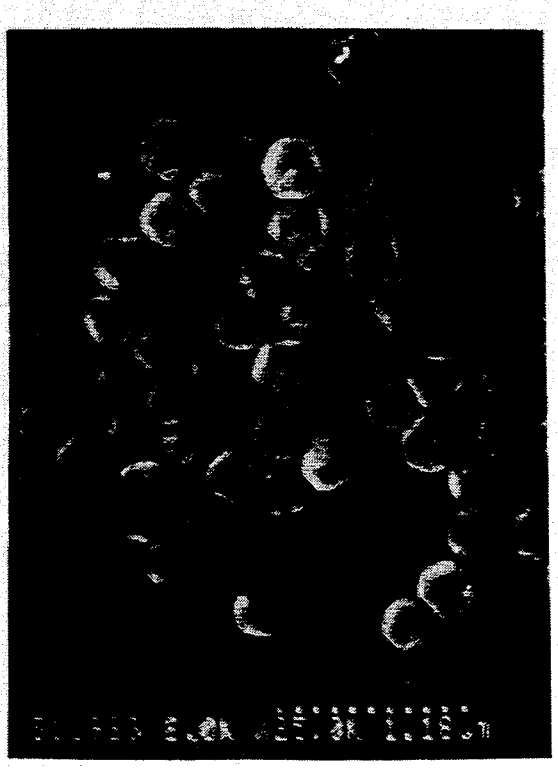

FIG. 2 is an electron micrograph of EM-2.

TABLE 2

| Grain growth conditions (EM-2) | | | | |
|---|---|---|---|---|
| Time | | | Addition rate of solution (ml/min.) | |
| (min.) | pH | pAg | Solution C-2 | Solution D-2 |
| 0 | 9.00 | 8.80 | 18.4 | 18.0 |
| 3.74 | 8.93 | 8.80 | 28.8 | 28.3 |
| 7.04 | 8.82 | 8.80 | 42.2 | 41.4 |
| 10.48 | 8.68 | 8.80 | 59.4 | 58.2 |
| 13.13 | 8.52 | 8.80 | 71.5 | 70.2 |
| 16.56 | 8.30 | 8.80 | 79.2 | 77.7 |
| 21.04 | 8.00 | 8.80 | 73.9 | 74.7 |
| 23.04 | 7.96 | 9.07 | 71.8 | 74.7 |
| 25.10 | 7.92 | 9.35 | 68.7 | 75.2 |
| 26.38 | 7.89 | 9.51 | 67.6 | 79.4 |
| 29.29 | 7.83 | 9.90 | 75.6 | 75.0 |
| 31.19 | 7.79 | 9.90 | 76.9 | 76.3 |
| 34.56 | 7.72 | 9.90 | 77.9 | 77.2 |
| 40.19 | 7.59 | 9.90 | 76.2 | 75.5 |
| 44.46 | 7.50 | 9.90 | 73.3 | 72.6 |

Manufacturing Example 3

In a manner identical to that of Manufacturing Example 1, the AgX (core/shell type AgBrI) grains of the invention were prepared, wherein an average size was 0.65 μm, and an average I content was 7.16 mol %.

| | |
|---|---|
| Solution A-3 | |
| Ossein gelatin | 45 g |
| KI | 116.8 g |
| 10% ethanol solution of PRONON | 30 ml |
| Distilled water added to make total quantity | 9191 ml |
| Solution B-3 | |
| Seed emulsion N-2 (average grain size, 0.27 μm; AgBrI; average I content, 2 mol %) | equivalent to 0.759 mole AgX |
| 56% aqueous acetic acid solution | 112.5 ml |
| 28% aqueous ammonium solution | 175.5 ml |
| TAI | 600 mg |
| Distilled water added to make total quantity | 2608 ml |
| Solution C-3 | |
| $AgNO_3$ | 1671 g |
| 28% aqueous ammonium solution | 1363 ml |
| Distilled water added to make total quantity | 2810 ml |
| Solution D-3 | |
| Ossein gelatin | 50 g |
| KBr | 2082.5 g |
| TAI | 5.338 g |
| Distilled water added to make total quantity | 5000 ml |
| Solution E-3 | |
| Same as Solution E-1 | |
| Solution F-3 | |
| Same as Solution F-1 | |

At 40° C. 201 ml of Solution C-3 was added to Solution A-3 in one minute, wherein the other conditions were the same as those in Manufacturing Example 1.

PH, pAg and the flow rates are shown in Table 3.

This emulsion was designated EM-3.

Figure 3:
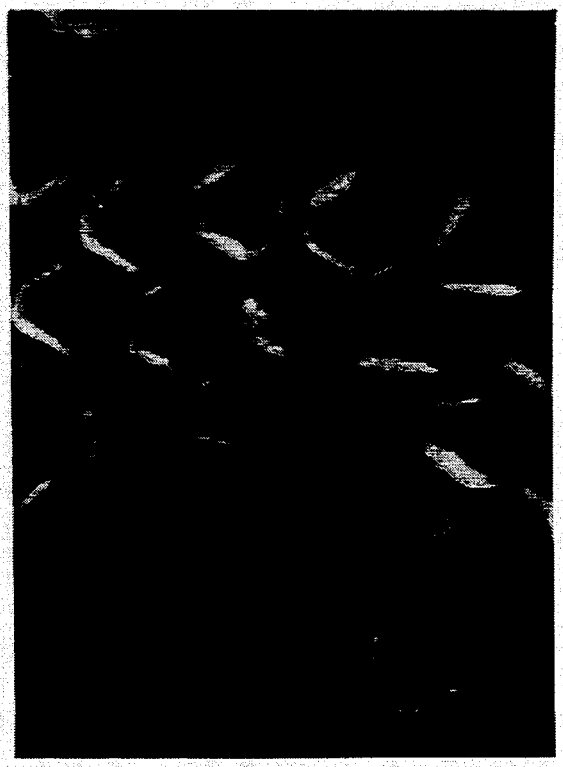

FIG. 3 is an electron micrograph of EM-3.

TABLE 3

| Grain growth conditions (EM-3) | | | | |
|---|---|---|---|---|
| Time | | | Addition rate of solution (ml/min.) | |
| (min.) | pH | pAg | Solution C-3 | Solution D-3 |
| 0 | 9.00 | 8.55 | 22.1 | 22.1 |
| 7.01 | 8.93 | 8.55 | 18.8 | 18.8 |
| 18.45 | 8.77 | 8.55 | 30.4 | 30.4 |
| 30.22 | 8.55 | 8.55 | 41.5 | 41.5 |
| 33.98 | 8.46 | 8.55 | 51.5 | 51.5 |
| 35.92 | 8.40 | 8.55 | 65.7 | 67.6 |

TABLE 3-continued

| Grain growth conditions (EM-3) | | | | |
|---|---|---|---|---|
| Time | | | Addition rate of solution (ml/min.) | |
| (min.) | pH | pAg | Solution C-3 | Solution D-3 |
| 38.19 | 8.31 | 9.04 | 77.4 | 84.3 |
| 39.60 | 8.25 | 9.38 | 83.7 | 97.2 |
| 41.64 | 8.18 | 9.79 | 55.8 | 82.7 |
| 44.07 | 8.11 | 10.12 | 38.7 | 79.5 |
| 44.83 | 8.10 | 10.20 | 35.6 | 36.4 |
| 61.76 | 7.80 | 10.20 | 30.4 | 31.1 |
| 82.4 | 7.50 | 10.20 | 24.5 | 25.1 |

Manufacturing Example 4

In a manner identical to that of Manufacturing Example 1, the Agx (core/shell type AgBrI) grains of the invention were prepared, wherein an average size was 2.0 μm, and an average I content was 6.54 mol %.

| | |
|---|---|
| Solution A-4 | |
| Ossein gelatin | 46.55 g |
| 10% ethanol solution of PRONON | 15 ml |
| KI | 107.5 g |
| Distilled water added to make total quantity | 6265 ml |
| Solution B-4 | |
| Seed emulsion N-3 (average grain size, 0.8 *m; AgBrI; average I content, 2 mol %) | equivalent to 0.6778 mole AgX |
| 56% aqueous acetic acid solution | 441 ml |
| 28% aqueous ammonium solution | 617 ml |
| TAI | 750 mg |
| Distilled water added to make total quantity | 5500 ml |
| Solution C-4 | |
| $AgNO_3$ | 1685 g |
| 28% aqueous ammonium solution | 1372 ml |
| Distilled water added to make total quantity | 2834 ml |
| Solution D-4 | |
| Ossein gelatin | 50 g |
| KBr | 2082.5 g |
| TAI | 4 g |
| Distilled water added to make total quantity | 5000 ml |
| Solution E-4 | |
| Same as Solution E-1 | |
| Solution F-4 | |
| Same as Solutioan F-1 | |

At 50° C., 185 ml of Solution C-4 was added to Solution A-4 in one minute, wherein the other conditions were the same as those in Manufacturing Example 1.

pH, pAg and the flow rates are shown in Table 4.

This emulsion was designated Em-4.

Figure 4:
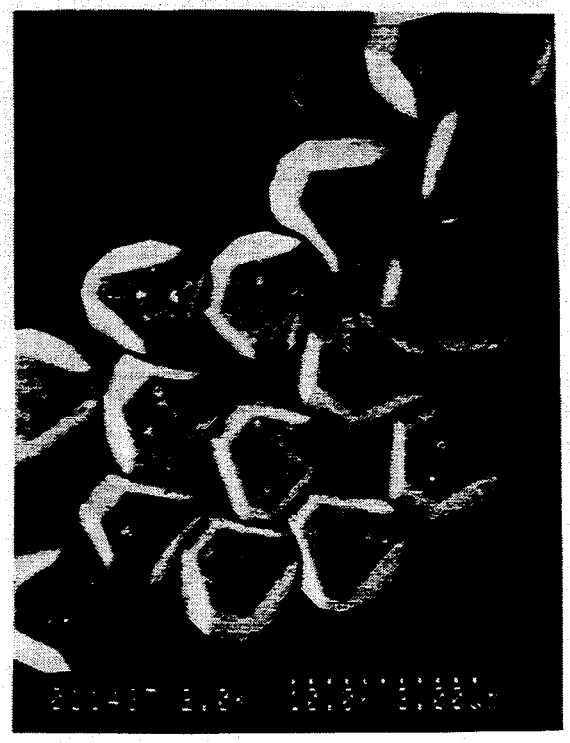

FIG. 4 is an electron micrograph of EM-4.

TABLE 4

| Grain growth conditions (EM-4) | | | | |
|---|---|---|---|---|
| Time | | | Addition rate of solution (ml/min.) | |
| (min.) | pH | pAg | Solution C-4 | Solution D-4 |
| 0 | 9.00 | 8.90 | 6.1 | 6.1 |
| 30.43 | 9.00 | 8.90 | 10.9 | 10.9 |
| 50.32 | 9.00 | 8.90 | 14.7 | 14.7 |
| 70.61 | 9.00 | 8.90 | 18.9 | 20.7 |
| 78.43 | 8.82 | 9.21 | 24.3 | 29.2 |
| 85.71 | 8.61 | 9.58 | 29.7 | 43.8 |
| 90.19 | 8.46 | 9.84 | 34.7 | 65.2 |
| 91.73 | 8.40 | 9.94 | 39.2 | 83.1 |
| 94.84 | 8.33 | 10.15 | 33.8 | 95.9 |
| 95.69 | 8.31 | 10.20 | 32.6 | 34.7 |
| 109.67 | 8.02 | 10.20 | 31.9 | 33.9 |
| 126.04 | 7.70 | 10.20 | 30.7 | 32.6 |
| 136.11 | 7.50 | 10.20 | 31.5 | 33.4 |

Manufacturing Example 5 (Comparative emulsion)

Using seven types of solution specified below, a silver bromoiodide emulsion (comparative) was prepared, wherein the emulsion comprised core/shell grains having an average size of 0.38 μm and an average I content of 8.46 mol %, and an individual grain had the I contents of 15 mol %, 5 mol %, and 3 mol % in an order from core

| | |
|---|---|
| Solution A-5 | |
| Ossein gelatin | 28.6 g |
| 10% ethanol solution of PRONON | 16.5 m |
| TAI | 247.5 mg |
| 56% aqueous acetic acid solution | 72.6 ml |
| 28% aqueous ammonium solution | 97.2 ml |
| Seed emulsion N-1 | equivalent to 0.1552 mole AgX |
| Distilled water added to make total quantity | 6600 ml |
| Solution B-5 | |
| Ossein gelatin | 13 g |
| KBr | 460.2 g |
| KI | 113.2 g |
| TAI | 665 mg |
| Distilled water added to make total quantity | 1300 ml |
| Solution C-5 | |
| Ossein gelatin | 17 g |
| KBr | 672.6 g |
| KI | 49.39 g |
| TAI | 870 mg |
| Distilled water added to make total quantity | 1700 ml |
| Solution D-5 | |
| Ossein gelatin | 8 g |
| KBr | 323.2 g |
| KI | 13.94 g |
| TAI | 409 mg |
| Distilled water added to make total quantity | 800 ml |
| Solution E-5 | |
| $AgNO_3$ | 1773.6 g |
| 28% aqueous ammonium solution | 1470 ml |
| Distilled water added to make total quantity | 2983 ml |
| Solution F-5 | |
| 20% aqueous KBr solution | amount needed for controlling pAg |
| Solution G-5 | |
| 56% aqueous acetic acid solution | amount needed for controlling pH |

Using a mixer same as in Manufacturing Example 1, Solutions E-5 and B-5 were simultaneously added to Solution A-5 by a double jet method, and upon termination of adding B-5, C-5 was added. Then, upon termination of adding C-5, D-5 was added. During adding, pAg, pH and the rates of adding Solutions E-5, B-5, C-5 and D-5 were controlled as specified in Table 5.

PAg and pH were controlled by changing the flow rates of Solutions F-5 and G-5 by a variable flow rate roller tube pump.

After addition of solution E-5 was complete, adjustment of pH and pAg, desalination, washing and redispersing were performed in a manner identical to that of Manufacturing Example 1.

This emulsion was designated EM-5.

TABLE 5

| Grain growth conditions (EM-5) | | | | | | |
|---|---|---|---|---|---|---|
| | | | Addition rate of solution (ml/min.) | | | |
| Time (min.) | pH | pAg | Solution E-5 | Solution B-5 | Solution C-5 | Solution D-5 |
| 0 | 9.00 | 8.55 | 9.8 | 9.3 | | |
| 7.85 | 8.08 | 8.55 | 30.7 | 29.2 | | |
| 11.80 | 8.63 | 8.55 | 44.9 | 42.7 | | |
| 17.33 | 8.25 | 8.55 | 61.4 | 58.4 | | |

TABLE 5-continued

| Grain growth conditions (EM-5) | | | | | | |
|---|---|---|---|---|---|---|
| | | | Addition rate of solution (ml/min.) | | | |
| Time (min.) | pH | pAg | Solution E-5 | Solution B-5 | Solution C-5 | Solution D-5 |
| 19.23 | 8.10 | 8.55 | 63.5 | 60.4 | | |
| 22.19 | 7.88 | 8.55 | 56.6 | 53.8 | | |
| 28.33 | 7.50 | 8.55 | 41.2 | 39.8 | 39.8 | |
| 36.61 | 7.50 | 9.38 | 31.9 | | 34.1 | |
| 40.44 | 7.50 | 9.71 | 30.6 | | 37.1 | |
| 45.14 | 7.50 | 10.12 | 34.6 | | 57.8 | |
| 45.97 | 7.50 | 10.20 | 37.3 | | 36.3 | |
| 57.61 | 7.50 | 10.20 | 57.3 | | 55.8 | 55.8 |
| 63.08 | 7.50 | 10.20 | 75.1 | | | 73.1 |
| 66.63 | 7.50 | 10.20 | 94.0 | | | 91.4 |

Manufacturing Example 6 (Comparative emulsion)

In a manner identical to that of Manufacturing Example 5, a silver bromoiodide emulsion (comparative) was prepared, wherein the emulsion comprised core/shell grains having an average size of 2.0 μm and an average I content of 6.54 mol %, an individual grain had the I contents of 15 mol %, 5 mol % and 0 mol % in an order from a core.

| | |
|---|---|
| Solution A-6 | |
| Ossein gelatin | 46.55 g |
| 10% ethanol solution of PRONON | 15 ml |
| TAI | 750 ml |
| 56% aqueous acetic acid solution | 441 ml |
| 28% aqueous ammonium solution | 703 ml |
| Seed emulsion N-3 | equivalent to 0.6778 mole AgX |
| Distilled water added to make total quantity | 12000 ml |
| Solution B-6 | |
| Ossein gelatin | 15 g |
| KBr | 520.5 g |
| KI | 130.7 g |
| TAI | 1.2 g |
| Distilled water added to make total quantity | 1500 ml |
| Solution C-6 | |
| Ossein gelatin | 20 g |
| KBr | 775.6 g |
| KI | 58.2 g |
| TAI | 1.6 g |
| Distilled water added to make total quantity | 2000 ml |
| Solution D-6 | |
| Ossein gelatin | 20 g |
| KBr | 814 g |
| TAI | 1.6 g |
| Distilled water added to make total quantity | 2000 ml |
| Solution E-6 | |
| $AgNO_3$ | 1575 g |
| 28% aqueous ammonium solution | 1283 ml |
| Distilled water added to make total quantity | 2648 ml |
| Solution F-6 | |
| Same as F-5 | |
| Solution G-6 | |
| Same as G-5 | |

An emulsion was prepared at 50° C. in the same conditions as those of Manufacturing Example 5, besides the grain growth conditions shown in Table 6.

This emulsion was designated Em-6.

TABLE 6

| Grain growth conditions (EM-6) | | | | | | |
|---|---|---|---|---|---|---|
| | | | Addition rate of solution (ml/min.) | | | |
| Time (min.) | pH | pAg | Solution E-6 | Solution B-6 | Solution C-6 | Solution D-6 |
| 0 | 9.00 | 8.90 | 6.1 | 6.1 | | |
| 30.4 | 9.00 | 8.90 | 10.9 | 10.9 | | |

TABLE 6-continued

| Grain growth conditions (EM-6) | | | | | | |
|---|---|---|---|---|---|---|
| | | | Addition rate of solution (ml/min.) | | | |
| Time (min.) | pH | pAg | Solution E-6 | Solution B-6 | Solution C-6 | Solution D-6 |
| 50.3 | 9.00 | 8.90 | 14.7 | 14.7 | | |
| 70.3 | 9.00 | 8.90 | 18.9 | 18.9 | 18.9 | |
| 78.4 | 8.82 | 9.21 | 24.3 | | 29.2 | |
| 85.7 | 8.61 | 9.58 | 29.7 | | 43.8 | |
| 90.2 | 8.46 | 9.84 | 34.7 | | 65.2 | |
| 91.7 | 8.40 | 9.94 | 39.2 | | 83.1 | |
| 94.8 | 8.33 | 10.15 | 33.8 | | 95.9 | |
| 95.7 | 8.31 | 10.20 | 32.6 | | 34.7 | |
| 109.7 | 8.02 | 10.20 | 31.9 | | 33.9 | 33.9 |
| 126.8 | 7.70 | 10.20 | 30.7 | | | 32.6 |
| 136.1 | 7.50 | 10.20 | 31.5 | | | 33.4 |

Manufacturing Example 7 (Comparative emulsion)

A silver bromoiodide emulsion (comparative) was prepared in the same manner as manufacturing Example 5, wherein the emulsion comprised the core/shell grains with an average size of 0.65 μm, and an average I content of 7.16 mol %, and an individual grain had the I contents of 15 mol %, 5 mol % and 3 mol % in an order from a core. This emulsion was designated EM-7

The seen emulsion used was N-2.

Manufacturing Example 8

Using four types of solution specified below, AgI grains were prepared.

| | |
|---|---|
| Solution A-8 | |
| Ossein gelatin | 242.6 g |
| 10% ethanol solution of PRONON | 14.6 ml |
| Sodium citrate | 18.2 g |
| KI | 56.2 g |
| Distilled water added to make total quantity | 4.85 lit. |
| $AgNO_3$ | 876 g |
| Solution B-8 | |
| Distilled water added to make total quantity | 1.47 lit. |
| Solution C-8 | |
| KI | 891.9 g |
| Distilled water added to make total quantity | 1.47 lit. |
| Solution D-8 | |
| $AgNO_3$ | 83.9 g |
| Distilled water added to make total quantity | 173 ml |

After Solution A-8 was poured into a reaction vessel and heated to 40° C., stirring by a propeller agitator, solutions B-8 and C-8 were added in 30 minutes to form the AgI grains having an average grain of approx. 0.045 μm.

Next, Solution D-8 was added to adjust pAg at 13. This emulsion was designated EM-8.

The suspension containing the AgI grains contained 0.709 mole of silver halide per liter.

Manufacturing Example 9

Using seven types of solution specified below, the core/shell type silver halide grains of the invention were prepared. The grains had an average grain size of 0.38 μm, and an average I content of 8.46 mol %.

| | |
|---|---|
| Solution A-9 | |
| Ossein gelatin | 28.77 g |
| 10% ethanol solution of PRONON | 16.5 ml |
| 0.5% aqueous TAI solution | 49.5 ml |
| Water added to make total quantity | 5582 ml |

-continued

| | |
|---|---|
| Solution B-9 | |
| Seed emulsion N-1 | equivalent to 0.1552 mole AgX |
| Sodium citrate | 1.692 g |
| Water added to make total quantity | 761 ml |
| Solution C-9 | |
| $AgNO_3$ | 1624 g |
| 28% aqueous ammonium solution | 1325 ml |
| Water added to make total quantity | 2731 ml |
| Solution D-9 | |
| Ossein gelatin | 30 g |
| KBr | 1249.5 g |
| 0.5% aqueous TAI solution | 507 ml |
| Water added to make total quantity | 3000 ml |
| Solution E-9 | |
| AgI suspension prepared in Manufacturing Example 8 (containing AgX equivalent to 0.8825 mole) | 1245 ml |
| Solution F-9 | |
| 20% aqueous KBr solution | amount needed for controlling pAg |
| Solution G-9 | |
| 56% aqueous acetic acid soltuion | amount needed for controlling pH |

After Solution B-9 was stirred at 50° C. for 60 minutes, it was added to Solution A-9 maintained at 40° C. stirring by the same stirrer as used in Manufacturing Example 1. Next, 97 mol of 28% aqueous ammonium solution and 72.6 ml of 56% aqueous acetic acid Solution were added, and then, using Solutions F-9 and G-9, pH and pAg were adjusted to 9.0 and 8.55, respectively. Next Solutions C-9 and D-9 were added by a double-jet method, while controlling pAg, pH, and the flow rate of C-9 and D-9 as specified in Table 7.

Meanwhile, Solution E-9 was added, while controlling the flow rates as shown in Table 7. pAg and pH was controlled by F-9 and G-9 in the same manner as in Manufacturing Example 1.

After pAg and pH were adjusted as in Manufacturing Example 1, desalination, washing and dispersing were performed, and the total quantity was adjusted to 3000 ml. This emulsion was designated Em-9.

Figure 5:
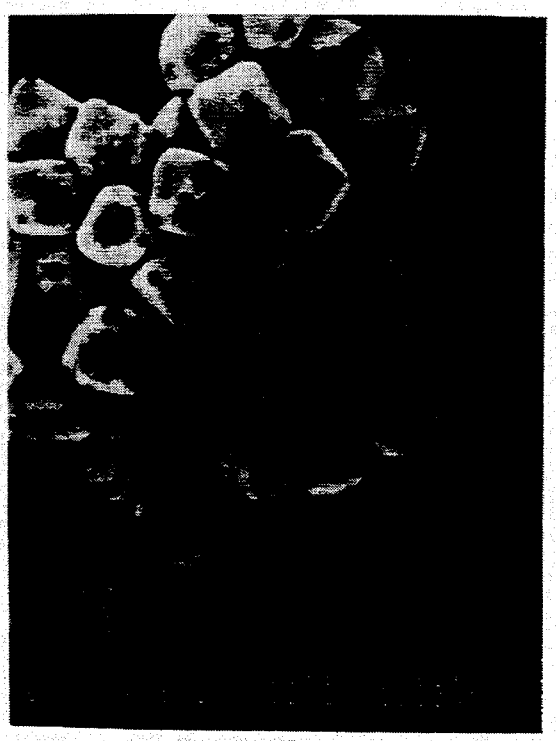

FIG. 5 is an electron micrograph of EM-9.

TABLE 7

| Grain growth conditions (EM-9) | | | | | |
|---|---|---|---|---|---|
| Time (min.) Solution C-9 | | Time (min.) Solution D-9 Flow rate (ml/min.) | | Time (min.) Solution E-9 Flow rate (ml/min.) | |
| 0.0 | 6 54 | 0.0 | 6.22 | | |
| 3.26 | 10.73 | 2.06 | 8.45 | | |
| 5.36 | 14.35 | 9.16 | 22.25 | 2.06 | 2.2 |
| 14.82 | 36.67 | 19.45 | 40.05 | | |
| 17.66 | 41.45 | 21.10 | 37.76 | 4.28 | 30.9 |
| 19.55 | 41.90 | 36.65 | 22.51 | 6.18 | 40.9 |
| 28.32 | 27.34 | 38.93 | 23.13 | 8.08 | 50.9 |
| 33.75 | 22.69 | 45.69 | 40.28 | 10.13 | 62.9 |
| 38.74 | 20.49 | 46.02 | 24.19 | 12.10 | 74.5 |
| 42.62 | 20.64 | 59.65 | 40.71 | 13.00 | 79.3 |
| 44.29 | 21.78 | 62.73 | 47.64 | 14.00 | 85.3 |
| 54.91 | 33.94 | 65.22 | 55.20 | 15.25 | 91.8 |
| 60.31 | 43.07 | 65.70 | 56.98 | | |
| 65.70 | 58.58 | 66.70 | 56.98 | 17.16 | 10.0 |
| 66.70 | 58.58 | | | | |

| Time (min.) pAg | | Time (min.) pH | |
|---|---|---|---|
| 0.0 | 8.55 | 0.0 | 9.00 |
| 28.36 | 8.55 | 2.48 | 8.96 |
| 32.39 | 8.98 | 5.93 | 8.88 |
| 37.20 | 9.42 | 10.13 | 8.72 |
| 42.40 | 9.87 | 15.46 | 8.39 |
| 45.01 | 10.10 | 21.00 | 7.96 |

TABLE 7-continued

| Grain growth conditions (EM-9) | | | |
|---|---|---|---|
| 46.01 | 10.20 | 25.79 | 7.64 |
| 66.68 | 10.20 | 28.37 | 7.50 |
| | | 66.68 | 7.50 |

Manufacturing Example 10

An emulstion was prepared in a manner identical to that of Manufacturing Example 9, except that Solution E-9 was added in one minute, following two minutes after starting of addition of Solution C-9.

This emulsion was designated EM-10.

Manufacturing Example 11

Using seven types of solution specified below, the core/shell type silver halide grains of the invention were prepared. The grains had an average size of 2.0 μm and an average I content of 6.54% mol %.

| | |
|---|---|
| Solution A-11 | |
| Ossein gelatin | 46.55 g |
| 10% ethanol solution of PRONON | 15 ml |
| Seed emulsion N-3 | amount equivalent to 0.6778 mole AgX |
| 56% aqueous acetic acid solution | 441 ml |
| 28% aqueous ammonium solution | 617 ml |
| 0.5% aqueous TAI solution | 150 ml |
| Distilled water added to make total quantity | 12 lit. |
| Solution B-11 | |
| $AgNO_3$ | 1575 g |
| 28% aqueous ammonium solution | 1283 ml |
| Distilled water added to make total quantity | 2648 ml |
| Solution C-11 | |
| Ossein gelatin | 50 g |
| KBr | 2082.5 g |
| 0.5% TAI solution | 4 g |
| Distilled water added to make total quantity | 5000 ml |
| Solution D-11 | |
| AgI suspension prepared in Manufacturing Example 8 (containing AgX equivalent to 0.647 mole) | 913 ml |
| Solution E-11 | |
| 20% aqueous KBr solution | amount needed for controlling pH |
| Solution G-11 | |
| 56% aqueous acetic acid solution | amount needed for controlling pAg |

Solution E-11 and G-11 were added to Solution A-11 maintained at 50° C. stirring by the same stirrer as used in Manufacturing Example 1 to adjust pH and PAg to 9.0 and 8.9, respectively. Next, Solutions B-11 and C-11 were added by a double jet method, while controlling pH, pAg, and the flow rates of B-11 and C-11 as specified in Table 8.

Solution D-11 was added while controlling the flow rate as shown in Table 8 and pH and pAg was controlled by E-11 and G-11 in the same manner as in Manufacturing Example 1.

After pAg, and pH were adjusted as in Manufacturing Example 1, desalination, washing and dispersing were performed, and the total amount was adjsuted to 3000 ml.

Figure 6:
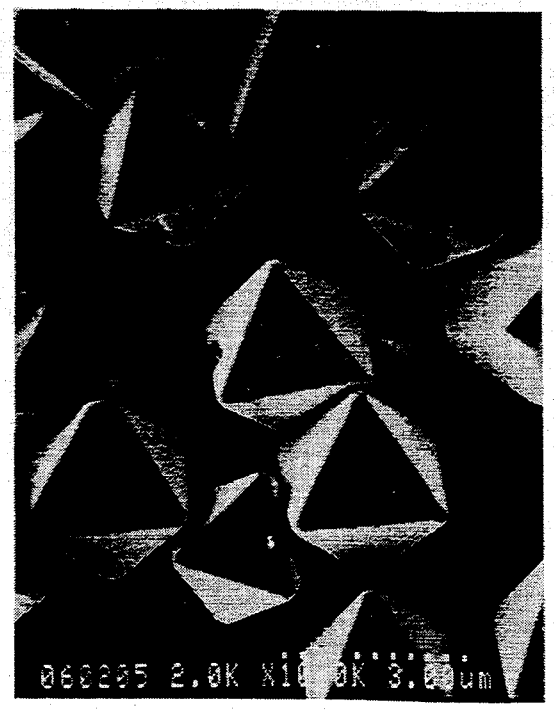
FIG. 6 is an electron micrograph of comparison grains.

This emulsion was designated EM-11. FIG. 6 is an electron micrograph of EM-11.

TABLE 8

| Grain growth conditions (EM-11) | | | | | |
|---|---|---|---|---|---|
| Time (min.) | flow | Time (min.) | flow | Time (min.) | flow |
| | rate of Solution B-11 (ml/min.) | | rate of Solution C-11 (ml/min.) | | rate of Solution D-11 (ml/min.) |
| 0.0 | 5.2113 | 0.0 | 5.2357 | 0.0 | 4.4860 |
| 22.1 | 7.9061 | 22.1 | 7.7449 | 22.1 | 6.8095 |
| 35.6 | 9.9313 | 69.4 | 15.6195 | 35.6 | 8.5528 |
| 69.4 | 15.7444 | 70.7 | 19.7068 | 69.4 | 13.5569 |
| 70.7 | 17.9139 | 77.40 | 25.8352 | 70.7 | 4.5817 |
| 72.1 | 18.9060 | 84.2 | 36.3375 | 73.5 | 5.0593 |
| 88.3 | 27.6167 | 88.3 | 46.8139 | 78.7 | 5.7139 |
| 91.0 | 30.8748 | 90.2 | 56.0684 | 82.1 | 6.3485 |
| 92.7 | 34.9538 | 92.7 | 78.8470 | 87.3 | 6.9010 |
| 96.9 | 28.8917 | 96.0 | 91.4597 | 90.2 | 7.5611 |
| 111.8 | 28.5231 | 96.9 | 30.7331 | 91.9 | 8.3604 |
| 112.7 | 29.9769 | 111.8 | 30.3826 | 92.7 | 8.9565 |
| 127.0 | 29.5860 | 112.7 | 31.6514 | 95.1 | 7.9554 |
| 137.4 | 30.5073 | 137.4 | 32.4166 | 96.9 | 7.4001 |
| 139.3 | 30.8073 | 139.3 | 32.4166 | 111.8 | 7.3320 |
| Time (min.) | pH | Time (min.) | pAg | | |
| 0.0 | 9.0000 | 0.0 | 8.9000 | | |
| 70.7 | 9.0000 | 70.7 | 8.9000 | | |
| 72.1 | 8.9700 | 72.1 | 8.9520 | | |
| 73.5 | 8.9400 | 73.5 | 9.0040 | | |
| 74.9 | 8.9100 | 74.9 | 9.0560 | | |
| 76.2 | 8.8800 | 76.2 | 9.1080 | | |
| 77.4 | 8.8500 | 77.4 | 9.1600 | | |
| 78.7 | 8.8200 | 78.7 | 9.2120 | | |
| 79.8 | 8.7900 | 79.8 | 9.2640 | | |
| 81.0 | 8.7600 | 81.0 | 9.3160 | | |
| 82.1 | 8.7300 | 82.1 | 9.3680 | | |
| 83.2 | 8.7000 | 83.2 | 9.4200 | | |
| 85.3 | 8.6400 | 84.2 | 9.4720 | | |
| 87.3 | 8.5800 | 85.3 | 9.5240 | | |
| 88.3 | 8.5500 | 86.3 | 9.5760 | | |
| 89.2 | 8.5200 | 87.3 | 9.6280 | | |
| 90.2 | 8.4900 | 88.3 | 9.6800 | | |
| 91.0 | 8.4600 | 89.2 | 9.7320 | | |
| 91.9 | 8.4300 | 90.2 | 9.7840 | | |
| 92.7 | 8.4000 | 91.0 | 9.8360 | | |
| 94.3 | 8.3640 | 91.9 | 9.8880 | | |
| 95.1 | 8.3460 | 92.7 | 9.9400 | | |
| 96.9 | 8.3100 | 93.5 | 9.9920 | | |
| 106.2 | 8.1300 | 94.3 | 10.0440 | | |
| 111.8 | 8.0220 | 95.1 | 10.0960 | | |
| 112.7 | 8.0040 | 96.0 | 10.1480 | | |
| 118.4 | 7.8960 | 96.9 | 10.2000 | | |
| 131.8 | 7.6440 | 139.2 | 10.2000 | | |
| 135.5 | 7.5720 | | | | |
| 139.2 | 7.5000 | | | | |

Manufacturing Example 12 (Comparative emulsion)

In a manner identical to that of Manufacturing Example 5, a silver bromoiodide emulsion was prepared, wherein the emulsion comprised the core/shell grains with an average size of 0.27 μm, and an average I content of 8.46 mol %. An individual grain had I contents of 3 mol %, 5 mol % and 15 mol % in an orders from an outermost shell. The seed emulsion was N-1. This emulsion was designated EM-12.

Manufacturing Example 13

Using the following solutions, a silver bromoiodide emulsion (comparative) was prepared, wherein the emulsion comprised the grains with an average size of 0.38 μm and an average I content of 2 mol %, and an I content was uniformly distributed in the individual silver halide grains.

| | |
|---|---|
| Solution A-13 | |
| Ossein gelatin | 28.6 g |
| 10% ethanol solution of PRONON | 16.5 ml |
| TAI | 247.5 mg |

-continued

| | |
|---|---|
| 56% aqueous acetic acid solution | 72.6 ml |
| 28% aqueous ammonium solution | 97.2 ml |
| Seed emulsion N-1 | equivalent to 0.1552 mole AgX |
| Distilled water added to make total quantity | 6600 ml |
| Solution B-13 | |
| Ossein gelatin | 38.0 g |
| KBr | 1551.0 g |
| KI | 44.2 g |
| TAI | 1944 mg |
| Distilled water added to make total quantity | 3800 ml |
| Solution C-13 | |
| $AgNO_3$ | 1773.6 g |
| 28% aqueous ammonium solution | 1470 ml |
| Distilled water added to make total quantity | 2983 ml |
| Solution D-13 | |
| 20% aqueous KBr solution | amount needed for controlling pAg |
| Solution E-13 | |
| 56% aqueous acetic acid solution | amount needed for controlling pH |

Using the same mixer as in Manufacturing Example 1, Solution B-13 and C-13 were simultaneously added to Solution A-13 by a double jet method at 40° C. During addition, pAg, pH and the flow rates of Solutions B-13 and C-13 were controlled as shown in Table 9.

pAg and pH were controlled by changing the flow rates of Solutions D-13 and E-13 by a variable flow rate roller tube pump.

After addition of solution C-13 was completed adjustment of pH and pAg, desalination, washing and redispersing were performed in a manner identical to that of Manufacturing Example 1. This emulsion was designated EM-13.

TABLE 9

| Grain growth conditions (EM-13) | | | | |
|---|---|---|---|---|
| | | | Addition rate of solution (ml/min.) | |
| Time (min.) | pH | pAg | Solution C-13 | Solution B-13 |
| 0 | 9.00 | 8.55 | 9.8 | 9.3 |
| 7.85 | 8.81 | 8.55 | 30.7 | 29.2 |
| 11.80 | 8.63 | 8.55 | 44.9 | 42.7 |
| 17.33 | 8.25 | 8.55 | 61.4 | 58.4 |
| 19.23 | 8.10 | 8.55 | 63.5 | 60.4 |
| 22.19 | 7.88 | 8.55 | 56.6 | 53.8 |
| 28.33 | 7.50 | 8.55 | 41.2 | 39.8 |
| 36.61 | 7.50 | 9.38 | 31.9 | 34.1 |
| 40.44 | 7.50 | 9.71 | 30.6 | 37.1 |
| 45.14 | 7.50 | 10.12 | 34.6 | 57.8 |
| 45.97 | 7.50 | 10.22 | 37.3 | 36.3 |
| 57.61 | 7.50 | 10.20 | 57.3 | 55.8 |
| 63.08 | 7.50 | 10.20 | 75.1 | 73.1 |
| 66.63 | 7.50 | 10.20 | 94.0 | 91.4 |

Manufacturing Example 14 (Comparative emulsion)

A monodispersed AgBrI emulsion was prepared in the same manner as manufacturing Example 13, wherein the emulsion comprised the grains with an average size of 0.27 μm and an average I content of 8.46 mol %, and an I content was uniformly distributed in the individual silver halide grains. The seed emulsion was N-1. This emulsion was designated EM-14.

Manufacturing Example 15

A monodispersed AgBrI emulsion was prepared in same manner as Manufacturing Example 13, wherein the emulsion comprised the grains with an average size of 0.65 μm, and an average I content of 2 mol %, and an I content was uniformly distributed in the individual silver halide grains. The seed emulsion used was N-1. This emulsion was designated EM-15.

Manufacturing Example 16 (Comparative emulsion)

A silver bromoiodide emulsion (comparative) was prepared in the same manner as Manufacturing Example 12, wherein the emulsion comprised the core/shell grains with an average size of 0.65 μm, and an average I content of 7.16 mol %, and the individual grains had the I contents of 15 mol %, 5 mol %, and 3 mol % in an order from a core. This emulsion was designated EM-16.

The seed emulsion was N-1.

Manufacturing Example 17 (Comparative emulsion)

A monodispersed AgBrI emulsion was prepared in the same manner as Manufacturing Example 13, wherein an average AgI content was 2 mol % and an average grain size was 0.27 μm. An I content was uniformly distributed in the individual grains. The seed emulsion was N-1.

This emulsion was designated EM-17.

Manufacturing Example 18 (Comparative emulsion)

A AgBrI emulsion was prepared in the same manner as Manufacturing Example 13, wherein an average I content was 2 mol % and an average grain size was 0.65 μm. An I content was uniformly distributed in the individual grains. This was designated EM-18.

The seed emulsion was N-2.

Manufacturing Example 19

A monodispersed AgBrI emulsion was prepared in the same manner as Manufacturing Example 17, wherein an average I content was 2 mol %, an average grain size was 2.0 μm. An I content was uniformly distributed in the individual grains. This emulsion was designated EM-19.

Manufacturing Example 20

Emulsions EM-20 and -21 were prepared in the manner identical to that of Manufacturing Example 1, except that the seed emulsion N-1 used for Manufacturing Example 1 was replaced with N-4 and N-5.

Manufacturing Example 21

A silver iodobromide emulsion EM-22 was prepared in the same manner as Manufacturing Example 13, wherein an average I content was 2 mol % and an average grain size was 0.48 μm. The seed emulsion was N-1.

Manufacturing Example 22

Emulsion EM-23 was prepared in the manner identical to that of Preparation Example 1, except that the seed emulsion used for Manufacturing Example 1 was replaced with an emulsion of N-1 and N-4 blended at a mole ratio of 1:1.

Table 10 summarizes the data of EM-1 through EM-23.

TABLE 10

| EM-No. | Average size μm | Average I content mol % | Seed emulsion | AgI distribution | Remark |
|---|---|---|---|---|---|
| EM-1 | 0.38 | 8.46 | N-1 | * | ○ |
| EM-2 | 0.27 | 8.46 | N-1 | * | ○ |
| EM-3 | 0.65 | 7.16 | N-2 | * | ○ |
| EM-4 | 2.0 | 6.54 | N-3 | * | ○ |
| EM-5 | 0.38 | 8.46 | N-1 | 15:5:3 | x |

TABLE 10-continued

| EM-No. | Average size μm | Average I content mol % | Seed emulsion | AgI distribution | Remark |
|---|---|---|---|---|---|
| EM-6 | 2.0 | 6.54 | N-3 | 15:5:0 | x |
| EM-7 | 0.65 | 7.16 | N-2 | 15:5:3 | x |
| EM-8 | 0.045 | 100 | — | | — |
| EM-9 | 0.38 | 8.46 | N-1 | * | ○ |
| EM-10 | 1.11 | 6.54 | N-3 | * | ○ |
| EM-11 | 2.0 | 6.54 | N-3 | 15:5:0 | ○ |
| EM-12 | 0.27 | 8.46 | N-1 | 15:5:3 | x |
| EM-13 | 0.38 | 2 | N-1 | Uniform | x |
| EM-14 | 0.27 | 8.46 | N-1 | Uniform | x |
| EM-15 | 0.65 | 2 | N-1 | Uniform | x |
| EM-16 | 0.65 | 7.16 | N-1 | 15:5:3 | x |
| EM-17 | 0.27 | 2 | N-1 | Uniform | x |
| EM-18 | 0.65 | 2 | N-2 | Uniform | x |
| EM-19 | 2 | 2 | N-1 | Uniform | x |
| EM-20 | 0.38 | 8.46 | N-4 | * | ○ |
| EM-21 | 0.38 | 8.46 | N-5 | * | ○ |
| EM-22 | 0.48 | 2 | N-1 | Uniform | x |
| EM-23 | 0.38 | 8.46 | N-1,4 | * | ○ |

○: Invention
x: Comparison
*X-ray diffraction analysis revealed the presence of a high I phase containing 30 to 40 mol % I.

EXAMPLE 1

Each of EM-1, EM-5 and EM-13 was subjected to gold/sulfur sensitization, and, then to spectral sensitization by adding the sensitizing dyes as specified in Table 11. Next, each emulsion was stabilized by addition of TAI and 1-phenyl-5-mercaptotetrazole. To each emulsion were added the conventional photographic additives such as a spreading, agent, a hardener etc. to prepare a coating solution. Using a conventional method, the coating solution was coated and dried on a subbed film base to prepare the respective samples.

Each of the preceding samples was evaluated in adsorbability of sensitizing dye as follows;

Each sample was divided into two pieces, one of which was allowed to stand in a refrigerator and the other, at the conditions of 50° C. and 80% RH, respectively for 2 days.

A transmission density of each sample was evaluated by a spectrophotometer, and an amount of a sensitizing dye desorbed at 50° C. and 80% RH was determined.

The degree of desorbability (Q) of sensitizing dye was determined by the following equation:

$$Q=(1-D_1/D_0)\times 100$$

where;

$D_0$: transmission density at max of a sample stored in the refrigerator $D_1$: transmission density at λmax of a sample allowed to stand at 50° C., 80% RH.

The data of each sample are summarized in Table 11.

A value of desorbability summarized in Table 11 is the relative value to those of Sample No. 1-1 for Sample No. 1-2 and 1-3, Sample No. 1-4 for Sample No. 1-5, Sample No. 1-6, for Sample No. 1-7 and Sample No. 1-8 for Sample No. 1-9.

TABLE 11

| Sample | Emulsion No. | Sensitizing dye (mg/mol Ag X) | Sensitizing dye (mg/mol Ag X) | Desorbability | Remark |
|---|---|---|---|---|---|
| 1-1 | EM-13 | B-101 (550) | B-102 (340) | 100 | x |
| 1-2 | EM-5 | B-101 (550) | B-102 (340) | 86 | x |
| 1-3 | EM-1 | B-101 (550) | B-102 (340) | 60 | ○ |
| 1-4 | EM-5 | B-101 (550) | — | 100 | x |
| 1-5 | EM-1 | B-101 (550) | — | 68 | ○ |
| 1-6 | EM-5 | A-3 (550) | — | 100 | x |
| 1-7 | EM-1 | A-3 (550) | — | 56 | ○ |
| 1-8 | EM-13 | A-3 (550) | A-2 (340) | 100 | x |
| 1-9 | EM-1 | A-3 (550) | A-2 (340) | 48 | ○ |

As can be found from the data in Table 11, the samples containing Em-1 of the invention are remarkably superior in desorbability of a sensitizing dye to those of the comparative emulsion (EM-5 and EM-13) containing the same sensitizing dyes as the samples of the invention, and, the samples containing the sensitizing dyes represented by the preceding Formula [A] were especially superior.

B-101

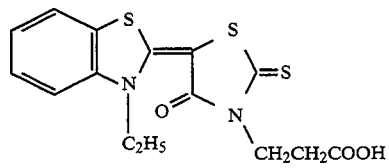

B-102

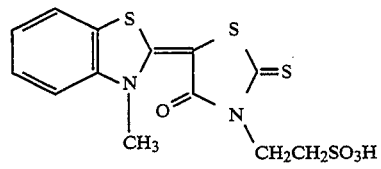

EXAMPLE 2

Each of EM-1 and EM-5 was subjected to gold/sulfur sensitization, and then to blue-spectral sensitization by adding 350 mg of each sensitizing dye (A-9) and sensitizing dye (A-3) per mol Ag. Next, TAI and 1-phenyl-5-mercaptotetrazole were added the for stablization. To each emulsion were added the conventional photographic additives such as a spreading agent a hardener etc. to prepare a coating solution. Using a conventional method, each coating solution was coated and dried on a subbed film base to prepare sample Nos. 2-1 and 2-2.

The yellow coupler shown in Table 12 was dissolved in a mixture solvent comprising ethyl acetate and dioctyl phthalate (DOP) of weight equal to that of the coupler, and the mixture was emulsified in an aqueous gelatin solution. Then, the emulsion was added to each of EM-1 and EM-5, which were respectively coated and dried in the same manner as the preceding samples to obtain Sample Nos. 2-3 and 2-4.

Each sample was subjected to wedge-exposure via a blue-filter. Then, Sample Nos. 2-1 and 2-2 were subjected to a 90 seconds processing by the automatic developing machine Model KX-500 (Konica Corporation) using the following processing solutions, in the following processing (I).

The samples allowed to stand for 2 days in an atmosphere of 50° C. and 80% RH were exposed, developed and stored for 2 days, and then evaluated likewise.

| Processing (I) | | |
|---|---|---|
| Developing | 25 sec. | 35° C. |
| Fixing | 25 sec. | |
| Washing | 25 sec. | |
| Drying | 15 sec. | |

The compositions of the processing solutions used in the respective processing steps are as follows:

| Developing Solution | |
|---|---|
| Potassium sulfite | 55.0 g |
| Hydroquinone | 25.0 g |
| 1-phenyl-3-pyrazolydone | 1.2 g |
| Boric acid | 10.0 g |
| Sodium hydroxide | 21.0 g |
| Triethylyne glycol | 17.5 g |
| 5-methylbenzotriazole | 0.07 g |
| 5-nitroindazole | 0.14 g |
| 1-phenyl-5-mercaptotetrazole | 0.015 g |
| Glutaraldehyde hydro bisulfite | 15.0 g |
| Glacial acetic acid | 16.0 g |
| Potassium bromide | 4.0 g |
| Triethylenetetraminehexaacetic acid | 2.5 g |

Water was added to make total quantity 1 liter, and pH was adjusted to 10.20.

| Fixing Solution | |
|---|---|
| Disodium ethylenediaminetetraacetate | 5.0 g |
| Tartaric acid | 3.0 g |
| Ammonium thiosulfate | 130.9 g |
| Sodium sulfite anhydride | 7.3 g |
| Boric acid | 7.0 g |
| Acetic acid (90 wt %) | 5.5 g |
| Sodium acetate trihydrate | 25.8 g |
| Aluminum sulfate; $18H_2O$ | 14.6 g |
| Sulfuric acid (50 wt %) | 6.77 g |

Water was added to make total quantity 1 liter, and pH was adjusted to 4.20.

Sample Nos. 2-3 and 2-4 were exposed likewise, and subjected to the following processing (II).

The samples allowed to stand for 2 days at 50° C. and 80% RH were processed likewise, and evaluated.

| Processing (II) 38° C. | |
|---|---|
| Color developing | 3 min. 15 sec. |
| Bleaching | 6 min. 30 sec. |
| Washing | 3 min. 15 sec. |
| Fixing | 6 min. 30 sec. |
| Washing | 3 min. 15 sec. |
| Stabilizing | 1 min. 30 sec. |
| Drying | |

The compositions of the processing solutions used in the respective processing steps are as follows.

| Color developing solution | |
|---|---|
| 4-amino-3-methyl-N-ethyl-N-(β-hydroxyethyl)-aniline sulfate | 4.75 g |
| Sodium sulfite anhydride | 4.25 g |
| Hydroxyl amine.½ sulfate | 2.0 g |
| Potassium carbonate anhydride | 37.5 g |
| Potassium bromide | 1.3 g |
| Trisodium nitrilotriacetate (monohydrate) | 2.5 g |
| Potassium hydroxide | 1.0 g |
| Water was added to make total quantity 1 liter. | |
| Bleaching solution | |
| Ferric ammonium ethylenediaminetetraacetate | 100.0 g |
| Diammonium ethylenediaminetetraacetate | 10.0 g |
| Potassium bromide | 150.0 g |
| Glacial acetic acid | 10.0 g |

Water was added to make total quantity 1 liter, and pH was adjusted to 6.0 using aqueous ammonium solution.

| Fixing solution | |
|---|---|
| Ammonium thiosulfate | 175.0 g |
| Ammonium sulfite anhydride | 8.6 g |
| Sodium metasulfite | 2.3 g |

Water was added to make total quantity 1 liter, and pH was adjusted to 6.0 using acetic acid.

| Stabilizing solution | |
|---|---|
| Formalin (37% aqueous solution) | 1.5 ml |
| Konidax (Konica Corporation) | 7.5 ml |

Water was added to make total quantity 1 liter.

The sensitivity, maximum density(Dmax), graininess and storage stability of each sample were evaluated.

The evaluation results are summarized in Table 12.

TABLE 12

| Sample No. | Emulsion No. | Coupler (mol %/mol AgX) | Instant processing Dmax | Instant processing Relative sensitivity ($S_1$) | Processing after 2 day-standing at 50° C./80% RH Relative sensitivity ($S_1$) Blue filter | Remark |
|---|---|---|---|---|---|---|
| 2-1 | EM-1 | — | 114 | 120 | 112 | ○ |
| 2-2 | EM-5 | — | 100 | 100 | 100 | x |
| 2-3 | EM-1 | Y4-9 (20.0) | 122 | 130 | 225 | ○ |
| 2-4 | EM-5 | Y4-9 (20.0) | 100 | 100 | 100 | x |

○: Invention
x: Comparison

Sensitivity values in Table 12 are expressed by the inverses of exposure corresponding to fog densities +0.1 in the samples either containing or not containing a coupler, and are the relative sensitivity values ($S_1$) to those of sample Nos. 2-2 and 2-4, which are set at 100.

Dmax values are the relative Dmax values to those of samples Nos. 2-2 and 2-4, which are set at 100.

As can be found from Table 12, the samples containing the emulsion of the invention (EM-1) are superior to those containing comparative emulsion (EM-5) in sensitivity in either instant after-storage processing and in Dmax. The sample containing a coupler was especially advantageous. The effect of the invention was also observed in the samples containing Y-23 or $Y_4$-14 instead of $Y_4$-9.

Graininess was evaluated by visual observation on photographic prints where each sample was enlarged 10 times, and sample Nos. 2-2 and 2-3 were found superior to sample Nos. 2-1 and 2-4.

The preceding effect was observed on each of the samples, wherein the amounts of sensitizing agent (A-9) and (A-3) were decreased to 60 wt % in Sample Nos. 2-1 and 2-3.

EXAMPLE 3

In the manner identical to that of Example 2, EM-3 and EM-7 were subjected to chemical and spectral sensitizations to prepare green-sensitive emulsions. To some of the emulsions were added magenta couplers dissolved in equivalent weight of DOP. Thus, sample Nos. 3-1 through 3-6 were prepared. Sensitizing dyes (A-18) and (A-34) were added by 300 mg and 30 mg per mol of Ag, respectively, for spectral sensitization.

Each of the samples was subjected to exposing and developing in the same manner as Example 2, wherein exposure was performed via a yellow filter. Sample Nos. 3-1 and 3-2 were processed by Processing (I) in Example 2; Sample Nos. 3-3 through 3-6 by Processing (II) in Example 2.

The results are summarized in Table 13. The sensitivities and Dmax of the samples containing no couplers are the relative values ($S_1$) and Dmax to those of Sample No. 3-2, and the sensitivities and Dmax of the samples containing couplers to those of Sample Nos. 3-4 and 3-6, which are set at 100, respectively.

TABLE 13

| Sample No. | Emulsion No. | Coupler (mol %/mol AgX) | Instant processing Dmax | Instant processing Relative sensitivity ($S_1$) | Processing after 2 day-standing at 50° C./80% RH Relative sensitivity ($S_1$) | Remark |
|---|---|---|---|---|---|---|
| 3-1 | EM-3 | — | 113 | 140 | 131 | ○ |
| 3-2 | EM-7 | — | 100 | 100 | 100 | x |
| 3-3 | EM-3 | M-2 (17.0) | 125 | 150 | 236 | ○ |
| 3-4 | EM-3 | M4-3 (17.0) | 100 | 147 | 278 | ○ |
| 3-5 | EM-7 | M-2 (17.0) | 127 | 100 | 100 | x |
| 3-6 | EM-7 | M1-3 (17.0) | 100 | 100 | 100 | x |

○: Invention
x: Comparison

As can e found from the results in Table 13, the sensitivities, Dmax and storage stability are improved to a large extent in the samples containing EM-3 of the invention and especially in the samples containing a coupler. Graininess was evaluated by the same method as Example 2 and sample Nos. 3-1, 3-13 and 3-6 were superior to samples Nos. 3-2, 3-4 and 3-5, respectively.

EXAMPLE 4

In the manner identical to that of Example 2, EM-4 and EM-6 were subjected to chemical sensitization, and then to spectralred sensitization by adding sensitizing dyes (A-57) and (A-56) by 20 mg and 2mg, respectively. To some of these emulsions was added a cyan coupler specified in Table 14 (dissolved in an equivalent weight of DOP) to prepare the samples. Each sample was subjected to exposing and developing in the same manner as Example 3. Sample Nos. 4-1 to 4-4 were developed by Processing (I) shown in Example 2 and the photographic densities were evaluated. The sensitivities and Dmax of Sample Nos. 4-1 and 4-3 are the relative sensitivity values ($S_1$) and Dmax to those of Sample Nos. 4-2 and 4-4, which are set at 100, respectively.

Table 14 summarizes the evaluation results.

TABLE 14

| Sample No. | Emulsion No. | Coupler (mol %/mol AgX) | Instant processing Dmax | Instant processing Relative sensitivity ($S_1$) | Processing after 2 day-standing at 50° C./80% RH Relative sensitivity ($S_1$) | Remark |
|---|---|---|---|---|---|---|
| 4-1 | EM-4 | — | 111 | 120 | 116 | ○ |
| 4-2 | EM-6 | — | 100 | 100 | 100 | x |
| 4-3 | EM-4 | C-8 (8.4) | 119 | 130 | 233 | ○ |
| 4-4 | EM-6 | C-8 (8.4) | 100 | 100 | 100 | x |

○: Invention
x: Comparison

It is apparent from the results in this table that the samples containing Emulsion EM-4 of the invention are remarkably improved in sensitivity, regardless of before or after storage, and Dmax before storage, and that the sensitivity of the sample containing a coupler is further improved to a large extent. Graininess was evaluated by the same method as Example 2 and Sample Nos. 4-1 and 4-3 were superior to Sample Nos. 4-2 and 4-4, respectively.

The effect on the invention was observed in each of the samples, wherein 50 mg of sensitizing dye (A-57) and 27 mg of sensitizing dye ( 56 ) each per mol of AgX were added to Sample Nos. 4-1 and 4 -3.

EXAMPLE 5

EM-1, EM-5, EM-9 and EM-10 were subjected to gold/sulfur sensitization, and then, to spectral green-sensitization by adding sensitizing dye (A-22) and (A-34) by 550 mg and 340 mg per tool Ag, respectively. Next, each emulsion was stabilized with TAI and 1-phenyl-5-methylmercaptotetrazole.

Magenta Coupler ($M_4$-4) dissolved in a mixture solvent of ethyl acetate and dinonyl phthalate (DNP), was dispersed in an aqueous gelatin solution. Then, the conventional photographic additives such as a spreading agent, a hardener etc. were added to each of the preceding emulsions to prepare the coating solutions. Each of the coating solutions was coated and dried on a subbed film base by a conventional method. Thus, Sample Nos. 5-1 through 5-4 were prepared.

The coated amounts of the respective components per square meter are shown below.

| | |
|---|---|
| Emulsion (converted to silver amount) | 1 g |
| Magenta Coupler ($M_4$-4) | 0.4 g |
| DNP | 0.4 g |
| Gelatin | 0.12 g |

Each sample was subjected to wedge exposure by a conventional method, and processed by Processing (II) in Example 2 with the same processing solutions.

Figure 7:
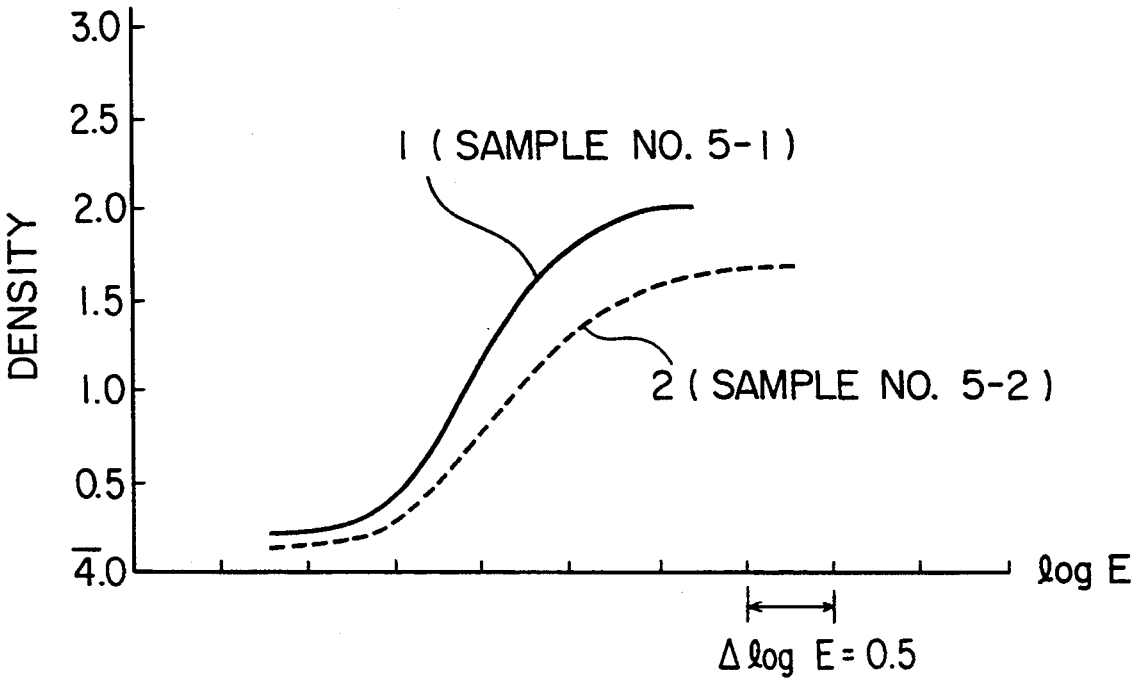
FIGS. 7 and 8 are graphic representations of the density vs. logE curve for inventive and comparison grains.

The specific curves of Sample Nos. 5-1 and 5-2 are shown in FIG. 7.

The specific curve 1 in FIG. 7 is that of Sample No. 5-1 (EM-1, invention) and the curve 2 is that of Sample No. 5-2 ( EM-5, comparative). Furthermore, Sample Nos. 5-3 and 5-4 exhibited the specific curves similar to that of Sample No. 5 -1.

$S_1$ sensitivity and $S_2$ sensitivity are summarized in Table 15.

$S_2$ sensitivity is an inverse of an exposure that provides the density of fog density +0.3, and is the relative value to Sample No. 5-2, which is set at 100.

TABLE 15

| Sample | Characteristics | |
|---|---|---|
| | $S_1$ sensitivity | $S_2$ sensitivity |
| Sample No. 5-1 (EM-1, invention) | 126 | 141 |
| Sample No. 5-2 (EM-5, comparison) | 100 | 100 |
| Sample No. 5-3 (EM-9, invention) | 126 | 138 |
| Sample No. 5-4 (EM-10, invention) | 125 | 139 |

It is apparent from the data in Table 15 and FIG. 7 that the photosensitive materials containing silver halide grains prepared by the manufacturing method of the invention is extremely sensitive, have high Dmax and comprise hard gradation, which suggests that differences of photographic characteristic among grains are small.

Next, graininess of Sample Nos. 5-1 through 5-4 was evaluated visually on a printed image enlarged 10 times at a density point of fog density +0.3.

It was found that the samples of the invention were far superior to Comparative Example No. 5-2 in image quality.

Effect of the present invention was observed about each of the samples which contains silver halide grains prepared by the same method as EM-9, except that AgI grains in Solution E-9 was replaced with AgBrI grains (I content 40 mol %, average grain size 0.05μ) and the samples which contains silver halide grains prepared by the same method as EM-9, except that 10 mol % of AgI grains in Solution E-9 was decreased and 10 mol % of KBr in Solution D-9 was replaced with KI.

EXAMPLE 6 (COMPARISON OF 2.0 μM GRAINS)

The samples were prepared in the manner identical to that of Example 5, except that the emulsion in Example 5 was replaced with EM-4, EM-6 and EM-11, and that the sensitizing dye was substituted as below.

The amount of sensitizing dye is per mol of silver.

| | |
|---|---|
| Sensitizing dye (A-23) | 20 mg |
| Sensitizing dye (A-20) | 15 mg |

The samples were exposed and developed in the same manner as Example 5.

Figure 8:
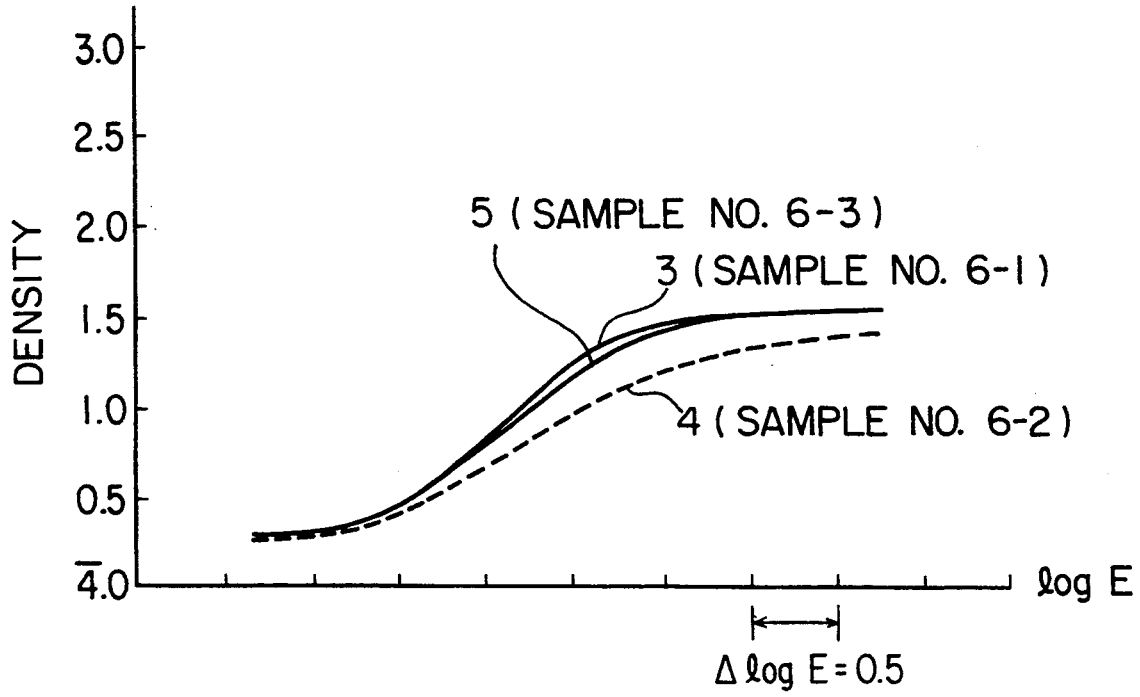

The specific curves are shown in FIG. 8.

The specific curve 3 in FIG. 8 is that of Sample No. 6-1 (EM-4, invention); curve 4 is that of Sample No. 6-2 (EM-6, comparative); and curve 5 is that of Sample No. 6-3 (EM-11, invention).

$S_1$ sensitivity and $S_2$ sensitivity are summarized in Table 16.

TABLE 16

| Sample | Characteristics | |
|---|---|---|
| | $S_1$ sensitivity | $S_2$ sensitivity |
| Sample No. 6-1 (EM-4, invention) | 120 | 145 |
| Sample No. 6-2 (EM-6, comparison) | 100 | 100 |
| Sample No. 6-3 (EM-11, invention) | 120 | 142 |

It is apparent from the data in Table 16 and FIG. 8 that the results obtained with 2.0 μm AgX grains were similar to those of Example 5. Effect of the present invention was observed in each of the samples where the amount of sensitizing dye (A-23) was increased to 40 mg and that of sensitizing dye (A-20) was decreased to 30 mg in sample Nos. 6-1 and 6-3. Next, the desorbability of sensitizing dye of Sample Nos. 6-1 through 6-3 was evaluated by the same method as Example 1.

The evaluation results are summarized in Table 17.

TABLE 17

| | Sensitizing dye desorbability |
|---|---|
| Sample No. 6-1 (invention) | 21% |
| Sample No. 6-2 (comparison) | 35% |
| Sample No. 6-3 (invention) | 18% |

As apparent from the results in the table, the samples of the invention showed less desorbability of sensitizing dyes, and, apparently, the silver halide emulsions of the invention are more prone to adsorb a sensitizing dye.

EXAMPLE 7

Sample Nos. 7-1 through 7-17 were prepared by replacing EM-1, A-9, A-3, $Y_4$-9 and DOP in sample No. 2-3 with emulsions, sensitizing dyes Y-5, and DNP as specified in Table 18.

The coated amounts of the respective components per square meter are shown below.

| | |
|---|---|
| Emulsion (converted to silver amount) | 1 g |
| Coupler (Y-5) | 0.4 g |
| DNP | 0.4 g |
| Gelatin | 0.12 g |

Each sample was subjected to wedge exposure with blue light according to a conventional method, and processed in the manner identical to that of Sample No. 2-3 by Processing (II).

The processed samples were evaluated for sensitivity ($S_1$), adsorbability of sensitizing dye and RMS granularity. The results are summarized in Table 18. The sensitivity of each sample is the relative value to those of Sample No. 7-2 for Sample Nos. 7-1 through 7-3, Sample No. 7-4 for Sample No. 7-5, Sample No. 7-6 for Sample Nos. 7-7 through 7-9, and Sample No. 7-10 through 7-17, which are set at 100, respectively.

The RMS granularity of each sample is a value obtained by multiplying 1000 times the density variation observed by scanning an area of a density (fog density +1.2) by a microdensitometer with spherical scanning diameter of 25 μm.

TABLE 18

| Sample No. | Emulsion | Sensitizing dye (mg/mol AgX) | Sensitizing dye (mg/mol AgX) | Desorbability | Granularity | Relative sensitivity | Remark |
|---|---|---|---|---|---|---|---|
| 7-1 | EM-13 | B-101 (550) | B-102 (340) | 58 | 40 | 50 | x |
| 7-2 | EM-5 | B-101 (550) | B-102 (340) | 50 | 45 | 100 | x |
| 7-3 | EM-1 | B-101 (550) | B-102 (340) | 35 | 35 | 100 | ∘ |
| 7-4 | EM-5 | B-101 (550) | — | 57 | 44 | 100 | x |
| 7-5 | EM-1 | B-101 (550) | — | 39 | 30 | 100 | ∘ |
| 7-6 | EM-5 | A-3 (550) | — | 45 | 46 | 100 | x |
| 7-7 | EM-1 | A-3 (550) | — | 25 | 26 | 118 | ∘ |
| 7-8 | EM-1 | A-2 (550) | — | 29 | 27 | 123 | ∘ |
| 7-9 | EM-1 | A-4 (550) | — | 25 | 25 | 108 | ∘ |
| 7-10 | EM-13 | A-3 (550) | A-2 (340) | 50 | 35 | 50 | x |
| 7-11 | EM-5 | A-3 (550) | A-2 (340) | 40 | 45 | 100 | x |
| 7-12 | EM-1 | A-3 (550) | A-2 (340) | 24 | 26 | 117 | ∘ |
| 7-13 | EM-1 | A-4 (550) | A-1 (340) | 20 | 25 | 121 | ∘ |
| 7-14 | EM-1 | A-14 (550) | A-3 (340) | 25 | 27 | 117 | ∘ |
| 7-15 | EM-1 | A-5 (550) | A-6 (340) | 20 | 27 | 113 | ∘ |
| 7-16 | EM-1 | A-9 (550) | A-10 (340) | 25 | 28 | 113 | ∘ |
| 7-17 | EM-1 | A-12 (550) | A-7 (340) | 28 | 27 | 117 | ∘ |

∘: Invention
x: Comparison

It is apparent from the data in Table 18 that the samples of the invention excel in sensitivity, desorbability of sensitizing dye and granularity, and that those having a sensitizing dye represented by Formula [A] are particularly excellent.

EXAMPLE 8

The samples were prepared in the manner identical to that of Sample No. 7-1 in Example 7, except that coupler Y-5 was replaced with $M_4$-4, and emulsion and sensitizing dye were replaced as specified in Table 19, and that exposure was made by green light instead of blue light. Next, sensitivity, RMS granularity and adsorbability of sensitizing dye were evaluated.

The sensitivity of each sample is the relative value to those of Sample No. 8-2 for Sample Nos. 8-1 through 8-3, Sample No. 8-4 for Sample No. 8-5, Sample No. 8-6 for Sample Nos. 8-7 and 8-8, and Sample No. 8-10 for Sample Nos. 8-9 through 8-23, which are set at 100, respectively.

TABLE 19

| Sample No. | Emulsion | Sensitizing dye (mg/mol AgX) | Sensitizing dye (mg/mol AgX) | Desorbability | Granularity | Relative sensitivity | Remark |
|---|---|---|---|---|---|---|---|
| 8-1 | EM-17 | B-103 (550) | B-104 (340) | 55 | 40 | 55 | x |
| 8-2 | EM-12 | B-103 (550) | B-104 (340) | 55 | 46 | 100 | x |
| 8-3 | EM-2 | B-103 (550) | B-104 (340) | 45 | 30 | 100 | ∘ |
| 8-4 | EM-12 | B-103 (550) | — | 60 | 45 | 100 | x |
| 8-5 | EM-2 | B-103 (550) | — | 47 | 35 | 103 | ∘ |
| 8-6 | EM-12 | A-23 (550) | — | 40 | 44 | 100 | x |
| 8-7 | EM-2 | A-23 (550) | — | 27 | 24 | 118 | ∘ |
| 8-8 | EM-2 | A-113 (550) | — | 26 | 27 | 123 | ∘ |
| 8-9 | EM-17 | A-23 (550) | A-20 (340) | 40 | 37 | 53 | x |
| 8-10 | EM-12 | A-23 (550) | A-20 (340) | 40 | 45 | 100 | x |
| 8-11 | EM-2 | A-23 (550) | A-20 (340) | 25 | 28 | 118 | ∘ |
| 8-12 | EM-2 | A-75 (550) | A-20 (340) | 20 | 24 | 122 | ∘ |
| 8-13 | EM-2 | A-22 (550) | A-34 (340) | 20 | 23 | 114 | ∘ |
| 8-14 | EM-2 | A-18 (550) | A-34 (340) | 23 | 27 | 110 | ∘ |
| 8-15 | EM-2 | A-17 (550) | A-35 (340) | 27 | 25 | 114 | ∘ |
| 8-16 | EM-2 | A-16 (550) | A-30 (340) | 25 | 23 | 110 | ∘ |
| 8-17 | EM-2 | A-23 (550) | A-54 (340) | 20 | 25 | 110 | ∘ |
| 8-18 | EM-2 | A-18 (550) | A-55 (340) | 28 | 26 | 106 | ∘ |
| 8-19 | EM-2 | A-31 (550) | A-18 (340) | 29 | 25 | 110 | ∘ |
| 8-20 | EM-2 | A-32 (550) | A-17 (340) | 22 | 24 | 111 | ∘ |
| 8-21 | EM-2 | A-17 (550) | A-47 (340) | 24 | 26 | 113 | ∘ |
| 8-22 | EM-2 | A-26 (550) | A-42 (340) | 25 | 23 | 114 | ∘ |
| 8-23 | EM-2 | A-23 (550) | A-118 (340) | 15 | 24 | 126 | ∘ |

∘: Invention
x: Comparison

B-103

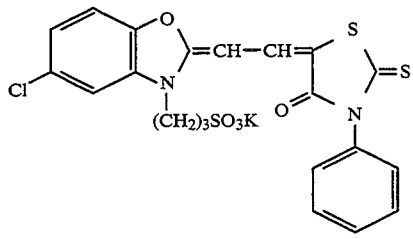

-continued

B-104

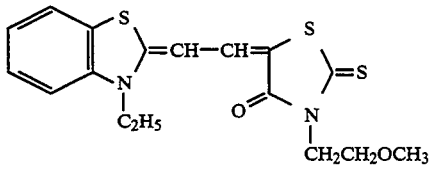

As can be found from the data in Table 19, the silver halide emulsion of the invention contained in a green-sensitive emulsion layer is less prone to desorb a sensitizing dye, and has good granularity, and especially, the samples containing sensitizing dyes represented by Formula [A] are excellent in every criterion, i.e. sensitivity, adsorbability of sensitizing dye and granularity.

Further, the effect of the present invention was preserved in each of the samples, even when the amount of sensitizing dye was decreased to 50 wt. % in sample Nos. 8-1 to 8-23.

In addition, the effect of the invention was reserved in the other two samples which contain silver halide grains with an average size of 0.27 μm and an average I content of 8.46 mol. %, and prepared by the same method as EM-2, except that AgI grains with an average size of 0.05 μm with AgI grains with an average size of 0.2 μm and 0.5 μm, respectively, each prepared from Solution A-2 and C-2.

EXAMPLE 9

The samples were prepared in the manner identical to that of Example 8, except that Emulsion EM-2 with EM-4, EM-12 was replaced with EM-6, EM-17 with EM-19 and the amount of sensitizing dye was decreased to 50 wt.% of that of Sample Nos. 8-1 to 8-23. Each sample was evaluated as well for sensitivity, RMS granularity, and adsorbability of sensitizing dye.

Even in the larger size silver halide grains with an average size of 2.0 μm, the samples containing the silver halide emulsions of the invention were improved in sensitivity, adsorbability of sensitizing dye and granularity, and these results were comparable to those of the emulsions in Example 8 containing AgX grains with an average size of 0.27 μm.

EXAMPLE 10

The samples were prepared in the manner identical to that of Example 7, except that coupler Y-5 was replaced with coupler $C_4$-33, and emulsions and sensitizing dyes were replaced as specified in Table 20, and that exposure was performed with red light. The samples were evaluated as well.

The sensitivity of each sample is the relative value to those of Sample No. 10-2 for Sample No. 10-1 through 10-3, Sample No. 10-4 for Sample No. 10-5 Sample No. 10-7 for Sample Nos. 10-7 through 10-8, and Sample No. 10-10 for Sample Nos. 10-9 through 10-19, which are set at 100, respectively.

TABLE 20

| Sample No. | Emulsion | Sensitizing dye (mg/mol AgX) | Sensitizing dye (mg/mol AgX) | Desorbability | Granularity | Relative sensitivity | Remark |
|---|---|---|---|---|---|---|---|
| 10-1 | EM-15 | B-105 (550) | B-106 (100) | 60 | 37 | 55 | x |
| 10-2 | EM-7 | B-105 (550) | B-106 (100) | 50 | 45 | 100 | x |
| 10-3 | EM-3 | B-105 (550) | B-106 (100) | 45 | 30 | 105 | ○ |
| 10-4 | EM-7 | B-105 (550) | — | 55 | 45 | 100 | x |
| 10-5 | EM-3 | B-105 (550) | — | 45 | 34 | 105 | ○ |
| 10-6 | EM-7 | A-57 (550) | — | 40 | 48 | 100 | x |
| 10-7 | EM-3 | A-57 (550) | — | 24 | 25 | 122 | ○ |
| 10-8 | EM-3 | A-56 (550) | — | 23 | 28 | 122 | ○ |
| 10-9 | EM-15 | A-58 (550) | A-59 (100) | 50 | 35 | 54 | x |
| 10-10 | EM-7 | A-58 (550) | A-59 (100) | 40 | 47 | 100 | x |
| 10-11 | EM-3 | A-58 (550) | A-59 (100) | 25 | 25 | 121 | ○ |
| 10-12 | EM-3 | A-57 (550) | A-56 (100) | 23 | 22 | 121 | ○ |
| 10-13 | EM-3 | A-66 (550) | A-81 (100) | 20 | 23 | 125 | ○ |
| 10-14 | EM-3 | A-67 (550) | A-76 (100) | 25 | 25 | 117 | ○ |
| 10-15 | EM-3 | A-68 (550) | A-89 (100) | 20 | 27 | 119 | ○ |
| 10-16 | EM-3 | A-61 (550) | A-56 (100) | 20 | 24 | 125 | ○ |
| 10-17 | EM-3 | A-100 (550) | A-89 (100) | 20 | 23 | 123 | ○ |
| 10-18 | EM-3 | A-101 (550) | A-113 (100) | 24 | 21 | 121 | ○ |
| 10-19 | EM-3 | A-110 (550) | A-82 (100) | 27 | 26 | 117 | ○ |

○: Invention
x: Comparison

B-105

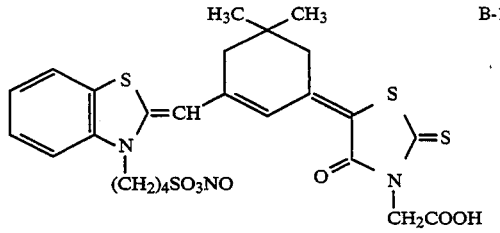

B-106

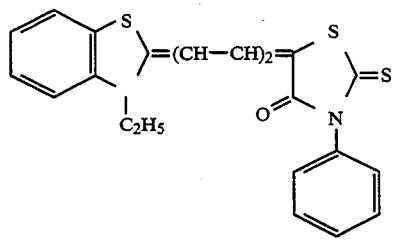

As can be seen from the data in Table 20, the samples comprising the silver halide emulsions of the invention contained in a red-sensitive emulsion layer are improved in sensitivity, desorption of sensitizing dye and granularity.

Further, the effect of the present invention was preserved in each of the samples, even when the amount of sensitizing dye (I) was decreased to 150 mg and that of sensitizing dye (II) was decreased to 80 mg in sample Nos. 10-1 to 10-19.

EXAMPLE 11

On a subbed cellulose acetate support were formed the layers specified below, to obtain a multilayer color photosensitive material No. 11-1.

The coated amounts of silver halide and colloidal silver are indicated by g/m$^2$ as converted to metal silver; those of the additives and gelatin are also by g/m$^2$; and sensitizing dye and coupler mol per mol of silver halide contained in the same layer.

The emulsions contained in the respective color-sensitive emulsion layers were subjected to optimum gold-/sulfur sensitization.

| Layer | Major components | Amount |
|---|---|---|
| Layer 1 (HC) (anti-halation layer | Black colloidal silver | 0.20 |
| | Gelatin | 1.5 |
| | Ultraviolet absorbent UV-1 | 0.1 |
| | Ultraviolet absorbent UV-2 | 0.2 |
| | Dioctyl phthalate (DOP) | 0.03 |
| Layer 2 (IL-1) (intermediate-layer) | Gelatin | 2.0 |
| | 2,5-di-t-octylhydroquinone (AS-1) | 0.1 |
| | DOP | 0.1 |
| Layer 3 (R-1) (1st red-sensitive emulsion layer) | EM-1 | 1.2 |
| | Gelatin | 1.1 |
| | Sensitizing dye (A-57) | $6 \times 10^{-5}$ |
| | Sensitizing dye (A-56) | $1 \times 10^{-5}$ |
| | Coupler ($C_4$-1) | 0.06 |
| | Coupler (CC-1) | 0.003 |
| | DOP | 0.6 |
| Layer 4 (R-2) (2nd red-sensitive emulsion layer) | EM-3 | 1.0 |
| | Gelatin | 1.1 |
| | Sensitizing dye (A-57) | $3 \times 10^{-5}$ |
| | Sensitizing dye (A-56) | $1 \times 10^{-5}$ |
| | Coupler ($C_4$-1) | 0.03 |
| | DOP | 0.3 |
| Layer 5 (IL-2) (intermediate-layer) | Gelatin | 0.8 |
| | AS-1 | 0.03 |
| | DOP | 0.1 |
| Layer 6 (G-1) (1st green-sensitive emulsion layer) | EM-1 | 1.1 |
| | Gelatin | 1.2 |
| | Sensitizing dye (A-22) | $2.5 \times 10^{-5}$ |
| | Sensitizing dye (A-34) | $1.2 \times 10^{-5}$ |
| | Coupler (M-2) | 0.045 |
| | Coupler (CM-1) | 0.009 |
| | Tricresyl phosphate (TCP) | 0.5 |
| Layer 7 (G-2) (2nd green-sensitive emulsion layer) | EM-3 | 1.3 |
| | Gelatin | 0.8 |
| | Sensitizing dye (A-23) | $1.5 \times 10^{-5}$ |
| | Sensitizing dye (A-20) | $1.0 \times 10^{-5}$ |
| | Coupler ($M_4$-3) | 0.03 |
| | TCP | 0.3 |
| Layer 8 (YC) (yellow-filter layer) | Gelatin | 0.6 |
| | Yellow colloidal silver | 0.08 |
| | AS-1 | 0.1 |
| | DOP | 0.3 |
| Layer 9 (B-1) (1st blue-sensitive emulsion layer) | EM-1 | 0.5 |
| | Gelatin | 1.1 |
| | Sensitizing dye (A-3) | $1.3 \times 10^{-5}$ |
| | Coupler (Y-2) | 0.29 |
| | TCP | 0.2 |
| Layer 10 (B-2) (2nd blue-sensitive emulsion layer) | EM-3 | 0.7 |
| | Gelatin | 1.2 |
| | Sensitizing dye (A-3) | $1 \times 10^{-5}$ |
| | Coupler (Y-2) | 0.08 |
| | TCP | 0.1 |
| Layer 11 (Pro-1) (1st protective layer) | Gelatin | 0.55 |
| | Ultraviolet absorbent UV-1 | 0.1 |
| | Ultraviolet absorbent UV-2 | 0.2 |
| | DOP | 0.03 |
| | AgBrI AgI, 1 mol % average size, 0.07 μm | 0.5 |
| Layer 12 (Pro-2) (2nd protective layer) | Gelatin | 0.5 |
| | Polymethyl methacrylate particles (dia., 1.5 μm) | 0.2 |
| | Formalin scavenger (HS-1) | 3.0 |

-continued

| Layer | Major components | Amount |
|---|---|---|
| | Hardener (H-1) | 0.4 |

In addition, to each layer was added a surfactant for a coating aid.

CM-1

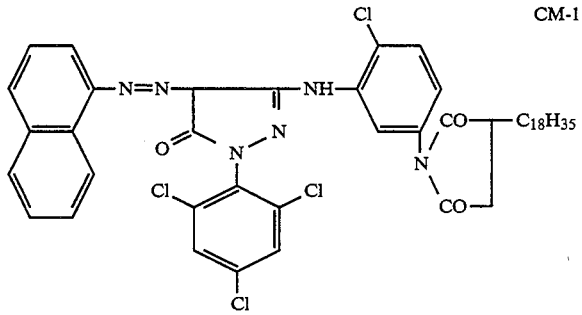

UV-1

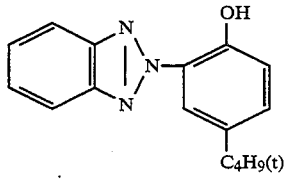

UV-2

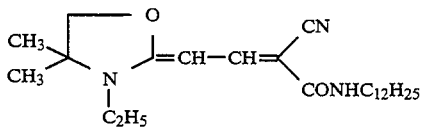

HS-1

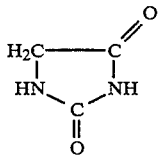

H-1

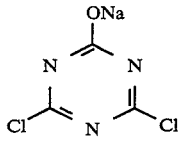

CC-1

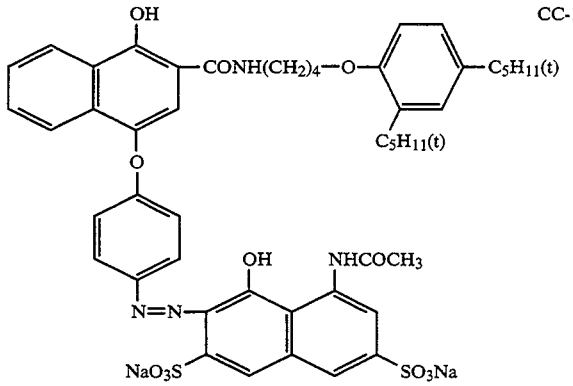

Sample Nos. 11-2 through 11-7 were prepared in the manner identical to that of Sample No. 11-1, except that a coupler was replaced as specified in Table 21. The coupler combinations in these multilayer samples were respectively designated Coupler Combination A, B, C, D, E, F, and G.

TABLE 21

| Sample | 11-1 Coupler Combination A | 11-2 Coupler Combination B | 11-3 Coupler Combination C | 11-4 Coupler Combination D | 11-5 Coupler Combination E | 11-6 Coupler Combination F | 11-7 Coupler Combination G |
|---|---|---|---|---|---|---|---|
| Layer 3 (EM-1) | C4-1 (0.006) CC-1 (0.003) | C-1 (0.06) CC-1 (0.003) | C4-1 (0.06) CC-1 (0.003) D-21 (0.003) | C4-1 (0.06) CC-1 (0.003) D-21 (0.003) DSR-17 (0.006) | C-8 (0.06) CC-1 (0.003) | C-30 (0.06) CC-1 (0.003) D-21 (0.003) | C-19 (0.06) CC-1 (0.003) D-21 (0.003) |
| Layer 4 (EM-3) | C4-1 (0.03) | C-1 (0.03) | C4-1 (0.03) D-21 (0.002) | C4-1 (0.03) D-21 (0.002) DSR-26 (0.003) | C-8 (0.03) | C-20 (0.03) D-21 (0.002) | C-19 (0.03) D-21 (0.002) |
| Layer 6 (EM-1) | M-2 (0.045) CM-1 (0.009) | M-2 (0.045) CM-1 (0.009) | M-2 (0.045) CM-1 (0.009) D-29 (0.001) | M-2 (0.045) CM-1 (0.009) | M-14 (0.045) CM-1 (0.009) | M-16 (0.045) CM-1 (0.009) D-29 (0.001) | M-13 (0.045) CM-1 (0.009) D-29 (0.001) |
| Layer 7 (EM-3) | M4-3 (0.03) | M4-3 (0.03) | M4-3 (0.03) D-29 (0.002) | M4-3 (0.045) | M-14 (0.03) | M-16 (0.03) D-29 (0.002) | M-18 (0.03) D-29 (0.002) |
| Layer 9 (EM-1) | Y-2 (0.29) | Y-2 (0.29) | Y-2 (0.29) | Y-2 (0.29) | Y-5 (0.29) | Y-3 (0.29) | Y-5 (0.29) |
| Layer 10 (EM-3) | Y-2 (0.08) | Y-2 (0.08) | Y-2 (0.08) D-4 (0.004) | Y-2 (0.08) D-4 (0.004) | Y-6 (0.08) | Y-6 (0.08) D-4 (0.004) | Y-6 (0.08) D-4 (0.004) |

Data in ( ) represents amount added (mol/mol AgX)

Multilayer Sample Nos. 11-8 through 11-14 were prepared in the manner identical to that of Sample Nos. 11-1 through 11-7, except that EM-1 was replaced with EM-5 (comparative emulsion) and that EM-3 with EM-7 (comparative emulsion).

Each of the samples was exposed with white light, and developed by Processing (II), and then, each was evaluated for relative sensitivity ($S_1$) and RMS (relative value).

The relative sensitivity was measured on the yellow, magenta, and cyan densities. A portion of each sample was allowed to stand for 2 days at 50° C. and 80% RH, and then sensitivity was measured in order to evaluate stability for aging.

The results are summarized in Table 22.

TABLE 22

| No. | Coupler combination | Relative sensitivity of instant processing* Yellow filter | Magenta filter | Cyan filter | Relative sensitivity of processing after 2 day-standing at 50° C./80% RH *1 Yellow filter | Magenta filter | Cyan filter | RMS value (relative value) 2* Yellow filter | Magenta filter | Cyan filter | Remarks |
|---|---|---|---|---|---|---|---|---|---|---|---|
| 11-1 | A | 130 | 150 | 120 | 120 | 130 | 105 | 85 | 84 | 89 | ○ |
| 11-2 | B | 140 | 160 | 130 | 115 | 135 | 135 | 105 | 82 | 80 | ○ |
| 11-3 | C | 125 | 165 | 125 | 100 | 145 | 110 | 67 | 63 | 68 | ○ |
| 11-4 | D | 120 | 145 | 120 | 100 | 120 | 105 | 51 | 44 | 52 | ○ |
| 11-5 | E | 150 | 155 | 120 | 125 | 140 | 95 | 78 | 70 | 88 | ○ |
| 11-6 | F | 130 | 155 | 130 | 105 | 140 | 100 | 65 | 67 | 70 | ○ |
| 11-7 | G | 150 | 160 | 145 | 125 | 150 | 115 | 64 | 65 | 66 | ○ |
| 11-8 | A | 100 | 100 | 100 | 60 | 40 | 40 | 119 | 121 | 125 | x |
| 11-9 | B | 95 | 100 | 90 | 50 | 35 | 50 | 124 | 123 | 118 | x |
| 11-10 | C | 105 | 110 | 100 | 100 | 55 | 35 | 35 | 100 | 108 | x |
| 11-11 | D | 100 | 105 | 105 | 60 | 50 | 30 | 30 | 76 | 70 | x |
| 11-12 | E | 90 | 100 | 95 | 60 | 45 | 50 | 105 | 104 | 114 | x |
| 11-13 | F | 95 | 90 | 90 | 65 | 45 | 40 | 96 | 96 | 96 | x |
| 11-14 | G | 90 | 90 | 85 | 50 | 40 | 45 | 98 | 98 | 100 | x |

*1 Indicated as a relative sensitivity to that of Sample No. 11-8 in instantant processing, which is set at 100.
*2 Relative value to that of Sample No. 11-8, i.e. 100.
○: Invention
x: Comparison
B: blue sensitive layer
G: green sensitive layer
R: red sensitive layer As can be seen from the data in Table 22, the samples comprising silver halide emulsions of the invention are superior to the comparative samples in sensitivity and granularity in the respective coupler combinations, and have much less desensitization attributable to desorption of sensitizing dye at a high temperature/high humidity also in the presence of a coupler.

The effects of the invention were observed also in the following modified in samples; Sample No. 11-3, DSR-27 was added to layer 3 by 0.006 mol/mol of Ag, and DSR-34 to layer 4 by 0.003 mol/mol of Ag; in Sample No. 11-2, DSR-21 was added to layer 6 by 0.004 mol/mol of Ag, DSR-21 and DSR-4 to layer 7 by 0.002 mol/mol of Ag, respectively, and DSR-20 to layer 8 by 0.006 mol/mol of Ag; in Sample No. 11-2, C-1 was replaced with C-5, C-11, C-31 and C-32 respectively; in Sample No. 11-2, M-2 with M-6, and Y-2 with Y-7; in Sample No. 11-5, M-14 was replaced with M-25, and Y-5 with Y-10.

EXAMPLE 12

The layers having the composition specified below were formed on a subbed cellulose acetate support to obtain a multilayer color photosensitive material No. 11-1.

The coated amounts are indicated by g/m$^2$ as converted to metal silver in silver halide and colloidal silver, by g/m$^2$ in the additives and gelatin; and by mol per mol of silver halide contained in the same layer in a sensitizing dye and a coupler.

The emulsions contained in the respective color-sensitive emulsion layers were subjected to optimum gold-/sulfur sensitization in a sensitizing dye and a coupler.

| Layer | Major components | Amount |
|---|---|---|
| Layer 1 (anti-halation layer | Black colloidal silver | 0.20 |
| | Gelatin | 1.5 |
| | Ultraviolet absorbent UV-1 | 0.1 |
| | Ultraviolet absorbent UV-2 | 0.2 |
| | Dioctyl phthalate (DOP) | 0.03 |
| Layer 2 (intermediate-layer) | Gelatin | 2.0 |
| | 2,5-di-tert-octylhydroquinone (AS-1) | 0.1 |
| | DOP | 0.1 |
| Layer 3 (1st red-sensitive emulsion layer) | EM-1 | 1.2 |
| | Gelatin | 1.1 |
| | Sensitizing dye (A-58) | $6 \times 10^{-5}$ |
| | Sensitizing dye (A-59) | $1 \times 10^{-5}$ |
| | Coupler ($C_4$-20) | 0.06 |
| | Coupler (CC-1) | 0.003 |
| | Coupler (D-23) | 0.0015 |
| | Coupler (D-34) | 0.002 |
| | DOP | 0.6 |
| Layer 4 (2nd red-sensitive emulsion layer) | EM-3 | 1.0 |
| | Gelatin | 1.1 |
| | Sensitizing dye (A-58) | $3 \times 10^{-5}$ |
| | Sensitizing dye (A-59) | $1 \times 10^{-5}$ |
| | Coupler ($C_4$-20) | 0.03 |
| | Coupler (D-34) | 0.001 |
| | DNP | 0.3 |
| Layer 5 (intermediate-layer) | Gelatin | 0.8 |
| | AS-1 | 0.03 |
| | DOP | 0.1 |
| Layer 6 (1st green-sensitive emulsion layer) | EM-1 | 1.1 |
| | Gelatin | 1.2 |
| | Sensitizing dye (A-22) | $2.5 \times 10^{-5}$ |
| | Sensitizing dye (A-34) | $1.2 \times 10^{-5}$ |
| | Coupler (M-15) | 0.045 |
| | Coupler (CM-1) | 0.009 |
| | Coupler (D-23) | 0.001 |
| | Coupler (D-26) | 0.003 |
| | Tricresyl phosphate (TCP) | 0.5 |
| Layer 7 (2nd green-sensitive emulsion layer) | EM-3 | 1.3 |
| | Gelatin | 0.8 |
| | Sensitizing dye (A-23) | $1.5 \times 10^{-5}$ |
| | Sensitizing dye (A-20) | $1.0 \times 10^{-5}$ |
| | Coupler ($M_4$-4) | 0.03 |

-continued

| Layer | Major components | Amount |
|---|---|---|
| | Coupler (D-26) | 0.001 |
| | TCP | 0.3 |
| Layer 8 (yellow-filter layer) | Gelatin | 0.6 |
| | Yellow colloidal silver | 0.08 |
| | AS-1 | 0.1 |
| | DOP | 0.3 |
| Layer 9 (1st blue-sensitive emulsion layer) | EM-1 | 0.5 |
| | Gelatin | 1.1 |
| | Sensitizing dye (A-3) | $1.3 \times 10^{-5}$ |
| | Coupler (Y-5) | 0.29 |
| | TCP | 0.2 |
| Layer 10 (2nd blue-sensitive emulsion layer) | EM-3 | 0.7 |
| | Gelatin | 1.2 |
| | Sensitizing dye (A-3) | $1 \times 10^{-5}$ |
| | Coupler (Y-5) | 0.08 |
| | Coupler (D-34) | 0.0015 |
| | TCP | 0.1 |
| Layer 11 (1st protective layer) | Gelatin | 0.55 |
| | Ultraviolet absorbent UV-1 | 0.1 |
| | Ultraviolet absorbent UV-2 | 0.2 |
| | DOP | 0.03 |
| | (AgBrI, (AgI, 1 mol % average size, 0.07 μm) | 0.5 |
| Layer 12 (Pro-2) (2nd protective layer) | Gelatin | 0.5 |
| | Polymethyl methacrylate particles (dia., 1.5 μm) | 0.2 |
| | Formalin scavenger (HS-1) | 3.0 |
| | Hardener (H-1) | 0.4 |

A surfactant was added to each layer as a coating aid in addition to the preceding components.

Sample Nos. 12-2 through 12-6 were prepared in the same manner as Sample No. 12-1, except that a sensitizing dye and an emulsion were replaced as specified in Table 23.

The respective samples were subjected to wedge exposing by white light, and then were developed in the same manner as Example 11. Relative sensitivity ($S_1$), desorbability of sensitizing dye and RMS granularity of green-sensitive layer were evaluated.

Sensitivity is a relative value to that of Sample No. 12-6, which is set at 100.

TABLE 23

| | Sample description | | | | | | | | | | | |
|---|---|---|---|---|---|---|---|---|---|---|---|---|
| | Layer | | | | | | | | | | | |
| | R-1 | | G-1 | | B-1 | | R-1 | | G-1 | | B-1 | |
| No. | Emulsion | Sensitizing dye | Emulsion | Sensitizing dye | Emulsion | Sensitizing dye | Emulsion | Sensitizing dye | Emulsion | Sensitizing dye | Emulsion | Sensitizing dye |
| 12-1 | EM-1 | A-58<br>A-59 | EM-1 | A-22<br>A-34 | EM-1 | A-3 | EM-3 | A-58<br>A-59 | EM-3 | A-23<br>A-23 | EM-3 | A-3 |
| 12-2 | EM-1 | A-57<br>A-56 | EM-1 | A-18<br>A-34 | EM-1 | A-4 | EM-3 | A-57<br>A-56 | EM-3 | A-75<br>A-20 | EM-3 | A-4 |
| 12-3 | EM-1 | A-58<br>A-59 | EM-1 | A-22<br>A-34 | EM-5 | A-3 | EM-3 | A-58<br>A-59 | EM-3 | A-23<br>A-20 | EM-7 | A-3 |
| 12-4 | EM-1 | A-58<br>A-59 | EM-1 | A-22<br>A-34 | EM-5 | A-3 | EM-7 | A-58<br>A-59 | EM-7 | A-23<br>A-20 | EM-7 | A-3 |
| 12-5 | EM-5 | A-58<br>A-59 | EM-5 | A-22<br>A-34 | EM-5 | A-3 | EM-7 | A-58<br>A-59 | EM-7 | A-23<br>A-20 | EM-7 | A-3 |
| 12-6 | EM-13 | A-58<br>A-59 | EM-13 | A-22<br>A-34 | EM-13 | A-3 | EM-15 | A-58<br>A-59 | EM-15 | A-23<br>A-20 | EM-15 | A-3 |

| | Performance | | | | | | | |
|---|---|---|---|---|---|---|---|---|
| | Relative sensivility | | | Desorbability | | | Granularity | |
| | R | G | B | R | G | B | | |
| 12-1 | 140 | 145 | 140 | 25 | 24 | 25 | 25 | Invention |
| 12-2 | 145 | 145 | 140 | 20 | 20 | 23 | 20 | Invention |
| 12-3 | 140 | 145 | 135 | 25 | 24 | 40 | 27 | Invention |
| 12-4 | 135 | 143 | 135 | 44 | 23 | 45 | 28 | Invention |
| 12-5 | 120 | 125 | 120 | 40 | 45 | 40 | 48 | Invention |
| | | | | | | | | Comparison |
| 12-6 | 120 | 100 | 100 | 40 | 40 | 45 | 35 | Invention |

TABLE 23-continued

Comparison

As can be found from the data in Table 23, the Sample Nos. 12-1 through 12-4 containing silver halide emulsions of the invention are superior to the comparative samples Nos. 12-5 and 12-6 in color sensitivity, granularity and desorbability of sensitizing dyes.

EXAMPLE 13

Sample No. 13-1 was prepared in the same manner as sample No. 12-1, except that A-58 in Layers 3 and 4 with A-57, and A-59 with A-56, and $M_4$-4 in Layer 7 with M-34.

Preparation of Sample No. 13-2 (comparative)

This sample was prepared in the same manner as Sample No. 13-1, except that EM-1 in Layers 3, 6 and 9 was replaced with EM-5 (comparative emulsion), and EM-3 in Layers 4, 7 and 10 with EM-7 (comparative emulsion).

Preparation of Sample No. 13-3 (invention)

This sample was prepared in the same manner as Sample No. 13-1, except that EM-1 in Layers 3, 6 and 9 was replaced with EM-9.

Each of these samples was divided into two pieces, where one piece was subjected to wedge exposing and developing as in Example 12, while the other was allowed to stand for 3 days at 50° C. and 80% relative humidity, and then subjected as well to wedge exposing and processed by Processing [II ].

The processes samples were evaluated for sensitivity ($S_1$) in instant processing, and increase in fog (Fog) at accelerated weathering conditions.

TABLE 24

| | | Property | |
|---|---|---|---|
| Sanoke | Layer | S1 sensitivity | ΔFog |
| Sample No. | B | 121 | 0.07 |
| 13-1 | G | 126 | 0.07 |
| (invention) | R | 119 | 0.06 |
| Sample No. | B | 100 | 0.11 |
| 13-2 | G | 100 | 0.12 |
| (comparison) | R | 100 | 0.11 |
| Sample No. | B | 122 | 0.07 |
| 13-3 | G | 125 | 0.06 |
| (invention) | R | 100 | 0.07 |

B: blue-sensitive emulsion layer
G: green-sensitive emulsion layer
R: red-sensitive emulsion layer As can be found from the data in Table 24, the sample containing silver halide emulsions (EM-1, EM-3 and EM-9) of the invention are superior to the comparative sample in sensitivity, and are improved in Δ fog caused by storage.

EXAMPLE 14

The layers of the following compositions were sequentially formed on a polyethylene terephthalate support to prepare a multi color photographic material.

In each of the following examples, the amounts of the additives in a photographic material are per square meter, unless otherwise specified. The amounts of silver halide and colloidal silver are indicated as converted to metal silver. Each emulsion was subjected to gold/sulfur sensitization.

Sample No. 14-1 (Coating mode A)

Layer 1: Anti-halation layer (HC)
Gelatin layer containing black colloidal silver
Layer 2: Intermediate layer (I.L.)
Gelatin layer containing emulsified dispersion of 2,5-di-tert-octylhydroquinone
Layer 3: Low-sensitivity red-sensitive silver halide emulsion layer (RL) comprising: monodispersed emulsion subjected to spectral redsensitization by sensitizing dyes (A-57) and (A-56) and containing AgBrI with an average grain size ($\bar{r}$) of 40 μm and AgI content of 6.0 mol % - - - coated silver amount, 1.8 g/m$^2$
Cyan coupler ($C_4$-20), 0.06 mol per mol of silver;
Colored; cyan coupler (CC-1), 0.003 mol of per mol of silver;
DIR compound (D-23), 0.0015 mol per mol of silver;
DIR compound (D-34), 0.002 mol per mol of silver;
High-boiling point solvent, dibutyl phthalate (DBP), 0.85 g/m$^2$
Layer 4: High-sensitivity red-sensitive silver halide emulsion layer (RH) comprising:
Monodispersed emulsion subjected to spectral redsensitization by sensitizing dyes (A-57) and (A-56) and containing AgBrI with an average grain size ($\bar{r}$) of 0.70 μm and AgI content of 7.0 mol % - - - coated silver amount, 1.3 g/m$^2$;
Cyan coupler ($C_4$-20), 0.03 mol per of mol silver;
DIR compound (D-34), 0.001 mol per mol of silver;
High boiling point solvent DBP, 0.32 g/m$^2$;
Layer 5: Intermediate layer (I.L.)
Gelatin layer, identical to Layer 2
Layer 6: Low-sensitivity green-sensitive silver halide emulsion layer (GL) comprising:
Emulsion Em-12, coated silver amount, 1.5 g/m$^2$;
Magenta coupler ($M_4$-4), 0.045 mol per mol of silver;
Colored magenta coupler (CM-1), 0.009 mol per mol of silver;
DIR compound (D-23), 0.0010 mol per mol of silver;
DIR compound (D-26), 0.0030 mol per mol of silver
High-boiling point solvent DBP, 0.91 g/m$^2$;
Layer 7: High-sensitivity green-sensitive silver halide emulsion layer (GH) comprising:
Emulsion Em-7, coated silver amount, being 1.4 g/m$^2$
Magenta coupler ($M_4$-4), 0.030 mol per mol of silver;
DIR compound (D-26), 0.0010 mol per mol of silver;
High-boiling point solvent DBP, 0.44 g/m$^2$;
Layer 8: Yellow filter layer (YC)
Gelatin layer comprising dispersion of yellow colloid silver and 2,5-di-tert-octylhydroquinone
Layer 9: Low-sensitivity blue-sensitive silver halide emulsion layer (BL) comprising:
Monodispersed emulsion subjected to spectral blue-sensitization by sensitizing dye (A-9) - - - coated silver amount, 0.9 g/m$^2$;
Yellow coupler (Y-5), 0.29 mol per mol of silver;
High-boiling point solvent TCP, 0.20 g/m$^2$;
Layer 10: High-sensitivity blue-sensitive silver halide emulsion layer (BH) comprising:

Monodispersed emulsion (subjected to spectral blue-sensitization by sensitizing dye (A-9) - - - coated silver amount, 1.3 g/m$^2$;
Yellow coupler (Y-5), 0.08 mol per mol of silver;
DIR compound (D-34 ), 0.0015 mol per mol of silver;
High-boiling point solvent TCP, 0.08 g/m$^2$;
Layer 11: 1st protective layer (P-1)
Gelatin layer comprising:
silver bromoiodide (AgI, 1 mol %; average grain size, 0.07 μm; coated silver amount, 0.5 g/m$^2$ );
Ultraviolet absorbents UV-1, and UV-2
Layer 12: 2nd protective layer (P-2)
Gelatin layer containing polymethyl methacrylate grains (dia., 1.5 μm), and formalin scavenger (HS-1)

The respective layers incorporated a gelatin hardener (H-1) and a surfactant, in addition to the above components.

The layer thickness of Layer 1 through Layer 12 was 22 μm, and the coated silver amount in Layer 1 through Layer 10 was 7.4 g/m$^2$.

Sample No. 14-2 (Coating mode B)

This sample was prepared in the same manner as Sample No. 14-1, except that the layer thickness of Layer 1 through Layer 12 was 17.6 μm and the coated silver amount in Layer 1 through Layer 10 was 5.9 g/m$^2$. In other words, the coated silver amount in each layer of Sample No. 14-2 was 20% less than that of Sample No. 14-1.

Sample Nos. 14-3 through 14-6

Sample Nos. 14-3 and 14-4 corresponding to Coating modes A and B were prepared by replacing emulsions EM-12 and EM-7 in the green-sensitive layers with EM-13 and EM-15, respectively. Likewise, Sample Nos. 14-5 and 14-6 corresponding to Coating modes A and B were prepared by replacing emulsions EM-12 and EM-7 with EM-2 and EM-3, respectively.

The respective samples were subjected to wedge exposing by white light, and then processed by Processing (II).

The processed samples were evaluated for sensitivity ($S_1$) of a green-sensitive layer, sharpness (MTF) and granularity (RMS). The evaluation results are summarized in Table 25.

To evaluate degree of improvement in sharpness, MTF (Modulation Transfer Function) of a dye image was determined, and sharpness is indicated by MTF value (%) at 30 cycles/mm.

The sensitivity ($S_1$) is a relative value to that of Sample No. 14-1, which is set at 100.

TABLE 25

| Sample No. | Emulsion in green sensitive layer | Layer thickness (μm) | Sensitivity $S_1$ | Granularity | Sharpness |
|---|---|---|---|---|---|
| 14-1 comparision | EM-12 EM-7 | 22 | 100 | 35 | 66 |
| 14-2 comparision | EM-12 EM-7 | 17.6 | 90 | 35 | 69 |
| 14-3 comparision | EM-13 EM-15 | 22 | 55 | 27 | 66 |
| 14-4 comparision | EM-17 EM-15 | 17.6 | 45 | 23 | 75 |
| 14-5 invention | EM-2 EM-3 | 22 | 124 | 30 | 65 |
| 14-6 invention | EM-2 EM-3 | 17.6 | 110 | 22 | 75 |

As can be found from the data in Table 25, the samples of the invention (Nos. 14-5, and 14-6 ) excel in general criteria, i.e. sensitivity, granularity and sharpness; as particularly indicated by Nos. 14-5 and 14-6, it was unexpected fact that the emulsion of the invention and thinner layer construction provided the samples with improved granularity.

EXAMPLE 15

The layers of the following compositions were formed on a support to prepare multicolor photosensitive materials Nos. 15-1 through 15-3.

Sample No. 15-1

Layer 1: Anti-halation layer (HC)
Gelatin layer containing black colloidal silver
Layer 2: Intermediate layer (I.L.)
Gelatin layer containing emulsified dispersion of 2,5-di-tert-octylhydroquinone
Layer 3: Low-sensitivity red-sensitive silver halide emulsion layer (R-1) comprising:
EM-5, coated silver amount, 1.8 g/m$^2$;
Sensitizing dye (A-57), $6\times10^{-5}$ mol per mol of silver;
Sensitizing dye (A-56), $1.0\times10^{-5}$ mol per mol of silver;
Cyan coupler ($C_4$-20), 0.06 mol per mol of silver;
Colored cyan coupler (CC-1), 0.003 mol per mol of silver;
DIR compound (D-23), 0.0015 mol per mol of silver;
DIR compound (D-34), 0.002 mol per mol of silver;
High-boiling point solvent DBP, 0.85 g/m$^2$;
Layer 4: High-sensitivity red-sensitive silver halide emulsion layer (R-2) comprising:
EM-16, coated silver amount, 1.3 g/m$^2$
Sensitizing dye (A-57), $3\times10^{-5}$ mol per mol of silver;
Sensitizing dye (A-56), $1.0\times10^{-5}$ mol per mol of silver;
Cyan coupler ($C_4$-20), 0.03 mol per mol of silver;
DIR compound (D-34), 0.001 mol per mol of silver;
High-boiling point solvent DBP, 0.32 g/m$^2$;
Layer 5: Intermediate layer (I.L.)
Gelatin layer, identical to Layer 2
Layer 6: Green-sensitive silver halide emulsion layer (G) comprising:
Em-12, coated silver amount, 2.3 g/m$^2$;
Sensitizing dye (A-23), $2.5\times10^{-5}$ mol per mol of silver;
Sensitizing dye (A-21), $1.2\times10^{-5}$ mol per mol of silver;
Magenta coupler ($M_4$-4), 0.045 mol per mol of silver;
Colored magenta coupler (CM-1), 0.009 mol per mol of silver;
DIR compound (D-23), 0.0010 mol per mol of silver;

DIR compound (D-26), 0.0030 mol per mol of silver;

High-boiling point solvent DBP, 1.08 g/m$^2$;

Layer 7: Yellow filter layer (YC-1 )

Gelatin layer comprising dispersion of yellow colloid silver and 2,5-di-tert-octylhydroquinone Layer 8: Low-sensitivity blue-sensitive silver halide emulsion layer (B-1) comprising:

EM-5, coated silver amount, 0.9 g/m$^2$;

Sensitizing dye (A-9), $1.3\times10-5$ mol per mol of silver;

Yellow coupler (Y-28), 0.29 mol per mol of silver;

High-boiling point solvent TCP, 0.20 g/m$^2$;

Layer 9: High-sensitivity blue-sensitive silver halide emulsion layer (B-2) comprising:

EM-16, coated silver amount, 0.5 g/m$^2$

Sensitizing dye (A-9), $1.0\times10^{-5}$ mol per mol of silver;

Yellow coupler (Y-28), 0.08 mol per mol of silver;

DIR compound (D-34), 0.0015 mol per mol of silver;

High-boiling point solvent TCP, 0 08 g/m$^2$;

Layer 10: 1st protective layer (P-1)

Gelatin layer comprising:

Silver bromoiodide (AgI, 1 mol %; average grain size, 0.07 μm; coated silver amount, 0.5 g/m$^2$);

Ultraviolet absorbents UV-1, and UV-2;

Layer 11: 2nd protective layer (P-2)

Gelatin layer containing polymethyl methacrylate grains (dia., 1.5 μm), and formalin scavenger (HS-1)

The respective layers incorporated a gelatin hardener (H-1) and a surfactant, in addition to the above components.

The layer thickness of Layer 1 through Layer 11 was 22 μm, and the coated silver amount in Layer 1 through Layer 9 was 6.8 g/m$^2$.

Sample No. 15-2

This sample was prepared in the same manner as Sample No. 15-1, except that EM-12 in Layer 6 was replaced with EM-17.

Sample No. 15-3

This sample was prepared in the same manner as Sample No. 15-1, except that EM-12 in Layer 6 was replaced with EM-2.

The respective samples were subjected to wedge exposing by white light, and then processed by Processing (II).

The processed samples were evaluated for sensitivity ($S_1$ ), maximum density Dmax, sharpness (MTF) and granularity (RMS). The evaluation results for the green-sensitive layers are summarized in Table 26.

Sensitivity ($S_1$ ) and RMS are the relative values to those of Sample No. 15-1, which are set at 100.

TABLE 26

| Sample No. | Emulsion in green sensitive layer | Property | | | |
|---|---|---|---|---|---|
| | | Dmax | MTF (%) | RMS | Sensitivity (S1) |
| 15-1 comparision | EM-12 | 2.38 | 80 | 100 | 100 |
| 15-2 comparision | EM-17 | 2.88 | 87 | 61 | 62 |
| 15-3 Invention | EM-2 | 2.89 | 87 | 61 | 116 |

TABLE 26-continued

As can be found from the data in Table 26, it is a surprising fact that the sample comprising EM-2 of the invention excels in general criteria, i.e. maximum density, sharpness, granularity and sensitivity.

EXAMPLE 16

Sample Nos. 16-1 through 16-3 were prepared in the same manner as Sample No. 15-1 in Example 15, except that EM-12 in Layer 6 was replaced as specified in Table 27.

The respective samples were evaluated in the same manner same as in Example 15, and the results are summarized in Table 27. Sensitivity ($S_1$) and RMS are the relative values to those of Sample No. 16-1, which are set at 100.

TABLE 27

| Sample No. | Emulsion in green sensitive layer | Property | | | |
|---|---|---|---|---|---|
| | | Dmax | MTF (%) | RMS | Sensitivity (S1) |
| 16-1 comparision | EM-5 | 2.12 | 78 | 100 | 100 |
| 16-2 comparision | EM-13 | 2.72 | 85 | 57 | 63 |
| 16-3 invention | EM-1 | 2.73 | 85 | 57 | 126 |

As can be seen from the data in Table 27, the sample of the invention excels in general criteria, i.e. maximum density, sharpness, granularity and sensitivity.

EXAMPLE 17

Sample Nos. 17-1 through 17-3 were prepared in the same manner as sample No. 15-1 in Example 15, except that EM-12 in Layer 6 was replaced as specified in Table 28.

The respective samples were evaluated in the same manner as in Example 15. Sensitivity ($S_1$ ) and RMS are the relative values to those of Sample No. 17-1, which are set at 100.

TABLE 28

| Sample No. | Emulsion in green sensitive layer | Property | | | |
|---|---|---|---|---|---|
| | | Dmax | MTF (%) | RMS | Sensitivity (S1) |
| 17-1 comparision | EM-16 | 1.79 | 74 | 100 | 100 |
| 17-2 comparision | EM-18 | 2.40 | 83 | 49 | 66 |
| 17-3 invention | EM-3 | 2.43 | 83 | 49 | 122 |

As can be found from the data in Table 28, the sample of the invention excels in general criteria, i.e. maximum density, sharpness, granularity and sensitivity.

EXAMPLE 18

The layers of the following compositions were formed on a support to prepare multicolor photosensitive material No. 18 -1.

Sample No. 18-1

In this sample, Layers 1 through 7 were identical to those of Sample No. 16-3 of Example 16, except that the layers following Layer 7 were composed as follows;

Layer 8: Blue-sensitive silver halide emulsion layer (B) comprising:

EM-1, coated silver amount, 1.1 g/m$^2$;

Sensitizing dye (A-9), $1.3\times10^{-5}$ mol per mol of silver;

Yellow coupler (Y-28), 0.29 mol per mol of silver;

High-boiling point solvent TCP, 0.22 g/m$^2$;

Layer 9: identical to Layer 10 in Sample No 16-3;

Layer 10: identical to Layer 11 in Sample No. 16-3;

Likewise, Sample Nos 18-2 through 18-5 were prepared as follows.

Sample No. 18-2

This sample was prepared by replacing yellow coupler Y-28 in Layer 8 of Sample No. 18-1 with an equivalent mole of Y-5.

Sample No. 18-3

This sample was prepared in the same manner as Sample No. 18-1, except that Layer 4 was removed and Layer 3 was composed as follows;

Layer 3: Red-sensitive silver halide emulsion layer (R)

EM-1, coated silver amount, 2.5 g/m$^2$;

Sensitizing dye (A-57), $6\times10^{-5}$ mol per mol of silver;

Sensitizing dye (A-56) $10\times10^{-5}$ mol per mol of silver;

Cyan coupler ($C_4$-20), 0.06 mol per mol of silver;

Colored cyan coupler (CC-1), 0.003 mol per mol of silver;

DIR compound (D-23), 0.0015 mol per mol of silver;

DIR compound (D-34), 0.002 mol per mol of silver;

High-boiling point solvent DBP, 0.94 g/m$^2$;

The respective samples and reference Sample No. 16-3 of Example 16 were processed in the same manner as in Example 15 and evaluated. The sensitivity ($S_1$) and RMS are the relative values to those of Sample No. 16-3, which are set at 100.

The layer order and the evaluation results of these samples are summarized in Table 29.

TABLE 29

| | Sample 16-3 | Sample 18-1 | Sample 18-2 | Sample 18-3 |
|---|---|---|---|---|
| Layer 11 | P-2 | — | P-2 | — |
| Layer 10 | P-1 | P-2 | P-2 | — |
| Layer 9 | B-2 (EM-16) | P-1 | P-1 | P-2 |
| Layer 8 | B-1 (EM-5) | B (EM-1) | B (EM-1) (YB-15) | P-1 |
| Layer 7 | YC | YC | YC | B-1 |
| Layer 6 | G (EM-1) | G (EM-1) | G (EM-1) | YC |
| Layer 5 | IL | IL | IL | G (EM-1) |
| Layer 4 | R-2 (EM-16) | R-2 (EM-16) | R-2 (EM-16) | IL |
| Layer 3 | R-1 (EM-5) | R-1 (EM-5) | R-1 (EM-5) | R (EM-1) |
| Layer 2 | IL | IL | IL | IL |
| Layer 1 | HC | HC | HC | HC |

TABLE 29-continued

| | Sample 16-3 | Sample 18-1 | Sample 18-2 | Sample 18-3 |
|---|---|---|---|---|
| Dmax B | 2.42 | 2.54 | 2.81 | 2.54 |
| Dmax G | 2.70 | 2.71 | 2.72 | 2.71 |
| Dmax R | 2.50 | 2.51 | 2.51 | 2.61 |
| MTF G | 85 | 68 | 87 | 87 |
| RMS G | 100 | 88 | 88 | 88 |
| Sensitivity G | 100 | 103 | 105 | 106 |
| Remark | Comparison | Invention | Invention | Invention |

Note: MTF, RMS, and sensitivity are the values for a green-sensitive layer. Dmax data are the values for the blue-, green-, and red-sensitive layers.

As can be found from comparison of the evaluation results of Sample Nos. 16-3 and 18-1 to 18-3, it is preferable that every photosensitive layer is single layer in order to balance the properties of maximum density, granularity, sharpness and sensitivity.

In the present invention, a yellow coupler of a benzoyl acetoanilide family further improves the maximum density of a blue-sensitive layer.

EXAMPLE 19

The layers of the following compositions were formed on a polyethylene terephthalate support to prepare a multilayer color photographic material.

Sample No. 19-1 (Coating mode C)

Layer 1: (HC)

Layer identical to Layer 1 in Sample No. 14-1

Layer 2: (I.L.)

Layer identical to Layer 2 in Sample No. 14-1

Layer 3: Red-sensitive silver halide emulsion layer (R) comprising:

monodispersed emulsion subjected to spectral red-sensitization by sensitizing dyes (A-57) and (A-56) and comprising AgBrI with an average grain size of 0.40 μm and AgI content of 6.0 mol % - - - coated silver amount, 3.1 g/m$^2$;

Cyan coupler ($C_4$-20), 0.06 mol per mol of silver;

Colored cyan coupler (CC-1 ), $2\times10^{-3}$ mol per mol of silver;

DIR compound (D-34), $1\times10^{-3}$ mol per mol of silver;

High-boiling point solvent DBP, 0.92 g/m$^2$;

Layer 4: (I.L)

Layer identical to Layer 5 in Sample No. 14-1

Layer 5: Green-sensitive silver halide emulsion layer (G) comprising:

Emulsion Em-12, coated silver amount, 2.9 g/m$^2$;

Magenta coupler (M4-4), 0.05 mol per mol of silver;

Colored magenta coupler (CM-1), $6\times10^{-3}$ mol per mol of silver;

DIR compound (D-26), $2.5\times10^{-3}$ mol per mol of silver;

High-boiling point solvent DBP, 1.02 g/m$^2$;

Layer 6: (YC)

Layer identical to Layer 8 in Sample No. 14-1

Layer 7: Blue-sensitive silver halide emulsion layer (B) comprising:

monodispersed emulsion subjected to spectral blue-sensitization by sensitizing dye (A-9) and comprising AgBrI with an average grain size of 0.48 μm and AgI content of 18 mol % - - - coated silver amount, 1.4 g/m$^2$;

Yellow coupler (Y-28), 0.28 mol per mol of silver;
DIR compound (P-34), $1.0\times10^{-3}$ mol per mol of silver;
High-boiling point solvent TCP, 0.23 g/m$^2$;
Layer 8: (P-1)
Layer identical to Layer 11 in Sample No. 14-1
Layer 9: (P-2)
Layer identical to Layer 12 in Sample No. 14-1

Sample No. 19 (Coating mode D)

Sample No. 19-2 was prepared in the same manner as Sample No. 19-1, except that the layer thickness in Layers 1 through 9 was 19 μm, and that the total coated silver amount in the three photosensitive layers was 6.4 g/m$^2$. That is, the coated silver amount in each layer of Sample No. 19-2 was 13.5% less than that of Sample No. 19-1. These thinner layers are hereunder identified by affixing two apostrophes (") to each layer described in Sample No. 19-1. For example, B" represents a layer 13.5% thinner than Layer B. This definition is applied hereinafter.

Sample Nos. 19-3, and 19-4

These samples were prepared by replacing Emulsion EM-12 in the green-sensitive layer of Sample Nos. 19-1 and 19-2 respectively, with EM-2.

Sample No. 19-5 (Coating mode E)

Sample No. 19-5 was prepared in the same manner as sample No. 19-3, except that the layer thickness in Layers 1 through 9 was 16 μm, and that the total coated silver layers was 5. 4 g/m$^2$. That is, the coated silver amount in each layer of Sample No. 19-5 was 27. 0% less than that of Sample No. 19-3. These thinner layers are hereunder identified by affixing three apostrophes (''') to each layer in Sample No. 19-1.

Sample No. 19-6 (Coating mode F)

Sample No. 19-6 was prepared in the same manner as Sample No. 19-3, except that the layer thickness in Layers 1 through 9 was 14 μm, and that the total coated silver amount 4.7 g/m$^2$. That is, the coated silver amount in each layer of Sample No. 19-6 was 36.5% less than that of Sample No. 19-3. These thinner layers are hereunder identified by affixing an asterisk (*) to each layer in Sample No. 19-1.

Sample No. 19-7 (Coating mode G)

Sample No. 19-7 was prepared in the same manner as Sample No. 19-3, except that the layer thickness in Layers 1 through 9 was 12.7 μm, and that the total coated silver amount was 4.3 g/m$^2$. That is, the coated silver amount in each layer of Sample No. 19-7 was 42% less than that of Sample No. 19-3. These thinner layers are hereunder identified by affixing two asterisks (**) to each layer in Sample No. 19-1.

Coating Modes C through G are summarized in Table 30.

TABLE 30

| Layer No. | Coating Mode C | D | E | F | G |
|---|---|---|---|---|---|
| 9 | P-2 | P-2" | P-2''' | P-2* | P-2** |
| 8 | P-1 | P-1" | P-1''' | P-1* | P-1** |
| 7 | B | B" | B''' | B* | B** |
| 6 | YC | YC" | YC''' | YC* | YC** |
| 5 | G | G" | G''' | G* | G** |
| 4 | IL | IL" | IL''' | IL* | IL** |
| 3 | R | R" | R''' | R* | R** |
| 2 | IL | IL" | IL''' | IL* | IL** |
| 1 | HC | HC" | HC''' | HC* | HC** |
| Layer thickness (μm) | 22 | 19 | 16 | 14 | 12.7 |
| Coated silver amount (g/m$^2$) | 7.4 | 6.4 | 5.4 | 4.7 | 4.3 |

Sample Nos. 19-8 and 19-9

These samples were prepared according to Coating Modes C and D respectively, by replacing emulsion EM-5 in the green-sensitive layer of Sample 19-1 with comparative emulsion EM-17.

These samples were subjected to exposing and processing as in Example 14, and then were evaluated. The evaluation results are summarized in Table 31.

TABLE 31

| Sample No. | 19-1 | 19-2 | 19-3 | 19-4 | 19-5 | 19-6 | 19-7 | 19-7 | 19-7 |
|---|---|---|---|---|---|---|---|---|---|
| Coating Mode | C | D | C | D | E | F | G | C | D |
| Layer thickness (μm) | 22 | 19 | 22 | 19 | 16 | 14 | 12.7 | 22 | 19 |
| Green-sensitive layer emulsion | | | | | | | | | |
| G and GI layers | EH-12 | EH-12 | EH-2 | EH-2 | EH-2 | EH-2 | EH-2 | EH-17 | EH-17 |
| GH layer | — | — | — | — | — | — | — | — | — |
| Sharpness MTF(G) | 65 | 68 | 68 | 76 | 80 | 90 | 94 | 67 | 77 |
| Granularity RMS(G) | 30 | 30 | 25 | 19 | 16 | 12 | 10 | 25 | 20 |
| Sensitivity (green) | 100 | 96 | 110 | 111 | 105 | 100 | 100 | 40 | 40 |
| Remarks | Comparison | Comparison | Invention | Invention | Invention | Invention | Invention | Comparison | Comparison |

MTF and RMS are the values of a green-sensitive layer

As can be found from the data in this table, the sensitivities of the samples of the invention are equal to or higher than those of Sample Nos. 19-1 and 19-2 containing conventional core/shell emulsions, and, the samples of the invention have been improved in granularity and sharpness to a large extent. Such effects of the invention is particularly significant with the layer thickness of not more than 15 μm.

EXAMPLE 20

The samples were prepared as per Table 32 and evaluated in the same manner as Example 19. The evaluation results are summarized in Table 32 together with the data of Sample Nos. 19-3 and 19-6 in Example 19.

TABLE 32

| Sample No. | 20-1 | 20-2 | 19-3 | 20-3 | 20-4 | 19-6 |
|---|---|---|---|---|---|---|
| Coating Mode | C | C | C | F | F | F |
| Layer thickness (μm) | 22 | 22 | 22 | 14 | 14 | 14 |

TABLE 32-continued

| Sample No. | 20-1 | 20-2 | 19-3 | 20-3 | 20-4 | 19-6 |
|---|---|---|---|---|---|---|
| Green-sensitive layer emulsion (Grain size) | EM-3 0.65 | EM-1 0.38 | EM-2 0.27 | EM-3 0/65 | EM-1 0.38 | EM-2 0.27 |
| AgI content (mol %) | 7.16 | 8.46 | 8.46 | 7.16 | 8.46 | 8.46 |
| Sharpness MTF (G) | 62 | 65 | 68 | 70 | 75 | 90 |
| Granularity RMS (G) | 28 | 26 | 25 | 25 | 18 | 12 |

It is apparent from the data in Table 32 that the finer silver halide grains of Sample Nos. 20-3, 20-4, and 19-6, each having thinner layers, contribute to further improving granularity and sharpness.

EXAMPLE 21

Sample No. 21-1 was prepared in the same manner as Example 5, besides that EM-1 of Sample No. 5-1 in Example 5 was replaced with EM-13.

Each of Sample Nos. 5-1, 5-2, and 21-1, was exposed to green light through an optical wedge, and then were processed by the following processing steps to obtain dye images.

| [Processing steps] | | |
|---|---|---|
| Color developing | (38° C.) | Specified in Table 33 |
| Bleach-fixing | (38° C.) | 4 min. |
| Washing | (20–33° C.) | 1 min. |
| Stabilizing | (20–33° C.) | 30 sec. |
| Drying | | |

The compositions of the processing solutions used in the processing steps were as follows;

| | |
|---|---|
| [Color developing solution] | |
| 4-amino-3-methyl-N-ethyl-N-hydroxyethylaniline sulfate | 5 g |
| Sodium sulfite anhydride | 4.25 g |
| Hydroxylamine.½ sulfate | 2.0 g |
| Compound (1) represented by Formula [IS] | 10 g |
| Potassium carbonate anhydride | 30.0 g |
| Sodium bromide | 1.3 g |
| Trisodum nitrilotriacetate (monohydrate) | 2.5 g |
| Potassium hydroxide | 1.0 g |
| Water added to make total quantity | 1 lit. |
| [Bleach-fixing solution] | |
| Ferric ammonium ethylenediaminetetraacetate | 200.0 g |
| Diammonium ethylenediaminetetraacetate | 2.0 g |
| Aqueous ammonia (28% solution) | 20.0 g |
| Ammonium thiosulfate | 175.0 g |

-continued

| | |
|---|---|
| Sodium sulfite anhydride | 8.5 g |
| Sodium metasulfite | 2.3 g |
| 2-amino-5-mercapto-1,3,4-thiadiazole | 1.5 g |

Water was added to make total quantity 1 lit., and pH was adjusted to 6.6 with aqueous ammonia.

| | |
|---|---|
| [Washing] | |
| Tap water | |
| [Stabilizing solution] | |
| Formalin (37% aqueous solution) | 1.5 ml |
| Konidax (Konica Corporation) | 7.5 ml |
| Water added to make total quantity | 1 lit. |

Sensitivity ($S_1$), granularity (RMS value) and sharpness (MTF value) of each dye image were measured. The results are summarized in Table 33.

Sensitivity $S_1$ is a relative value to that of Sample No. 21-1 developed in 60 seconds, which is set at 100.

TABLE 33

| Sample No. | EM | $S_1$ sensitivity | | | Granularity | | | Sharpness | | | Remark |
|---|---|---|---|---|---|---|---|---|---|---|---|
| | | Color developing time (sec.) | | | | | | | | | |
| | | 60 | 120 | 180 | 60 | 120 | 180 | 60 | 120 | 180 | |
| 5-1 | EM-1 | 151 | 148 | 138 | 23 | 23 | 30 | 87 | 85 | 78 | ∘ |
| 5-2 | EM-5 | 127 | 120 | 110 | 28 | 30 | 35 | 78 | 77 | 69 | x |
| 21-1 | EM-13 | 127 | 120 | 110 | 28 | 30 | 35 | 78 | 77 | 69 | x |

∘: Invention
x: Comparison

It can be found from the data in Table 33 that the samples of the invention developed within 120 seconds can provide further improved sensitivity, granularity and sharpness.

EXAMPLE 22

Sample No. 22-1 was prepared in the same manner as Sample No. 12-1, except that sensitizing dye A-58 in Layer 3 was replaced with A-57, and sensitizing dye A-59 with A-56.

Preparation of Sample No. 22-2

This sample was prepared in the same manner as Sample No. 22-1, except that EM-1 in Layers 3, 6 and 9 in Sample No. 22-1 was replaced with EM-5 (comparative emulsion), and EM-3 in Layers 4, 7 and 10 with EM-7 (comparative sample).

Preparation of Sample No. 22-3

This sample was prepared in the same manner as Sample No. 22-1, except that EM-1 in Layers 3, 6 and 9 in Sample No. 22-1 was replaced with EM-13 (comparative emulsion), and EM-3 in Layers 4, 7 and 10 with EM-15 (comparative sample).

Each of the samples was exposed to white light through an optical wedge, and was processed by processing steps as in Example 21. The yellow, magenta and cyan dye images of these samples were evaluated for $S_1$ sensitivity, granularity and sharpness. The evaluation results are summarized in Table 34.

Sensitivity $S_1$ is a relative value to that of Sample 22-3 developed in 60 seconds, which is set at 100.

TABLE 34

| Color developing time (sec.) | 60 | | | 120 | | | 180 | | | |
|---|---|---|---|---|---|---|---|---|---|---|
| Sample No. | R | G | B | R | G | B | R | G | B | Remark |
| | $S_1$ sensitivity | | | | | | | | | |
| 22-1 | 153 | 154 | 152 | 149 | 150 | 149 | 138 | 140 | 135 | |
| 22-2 | 130 | 131 | 129 | 123 | 121 | 122 | 111 | 108 | 108 | |
| 22-3 | 100 | 100 | 100 | 97 | 98 | 97 | 87 | 87 | 85 | |
| | Granularity | | | | | | | | | |
| 22-1 | 26 | 26 | 27 | 27 | 27 | 27 | 30 | 32 | 31 | |
| 22-2 | 31 | 32 | 33 | 33 | 33 | 32 | 38 | 40 | 40 | |
| 22-3 | 30 | 31 | 32 | 32 | 34 | 34 | 36 | 38 | 37 | |
| | Sharpness | | | | | | | | | |
| 22-1 | 80 | 82 | 84 | 78 | 81 | 83 | 72 | 73 | 76 | ○ |
| 22-2 | 72 | 73 | 74 | 67 | 68 | 71 | 58 | 59 | 60 | x |
| 22-3 | 72 | 74 | 75 | 68 | 68 | 72 | 66 | 63 | 64 | x |

○: Invention
x: Comparison

It can be found from Table 34 that multilayer Sample No. 22-1 of the invention developed within 120 seconds can provide further improved sensitivity, granularity and sharpness as well as in Example 21.

EXAMPLE 23

Preparation of Sample Nos. 23-1 through 23-4

These samples were prepared in the same manner as Sample No. 22-1 in Example 22, except that the emulsions in Sample No. 22-1 were replaced with the emulsions specified in Table 35, and that in Sample Nos. 23-3 and 23-4, Layers 4, 7 and 10 were removed from Sample No. 23-1 and 23-2 to make the respective photosensitive layers single.

The respective samples were exposed and processed as in Example 21. Then, sensitivity $S_1$, granularity (RMS value) and sharpness (MTF values) of the magenta day images were measured. The results are summarized in Table 35. Sensitivity ($S_1$) is a relative value to that of Sample No. 23-2 (60 seconds), which is set at 100.

TABLE 35

| | Color developing time (sec.) EM | | | | | | | | | | | | | | | |
|---|---|---|---|---|---|---|---|---|---|---|---|---|---|---|---|---|
| | Blue-sensitive layer | | Green-sensitive layer | | Red sensitive layer | | | | | | | | | | | |
| Sample No. | Layer 9 | Layer 10 | Layer 6 | Layer 7 | Layer 3 | Layer 4 | $S_1$ sensitivity 60 | 120 | 180 | Granularity 60 | 120 | 180 | Sharpness 60 | 120 | 180 | Remark |
| 22-1 | EM-1 | EM-3 | EM-1 | EM-3 | EM-1 | EM-3 | 177 | 172 | 161 | 26 | 27 | 32 | 82 | 81 | 73 | ○ |
| 23-1 | EM-2 | EM-1 | EM-2 | EM-1 | EM-2 | EM-1 | 126 | 124 | 113 | 22 | 23 | 32 | 84 | 83 | 75 | ○ |
| 23-2 | EM-12 | EM-5 | EM-12 | EM-5 | EM-12 | EM-5 | 100 | 99 | 101 | 28 | 28 | 34 | 76 | 75 | 68 | x |
| 23-3 | EM-1 | — | EM-1 | — | EM-1 | — | 132 | 126 | 111 | 22 | 24 | 30 | 87 | 85 | 78 | ○ |
| 23-4 | EM-2 | — | EM-2 | — | EM-2 | — | 117 | 117 | 111 | 21 | 22 | 28 | 89 | 88 | 80 | ○ |

○: Invention
x: Comparison

As can be found from the data in Table 35, the samples of the invention developed within 120 seconds provide excellent granularity and sharpness and high sensitivity.

Further the yellow and cyan dye images were evaluated as well, and the similar results were obtained.

EXAMPLE 24

Each of EM-1 through −3, −7, −13, −17, and −20 through 23 was subjected to gold/sulfur sensitization, and then to spectral green-sensitization by sensitizing dyes (A-22) and (A-34) as per specified in Table 36. Next, each emulsion was stabilized by TAI and 1-phenyl-5-mercaptotetrazole.

To each emulsion were added to dispersion prepared by dispersing magenta coupler ($M_4$-4) dissolved in a mixture solvent of ethyl acetate and dinonylphthalate (DNP) in an aqueous gelatin solution, and the conventional photographic additives such as a spreader, a hardener etc. to prepare a photographic coating solution. It was coated and dried on a subbed cellulose acetate support by a conventional method to obtain a photosensitive material sample.

The coated amounts of the respective compounds per square meter of support are specified below.

| | |
|---|---|
| Emulsion (converted to silver amount) | 1 g |
| magenta coupler | 0.4 g |
| DNP | 0.4 g |
| gelatin | 0.12 g |

Each sample was subjected to wedge exposing by a conventional method, and was processed by Processing (II).

The Processed samples were evaluated for sensitivity $S_1$. The results are summarized in Table 36.

The sensitivity values in the table are relative to the sensitivity 100 of a sample having EM-1 to which were added sensitizing dyes (A-22) and (A-34) in amounts, respectively, of 550 mg and 340 mg per mol of silver.

TABLE 36

| Emulsion used | Amount of sensitizing dye (mg/molAg) Sensitizing dye (A-22) | Sensitizing dye (A-34) | Relative sensitivity | Remark |
|---|---|---|---|---|
| EM-1 | 550 | 340 | 100 | ∘ |
| EM-1 | 183 | 113 | 28 | ∘ |
| EM-20 | 550 | 340 | 24 | ∘ |
| EM-21 | 550 | 340 | 26 | ∘ |
| EM-5 | 550 | 340 | 84 | x |
| EM-13 | 550 | 340 | 58 | x |
| EM-2 | 775 | 480 | 45 | ∘ |
| EM-17 | 775 | 480 | 30 | x |
| EM-3 | 320 | 280 | 367 | ∘ |
| EM-7 | 320 | 200 | 260 | x |
| EM-22 | 435 | 270 | 102 | x |

∘: Invention
x: Comparison

Sample No. 24-1 to 24-8, which contain the emulsions having various sensitivities, were prepared in the same manner as the samples specified in Table 36, except that the emulsions were combined as specified in Table 37.

Each of these samples was subjected to wedge exposure by a conventional method, and processed by Processing (II).

The processed samples were evaluated for exposure latitude, sensitivity ($S_1$) and granularity (RMS). The evaluation results are summarized in Table 37.

Exposure latitude is indicated as follows, provided that $\Delta D$ is the difference between the minimum and maximum densities on a specific curve: where $$\Delta \log E = \log E(F + 0.1 \times \Delta D) - \log E(D - 0.1 \times \Delta D)$$

| | |
|---|---|
| $\log E(F + 0.1 \times \Delta D)$: | sensitivity at (minimum density + $0.1 \times \Delta D$) |
| $\log E(D - 0.1 \times \Delta D)$: | sensitivity at (maximum density − $0.1 \times \Delta D$) |

TABLE 38

| Sample No. | Emulsion used | Latitude | Relative sensitivity | Granularity |
|---|---|---|---|---|
| 24-1 (invention) | EM-1:EM-17 = 1:1 | 3.3 | 160 | 10 |
| 24-2 (invention) | EM-1:EM-2 = 1:1 | 3.2 | 175 | 11 |
| 24-3 (invention) | EM-1:EM-1 (amount of dye, ⅓ of No. 25-1) | 3.2 | 162 | 12 |
| 24-4 (invention) | EM-1:EM-20 = 1:1 (amount of dye, ⅓ of No. 25-1) | 3.4 | 167 | 11 |
| 24-5 (invention) | EM-23* | 3.4 | 168 | 11 |
| 24-6 (invention) | EM-1:EM-21 = 1:1 | 3.3 | 165 | 11 |
| 24-7 (comparison) | EM-5:EM-17 = 1:1 | 3.3 | 130 | 35 |
| 24-8 (comparison) | EM-13:EM-17 = 1:1 | 3.2 | 100 | 11 |

*EM-23: EM-23 has been subjected to gold/sulfur sensitization, to spectral green-sensitization by 550 mg of sensitizing dye (A-22) and 340 mg of sensitizing dye (A-34) per mol AgX and then to stabilization by TAI and 1-phenyl-5-mercaptotetrazole.

As can be found from the data in Table 37, the samples of the invention have wide exposure latitude balanced with higher sensitivity and excellent granularity. Additionally, it is possible to perform chemical aging for the emulsion of Sample No. 24-4; and grain growth and chemical aging for the emulsion of Sample No. 24-5 in a single batch. This feature is advantageous in reducing manufacturing cost of sensitive material. Particularly, Sample Nos. 24-4 to 24-6 exhibit stable photographic performance even under a variable processing condition (e.g. pH, temperature). Effect mentioned above was observed about each of samples in which Rh ion in EM-20 and EM-23 was replaced to Ru ion or Os ion. Particularly, Sample Nos. 24-4 to 24-6 exhibit stable photographic performance even under a variable processing condition (e.g. pH, temperature). Effect mentioned above was observed about each of samples in which Rh ion in EM-20 and EM-23 was replaced to Ru ion or Os ion.

EXAMPLE 25

Preparation of Sample No. 25-1

This sample was a modification of Sample No. 12-1: in Layer 3, 0.5 mol equivalent of EM-1 was replaced with EM-17, sensitizing dye A-58 with A-57, and A-59 with A-56; in Layer 4, 0.5 mol equivalent of EM-3 with EM-22, sensitizing dye A-58 with A-57, and A-59 with A-56; in Layer 6, 0.5 mol equivalent of EM-1 was replaced with EM-22, and coupler M-15 with $M_4$-4; in Layer 7, 0.5 mol equivalent of EM-3 was replaced with EM-22, and coupler $M_4$-4 with M-15; in Layer 9, 0.5 mol equivalent of EM-1 was replaced with EM-17; and in Layer 10, 0.5 mol equivalent of EM-3 was replaced with EM-22.

Preparation of Sample No. 25-2 (comparative)

This sample was prepared in the same manner as Sample No. 25-1, except that EM-1 in Layers 3, 6 and 9 of Sample No. 25-1 was replaced with EM-5, and EM-3 in Layers 4, 7 and 10 with EM-7.

The respective samples were subjected to wedge exposure, and developed as in Example 24. Latitude and granularity were evaluated. The evaluation results are summarized in Table 38.

TABLE 38

| Sample No. | Latitude B | G | R | Granularity B | G | R |
|---|---|---|---|---|---|---|
| 26-1 (Invention) | 4.3 | 4.4 | 4.2 | 4.3 | 4.4 | 4.2 |
| 26-2 (Comparative) | 4.4 | 4.5 | 4.2 | 4.4 | 4.5 | 4.2 |

B, G, and R mean blue-sensitive, green-sensitive, and red-sensitive layers, respectively.

As can be found from the data in Table 38, the sample of the invention has a wide exposure latitude balanced with excellent granularity.

EXAMPLE 26

The layers specified below were formed on a subbed cellulose acetate support to obtain a multilayer color photosensitive material No. 26-1.

The coated amounts are indicated by g/m² as converted to metal silver in silver halide and colloidal silver; by g/m² in additives and gelatin; and by mol per mol of silver halide contained in the same layer in sensitizing dye and coupler.

The emulsions contained in the respective emulsion layers were subjected to optimum sensitization in the same manner as Example 24.

| Layer | Major components | Amount |
|---|---|---|
| Layer 1 (HC) (anti- | Black colloidal silver | 0.20 |
| | Gelatin | 1.5 |

-continued

| Layer | Major components | Amount |
|---|---|---|
| halation layer | Ultraviolet absorbent UV-1 | 0.1 |
| | Ultraviolet absorbent UV-2 | 0.2 |
| | Dioctyl phthalate (DOP) | 0.03 |
| Layer 2 (IL-1) (intermediate-layer) | Gelatin | 2.0 |
| | 2,5-di-tert-octylhydroquinone (AS-1) | 0.1 |
| | DOP | 0.1 |
| Layer 3 (R-1) (red-sensitive emulsion layer) | EM-5 and EM-17 blended at 1:1 | 1.5 |
| | Gelatin | 1.4 |
| | Sensitizing dye (A-57) | $7.5 \times 10^{-5}$ |
| | Sensitizing dye (A-56) | $1.3 \times 10^{-5}$ |
| | Coupler ($C_4$-20) | 0.075 |
| | Coupler (CC-1) | 0.004 |
| | Coupler (D-23) | 0.0019 |
| | Coupler (D-34) | 0.005 |
| | DOP | 0.75 |
| Layer 4 (IL-2) (intermediate-layer) | Gelatin | 0.8 |
| | AS-1 | 0.03 |
| | DOP | 0.1 |
| Layer 5 (G-1) (green-sensitive emulsion layer) | EM-1 and EM-20 blended at 1:1 | 1.4 |
| | Gelatin | 1.5 |
| | Sensitizing dye (A-22) | $3.1 \times 10^{-5}$ |
| | Sensitizing dye (A-34) | $1.5 \times 10^{-5}$ |
| | Coupler ($M_4$-4) | 0.056 |
| | Coupler (CM-1) | 0.011 |
| | Coupler (D-23) | 0.001 |
| | Coupler (D-26) | 0.004 |
| | Tricresyl phosphate (TCP) | 0.6 |
| Layer 6 (YC) (yellow-filter layer) | Gelatin | 0.6 |
| | Yellow colloidal silver | 0.08 |
| | AS-1 | 0.1 |
| | DOP | 0.3 |
| Layer 7 (B-1) (blue-sensitive emulsion layer) | EM-5 and EM-17 blended at 1:1 | 0.63 |
| | Gelatin | 1.4 |
| | Sensitizing dye (A-3) | $1.6 \times 10^{-5}$ |
| | Coupler (Y-5) | 0.36 |
| | TCP | 0.25 |
| Layer 8 (Pro-1) (1st protective layer) | Gelatin | 0.55 |
| | Ultraviolet absorbent UV-1 | 0.1 |
| | Ultraviolet absorbent UV-2 | 0.2 |
| | DOP | 0.03 |
| | AgBrI (AgI, 1 mol % average size, 0.07 μm) | 0.5 |
| Layer 9 (Pro-2) (2nd protective layer) | Gelatin | 0.5 |
| | Polymethyl methacrylate particles (dia., 1.5 μm) | 0.2 |
| | Formalin scavenger (HS-1) | 3.0 |
| | Hardener (H-1) | 0.4 |

A surfactant was added to each layer as a coating aid.

Preparation of Sample No. 26-2 (Invention)

This sample was prepared by replacing EM-5 and EM-17 in Layer 7 of Sample No. 26-1 with EM-1 and EM-20, respectively.

Preparation of Sample Nos. 26-3 (Invention)

This sample was prepared by replacing EM-5 and EM-17 in Layers 3 and 7 of Sample No. 26-1 with EM-1 and EM-20, respectively.

The Sample Nos. 26-1 through 26-3 were subjected to wedge exposure by a conventional method, and were developed as in Example 24. Each of the processed samples were evaluated for latitude, sensitivity ($S_1$), granularity and sharpness. The evaluation results are summarized in Table 39.

Sensitivity was a relative value to that of Sample No. 26-1, which is set at 100.

TABLE 39

| Sample No. | Layer of the invention | Latitude | Relative sensitivity | Granularity | Sharpness* |
|---|---|---|---|---|---|
| 26-1 | Green-sensitive layer | 3.6 | 100 | 16 | 100 |
| 26-2 | Blue-sensitive layer Green-sensitive layer | 3.5 | 101 | 14 | 109 |
| 26-3 | All layer | 3.5 | 103 | 11 | 121 |

*Sharpness is a relative value to a MTF value of Sample No. 26-1 at 10 lines/mm, which is set at 100.

As can be found from the data in Table 39, more the layers of the invention, more excellent granularity and sharpness.

What is claimed is:

1. A photosensitive silver halide photographic material comprising a support and, provided thereon, photographic component layers including at least one photosensitive silver halide emulsion layer containing core/shell silver halide grains (1) comprised of seed silver halide grains, having grown on their surfaces, a shell comprised of plural silver halide phases having differing silver iodide content, said core/shell silver halide grains being prepared by mixing a water soluble silver salt solution and a water soluble halide solution comprising at least one halide other than an iodide, into a solution containing seed silver halide grains, said mixing being carried out, for at least some portion of the time period during which said silver halide shell is being grown, in the presence of preformed fine silver iodide grains, the concentration of said preformed fine silver iodide grains being greater at an early stage of growing the core/shell silver halide grains than at the termination of said growing, whereby a shell of silver halide including the iodide from the preformed silver iodide grains is formed on the surface of the seed silver halide grains and the silver halide phase of maximum iodide content is an inner phase.

2. The material of claim 1, wherein the average particle size of the preformed silver iodide grains is 0.001 to 0.7 μm.

3. The material of claim 2, wherein the average particle size is 0.005 to 0.3 μm.

4. The material of claim 2, wherein the average particle size is 0.01 to 0.1 μm.

5. The material of claim 1, wherein a content of the silver halide grains (1) is not less than 30 mol % of total silver halides contained in the silver halide emulsion layer.

6. The material of claim 1, wherein the emulsion layer comprises a spectral sensitizing dye.

7. The material of claim 6, wherein an amount of the spectral sensitizing dye incorporated into the emulsion layer is $1 \times 10^{-6}$ to $1 \times 10^{-2}$ mol per mol of silver halide.

8. The material of claim 6, wherein said spectral sensitizing dye is represented by Formula [A ]; Formula [A]

$$[D^p - L^a = D^q]^s \oplus (X\ominus)_s$$

wherein $D^p$ and $D^q$ represents independently an electron donative basic heterocyclic group and $L^a$ represents a conjugated linear linkage group; X represents an acid anion, and s represents an integer of 0 or 1.

9. The material of claim 8, wherein the spectral sensitizing dye is represented by Formula (I) or (II);

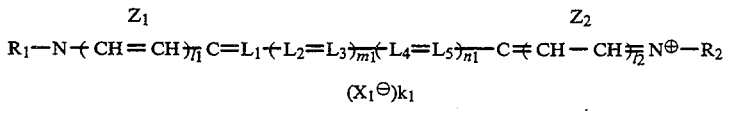

Formula (I)

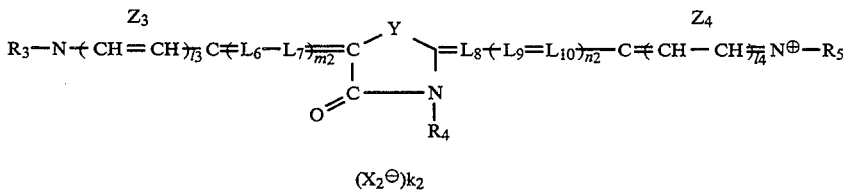

Formula (II)

wherein $Z_1$ and $Z_4$ represent independently the group of the atoms necessary to form a five or six-membered nitrogen containing heterocyclic ring; $L_1$ to $L_{10}$ each individually represents a methine group; Y represents an oxygen atom, a sulfur atom, a selenium atom or —N—$R_7$; $R_1$, $R_2$, $R_3$ and $R_5$ represent an alkyl group, and $R_4$ and $R_7$ represent independently an alkyl group, an alicyclic group, a heterocyclic group or an aryl group; $X_1$ and $X_2$ represent an acid anion; $k_1$, $k_2$ and $l_1$ to $l_4$ represent independently an integer of 0 or 1, and $m_1$, $m_2$, $n_1$ and $n_2$ represent independently an integer of 0 to 2, provided that the sum of $m_2$ and $n_2$ is not more than 2.

10. The material of claim 9, wherein the heterocyclic ring is a thiazole ring, a selenzaole ring, an oxazole ring, a tetrazole ring, a pyridine ring, a pyrroline ring, a cyaninhetero ring, an oxazoline ring, a thiazoline ring, an isooxazoline ring, a thiadiazole ring, a thienothiazole ring, an imidazoquinoxaline ring, an imidazoquinoline ring, a pyrrolopyridine ring, or a pyrrolopyrazine ring.

11. The material of claim 9, wherein $R_4$ and $R_7$ represent 5 to 6-membered alicyclic groups.

12. The material of claim 9, wherein $R_4$ and $R_7$ represent pyridyl groups or thiazolyl groups.

13. The material of claim 9, wherein the spectral sensitizing dye is represented by Formula [Ia], [IIb], [Ic], [Id], [Ie] or [IIa];

Formula [Ia]

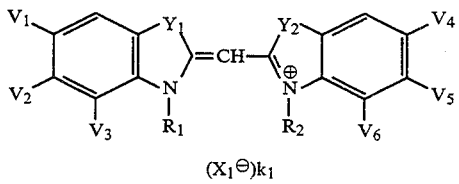

Formula [Ib]

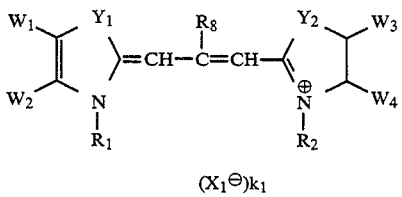

Formula [Ic]

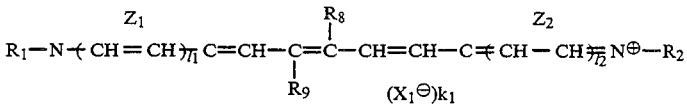

Formula [Id]

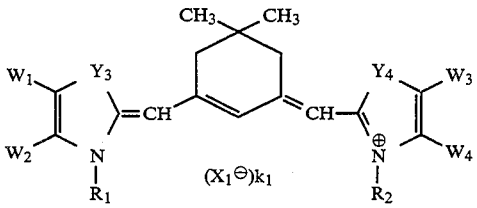

Formula [Ie]

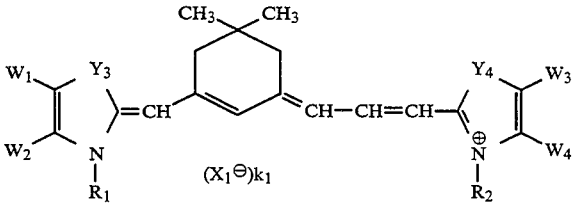

-continued

Formula [IIa]

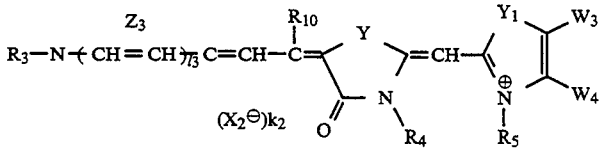

wherein $Z_1$ to $Z_3$, Y, $R_1$ to $R_5$, $R_7$, $X_1$, $X_2$, $l_1$ to $l_3$, $k_1$ and $k_2$ represent the same groups and numbers as those defined in Formula [I] and [II]; $Y_1$ and $Y_2$ represent independently an oxygen atom, a sulfur atom, a selenium atom, a tellurium atom, or —N—$R_7$; $Y_3$ and $Y_4$ represent independently an oxygen atom, a sulfur atom, a selenium atom or a tellurium atom; $V_1$ to $V_6$ represent independently a hydrogen atom, an alkyl group, an alkoxy group, a halogen atom, an aryl group, a hydroxy group, a cyano group, an alkoxycarbonyl group, a carbamoyl group, a sulfamoyl group, or a sulfonyl group; $W_1$ to $W_4$ represents independently a hydrogen atom, an alkyl group or an aryl group; $R_8$ represents a hydrogen atom, an alkyl group, an aralkyl group, an aryl group, a heterocyclic group, or an acid nuclei group; $R_9$ represents a hydrogen atom, an alkyl group, an alkoxy group or an aryloxy group; $R_{10}$ represents an alkyl group, a lower alkoxy group or a phenyl group.

14. The material of claim 1, wherein substantially all iodide for forming said silver halide grains growing from the seed silver halide grains is supplied by the preformed fine silver iodide grains.

15. The material of claim 1, wherein the silver halide grains (1) comprise silver bromoiodide or silver bromochloroiodide.

16. The material of claim 15, wherein the silver halide grains (1) comprise silver bromoiodide.

* * * * *

UNITED STATES PATENT AND TRADEMARK OFFICE

CERTIFICATE OF CORRECTION

PATENT NO. : 5,340,710

DATED : August 23, 1994

INVENTOR(S) : Yukio OHYA et al.

It is certified that error appears in the above-indentified patent and that said Letters Patent is hereby corrected as shown below:

Claim 13, column 192, line 28 change "[IIb]" to --[Ib]--.

Claim 9, columns 191-192, Formula (I) change

" 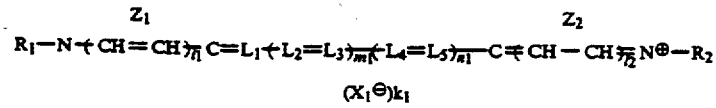 Formula (I) "

to -- 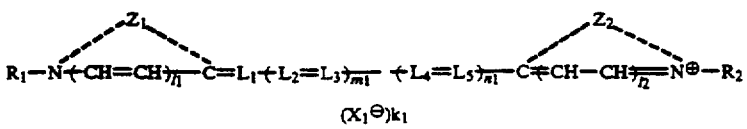 Formula [I] --.

UNITED STATES PATENT AND TRADEMARK OFFICE

CERTIFICATE OF CORRECTION

PATENT NO. : 5,340,710

DATED : August 23, 1994

INVENTOR(S) : Yukio OHYA et al.

It is certified that error appears in the above-indentified patent and that said Letters Patent is hereby corrected as shown below:

Claim 9, columns 191-192, Formula (II) change

" 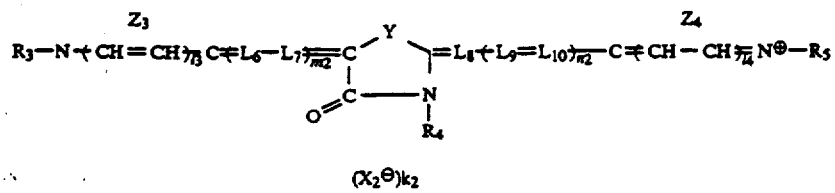 Formula (II) "

to -- 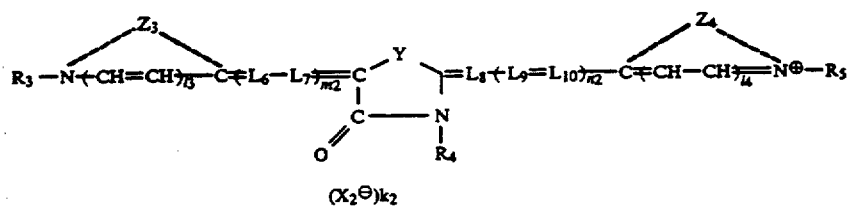 Formula [II] --.

Claim 13, columns 191-192, Formula (Ic) change

" 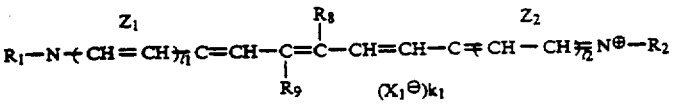 Formula [Ic] "

to -- 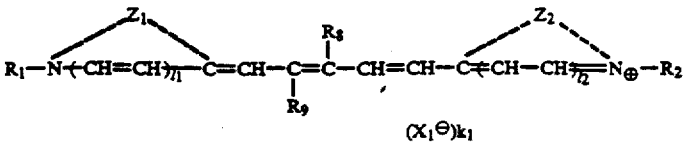 Formula [Ic] --.

UNITED STATES PATENT AND TRADEMARK OFFICE

CERTIFICATE OF CORRECTION

PATENT NO. : 5,340,710 Page 3 of 3

DATED : August 23, 1994

INVENTOR(S) : Yukio OHYA et al.

It is certified that error appears in the above-indentified patent and that said Letters Patent is hereby corrected as shown below:

Claim 13, columns 193-194, Formula (IIa) change

" 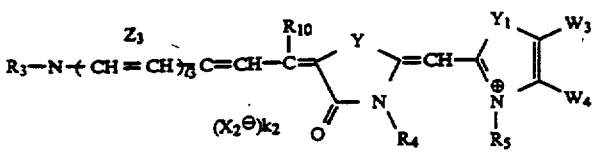 Formula [IIa] "

to -- 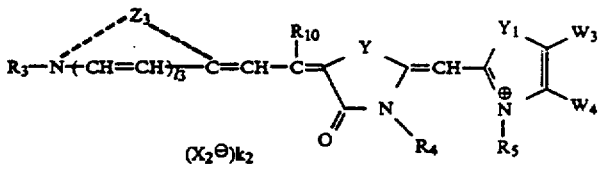 Formula [IIa] --.

Signed and Sealed this

Ninth Day of May, 1995

Bruce Lehman

*Attest:*

BRUCE LEHMAN

*Attesting Officer*

*Commissioner of Patents and Trademarks*